US007871747B2

(12) United States Patent
Shimoyama et al.

(10) Patent No.: US 7,871,747 B2
(45) Date of Patent: Jan. 18, 2011

(54) ELECTROPHOTOGRAPHIC PHOTOCONDUCTOR HAVING CHARGE BLOCKING AND MOIRE PREVENTING LAYERS

(75) Inventors: Keisuke Shimoyama, Numazu (JP); Eiji Kurimoto, Numazu (JP); Takeshi Orito, Numazu (JP); Tatsuya Niimi, Numazu (JP); Shinichi Kawamura, Kawasaki (JP); Yoshiki Yanagawa, Numazu (JP); Michitaka Sasaki, Chiba (JP)

(73) Assignee: Ricoh Company, Ltd., Tokyo (JP)

( * ) Notice: Subject to any disclaimer, the term of this patent is extended or adjusted under 35 U.S.C. 154(b) by 640 days.

(21) Appl. No.: 11/518,944

(22) Filed: Sep. 12, 2006

(65) Prior Publication Data

US 2007/0059619 A1 Mar. 15, 2007

(30) Foreign Application Priority Data

| | | |
|---|---|---|
| Sep. 13, 2005 | (JP) | 2005-264724 |
| Sep. 15, 2005 | (JP) | 2005-267862 |
| Sep. 15, 2005 | (JP) | 2005-269160 |
| Sep. 15, 2005 | (JP) | 2005-269161 |
| Sep. 15, 2005 | (JP) | 2005-269162 |
| Sep. 15, 2005 | (JP) | 2005-269166 |
| Sep. 16, 2005 | (JP) | 2005-270999 |
| Sep. 16, 2005 | (JP) | 2005-271007 |
| Sep. 16, 2005 | (JP) | 2005-271015 |

(51) Int. Cl.
*G03G 5/04* (2006.01)
*G03G 5/06* (2006.01)

(52) U.S. Cl. ..... 430/64; 430/60; 430/65; 430/78

(58) Field of Classification Search ..... 430/60, 430/64, 65, 78
See application file for complete search history.

(56) References Cited

U.S. PATENT DOCUMENTS

| | | | | |
|---|---|---|---|---|
| 5,789,127 | A * | 8/1998 | Yamaguchi et al. | 430/64 |
| 5,908,725 | A * | 6/1999 | Ueda | 430/65 |
| 2005/0069797 | A1* | 3/2005 | Niimi et al. | 430/78 |
| 2006/0057479 | A1* | 3/2006 | Niimi et al. | 430/59.4 |
| 2007/0219375 | A1* | 9/2007 | Fujiyama et al. | 430/77 |

FOREIGN PATENT DOCUMENTS

| | | | |
|---|---|---|---|
| CN | 1938321 A | | 3/2007 |
| EP | 1 736 476 A1 | | 12/2006 |
| JP | 57-12244 | | 7/1982 |
| JP | 6-293769 | | 10/1994 |
| JP | 7-10912 | | 1/1995 |
| JP | 7-91486 | | 4/1995 |
| JP | 3003664 | | 11/1999 |
| JP | 2001-19871 | | 1/2001 |
| JP | 3286704 | | 3/2002 |
| JP | 2005-128496 | | 5/2005 |
| JP | 2005-154409 | | 6/2005 |
| JP | 2005154409 A | * | 6/2005 |
| WO | WO 2005092901 A1 | * | 10/2005 |

OTHER PUBLICATIONS

U.S. Appl. No. 11/521,493, filed Sep. 15, 2006, Kurimoto, et al.
U.S. Appl. No. 11/736,919, filed Apr. 18, 2007, Shimoyama, et al.

* cited by examiner

*Primary Examiner*—Christopher RoDee
(74) *Attorney, Agent, or Firm*—Oblon, Spivak, McClelland, Maier & Neustadt, L.L.P.

(57) ABSTRACT

To provide an electrophotographic photoconductor that has a layer containing a compound represented by the following general formula (1), and an image forming apparatus using the electrophotographic photoconductor.

General Formula (1)

where $R^1$ and $R^2$ independently represent any one of a hydrogen atom, substituted or unsubstituted alkyl group, substituted or unsubstituted cycloalkyl group and substituted or unsubstituted aralkyl group, and $R^3$, $R^4$, $R^5$, $R^6$, $R^7$, $R^8$, $R^9$ and $R^{10}$ independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group.

7 Claims, 11 Drawing Sheets

ELECTROPHOTOGRAPHIC PHOTOCONDUCTOR HAVING CHARGE BLOCKING AND MOIRE PREVENTING LAYERS

BACKGROUND OF THE INVENTION

1. Field of the Invention

The present invention relates to an image forming apparatus that involves an electrostatic copying process for image forming (e.g., a copier, facsimile machine, and printer), a process cartridge provided to the image forming apparatus, and an image forming method adopted for the image forming apparatus.

2. Description of the Related Art

In recent years, information processing systems that utilize electrophotography have been remarkably developed. In particular, photoprinters that covert information into digital signals for information recording by means of light beam have been remarkably successful in terms of their print quality and reliability. This digital recording technology is applied not only to printers, but also to general copiers, and therefore, the development of so-called digital copiers has been made. In addition, since analogue copiers that utilize this digital recording technology are provided with various information processing functions, it is expected that the demand for such copiers will increase in the near future.

In such digital copiers and digital printers, an image generally occupies as low as 10% or less of the area of document, and therefore, reversal development (positive/negative development) is mainly employed in which image portions are exposed and charge-removed portions of the photoconductor are developed using toner in view of degradation of the light source and photo fatigue of photoconductor. The reversal development requires less amount of irradiation for the photoconductor and is advantageous in light of photo fatigue due to repetitive exposure. The reversal development, however, entails generation of dot defects (e.g., background smear and black dots) at backgrounds (or white solid regions) in a case of charge leakage caused due to minute defects on the photoconductor. These unwanted dots may be mistaken for dots in a drawing or for periods and/or commas in an English document; therefore, they are fatal defects for images.

In most cases, these defects are mainly attributed to partial charge leakage from the photoconductor. Major challenges to this problem include improving the pressure resistance of the photoconductor, improving the uniformity of charge distribution over the photoconductor surface, and keeping voltage more constant. To achieve these objects, an attempt has been made to provide an intermediate layer (under layer) between a conductive support and a photosensitive layer. This intermediate layer is composed primarily of binder resin, and contains dispersed filler on an as-needed basis.

For example, if such an intermediate layer consists of binder resin as disclosed in Japanese Patent Application Laid-Open (JP-A) Nos.47-6341, 60-66258, 52-10138 and 58-105155, the intermediate layer needs to be made very thin because binder resin is highly electrically insulating; in most cases, the intermediate layer needs to be as thin as 2 μm or less. In this case, the intermediate layer is produced through wet coating process and thus it is difficult to avoid generation of pinholes in the film being made. For this reason, the intermediate layer may not be as effective as expected.

Because almost all mainstream photoconductors are hole transporting photoconductors, their intermediate layers are made thick by the addition of electron transporting fillers to thereby prevent the generation of pinholes therein.

Intermediate layers composed of dispersed filler resin as disclosed in JP-A Nos.58-58556, 60-111255, 59-17557, 60-32054, 64-68762, 64-68763, 64-73352, 64-73353, 1-118848 and 1-118849, however, contain ultrafine filler particles of submicron or smaller sizes, which are too costly and bulky to be used. For these reasons, submicron particles (primary particle diameter of 0.3 μm at the minimum) are often used. Such submicron particles entail re-aggregation of filler particles in their dispersion or upon deposition of film to result in film thickness variations of 1 μm or greater in some cases, making it impossible to provide an intermediate layer that allows designing of a photoconductor with uniform charge distribution and constant voltage.

In recent years the exposure density has increased and toner particles for development have become finer and finer, and the resolution of image has increased accordingly. Moreover, color-image printing has become available and therefore the opportunity to printout solid images and half-tone images has also increased. Under such circumstances, how electrostatic characteristics of the photoconductor can be made constant even after repetitive use and/or under different usage environments is a great challenge to be tackled. Much attempts have been made, though, a satisfactory technology has yet been made.

When a photoconductor is used time and time again, a surface layer (generally a charge transporting layer) of the photoconductor wears out. General image forming apparatus that use a photoconductor apply constant voltage for the charging of the photoconductor (i.e., non-exposed portions). Accordingly, when the surface layer wears out, the intensity of electric field applied to the photoconductor increases. As described above, since image defects such as background smear are caused due primarily to charge leakage, the likelihood of charge leakage is dependent on the electric field intensity; the higher the intensity, the more likely it is that charge leakage occurs.

An attempt has been made to provide a surface protection layer on the photoconductor surface in order to solve this problem. Examples of photosensitive layers with improved wear resistance include (i) those using a curable binder for a crosslinked charge transporting layer (see JP-A No.56-48637), (ii) those using a high-molecular charge transporting substance (see JP-A No.64-1728), and (iii) those in which an inorganic filler is dispersed in a crosslinked charge transporting layer (see JP-A No.04-281461). A photoconductor is also known that contains a cured material resulted from polyfunctional acrylate monomers for improved wear resistance and improvided scratch resistance of the photosensitive layers (i) (see Japanese Patent (JP-B) No.3262488). Moreover, it is also known to provide an charge transporting layer formed from a coating solution consisting of monomers containing a carbon-carbon double bond, a charge transporting substance containing a carbon-carbon double bond, and a binder resin (see JP-B No.3194392). Furthermore, photosensitive layers that contain compounds obtained by curing hole transporting compounds bearing two or more polymerizable groups in one molecule are also known (see JP-A No.2000-66425).

These surface protection technologies have allowed improvement of wear resistance of the photoconductor and lowered the increase rate of electrical field intensity, thereby reducing in fact the generation of image defects due to charge leakage. However, problems specific to the protection layer have occurred. For example, the amount of substance that accumulates on the surface of the photoconductor after repetitive use increases due to the reduced wear volume of the surface protective layer, resulting in creation of abnormal images (e.g., blurred images). These problems, however, can be solved by improving the protective layer and/or by using different methods of using the photoconductor, e.g., by employing a drum heater.

The improvements for a surface protective layer and developments for the method of aptly using a photoconductor have increased the wear resistance of the photoconductor, apparently extending the photoconductor life. Thus, a long time usage of photoconductor has been made possible, which seems to be impossible with photoconductor having no surface protective layers. Electrostatic fatigue has unexpectedly become a life-determining factor of photoconductor in terms of image defects caused due to photoconductor wearing out and charge leakage.

SUMMARY OF THE INVENTION

An object of the present invention is to provide an electrophotographic photoconductor that generates minimum abnormal images and features small variations in electrostatic characteristics after repetitive use of an image forming apparatus and/or under different usage environments. Another object of the present invention is to provide an image forming apparatus and full-color image forming apparatus that can always achieve stable image output by use of the electrophotographic photoconductor. Still another object of the present invention is to provide a very easy-to-use process cartridge.

The electrophotographic photoconductor of the present invention has a layer including a compound represented by the following general formula (1).

General Formula (1)

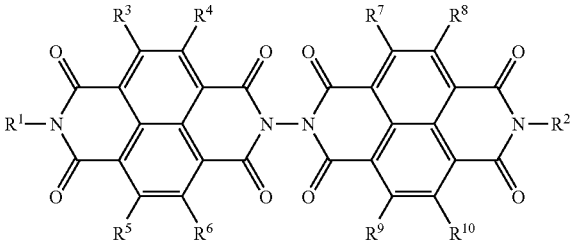

where $R^1$ and $R^2$ independently represent any one of a hydrogen atom, substituted or unsubstituted alkyl group, substituted or unsubstituted cycloalkyl group and substituted or unsubstituted aralkyl group, and $R^3$, $R^4$, $R^5$, $R^6$, $R^7$, $R^8$, $R^9$ and $R^{10}$ independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group The electrophotographic photoconductor preferably includes a support; an under layer; and a photosensitive layer, the under layer and the photosensitive layer being disposed on or over the support, wherein the photosensitive layer comprises a compound represented by the general formula (1), and wherein the under layer is composed of a charge blocking layer and a moire preventing layer.

The electrophotographic photoconductor preferably includes: a support; a photosensitive layer; and a surface protective layer, the photosensitive layer and the surface protective layer being disposed on or over the support, wherein the photosensitive layer comprises a compound represented by the general formula (1), and wherein the surface protective layer comprises a cured material obtained by curing a radically polymerizable compound that bears three or more functional groups and has no charge transporting structure and a radically polymerizable compound that bears one functional group and has a charge transporting structure.

The electrophotographic photoconductor preferably includes: a support; an under layer; and a photosensitive layer, the under layer and the photosensitive layer being disposed on or over the support, wherein the photosensitive layer comprises a compound represented by the general formula (1), and wherein the under layer is composed of a conductive layer and a barrier layer.

The electrophotographic photoconductor preferably includes: a support; an under layer; and a photosensitive layer, the under layer and the photosensitive layer being disposed on or over the support, wherein the photosensitive layer comprises a compound represented by the general formula (1), and wherein the support is a support whose surface has been subjected to anodizing treatment for forming an anodized film thereon.

The electrophotographic photoconductor preferably includes: a support; a photosensitive layer; and a surface protective layer, the photosensitive layer and the under layer being disposed on or over the support, wherein the photosensitive layer comprises a compound represented by the general formula (1), and wherein the under layer comprises two different metal oxides (T1) and (T2) with different average particle diameters and satisfies the condition $0.2<(D2/D1)\leqq 0.5$ (where D1 is the average particle diameter of the metal oxide (T1) having an average particle diameter larger than that of the other metal oxide (T2), and D2 is the average particle diameter of the metal oxide (T2)).

The electrophotographic photoconductor preferably includes: a support; an intermediate layer; and a photosensitive layer, the intermediate layer and the photosensitive layer being disposed on or over the support, wherein the intermediate layer comprises a compound represented by the general formula (1).

The electrophotographic photoconductor preferably includes: a support; an under layer; and a photosensitive layer, the intermediate layer and the photosensitive layer being disposed on or over the support, wherein the photosensitive layer comprises a compound represented by the general formula (1), and wherein the under layer comprises an organic metal compound and a silane coupling agent.

The electrophotographic photoconductor preferably includes: a support; a photosensitive layer; and a surface protective layer, the photosensitive layer and the surface protective layer being disposed on or over the support, wherein the photosensitive layer comprises a compound represented by the general formula (1), and wherein the surface protective layer comprises at least one of a diamond like carbon and an amorphous carbon, both containing hydrogen.

A first aspect of the image forming apparatus of the present invention is an image forming apparatus which includes an electrophotographic photoconductor, wherein the electrophotographic photoconductor includes a layer comprising a compound represented by the following general formula (1).

General Formula (1)

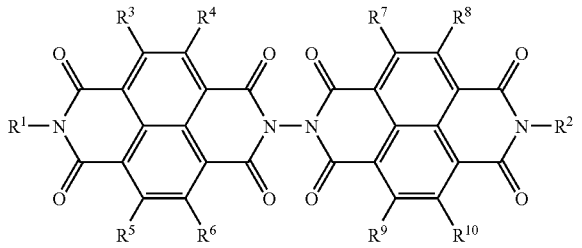

where $R^1$ and $R^2$ independently represent any one of a hydrogen atom, substituted or unsubstituted alkyl group, substituted or unsubstituted cycloalkyl group and substituted or unsubstituted aralkyl group, and $R^3$, $R^4$, $R^5$, $R^6$, $R^7$, $R^8$, $R^9$ and $R^{10}$ independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group A second aspect of the image forming apparatus of the present invention is an image forming apparatus which includes: an electrophotographic photoconductor; a charging unit configured to equally charge a surface of the electrophotographic photoconductor; an exposure unit configured to selectively expose the electrophotographic photoconductor to form a latent electrostatic image thereon; and a developing unit configured to develop the latent electrostatic image using a toner, wherein the electrophotographic photoconductor comprises a support and a photosensitive layer disposed on or over the support, wherein the photosensitive layer comprises a compound represented by the following general formula (1) and titanyl phthalocyanine which has a maximum peak at least at a Bragg angle 2θ(±0.2°) of 27.2° in its X-ray diffraction spectrum for CuKα X-ray (wavelength=1.542 angstrom), and wherein the image forming apparatus is operated under the condition that the time from exposure to development is 300 msec or less.

General Formula (1)

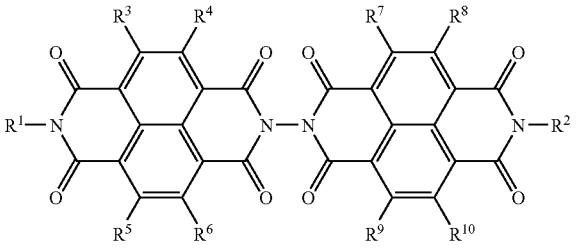

where $R^1$ and $R^2$ independently represent any one of a hydrogen atom, substituted or unsubstituted alkyl group, substituted or unsubstituted cycloalkyl group and substituted or unsubstituted aralkyl group, and $R^3$, $R^4$, $R^5$, $R^6$, $R^7$, $R^8$, $R^9$ and $R^{10}$ independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group The image forming method of the present invention includes: equally charging a surface of an electrophotographic photoconductor which includes a layer comprising a compound represented by the general formula (1); selectively exposing the electrophotographic photoconductor to form a latent electrostatic image thereon; and developing the latent electrostatic image using a toner, wherein the electrophotographic photoconductor comprises a support and a photosensitive layer disposed on or over the support, and wherein the photosensitive layer comprises a compound represented by the following general formula (1) and titanyl phthalocyanine which has a maximum peak at least at a Bragg angle 2θ(±0.2°) of 27.2° in its X-ray diffraction spectrum for CuKα X-ray (wavelength=1.542 angstrom).

General Formula (1)

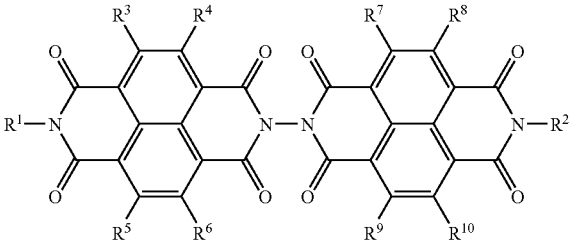

where $R^1$ and $R^2$ independently represent any one of a hydrogen atom, substituted or unsubstituted alkyl group, substituted or unsubstituted cycloalkyl group and substituted or unsubstituted aralkyl group, and $R^3$, $R^4$, $R^5$, $R^6$, $R^7$, $R^8$, $R^9$ and $R^{10}$ independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group The process cartridge of the present invention includes: an electrophotographic photoconductor which includes a layer comprising a compound represented by the general formula (1); and at least one unit selected from the group consisting of a charging unit, a developing unit, a transferring unit, and a cleaning unit, wherein the process cartridge can be detachably attached to an image forming apparatus.

General Formula (1)

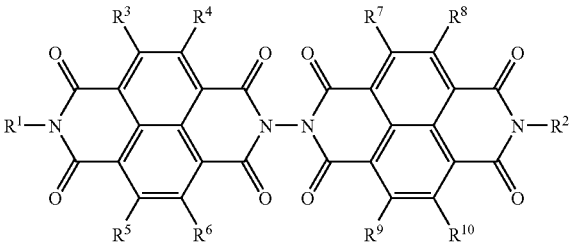

where $R^1$ and $R^2$ independently represent any one of a hydrogen atom, substituted or unsubstituted alkyl group, substituted or unsubstituted cycloalkyl group and substituted or unsubstituted aralkyl group, and $R^3$, $R^4$, $R^5$, $R^6$, $R^7$, $R^8$, $R^9$ and $R^{10}$ independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group

Figure 1:
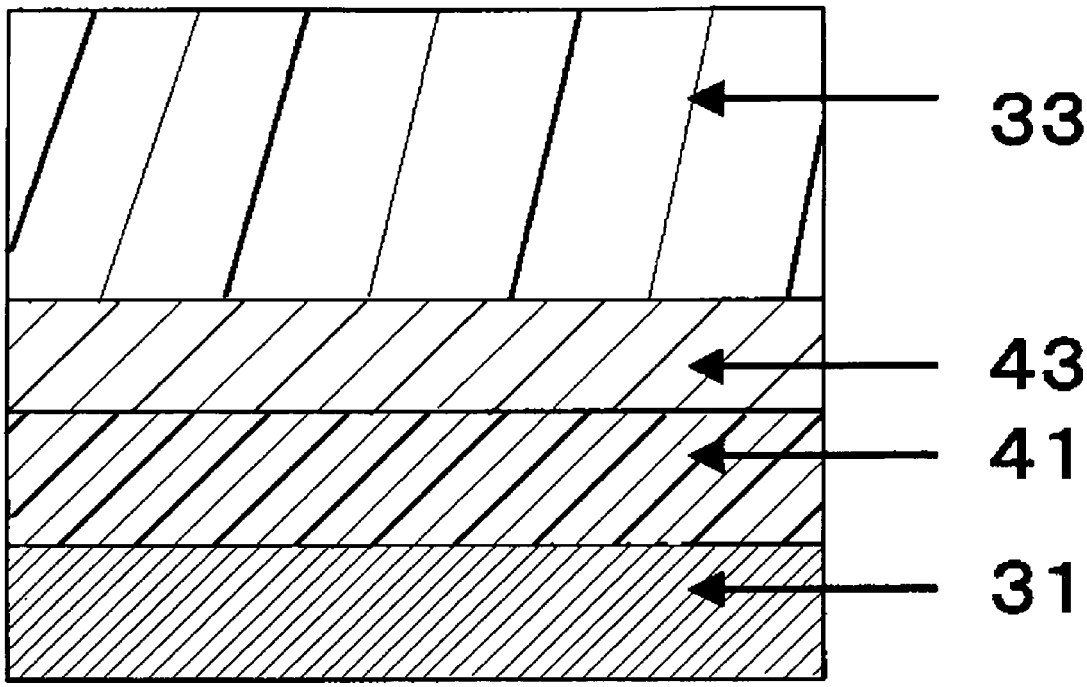
FIG. 1 is a cross-sectional view showing a configuration of the electrophotographical photoconductor of the present invention.

DESCRIPTION OF THE PREFERRED EMBODIMENTS (Electrophotographic Photoconductor)

The electrophotographic photoconductor of the present invention includes a layer comprising a compound represented by the following general formula (1).

General Formula (1)

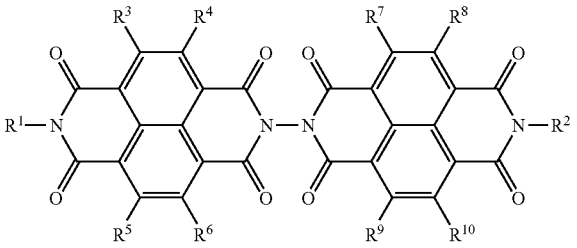

where $R^1$ and $R^2$ independently represent any one of a hydrogen atom, substituted or unsubstituted alkyl group, substituted or unsubstituted cycloalkyl group and substituted or unsubstituted aralkyl group, and $R^3$, $R^4$, $R^5$, $R^6$, $R^7$, $R^8$, $R^9$ and $R^{10}$ independently represent any one of a hydrogen atom, halogen atom, cyano group, nitro group, amino group, hydroxyl group, substituted or unsubstituted alkyl group, substituted or unsubstituted cycloalkyl group and substituted or unsubstituted aralkyl group For the substituted or unsubstituted alkyl groups, alkyl groups of 1 to 25 carbon atoms, more preferably, alkyl groups of 1 to 10 carbon atoms are used. Specific examples include straight-chain alkyl groups such as methyl group, ethyl group, n-propyl group, n-butyl group, n-hexyl group, n-peptyl group, n-octyl group, n-nonyl group and n-decyl group, branched-chain alkyl groups such as i-propyl group, s-butyl group, t-butyl group, methylpropyl group, dimethylpropyl group, ethylpropyl group, diethylpropyl group, methylbutyl group, dimethylbutyl group, methylpentyl group, dimethylpentyl group, methylhexyl group and dimethylhexyl group, and alkyl groups substituted with alkoxyalkyl group, monoalkylaminoalkyl group, dialkylaminoalkyl group, halogen-substituted alkyl group, alkylcarbonylalkyl group, carboxyalkyl group, alkanoyloxyalkyl group, aminoalkyl group, alkyl group substituted with carboxyl group that may be esterified and/or alkyl group substituted with cyano group. Note that the positions of these substituents on alkyl carbon atoms are not particularly limited, and substituted or unsubstituted alkyl groups in which one or more of their carbon atoms are replaced by a hetero atom (e.g., N, O, or S) are also included.

For the substituted or unsubstituted cycloalkyl groups, cycloalkyls of 3 to 25 carbon atoms, more preferably, cycloalkyls of 3 to 10 carbon atoms are used. Specific examples thereof include cyclopropane, cyclobutane, cyclopentane, cyclohexane, cycloheptane, cyclooctane, cyclononane, cyclodecane, alkyl-substituted cycloalkyls such as methylcyclopentane, dimethylcyclopentane, methylcyclohexane, dimethylcyclohexane, trimethylcyclohexane, tetramethylcyclohexane, ethylcyclohexane, diethylcyclohexane and t-butylcyclohexane, and cycloalkyls substituted with alkoxylalkyl group, monoalkylaminoalkyl group, dialkylaminoalkyl group, halogen-substituted alkyl group, alkoxycarbonylalkyl group, carboxyalkyl group, alkanoyloxyalkyl group, aminoalkyl group, halogen atom, amino group, carboxyl group that may be esterified, cyano group, etc. Note also that the positions of these substituents on cycloalkyl carbon atoms are not particularly limited, and substituted or unsubstituted cycloalkyl groups in which one or more of their carbon atoms are replaced by a hetero atom (e.g., N, O, or S) are also included.

Examples of the substituted or unsubstituted aralkyl groups include the foregoing substituted or unsubstituted alkyl groups that are substituted with aromatic ring(s); aralkyl groups of 6 to 14 carbon atoms are preferable. Specific examples include benzyl group, perfluorophenylethyl group, 1-phenylethyl group, 2-phenylethyl group, terphenylethyl group, dimethylphenylethyl group, diethylphenylethyl group, t-butylphenylethyl group, 3-phenylpropyl group, 4-phenylbutyl group, 5-phenylpentyl group, 6-phenylhexyl group, benzhydryl group, and trityl group.

More specifically, compounds represented by the following formulae (2) to (6) are preferable because resultant images are of high quality. Note in each formula that Me represents methyl group.

Formula (2)

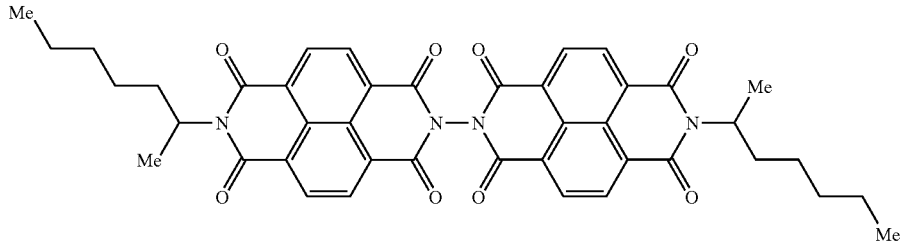

Formula (3)

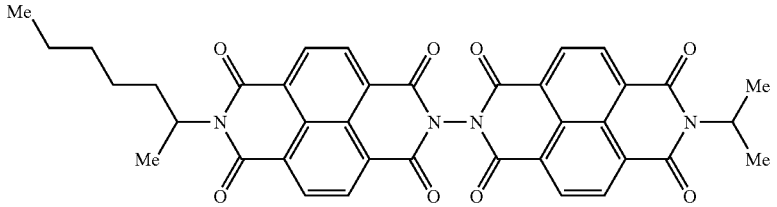

Formula (4)

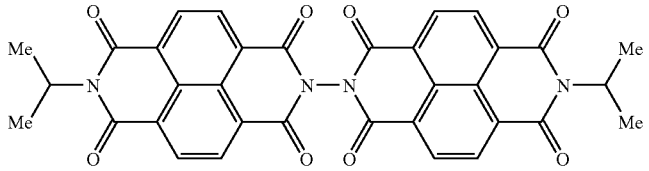

Formula (5)

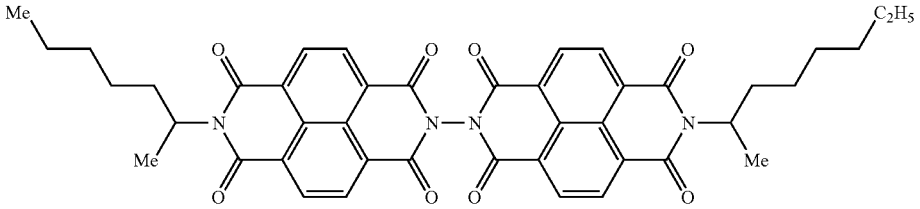

Formula (6)

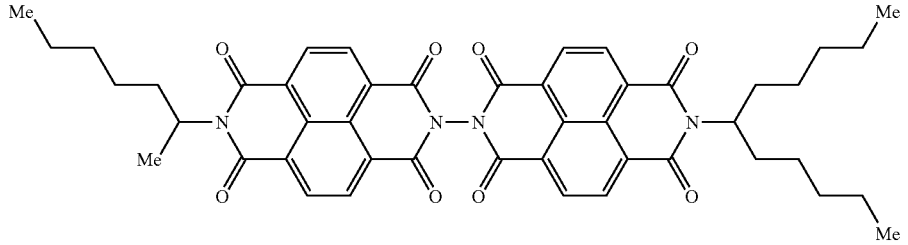

For the method of producing electron transporting compounds represented by the foregoing general formula (1), the following methods can be exemplified: A method in which naphthalenecarboxylic acid or anhydride thereof is allowed to react with an amine to produce a monoimide; and a method in which naphthalenecarboxylic acid or anhydride is allowed to react with an amine after adjustment of pH by the addition of a buffer. Mono-imidization is carried out in the presence or absence of a solvent which is not particularly limited. Solvents that do not react with reactants and products and can be used at 50° C. to 250° C. are suitably used; examples include benzene, toluene, xylene, chloronaphthalene, acetic acid, pyridine, methylpyridine, dimethylformamide, dimethylacetoamide, dimethylethyleneurea, and dimethylsulfoxide. For pH adjustment, a buffer obtained by mixing a basic aqueous solution (e.g., potassium hydroxide or lithium hydroxide aqueous solution) with an acid (e.g., phosphoric acid). Dehydration of a carboxylic acid derivative prepared by reaction of a carboxylic acid with an amine or diamine is carried out in the presence or absence of a solvent which is not particularly limited. A solvent that does not react with reactants and products and can be used at 50° C. to 250° C. is suitably used; examples include benzene, toluene, xylene, chloronaphthalene, and acetic acid anhydride. Every reaction may be carried out in the presence or absence of catalyst. For example, molecular sieves, benzenesulfonic acid, p-toluenesurfonic acid or the like can be used as a dehydrating agent.

Layers that contain the compound represented by the foregoing general formula (1) are not particularly limited as long as they contain it; examples include a photosensitive layer and an intermediate layer.

If a photosensitive layer contains the compound represented by the foregoing general formula (1) and has a single layer structure, this compound is used as an electron transporting substance. Although depending on whether a photocarrier generation site is in the vicinity of the photoconductor surface side or support side, the compound is used like an additive (meaning that the compound is not a major ingredient) when the photosensitive layer is configured to transport holes mainly, and it is used as a main charge (electron) transporting substance when electrons are transported mainly. More specifically, in a case where a single-layer photosensitive layer is positively charged for use and is so configured that photocarriers are generated in the vicinity of its surface, holes travel long distance as charges in the photosensitive layer. In this case, the main charge transporting substance is a hole transporting substance, and an electron transporting compound represented by the general formula (1) serves as a substance for transporting electrons to the photosensitive layer. On the other hand, if photocarriers are generated at positions closed to the support, electrons are mainly transported. In this case, the electron transporting agent represented by the general formula (1) serves as a main charge transporting substance. When the photosensitive layer is negatively charged for use, these relationships are opposite to those given above.

In addition, if a multilayer photosensitive layer is used, it is likely that some of the layers constituting the layer may not receive the compound according to their polarity. If the multilayer photosensitive layer consists of a charge generating layer and a charge transporting layer and if the photosensitive layer is negatively charged for use, holes are mainly transported. For this reason, the electron transporting compound represented by the general formula (1) is used like an additive when added to the charge transporting layer, and is used as an electron transporting substance when added to the electron generating layer. Conversely, if the multilayer photosensitive layer is positively charged for use, electrons are mainly transported. Thus, the electron transporting compound represented by the general formula (1) is used as a charge transporting substance when added to the charge transporting layer, and is used like an additive when added to the electron generating layer.

<Electrophotographic Photoconductor of First Embodiment>

The electrophotographic photoconductor of the first embodiment comprises a support, an under layer and a photosensitive layer, the under layer and photosensitive layer being disposed on or over the support, wherein the photosensitive layer comprises a compound represented by the foregoing general formula (1), and wherein the under layer is composed of a charge blocking layer and a moire preventing layer.

The function of the charge blocking layer is to prevent charges, which are induced at an electrode (i.e., conductive support) and have a polarity opposite to that of charges applied upon photoconductor charging, from entering the photosensitive layer. Specifically, when the photoconductor is to be negatively charged, the charge blocking layer prevents entry of holes into the photosensitive layer. When the photoconductor is to be positively charged, the charge blocking layer prevents entry of electrons into the photosensitive layer. Specific examples of the charge blocking layer include: (1) layers prepared by anodic oxidation, such as an aluminum oxide layer; (2) inorganic insulating layers such as a SiO insulating layer; (3) layers formed of a network of a glassy metal oxide as disclosed in JP-A No.03-191361; (4) layers made of polyphosphazene as disclosed in JP-A No.03-141363; (5) layers made of a reaction product of aminosilane as disclosed in JP-A No.03-101737; (6) layers made of insulating binder resin; and (7) layers made of curable binder resin. Among these, layers made of insulating resin and layers made of curable resin that can be formed by a wet coating process are preferable. Since both the moire preventing layer and the photosensitive layer are typically formed on the charge blocking layer, it is essential that the charge blocking layer be made of material or have a structure, which is not eroded by coating solvents used to prepare these layers by a wet coating process.

Suitable resins for use in the charge blocking layer include thermoplastic resins such as polyamide resins, polyester resins, and vinyl chloride/vinyl acetate copolymers, and thermosetting resins prepared by thermally polymerizing a compound having a plurality of active hydrogen atoms (e.g., hydrogen atoms from —OH, —$NH_2$, or —NH) with a compound having a plurality of isocyanate groups and/or a compound having a plurality of epoxy groups. Specific examples of the compounds having a plurality of active hydrogen atoms include polyvinyl butyrals, phenoxy resins, phenol resins, polyamides, polyesters, polyethylene glycol, polypropylene glycol, polybutylene glycol and acrylic resins bearing active hydrogen atoms (e.g., hydroxyethyl methacrylate). Specific examples of the compounds having a plurality of isocyanate groups include tolylene diisocyanate, hexamethylene diisocyanate, diphenylmethane diisocyanate, and prepolymers thereof. Specific examples of the compounds having a plurality of epoxy groups include bisphenol A based-epoxy resins.

Among these, polyamides are preferable in view of film-formability, environmental stability, and resistance to solvents.

Among these, N-methoxymethylated nylon is most preferable. Polyamide resins inhibit entry of electrons highly effectively and have less influence on the residual potential. Moreover, these polyamide resins are alcohol-soluble but ketone-insoluble, and can produce uniform, thin films even by a dip coating process, exhibiting excellent coating properties. In particular, excellent coating properties are of importance to ensure stable image quality, because the under layer needs to be made thin so as to minimize the influences of the residual potential increase and requires uniform thickness.

In general, however, alcohol-soluble resins are strongly humidity dependent—resistance increases under low-humidity environment to cause residual potential increase, and resistance decreases under high-humidity environment to cause charge reduction. N-methoxymethylated nylon, by contrast, provides excellent electrical isolation, is very excellent in terms of its capacity of blocking charges coming from the conductive support, has less influence on the residual potential, is less dependent on environmental conditions, and can always ensure stable image quality even when the usage environment of the image forming apparatus changes. Thus, N-methoxymethylated nylon is used most suitably when an under layer is provided. In addition, when N-methoxymethylated nylon is used, the residual potential becomes less dependent on the thickness of the charge blocking layer, thereby reducing influences on residual potential and obtaining an effect of reducing background smear.

The proportion of methoxymethyl groups in N-methoxymethylated nylon is not particularly limited, however, it is preferably 15 mol % or more. The effects brought about by using N-methoxymethylated nylon vary depending on the degree of methoxymethylation. If the proportion of methoxymethyl groups is less than 15 mol %, N-methoxymethylated nylon becomes more humidity dependent, and an alcohol solution thereof becomes clouded, resulting in slight reduction in temporal stability of its coating solution in some cases.

In addition, thermosetting resins obtained by thermally polymerizing oil-free alkyd resins with amino resins (e.g., butylated melamine resin), and photocurable resins obtained by reacting unsaturated resins (e.g., unsaturated polyurethane resins and unsaturated polyester resins) with a photopolymerization initiator such as a thioxanthone compound or methylbenzyl formate, can also be used as binder resins.

Furthermore, conductive polymers with rectification properties, and/or electron-accepting or electron-donating resin or compound, selected according to the charge polarity, can also be added to prevent entry of charges from the support.

The charge blocking layer preferably has a thickness ranging from 0.1 μm to less than 4.0 μm and, more preferably, from 0.3 μm to 1.5 μm. When the charge blocking layer is too thick, the residual potential of the photoconductor significantly increases particularly under low temperature and low humidity conditions after repetitive selective exposure. If the charge blocking layer is too thin, the charge blocking effect becomes poor. The charge blocking layer can additionally include such ingredient(s) as a curing (crosslinking) agent, solvent, additive and/or curing promoter on an as-needed basis. The charge blocking layer can be formed by applying a coating solution on a base by a normal coating process such as blade coating, dip coating, spray coating, bead coating, or nozzle coating, followed by drying or curing using heat or light.

The function of the moire preventing layer is to prevent the occurrence of moire fringes in images due to interference of light caused upon optical image writing using coherent light (e.g., laser beam). The moire preventing layer scatters the light for optical writing. In order to achieve this function, the moire preventing layer preferably contains a material with a high index of refraction. The moire preventing layer typically contains a binder resin and an inorganic pigment which is dispersed in the binder resin. In particular, white inorganic pigments are suitably used. Suitable examples of the white inorganic pigments include titanium oxide, calcium fluoride, calcium oxide, silica, magnesium oxide and aluminum oxide. Among these pigments, titanium oxide is preferable because of its high hiding capability.

The photoconductor of the present invention is so designed that entry of charges from the support is blocked by the charge blocking layer, and therefore, it is preferable that the moire preventing layer at least have a capacity to transport charges having the same polarity as that of the charges formed on the surface of the photoconductor in order to prevent residual potential increase. For example, in a case of a negatively charged photoconductor, the moire preventing layer preferably has an electron conducting capacity. Therefore, it is preferable to use an electron-conducting inorganic pigment or a conductive inorganic pigment for the moire preventing layer. Alternatively, the use of conductive material (e.g., acceptors) for the formation of the moire preventing layer enhances the effect of the present invention.

Binder resins identical to those used for the charge blocking layer can be used for the moire preventing layer. In view of the fact that a photosensitive layer is formed on the moire preventing layer, it is essential that these binder resins never erode when they come in contact with the coating solution for photosensitive layer.

For the binder resins, thermosetting resins are suitably used. Most preferably, alkyd/melamine resin mixtures are used. The mixing ratio of alkyd resin to melamine resin is an important factor that influences the structure and characteristics of the moire preventing layer; a suitable mixing ratio (i.e., the alkyd/melamine ratio) on a mass basis is 5/5 to 8/2. If too much melamine resin is used, the binder resin shrinks too much upon thermal curing, resulting in defects in the resultant coated film and unfavorably increasing the residual potential of photoconductor. If too much alkyd resin is used, the residual potential of photoconductor decreases but the bulk resistance decreases too much, unfavorably increasing background smear.

The volume ratio of the inorganic pigment to the binder resin in the moire preventing layer is also an important factor; it is preferably from 1/1 to 3/1. If this volume ratio of inorganic pigment to binder resin is below 1/1, not only the moire preventing effect decreases but also the residual potential may increase after repeated use. If this volume ratio of inorganic pigment to binder resin is greater than 3/1, it may result not only in poor binding capacity of binder resin, but also in poor surface characteristics of film to make it difficult to form an upper photosensitive layer thereon. This may cause a serious problem when a multilayer photosensitive layer is adopted, where thin layers like a charge generating layer are formed. In addition, in this case, the binder resin cannot cover the entire surface of inorganic pigment particles, allowing a charge generating substance to come in direct contact with the inorganic pigment in some cases to thereby increase the likelihood of the production of heated carriers, which may lead to increased background smear.

By using two different titanium oxides with different average particle diameters for the moire preventing layer, the conductive support can be effectively hidden by the moire preventing layer and thus the occurrence of a moire fringe and the formation of pinholes can be prevented. In order for this to happen, it is important that the ratio between the average particle diameters (D1) and (D2) of the two different titanium oxides (T1) and (T2) satisfy the condition $0.2<D2/D1\leqq 0.5$. More specifically, if the average particle diameter ratio is outside the range specified by the present invention, i.e., if the ratio of the average particle diameter (D2) of the metal oxide (T2) to the average particle diameter (D1) of the other metal oxide (T1)—one with a larger average particle diameter—is too small ($D2/D1<0.2$), it results in activation of the metal oxide surface to significantly reduce the electrostatic stability of photoconductor. If the ratio of the average particle diameter (D2) of the metal oxide (T2) to the average particle diameter (D1) of the metal oxide (T1) is too large ($D2/D1>0.5$), the capability to hide the conductive support decreases, increasing the likelihood of the occurrence of moire fringes and/or abnormal images. As used herein, the average particle diameter means an average particle diameter obtained from a particle size measurement for a metal oxide dispersion prepared by vigorously dispersing metal oxide in an aqueous medium.

Furthermore, the average particle diameter (D2) of titanium oxide (T2) —one with a smaller average particle diameter—is also an important factor, and it is important that the condition $0.05\ \mu m<D2<0.20\ \mu m$ be satisfied. When D2 is 0.05 μm or less, hiding capability of the moire preventing layer may be reduced to create moire fringes. If D2 is 0.20 μm or more, the packing density of titanium oxide particles in the moire preventing layer is reduced, and thus the effect of preventing background smear cannot be fully brought about.

The proportion of the metal oxide (T2) in the metal oxides (T1) and (T2) on a mass basis is also an important factor. If $T2/(T1+T2)$ is less than 0.2, the packing density of titanium oxide particles is not so large, and thus the effect of preventing background smear cannot be fully brought about. If $T2/(T1+T2)$ is greater than 0.8, the hiding capability of the moire preventing layer may be reduced to cause generation of moire fringes. For this reason, it is important that the proportion of the metal oxide (T2) in the metal oxides (T1) and (T2) on a mass basis is such that $0.2\leqq T2(T1+T2)\leqq 0.8$.

The moire preventing layer preferably has a thickness of 1 μm to 10 μm and more preferably, 2 μm to 5 μm. If the thickness of the moire preventing layer is less than 1 μm, the moire preventing effect cannot be fully brought about. If the thickness of the moire preventing layer is greater than 10 μm, it undesirably results in increased residual potential.

The moire preventing layer is typically prepared in the following manner: An inorganic pigment is first dispersed in a solvent together with a binder resin using a dispersion machine such as a ball mill, sand mill, or Attritor, followed by addition of, for example, a curing (crosslinking) agent, solvent, additive and/or curing promoter where appropriate. The coating solution thus prepared is then applied on the charge blocking layer by blade coating, dip coating, spray coating, bead coating, or nozzle coating, followed by drying or curing using light or heat.

<Electrophotographic Photoconductor of Second Embodiment>

The electrophotographic photoconductor of the second embodiment comprises a support, a surface protective layer and a photosensitive layer, a the surface protective layer and photosensitive layer being disposed on or over the support, wherein the photosensitive layer contains a compound represented by the foregoing general formula (1), and wherein the surface protective layer preferably contains a cured material obtained from a radically polymerizable compound that has three or more functional groups and has no charge transporting structure and from a radically polymerizable compound that has one functional group and has a charge transporting structure.

The surface protective layer is provided on the photosensitive layer for the purpose of protection of the photosensitive layer. In recent years daily use of computers has created a demand for printers with high-speed output and small size. It is therefore possible to effectively use the photoconductor of the present invention that is provided with a surface protection layer for increased durability, is of high sensitivity, and free of defects.

Examples of protective layers applicable to the present invention include those prepared by curing radically polymerizable monomer that bears three or more functional groups and has no charge transporting structure and radically polymerizable monomer that bears one functional group and has a charge transporting structure.

This protective layer has a crosslinked structure of cured radically polymerizable monomers with three or more functional groups and thus has a highly developed three-dimensional network, providing a fairly hard, resilient surface layer with a high crosslink density. In addition, this protective layer has so uniform and smooth surface that it is made possible to achieve high wear resistance and high defect resistance. Although it is important to increase the crosslink density—the number of crosslink bonds per unit volume—in the photoconductor surface, a number of crosslink bonds are formed instantaneously in curing reaction to cause internal stress due to volume shrinkage. This internal stress increases with increasing thickness of the crosslinked protective layer, increasing the likelihood of generating cracks and/or occurring film separation when the protective layer has been cured thoroughly. This phenomenon does not appear initially, though, it may appear with time due to damages and/or thermal fluctuations in a series of repetitive image forming processes—charging, developing, transferring, and cleaning.

An example of the method of solving this problem is to make the cured resin layer flexible by (1) the introduction of high-molecular components in a crosslinked layer or crosslinked structure, (2) by the use of a great amount of radically polymerizable monofunctional monomers and radically polymerizable bifunctional monomers bearing two, or (3) by the use of multifunctional monomers bearing flexible groups. In every method, however, the crosslink density becomes too small to achieve drastic increase in wear resistance. The photoconductor of the present invention, by contrast, has a protective layer with a developed three-dimensional network with a high crosslink density, which is provided on a charge transporting layer and preferably has a thickness in a range of 1 μm to 10 μm. In this way it is made possible to avoid generation of cracks and/or occurrence of film separation and to achieve extremely high wear resistance. By setting the protective layer thickness to 2 μm to 8 μm, it is possible to reduce the likelihood of the occurrence of the foregoing problems and to expand the range of choice of available materials that can increase crosslink density for further increased wear resistance.

The photoconductor of the present invention can avoid generation of cracks and/or occurrence of film separation because internal stress never increases since the protective layer can be made thin, and because internal stress in the uppermost protective layer can be reduced since a photosensitive layer or charge transporting layer is provided under the protective layer. For this reason, the protective layer does not require a great amount of high-molecular material, and defects and toner filming are less likely to occur, which are caused due to the fact that the high-molecular material is incompatible with a cured material resulted from polymerization of radically polymerizable compositions (e.g., radically polymerizable monomers and radically polymerizable compounds having a charge transporting structure). In addition, when a thick protective layer is entirely cured by irradiation with light beam, its charge transporting structure absorbs the beam, inhibiting light adimission and preventing full progression of curing reaction inside the layer. In contrast to this, the protective layer of the present invention is made thin, preferably to a thickness of 10 μm or less, thus allowing the curing reaction to occur throughout the layer. In this way high wear resistance is also achieved inside the layer, as is at the surface. Upon formation of the protective layer of the present invention, a radically polymerizable monomer that bears one functional group and has a charge transporting structure is used in addition to a radically polymerizable monomer bearing three or more functional groups. The former monomer that bears one functional group and has a charge transporting structure is incorporated into crosslink bonds formed upon curing of the latter monomer. In contrast to this, if low-molecular charge transporting substances that have no functional groups are contained in a protective layer, their poor compatibility causes them to be precipitated and/or makes the resulting protective layer cloudy to reduce its mechanical strength. Meanwhile, if charge transporting compounds bearing two or more functional groups are used as a main component, they are immobilized to the crosslinked structure by their multiple bonds to increase the crosslink density. However, the charge transporting structure is so bulky that the strain in the cured resin structure increases too much, leading to increased internal stress in the protective layer.

Furthermore, the photoconductor of the present invention has excellent electrical characteristics and thus shows excellent stability for repetitive use, achieving high durability and high stability. This is attributed to the fact that as constituent material of the protective layer radically polymerizable compounds that have one functional group and have a charge transporting structure are held between crosslink bonds in a pendant-like form. Unlike these compounds, charge transporting substances bearing no functional groups are precipitated to make the layer white, significantly reducing electrical characteristics after repetitive use, e.g., reduced sensitivity and/or increased residual potential. When charge transporting compounds bearing two or more functional groups are used as a main component, they are immobilized to the crosslinked structure by their multiple bonds and thus intermediates (cation radicals) produced during electron transportation are not stabilized well. For this reason, it is likely that sensitivity will decrease and residual potential will increase due to charge trap. Poor electrical characteristics lead to images with reduced density and thin characters. Moreover, the photoconductor of the present invention can adopt a conventional charge transporting layer design that ensures high electron mobility with less trapped charges. Accordingly, it is possible to minimize electrical side-effects against the protective layer.

By making the protective layer of the present invention insoluble in organic solvents upon its formation, its wear resistance can be dramatically enhanced particularly. The protective layer of the present invention is prepared by curing radically polymerizable monomer that bears three or more functional groups and has no charge transporting structure and radically polymerizable monomer that bears one functional group and has a charge transporting structure. A three-dimensional network is developed throughout the layer and thus high crosslink density is realized. However, there may be a case where the crosslink density may be reduced in some areas of the layer or the layer is formed as an aggregate of densely crosslinked fine cured particles, depending on the presence of ingredients other than those described above (e.g., mono-or bi-functional monomers, additives such as high molecular binder, antioxidant, leveling agent, and/or plasticizer, and ingredients from the lower layer) and/or on the curing conditions. In such a protective layer the binding force between cured particles are weak, allowing the protective layer to dissolve into an organic solvent, and during a repetitive image forming process the protective layer tends to partially wear out and fine cured particles are likely to come off the protective layer. By making the protective layer insoluble in organic solvents as in the present invention, it is possible to achieve significant increase in wear resistance. This is because a three-dimensional network is developed for high crosslink density and because curing reaction takes place over a wide area of the protective layer to increase the molecular weight of the resultant cured material.

Next, constituent materials for coating solution for the protective layer of the present invention will be described.

A radically polymerizable monomer used in the present invention that bears three or more functional groups and has no charge transporting structure means a monomer that has no hole transporting structure (e.g., triarylamine, hydrazone, pyrazoline, or carbazole) and no electron transporting structure (e.g., fused polycyclic quinone, diphenoquinone, or electron-attracting aromatic rings bearing cyano group and/or nitro group) and that bears three or more radically polymerizable functional groups. The radically polymerizable functional group is not particularly limited as long as it contains carbon-carbon double bond(s) and can be radically polymerized; examples of such a functional group include 1-substituted ethylene groups and 1,1-disubstituted ethylene groups, shown below. (1) Examples of 1-substituted ethylene groups include those represented by the following formula:

$$CH_2{=}CH{-}X_1{-} \qquad \text{Formula (10)}$$

where $X_1$ represents an optionally substituted arylene group such as phenylene group or naphthylene group, an optionally substituted alkenylene group, —CO—, —COO—, —CON($R_{10}$) (where $R_{10}$ represents a hydrogen atom, alkyl group such as methyl group or ethyl group, aralkyl group such as benzyl group, naphthylmethyl group or phenethyl group, or aryl group such as phenyl group or naphthyl group), or S—.

Specific examples of these functional groups include vinyl group, styryl group, 2-methyl-1,3-butadienyl group, vinylcarbonyl group, acryloyloxy group, acryloylamide group, and vinylthioether group. (2) Examples of 1,1-disubstituted ethylene groups include those represented by the following formula:

$$CH_2{=}C(Y){-}X_2{-} \qquad \text{Formula (11)}$$

where Y represents an optionally substituted alkyl group, optionally substituted aralkyl group, optionally substituted aryl group such as phenyl group or naphthyl group, halogen atom, cyano group, nitro group, alkoxy group such as methoxy group or ethoxy group, —$COOR_{11}$ (where $R_{11}$ represents a hydrogen atom, optionally substituted alkyl group such as methyl group or ethyl group, optionally substituted aralkyl group such as benzyl group or phenethyl group, or optionally substituted aryl group such as phenyl group or naphthyl group) or $CONR_{12}R_{13}$ (where $R_{12}$ and $R_{13}$ may be identical or different, each representing a hydrogen atom, optionally substituted alkyl group such as methyl group or ethyl group, optionally substituted aralkyl group such as benzyl group, naphthylmethyl group or phenetyl group, or optionally substituted aryl group such as phenyl group or naphthyl group), and $X_2$ represents substituents identical to those represented by X1 in the formula (10), a single bond, or alkylene group; at least one of Y and $X_2$ represents an oxycarbonyl group, cyano group, alkenylene group, or aromatic ring.

Specific examples of these functional groups include α-acryloyloxy chloride group, methacryloyloxy group, α-cyanoacryloyoxy group, α-cyanophenylene group, and methacryloylamino group.

Additional substituents added to the substituents represented by $X_1$, $X_2$ and Y include halogen atoms, nitro group, cyano group, alkyl groups such as methyl group and ethyl group, alkoxy groups such as methoxy group and ethoxy group, aryloxy groups such as phenoxy group, aryl groups such as phenyl group and naphthyl group, and aralkyl groups such as benzyl group and phenetyl group.

Among these radically polymerizable functional groups, acryloyloxy group and methacryloyloxy group are most preferable. Compounds bearing three or more acryloyloxy groups can be prepared by esterification reaction or transesterification reaction between, for example, a compound bearing three or more hydroxyl groups in its molecule and acrylic acid (acrylate), acrylic acid halide or acrylic acid ester. Compounds bearing three or more methacyloyloxy groups can be prepared in similar way. Radically polymerizable functional groups in a monomer bearing three or more radically polymerizable functional groups may be identical or different.

Specific examples of the radically polymerizable monomer that bears three or more functional groups and has no charge transporting structure include, but not limited to, those shown below.

Examples of the radically polymerizable monomer used in the present invention include trimethylolpropane triacrylate (TMPTA), ethylene oxide-modified (hereinafter abbreviated as EO-modified) trimethylolpropane triacrylate, propylene oxide-modified (hereinafter abbreviated as PO-modified) trimethylolpropane triacrylate, caprolactone-modified trimethylolpropane triacrylate, alkylene-modified trimethylolpropane trimethacrylate, pentaerythritol triacrylate, pentaerythritol tetraacrylate (PETTA), glycerol triacrylate, epichlorohydrin-modified (hereinafter abbreviated as ECHmodified) glycerol triacrylate, PO-modified glycerol triacrylate, tris(acryloxyethyl)isocyanurate, dipentaerythritol hexaacrylate (DPHA), caprolactone-modified dipentaerythritol hexaacrylate, dipentaerythritol hydroxypentaacrylate, alkylated dipentaerythritol pentaacrylate, alkylated dipentaerythritol tetraacrylate, alkylated dipentaerythritol triacrylate, dimethylolpropane tetraacrylate (DTMPTA), pentaerythritolethoxy tetraacrylate, EO-modified phosphonic acid triacrylate, and 2,2,5,5,-tetrahydroxymethylcyclopentanone tetraacrylate. These may be used singly or in combination.

With respect to the radically polymerizable monomer used in the present invention that bears three or more functional groups and has no charge transport structure, the ratio of its molecular weight to the number of functional groups in the monomer, (i.e., molecular weight/number of functional groups), is preferably 250 or less in order to form crosslink bonds that are densely populated in the crosslinked surface layer. If this ratio is greater than 250, the crosslinked surface layer become more flexible, somewhat reducing its wear resistance; therefore, it is not preferable to use monomers that contain excessively long modification groups alone among those with modifcation groups such as EO, PO, and caprolactone. The content of radically polymerizable monomers having three or more functional groups used for a protective layer is 20% by mass to 80% by mass based on the total mass of the protective layer and, more preferably, 30% by mass to 70% by mass. If less than 20% by mass is used, wear resistance may not be improved significantly compared to using conventional thermoplastic binder resin, because the density of three-dimensional crosslink bonds formed in the protective layer is small. If more than 80% by mass is used, it results in reduced electrical characteristics decrease in the content of charge transporting compound. Different processes require different electrical characteristics and different degree of wear resistance, and the thickness of the protective layer in the photoconductor changes accordingly. However, the content of radically polymerizable monomers is preferably 30% by mass to 70% by mass in view of the balance between electrical characteristics and wear resistance.

A radically polymerizable monomer in the present invention that bears one functional group and a charge transporting structure used means a monomer that has a hole transporting structure (e.g., triarylamine, hydrazone, pyrazoline, or carbazole) or an electron transporting structure (e.g., fused polycyclic quinones, diphenoquinone, or electron-attracting aromatic rings bearing cyano group and/or nitro group) and that bears one radically polymerizable functional group. Examples of such a radically polymerizable functional group include those described above; in particular, acryloyloxy group and methacryloyloxy group are preferable. For the charge transport structure, triarylamine structure is highly effective, and by employing compounds represented by the general formula (i) and (ii), electrical characteristics (e.g., sensitivity and residual potential) may be stabilized in a suitable way.

General Formula (i)

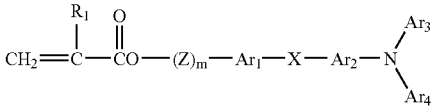

-continued

General Formula (ii)

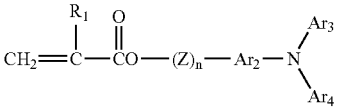

where $R_1$ represents a hydrogen atom, halogen atom, substituted or unsubstituted alkyl group, substituted or unsubstituted aralkyl group, substituted or unsubstituted aryl group, cyano group, nitro group, alkoxy group, —$COOR_7$ (where $R_7$ represents a hydrogen atom, substituted or unsubstituted alkyl group, substituted or unsubstituted aralkyl group, or substituted or unsubstituted aryl group), halogenated carbonyl group, or $CONR_8R_9$ (where $R_8$ and $R_9$ independently represent a hydrogen atom, halogen atom, substituted or unsubstituted alkyl group, substituted or unsubstituted aralkyl group, or substituted or unsubstituted aryl group), $Ar_1$ and $Ar_2$ independently represent a substituted or unsubstituted arylene group, $Ar_3$ and $Ar_4$ independently represent a substituted or unsubstituted aryl group, X represents a single bond, substituted or unsubstituted alkylene group, substituted or unsubstituted cycloalkylene group, substituted or unsubstituted oxyalkylene group, oxy group, thio group, or vinylene group, Z represents a substituted or unsubstituted alkylene group, substituted or unsubstituted oxyalkylene group, or alkyleneoxycarbonyl group, and "m" and "n" independently represent an integer of 0 to 3.

Examples of the substituent $R_1$ in the formulae (1) and (2) include as alkyl group methyl group, ethyl group, propyl group and butyl group, as aryl group phenyl group and naphthyl group, as aralkyl group benzyl group, phenethyl group and naphthylmethyl group, and as alkoxy group methoxy group, ethoxy group and propoxy group. These groups may be further substituted with a halogen atom, nitro group, cyano group, alkyl group such as methyl group and ethyl group, alkoxy group such as methoxy group and ethoxy group, aryloxy group such as phenoxy group, aryl group such as phenyl group and naphthyl group, and/or aralkyl group such as benzyl group and phenethyl group.

Most preferably, $R_1$ represents a hydrogen atom or methyl group.

Each of $Ar_3$ and $Ar_4$ represents a substituted or unsubstituted aryl group; examples thereof include fused polycyclic hydrocarbon groups, non-fused cyclic hydrocarbon groups, and heterocyclic groups.

For the fused polycyclic hydrocarbon groups, those having 18 or less carbon atoms that participate in ring formation are preferable; examples include pentanyl group, indenyl group, naphthyl group, azulenyl group, heptarenyl group, biphenylenyl group, as-indacenyl group, s-indacenyl group, fluorenyl group, acenaphthylenyl group, pleiadenyl group, acenaphthenyl group, phenalenyl group, phenanthryl group, antholyl group, fluoranthenyl group, acephenanthrylenyl group, aceanthrylenyl group, triphenylenyl group, pyrenyl group, chrysenyl group, and naphthacenyl group.

Examples of the non-fused cyclic hydrocarbon groups include monovalent, monocyclic hydrocarbon compounds such as benzene, diphenyl ether, polyethylenediphenyl ether, diphenylthioether and diphenylsulphone, monovalent, non-fused polycyclic hydrocarbon compounds such as biphenyl, polyphenyl, diphenylalkane, diphenylalkene, diphenylalkyne, triphenylmethane, distyrylbenzene, 1,1-diphenylcycloalkane, polyphenylalkane and polyphenylalkene, and monovalent, cyclic hydrocarbon compounds such as 9,9-diphenylfluorene.

Examples of heterocyclic groups include monovalent groups such as carbazole, dibenzofuran, dibenzothiphene, oxadiazole, and thiadiazole.

The aryl groups represented by $Ar_3$ and $Ar_4$ may have substituent(s) described in (1) to (8) below, for example.

(1) a halogen atom, cyano group, nitro group, and the like.

(2) alkyl groups, preferably straight- or branched-chain alkyl groups of 1 to 12 carbon atoms, more preferably 1 to 8 carbon atoms, and most preferably 1 to 4 carbon atoms. These alkyl groups may be substituted with a fluorine atom, hydroxyl group, cyano group, alkoxy group of 1 to 4 carbon atoms, phenyl group, or phenyl group substituted with a halogen atom, alkyl group of 1 to 4 carbon atoms or alkoxy group of 1 to 4 carbon atoms. Specific examples include methyl group, ethyl group, n-butyl group, i-propyl group, t-butyl group, s-butyl group, n-propyl group, tri-fluoromethyl group, 2-hydroxyethyl group, 2-ethoxyethyl group, 2-cyanoethyl group, 2-methoxyethyl group, benzyl group, 4-chlorobenzyl group, 4-methylbenzyl group, and 4-phenylbenzyl group.

(3) alkoxy groups (—$OR_2$), where $R_2$ represents the alkyl group defined in (2). Specific examples include methoxy group, ethoxy group, n-propoxy group, i-propoxy group, t-butoxy group, n-butoxy group, s-butoxy group, i-butoxy group, 2-hydroxyethoxy group, benzyloxy group, and trifluoromethoxy group.

(4) aryloxy groups; phenyl group and naphthyl group can be exemplied as an aryl group. These may be substituted with an alkoxy group of 1 to 4 carbon atoms, alkyl group of 1 to 4 carbon atoms, or halogen atom. Specific examples include phenoxy group, 1-naphthyloxy group, 2-naphthyloxy group, 4-methoxyphenoxy group, and 4-methylphenoxy group.

(5) alkylmercapto groups and arylmercapto groups; specific examples include methylthio group, ethylthio group, phenylthio group, and p-methylphenylthio group.

(6) Groups represented by the formula:

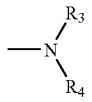

where $R_3$ and $R_4$ independently represent a hydrogen atom, alkyl group defined in (2) or aryl group. Examples of the aryl group include phenyl group, biphenyl group and naphthyl group all of which may be substituted with alkoxy group of 1 to 4 carbon atoms, alkyl group of 1 to 4 carbon atoms, and/or halogen atom. $R_3$ and $R_4$ may join together to form a ring.

Specific examples of groups listed in (6) include amino group, diethylamino group, N-methyl-N-phenylamino group, N,N-diphenylamino group, N,N-di(tryl)amino group, dibenzylamino group, piperidino group, morpholino group, and pyrrolidino group.

(7) alkylenedioxy groups and alkylenedithio groups, such as methylenedioxy group and methylenedithio group.

(8) substituted or unsubstituted styryl group, substituted or unsubstituted β-phenylstyryl group, diphenylaminophenyl group, ditolylaminophenyl group, and the like.

Examples of arylene groups represented by $Ar_1$ and $Ar_2$ include divalent groups derived from aryl groups represented by $Ar_3$ and $Ar_4$.

X represents a single bond, substituted or unsubstituted alkylene group, substituted or unsubstituted cycloalkylene group, substituted or unsubstituted alkylene ether group, oxygen atom, sulfur atom, or vinylene group.

Examples of substituted or unsubstituted alkylene groups are straight- or branched-chain alkylene groups of 1 to 12 carbon atoms, more preferably 1 to 8 carbon atoms, and most preferably 1 to 4 carbon atoms. The alkylene groups may be further substituted with a fluorine atom, hydroxyl group, cyano group, alkoxy group of 1 to 4 carbon atoms, phenyl group, or phenyl group substituted with a halogen atom, alkyl group of 1 to 4 carbon atoms, or alkoxy group of 1 to 4 carbon atoms. Specific examples thereof include methylene group, ethylene group, n-butylene group, i-propylene group, t-butylene group, s-butylene group, n-propylene group, trifluoromethylene group, 2-hydroxyethylene group, 2-ethoxyethylene group, 2-cyanoethylene group, 2-methoxyethylene group, benzylidene group, phenylethylene group, 4-chlorophenylethylene group, 4-methylphenylethylene group, and 4-biphenylethylene group.

Examples of substituted or unsubstituted cycloalkylene groups include cyclic alkylene groups of 5 to 7 carbon atoms; the cyclic alkylene groups may be further substituted with a fluorine atom, hydroxyl group, alkyl group of 1 to 4 carbon atoms, or alkoxy group of 1 to 4 carbon atoms. Specific examples thereof include cyclohexylidene group, cyclohexylene group, and 3,3-dimethylcyclohexylidene group.

Examples of substituted or unsubstituted alkylene ether groups include ethyleneoxy group, propyleneoxy group, ethylene glycol, propylene glycol, diethylene glycol, tetraethylene glycol, and tripropylene glycol. Alkylene ether groups and alkylene groups may be substituted with a hydroxyl group, methyl group, ethyl group, or the like.

The vinylene group is represented by the following general formula:

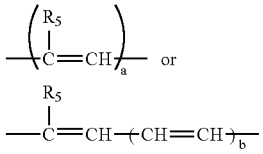

where $R_5$ represents a hydrogen atom, alkyl group identical to the one defined in (2), or aryl group identical to the one represented by $Ar_3$ and $Ar_4$, "a" represents an integer of 1 or 2, and "b" represents an integer of 1 to 3.

Z represents a substituted or unsubstituted alkylene group, substituted or unsubstituted bivalent alkylene ether group, or bivalent alkyleneoxycarbonyl group.

Examples of the substituted or unsubstituted alkylene group include those represented by X.

Examples of the substituted or unsubstituted bivalent alkylene ether group include bivalent alkylene ether groups represented by X.

Examples of the bivalent alkyleneoxycarbonyl groups include bivalent caprolactone-modified groups.

Preferred examples of the radically polymerizable compound of the present invention that bears one functional group and has a charge transport structure are those represented by the following general formula (iii).

General Formula (iii)

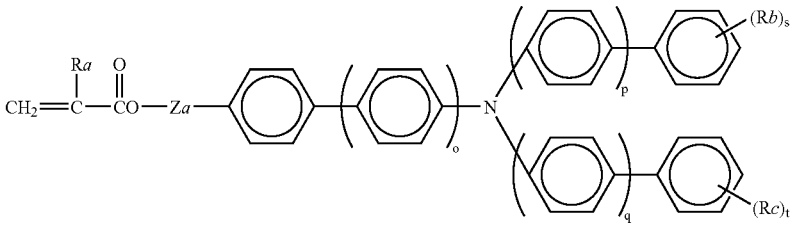

where "o," "p" and "q" independently represent an integer of 0 or 1, Ra represents a hydrogen atom or methyl group, Rb and Rc independently represent an alkyl group of 1 to 6 carbon atoms, "s" and "t" independently represent an integer of 0 to 3, and Za represents a single bond, methylene group, ethylene group, or group represented by any of the following formulas.

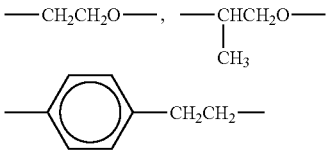

In compounds represented by the general formula (iii), substituents Rb and Rc preferably represent a methyl group or ethyl group.

The radically polymerizable compounds of the present invention that have one function group and have a charge transporting structure, represented by the general formula (i), (ii) and (iii), in particular those represented by the general formula (iii) that have one functional group, undergo polymerization reaction in which adjacent molecules are joined together through single bonds from their terminal carbon-carbon double bonds. For this reason, they are incorporated in a growing polymer chain rather than forming a terminal structure. In a polymer produced by polymerization with radically polymerizable monomers bearing three or more functional groups, these radically polymerizable compounds that bear one functional group exist within main chains as well as within crosslinked chains formed between adjacent main chains (note that these crosslinked chains are of two types: intermolecular crosslinked chains formed between one polymer and another, and intramolecular crosslinked chains that connect within one molecule certain sites of a folded main chain to other distant sites derived from monomers polymerized to the main chain). No matter whether the radically polymerizable compound bearing one functional group exists in the main chains or in the crosslinked chains, the triarylamine structure attached to the chain is bulky because it has at least three aryl groups placed in a radial direction from the nitrogen atom. The three aryl groups, however, are not directly attached to the chains but indirectly attached thereto via carbonyl groups or the like; therefore, their steric hindrance is small. Thus, the triarylamine structures are spatially spaced at an appropriate distance in the polymer and thus the intermolecular strain is small. It is also assumed that the polymer may have an intermolecular structure that can prevent the disconnection of charge transport paths when used for a surface layer of a photoconductor.

Specific examples of the radically polymerizable compound of the present invention that bears one functional group and has a charge transporting structure include, but not limited to, those listed below.

No. 1

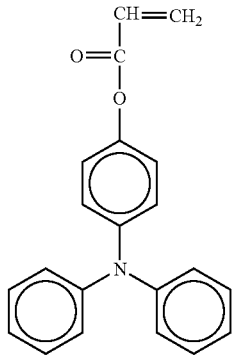

No. 2

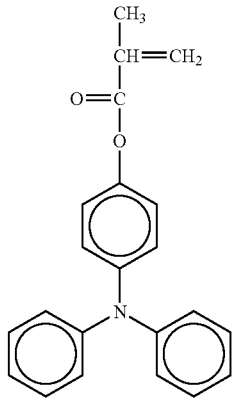

No. 3

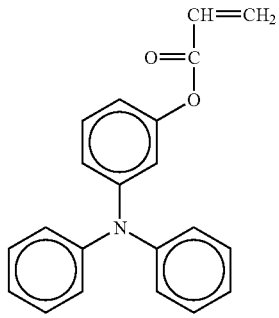

-continued
No. 4
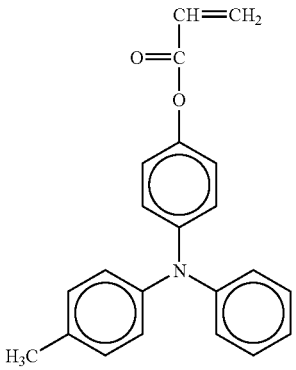
No. 5
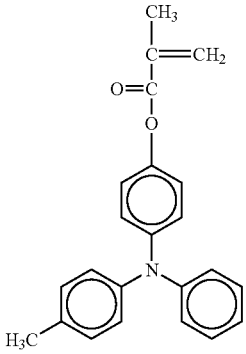
No. 6
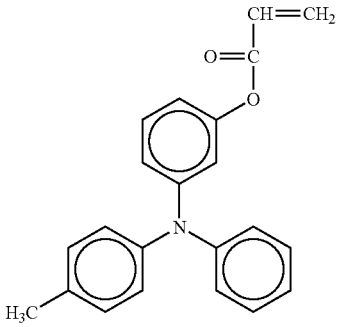
No. 7
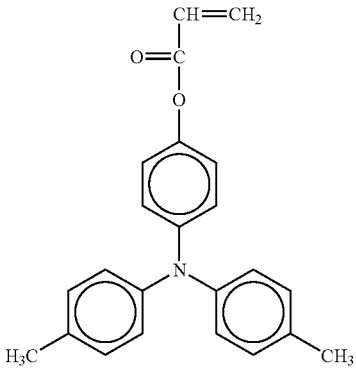
-continued
No. 8
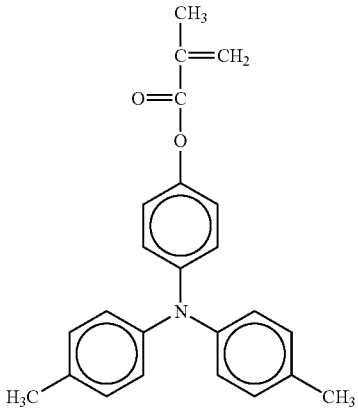
No. 9
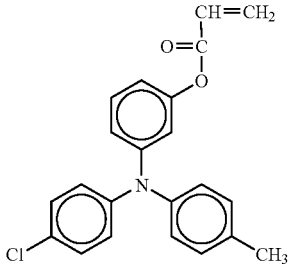
No. 10
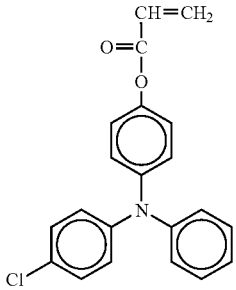
No. 11
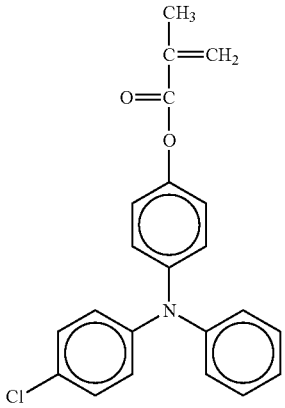

-continued
No. 12
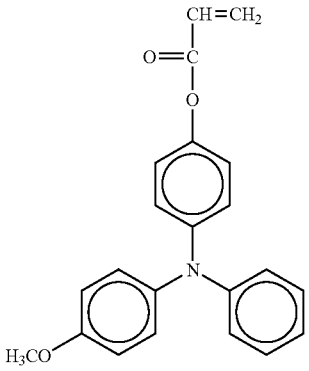
No. 13
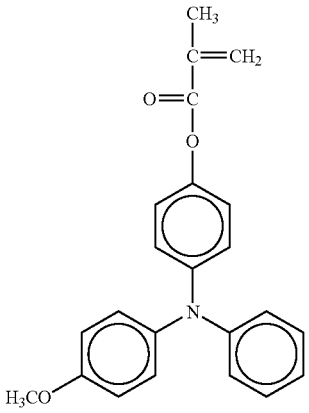
No. 14
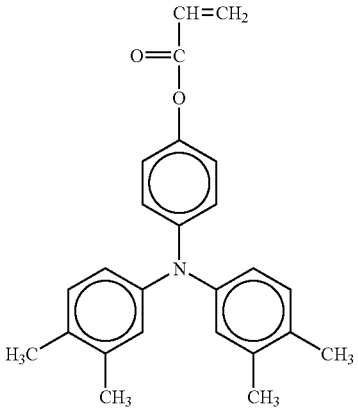
No. 15
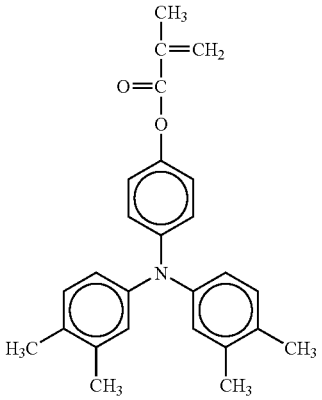
-continued
No. 16
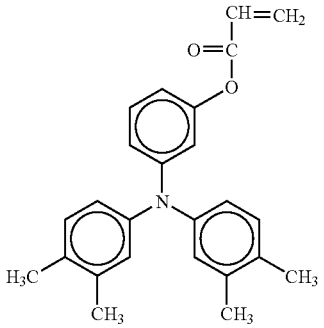
No. 17
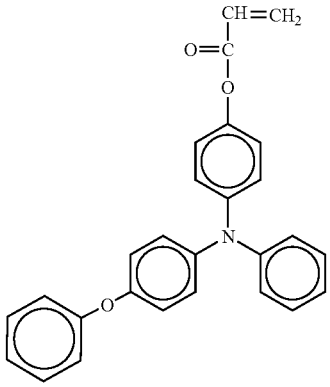
No. 18
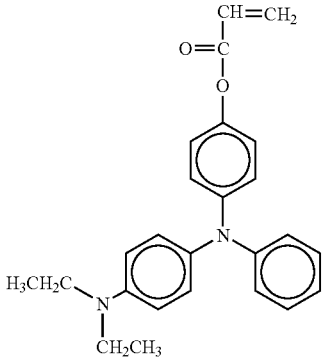
No. 19
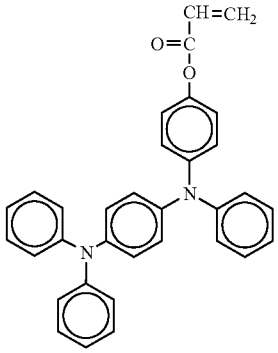

-continued
No. 20
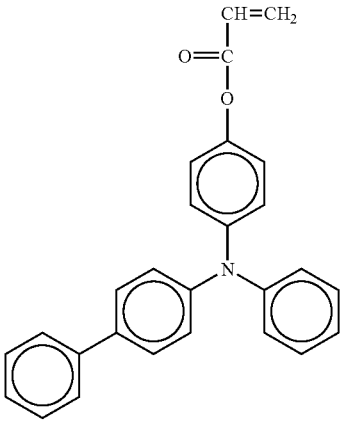
No. 21
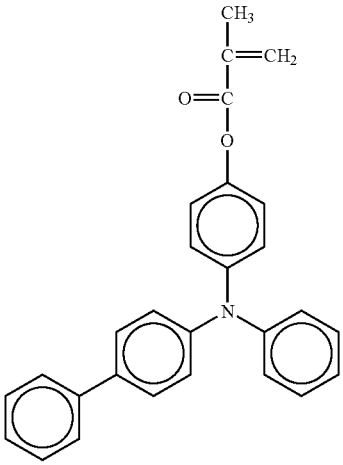
No. 22
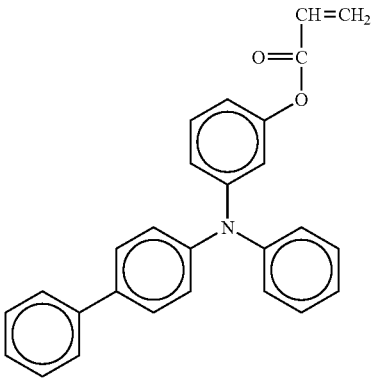
-continued
No. 23
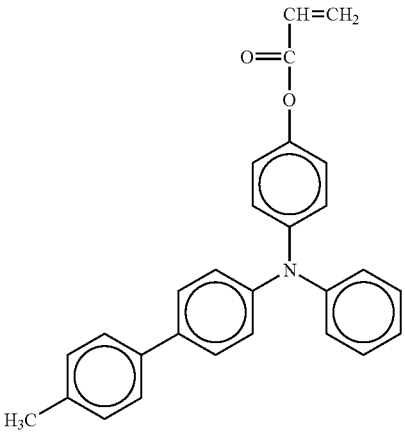
No. 24
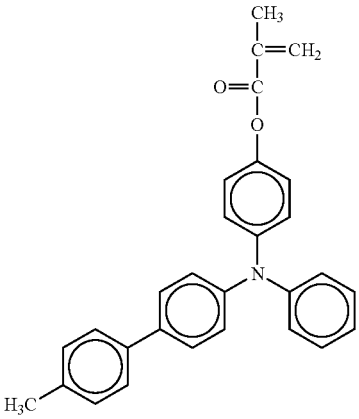
No. 25
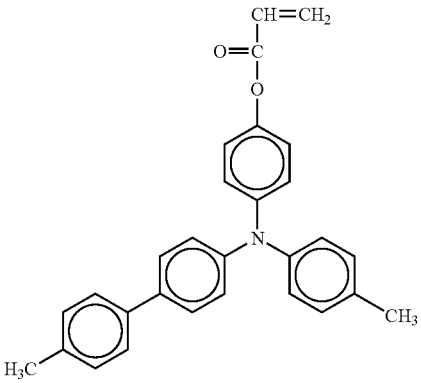

-continued
No. 26
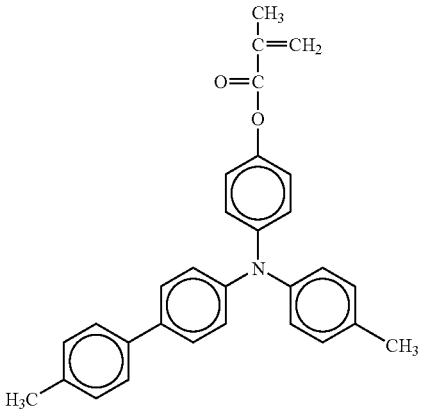
No. 27
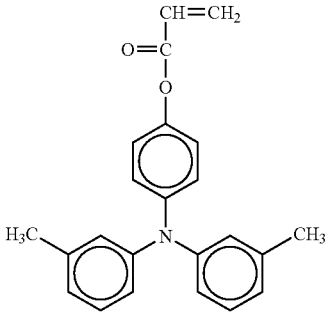
No. 28
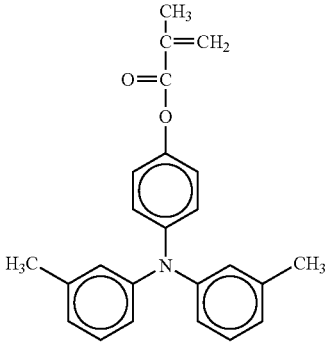
No. 29
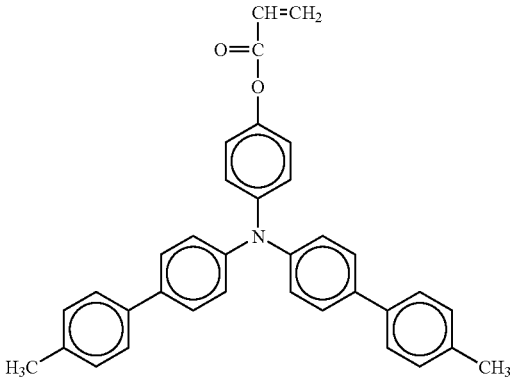
-continued
No. 30
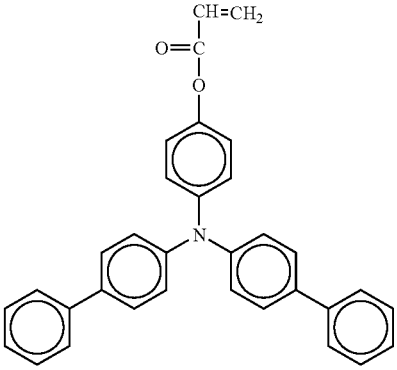
No. 31
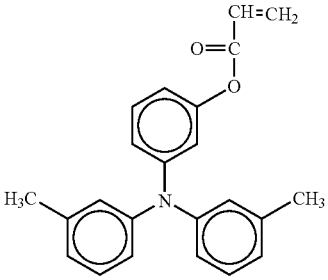
No. 32
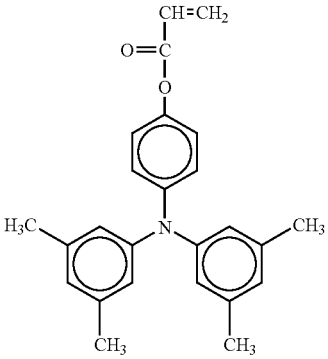
No. 33
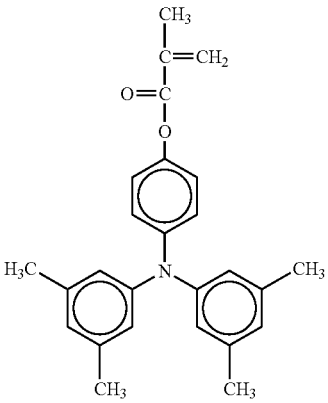

-continued
No. 34
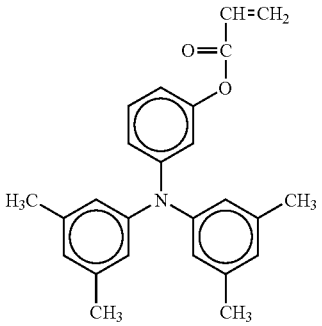
No. 35
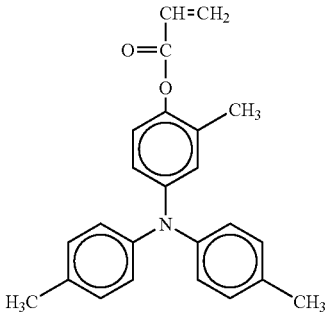
No. 36
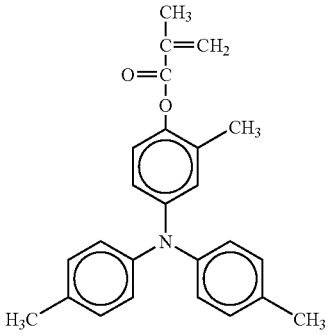
No. 37
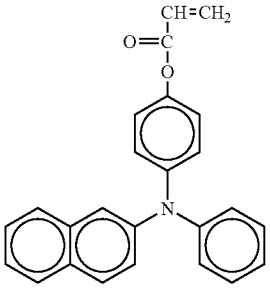
No. 38
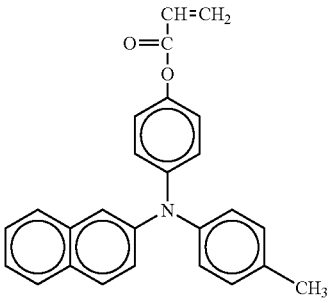
-continued
No. 39
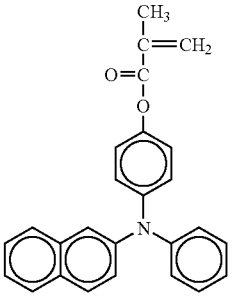
No. 40
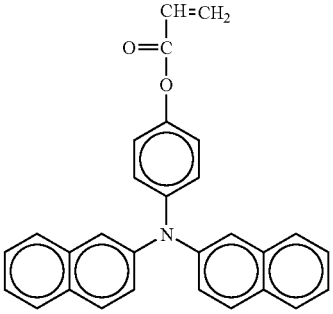
No. 41
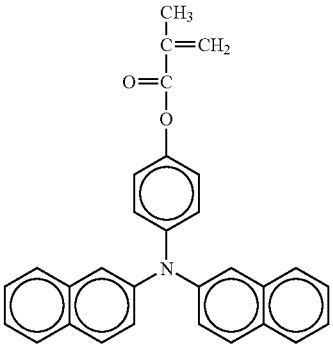
No. 42
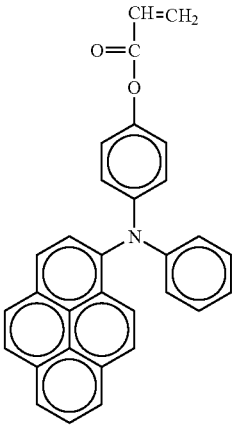

-continued
No. 43
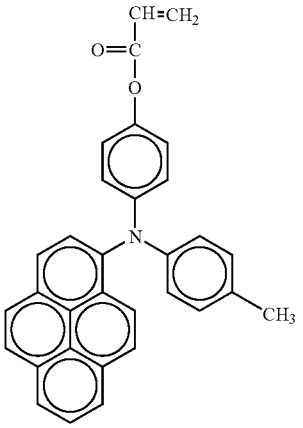
No. 44
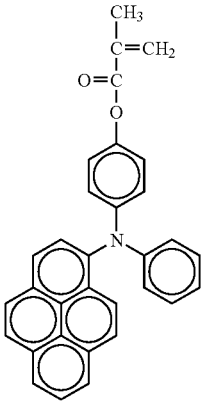
No. 45
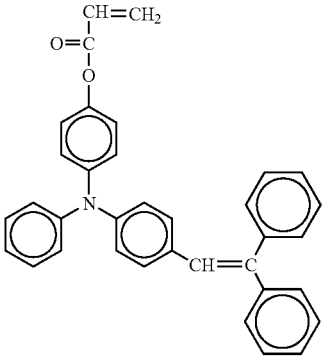
No. 46
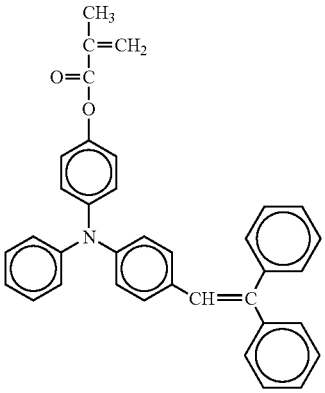
-continued
No. 47
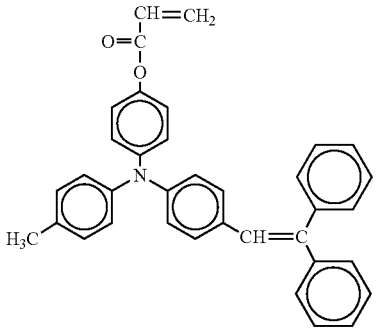
No. 48
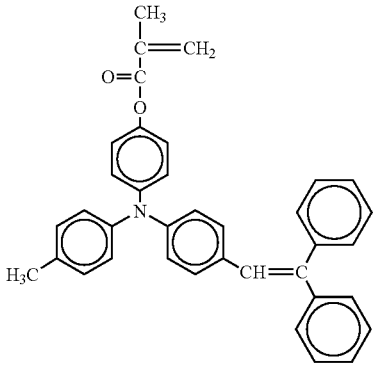
No. 49
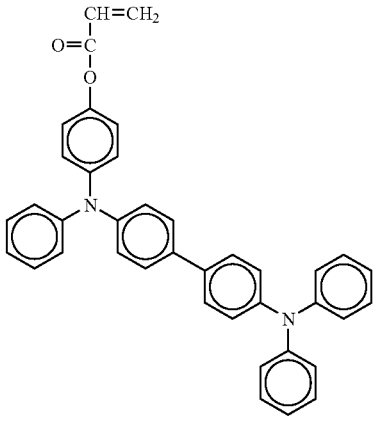
No. 50
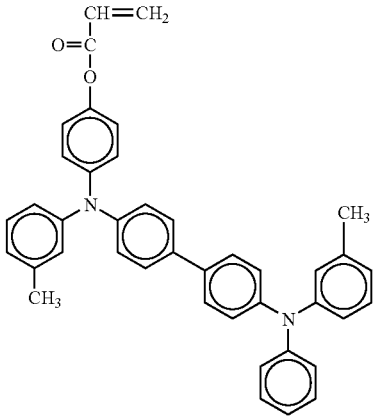

-continued
No. 51
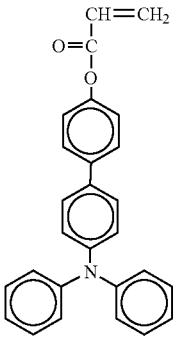
No. 52
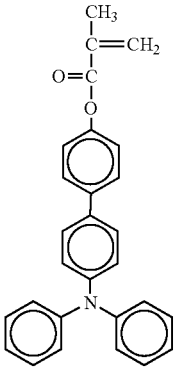
No. 53
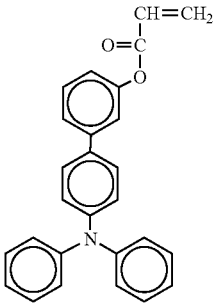
No. 54
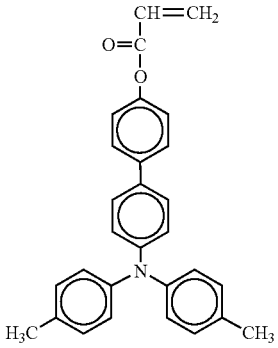
-continued
No. 55
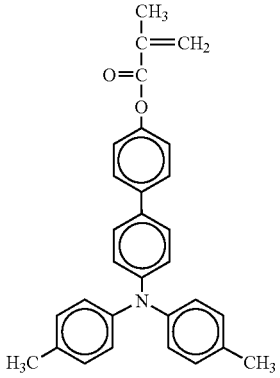
No. 56
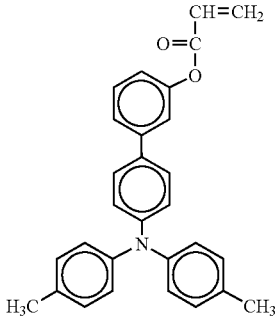
No. 57
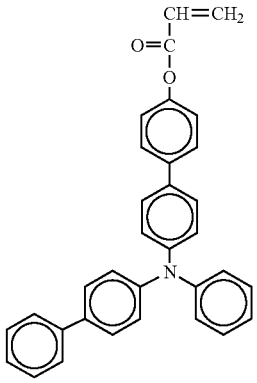
No. 58
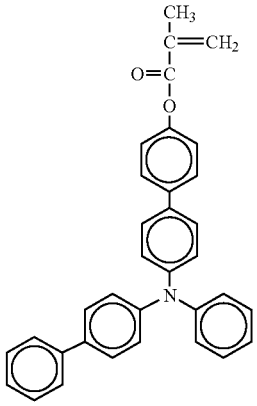

-continued
No. 59
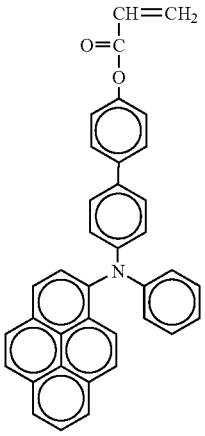
No. 60
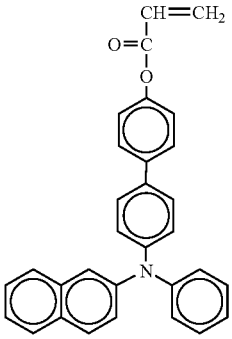
No. 61
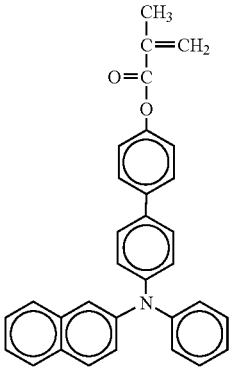
No. 62
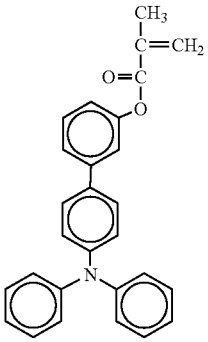
-continued
No. 63
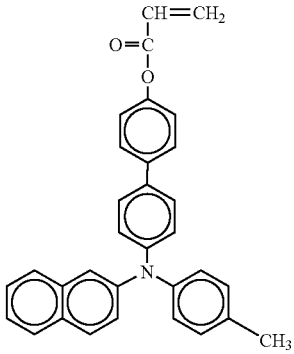
No. 64
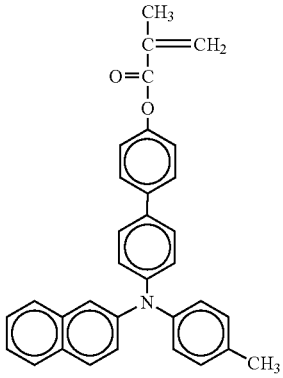
No. 65
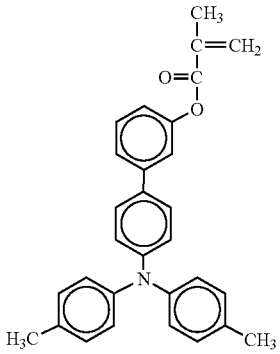
No. 66
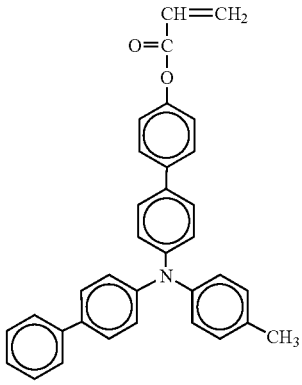

-continued
No. 67
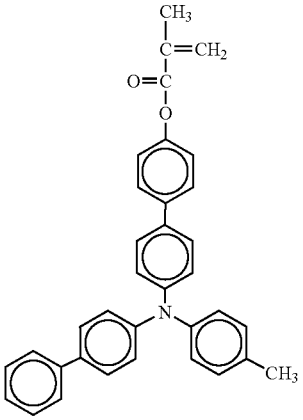
No. 68
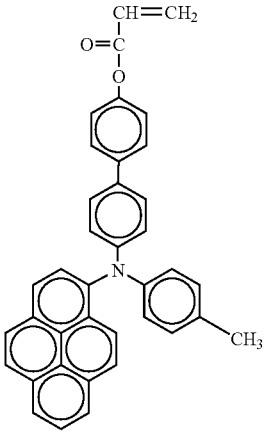
No. 69
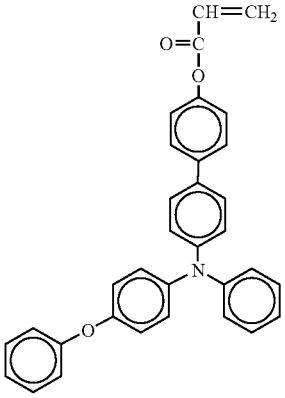
-continued
No. 70
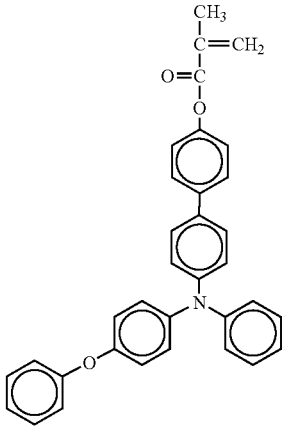
No. 71
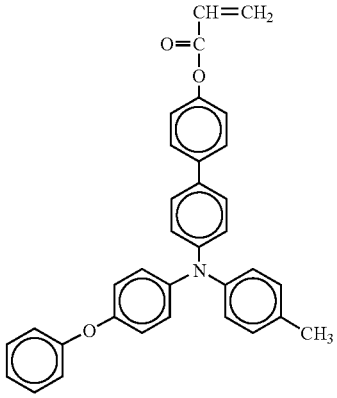
No. 72
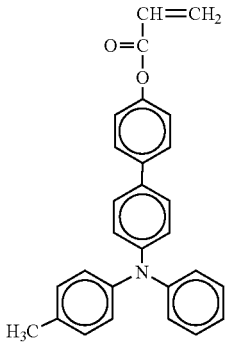
No. 73
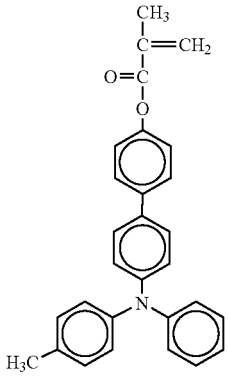

-continued
No. 74
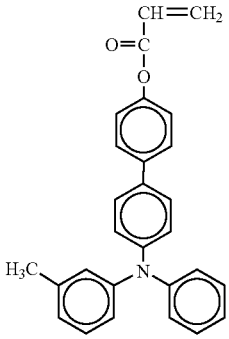
No. 75
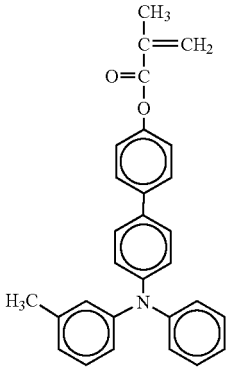
No. 76
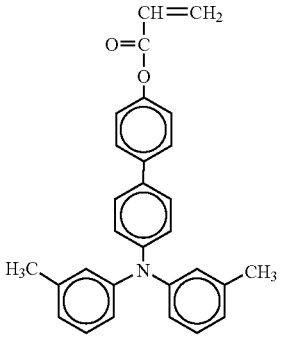
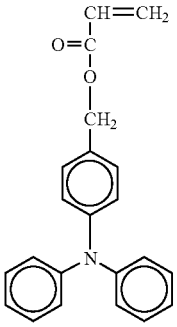
-continued
No. 78
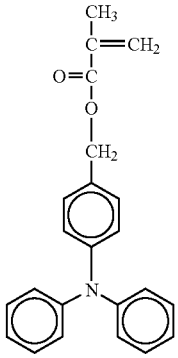
No. 79
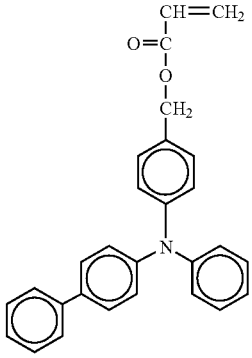
No. 80
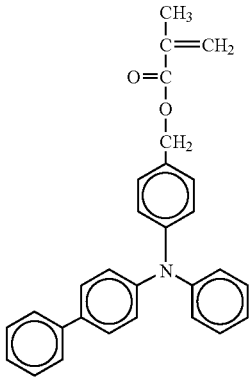
No. 81
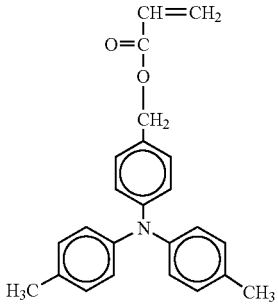

-continued
No. 82
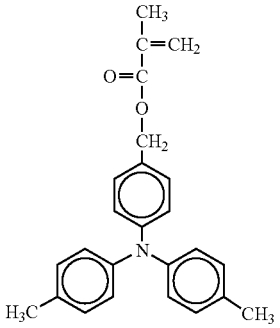
No. 83
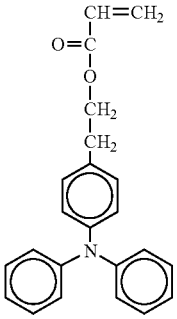
No. 84
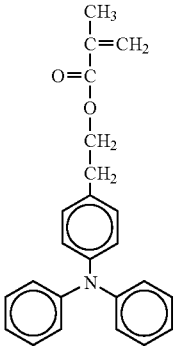
No. 85
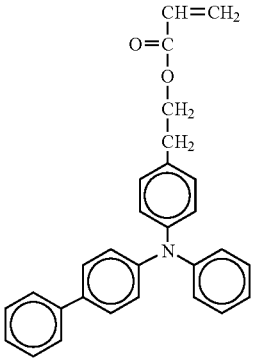
-continued
No. 86
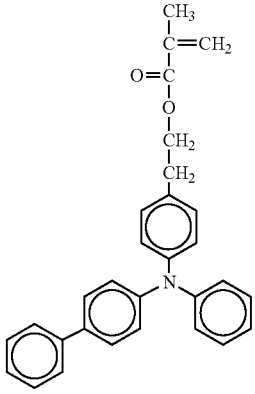
No. 87
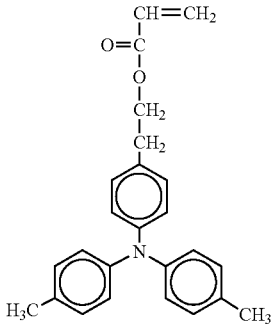
No. 88
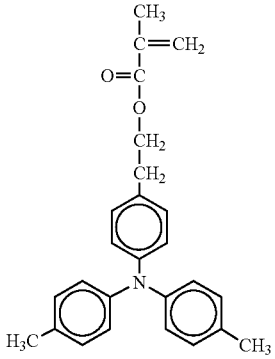
No. 89
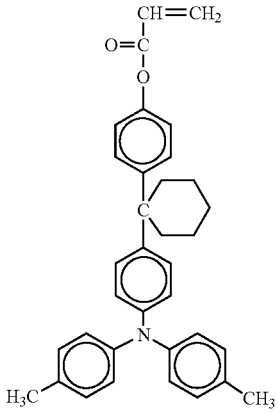

-continued
No. 90
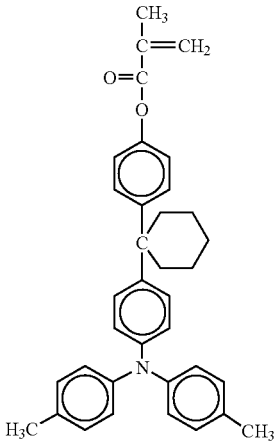
No. 91
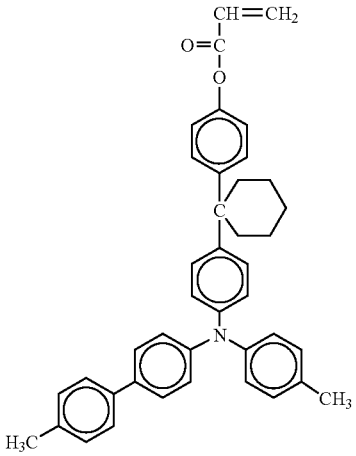
No. 92
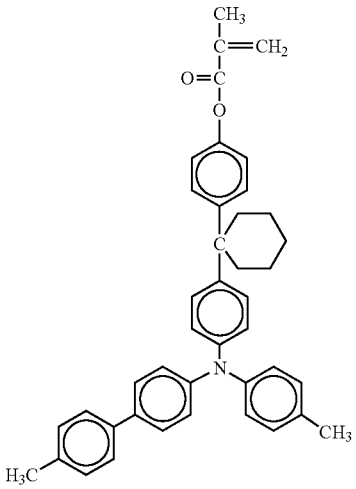
-continued
No. 93
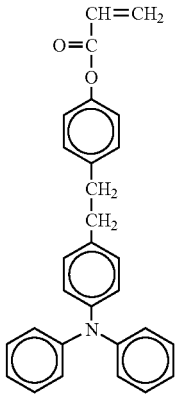
No. 94
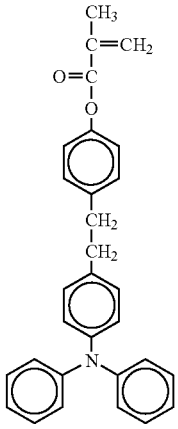
No. 95
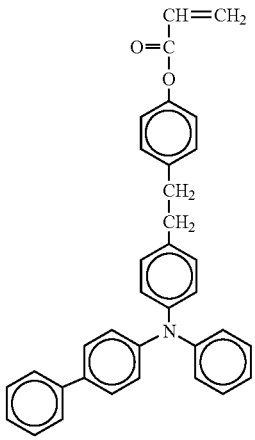

-continued
No. 96
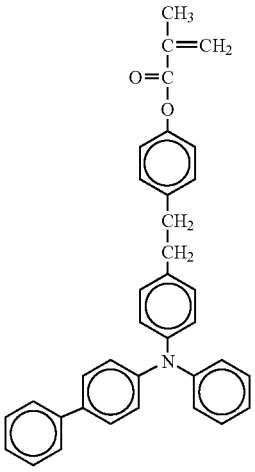
No. 97
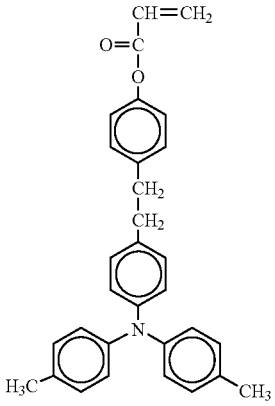
No. 98
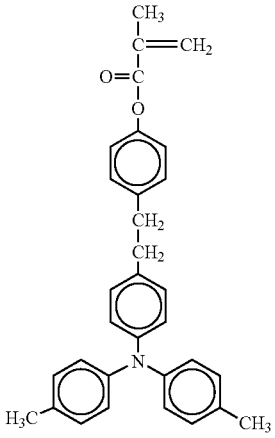
-continued
No. 99
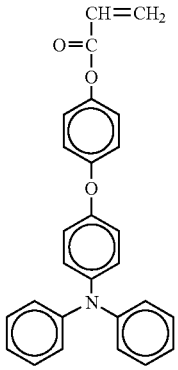
No. 100
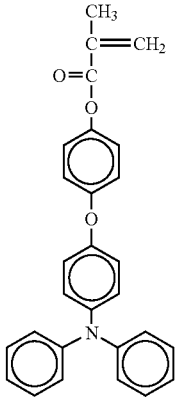
No. 101
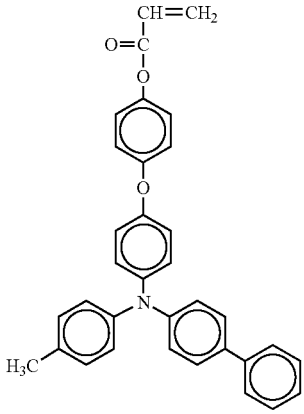
No. 102
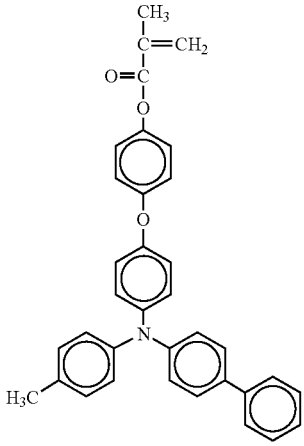

-continued
No. 103
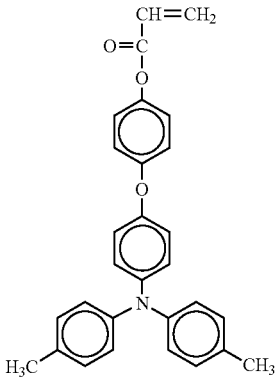
No. 104
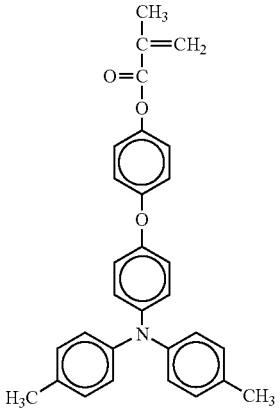
No. 105
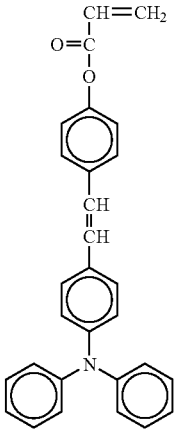
-continued
No. 106
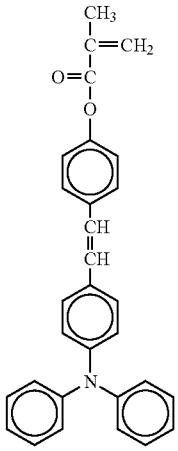
No. 107
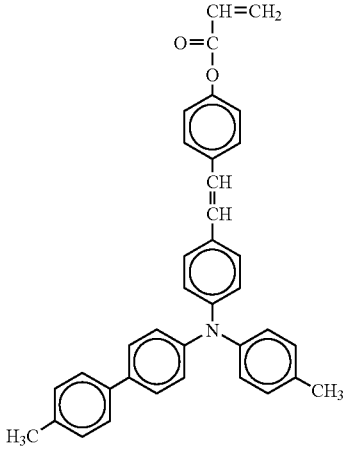
No. 108
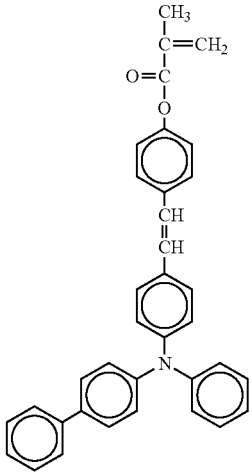

-continued
No. 109
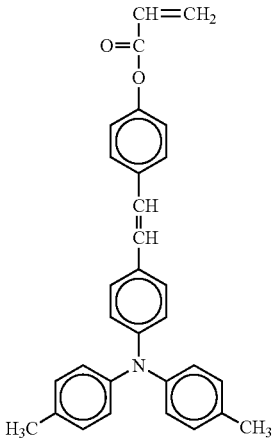
No. 110
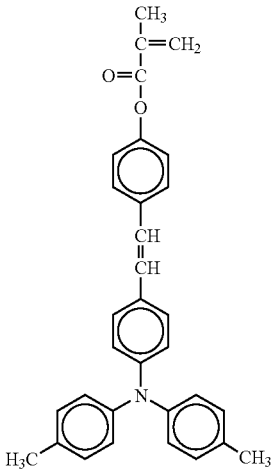
No. 111
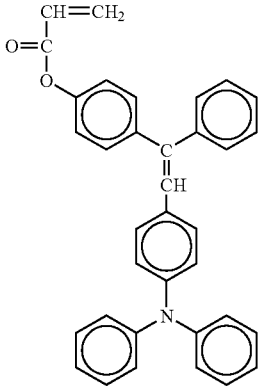
-continued
No. 112
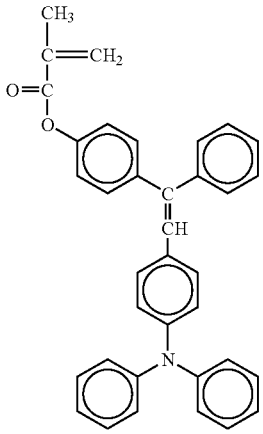
No. 113
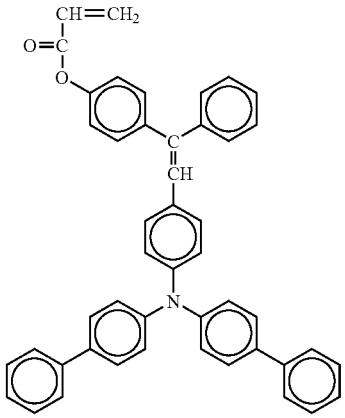
No. 114
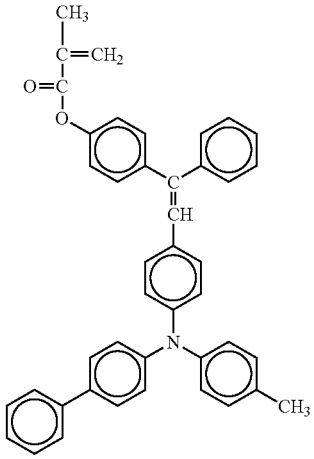

-continued
No. 115
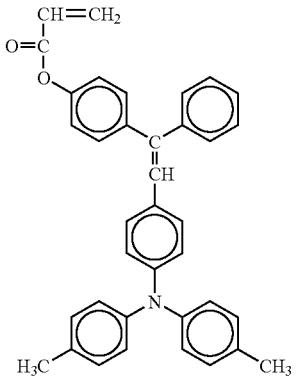
No. 116
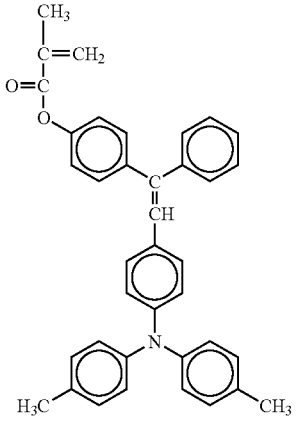
No. 117
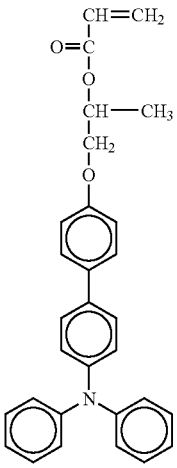
-continued
No. 118
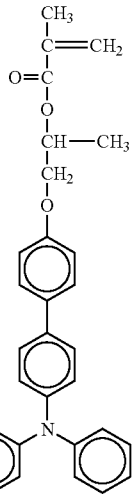
No. 119
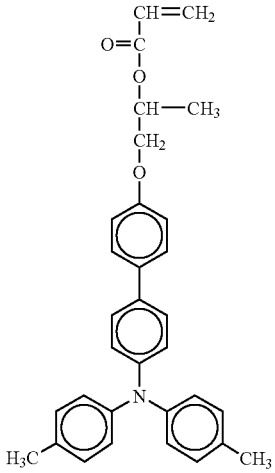
No. 120
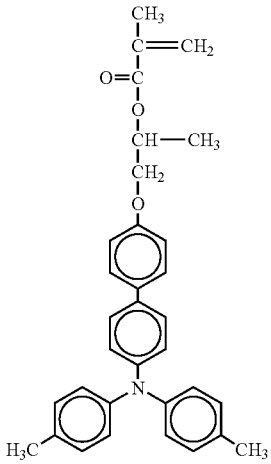

-continued
No. 121
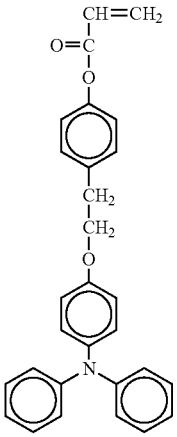
No. 122
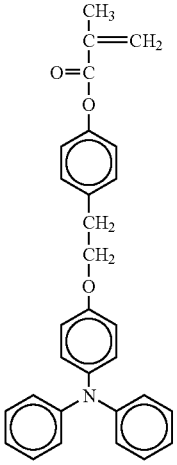
No. 123
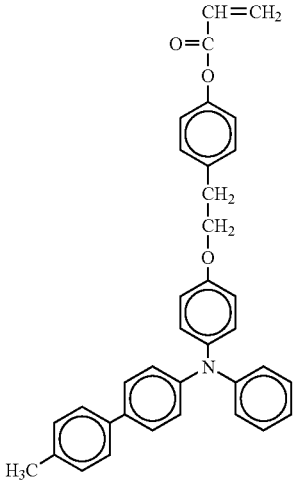
-continued
No. 124
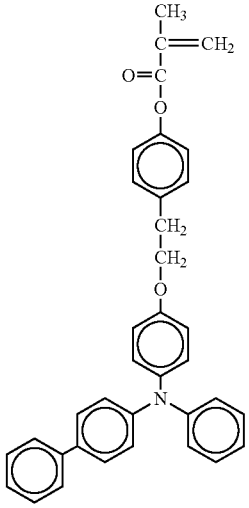
No. 125
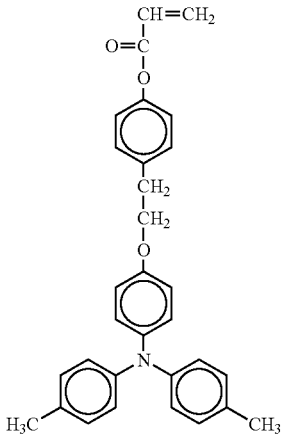
No. 126
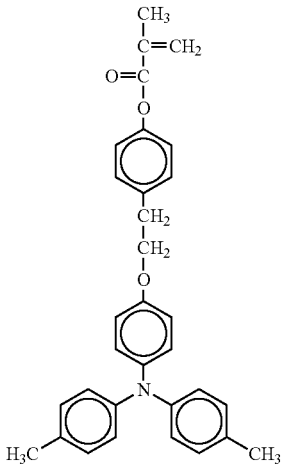

-continued
No. 127
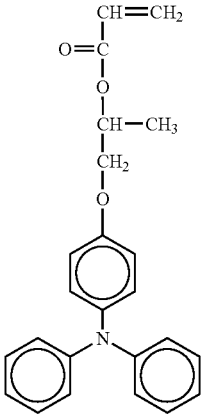
No. 128
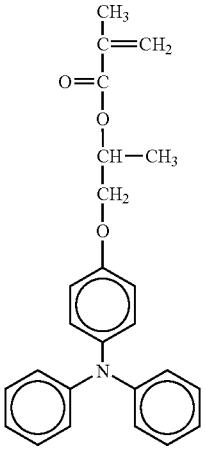
No. 129
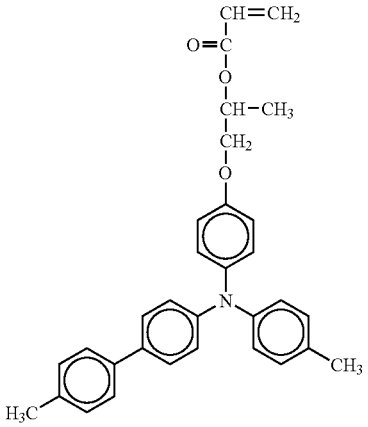
-continued
No. 130
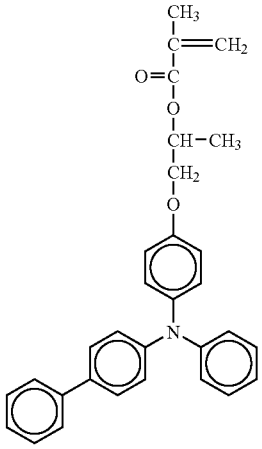
No. 131
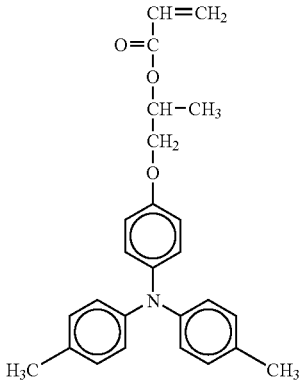
No. 132
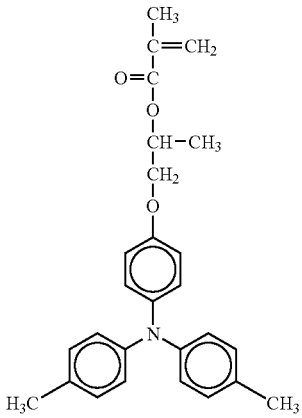
No. 133
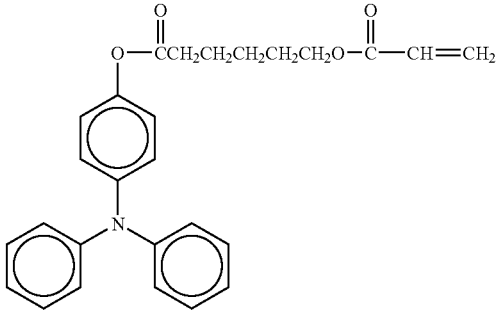

-continued
No. 134
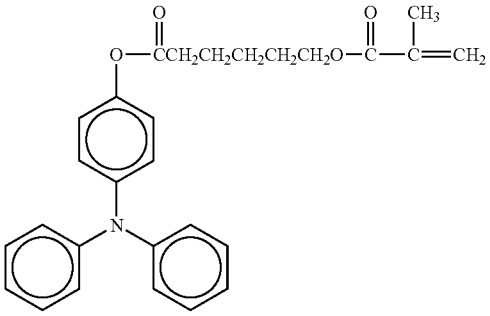
No. 135
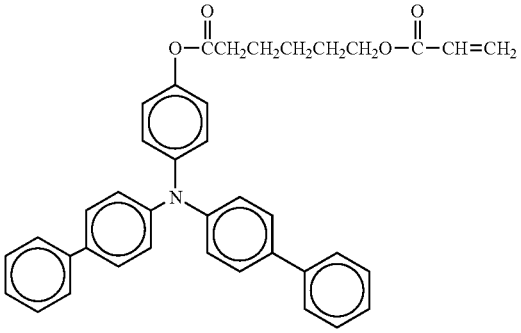
No. 136
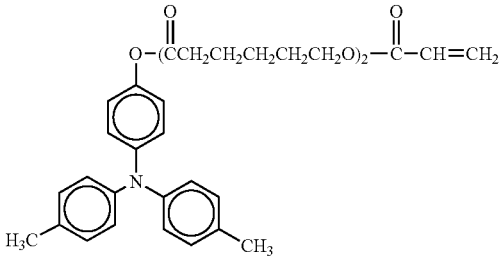
No. 137
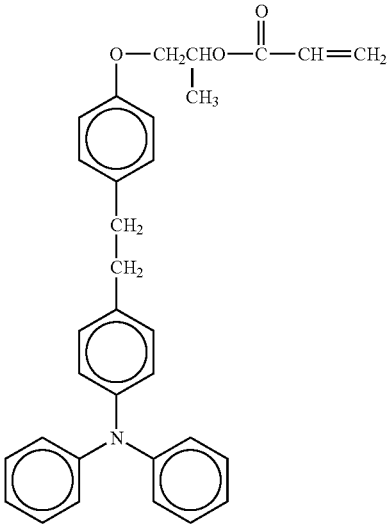
-continued
No. 138
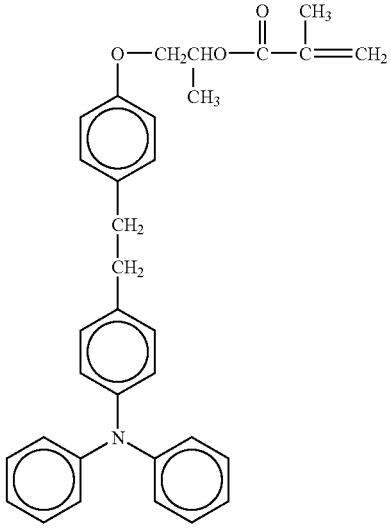
No. 139
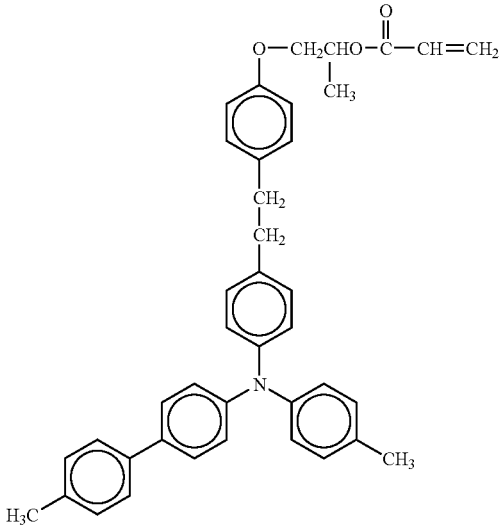
No. 140
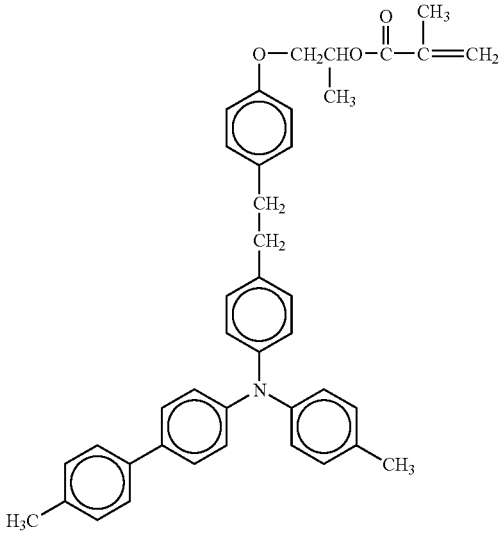

-continued
No. 141
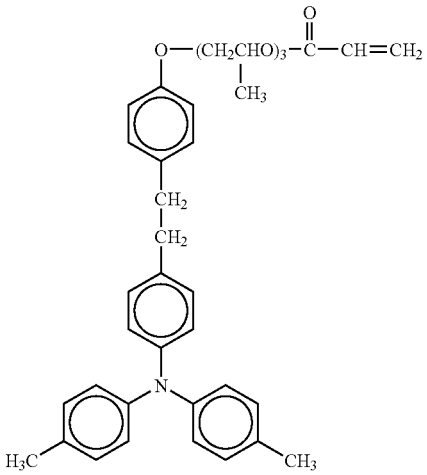
No. 142
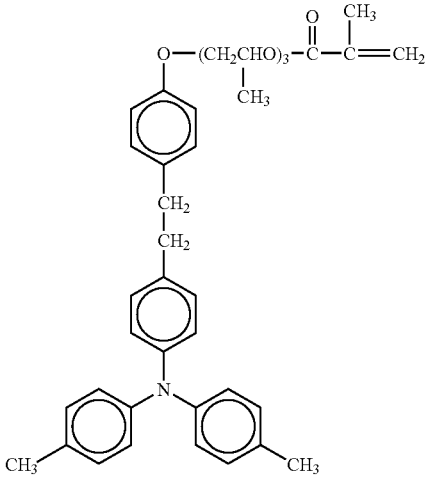
No. 143
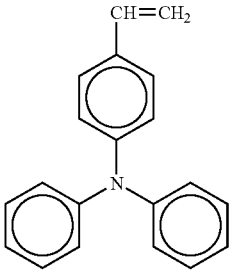
No. 144
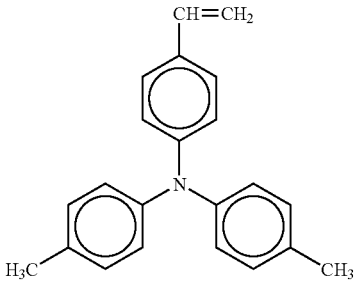
-continued
No. 145
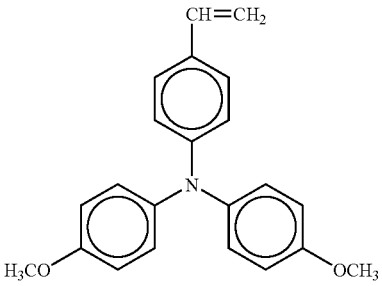
No. 146
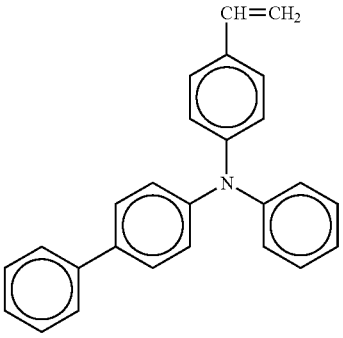
No. 147
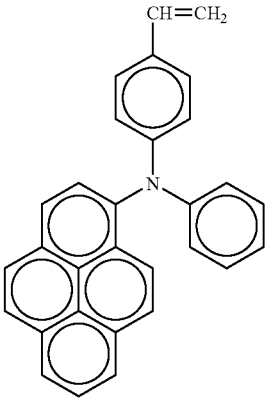
No. 148
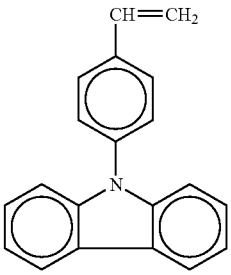
No. 149
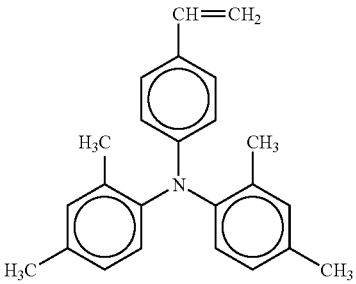

-continued
No. 150
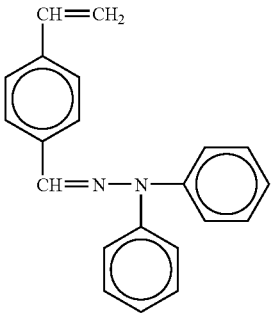
No. 151
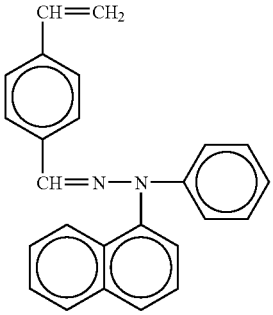
No. 152
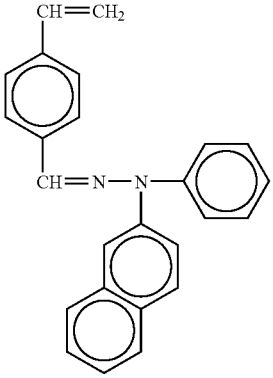
No. 153
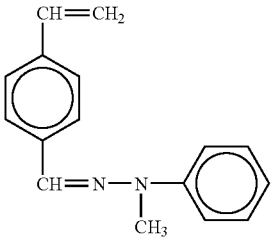
No. 154
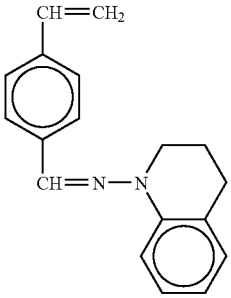
-continued
No. 155
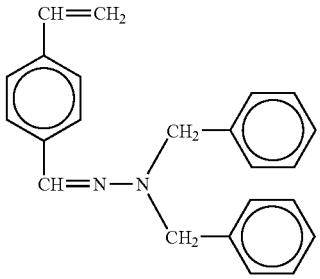
No. 156
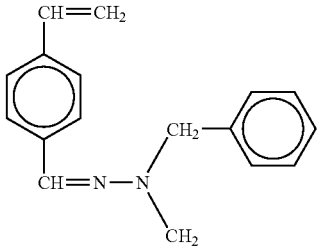
No. 157
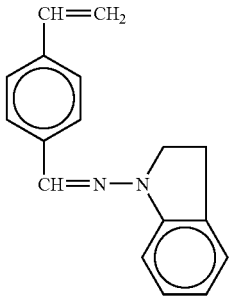
No. 158
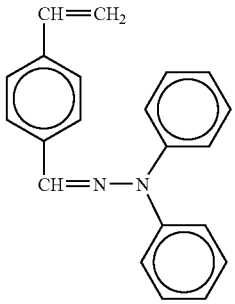
No. 159
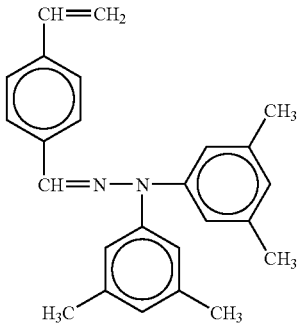

-continued

No. 160

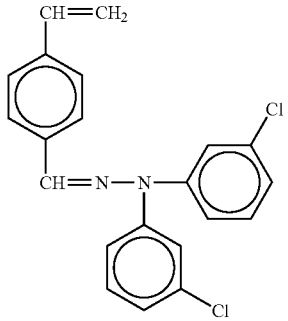

The radically polymerizable compound of the present invention that bears one functional group and has a charge transporting structure employed is essential for providing a crosslinked surface layer with charge transport ability. The content of the radically polymerizable compound is preferably 20% by mass to 80% by mass, more preferably 30% by mass to 70% by mass based on the total mass of the crosslinked surface layer. If less than 20% by mass is used, the charge transport ability of the crosslinked surface layer may not be sufficiently maintained, which in turn may cause reduction in its electrical characteristics (e.g., sensitivity reduction and residual potential increase) after repetitive use. If more than 80% by mass is used, the content of radically polymerizable monomers bearing three or more functional groups decreases, reducing the crosslink density to provide insufficient wear resistance in some cases. Although different processes require different electrical characteristics and different degree of wear resistance and thus the thickness of the protective layer in the photoconductor changes accordingly, the content of the radically polymerizable compound bearing one functional group is most preferably 30% by mass to 70% by mass in view of the balance between electrical characteristics and wear resistance.

The protective layer constituting the photoconductor of the present invention is one formed by curing at least a radically polymerizable monomer that bears three or more functional groups and has no charge transporting structure and a radically polymerizable monomer that bears one functional group and has a charge transporting structure. Furthermore, known radically polymerizable monofunctional monomers, known radically polymerizable bifunctional monomers, and/or known radically polymerizable oligomers may be used together for the purpose of viscosity control during coating process, stress relief of protective layer, surface energy reduction, and/or friction coefficient reduction. Known radically polymerizable monomers or oligomers can be used.

Examples of the radically polymerizable monomer bearing one functional group (radically polymerizable monofunctional monomer) include 2-ethylhexyl acrylate, 2-hydroxyethyl acrylate, 2-hydroxypropyl acrylate, tetrahydrofurfuryl acrylate, 2-ethylhexylcarbitol acrylate, 3-methoxybutyl acrylate, benzyl acrylate, cyclohexyl acrylate, isoamyl acrylate, isobutyl acrylate, methoxytriethyleneglycol acrylate, phenoxytetraethyleneglycol acrylate, cetyl acrylate, isotearyl acrylate, stearyl acrylate, and styrene monomer.

Examples of the radically polymerizable monomer bearing two functional groups (radically polymerizable bifuntional monomer) include 1,3-butanediol diacrylate, 1,4-butanediol diacrylate, 1,4-butanediol dimethacrylate, 1,6-hexanediol diacrylate, 1,6-hexanediol dimethacrylate, diethyleneglycol diacrylate, neopentylglycol diacrylate, EO-modified bisphenol A diacrylate, and EO-modified bisphenol F diacrylate, neopentylglycoldiacrylate.

Examples of the functional monomer include fluorinated monomers such as octafluoropentylacrylate, 2-perfluorooctylethyl acrylate, 2-perfluorooctylethyl methacrylate and 2-perfluoroisononylethyl acrylate; and vinyl monomers, acrylates and methacrylates which have a polysiloxane group such as acryloylpolydimethylsiloxaneethyl, methacryloylpolydimethylsiloxaneethyl, acryloylpolydimethylsiloxanepropyl, acryloylpolydimethylsiloxanebutyl, and diacryloylpolydimethylsiloxanediethyl, having 20 to 70 siloxane repeating units as described in Japanese Patent Application Publication (JP-B) No.05-60503 and 06-45770.

Examples of the radically polymerizable oligomer include epoxy acrylate oligomers, urethane acrylate oligomers, and polyester acrylate oligomers.

Note, however, that excessive amounts of radically polymerizable monomers and/or radically polymerizable oligomers having one or two functional groups leads to reduced density of three-dimensional crosslink bonds in the protective layer, thereby reducing its wear resistance. For this reason, the total content of these monomers and/or oligomers is preferably 50 parts by mass or less per 100 parts of radically polymerizable monomers bearing three or more functional groups and, more preferably 30 parts by mass or less.

As described above, the protective layer of the present invention is one formed by curing at least a radically polymerizable compound that bears three or more functional groups and has no charge transporting structure and a radically polymerizable compound that bears one functional group and has a charge transporting structure. Where appropriate, a polymerization initiator may be added to a coating solution for protective layer in order to facilitate the curing reaction.

When a thermal polymerization initiator is employed, examples thereof include peroxide-based initiators such as 2,5-dimethyl hexane-2,5-dihydro peroxide, diqumyl peroxide, benzoyl peroxide, t-butylqumyl peroxide, 2,5-dimethyl-2,5-di(peroxybenzoyl)hexine-3, di-t-butyl beroxide, t-butyl hydroberoxide, cumene hydroberoxide, lauroyl peroxide and 2,2-bis(4,4-di-t-butylperoxycyclohexyl)propane, and azo-based initiators such as azobis isobutylnitrile, azobiscyclohexane carbonitrile, azobisisobutyricmethyl, azobisisobutylamidin hydrochloride and 4,4-azobis-4-cyanovalericacid.

When a photopolymerization initiator is employed, examples thereof include acetophenone-based or ketal-based compounds such as diethoxyacetophenone, 2,2-dimethoxy-1,2-diphenylethan-1-one, 1-hydroxycyclohexyl-phenyl-ketone, 4-(2-hydroxyethoxy)phenyl-(2-hydroxy-2-propyl)ketone, 2-benzyl-2-dimethylamino-1-(4-morpholinophenyl) butanone-1,2-hydroxy-2-methyl-1-phenylpropane-1-one, 2-methyl-2-morpholino(4-methylthiophenyl)propane-1-one, and 1-phenyl-1,2-propanedione-2-(o-ethoxycarbonyl) oxime; benzoinether-based photo initiators such as benzoin, benzoinmethylether, benzoinethylether, benzoinisobutylether, and benzoinisopropyl ether; benzophenone-based photoinitiators such as benzophenone, 4-hydroxybenzophenone, methyl o-benzoylbenzoate, 2-benzoylnaphthalene, 4-benzoylbiphenyl, 4-benzoylphenylether, acrylated benzophenone, and 1,4-benzoylbenzene; thioxanthone-based photoinitiators such as 2-isopropylthioxanthone, 2-chlorothioxanthone, 2,4-dimethylthioxanthone, 2,4-diethylthioxanthone, and 2,4-dichlorothioxanthone; and other photopolymerization initiators such as ethylanthraquinone, 2,4,6-trimethylbenzoyldiphenylphosphine oxide, 2,4,6-trimethylbenzoylphenylethoxyphosphine oxide, bis(2,4,6-trimethylbenzoyl)phenylphosphine oxide, bis(2,4-dimethoxybenzoyl)-2,4,4-trimethylpentylphosphine oxide, methylphenylglyoxyester, 9,10-phenanthrene compounds, acridine compounds, triazine compounds, and imidazole compounds. Also, compounds that have photopolymerization promoting effect can be used alone or together with the photopolymerization initiator described above; examples of such promoters include triethanolamine, methyldiethanolamine, ethyl 4-dimethylaminobenzoate, isoamyl 4-dimethylaminobenzoate, (2-dimethylamino)ethylbenzoate, and 4,4'-dimethylaminobenzophenone.

These polymerization initiators may be used singly or in combination. The content of a polymerization initiator is preferably 0.5 part by mass to 40 parts by mass per 100 parts by mass of radically polymerizable contents and, more preferably, 1 part by mass to 20 parts by mass.

Furthermore, additives may be added to a coating solution for forming the protective layer of the present invention where necessary; examples include various plasticizers for relieving stress and improving adhesion, leveling agents, and low-molecular charge transporting substances that are not radically reactive. Known additives can be used. Plasticizers applicable in the present invention include those commonly used for conventional resins, such as dibutylphthalate and dioctylphthalate. The added amount of such an additive is preferably 20% by mass or less based on the total solids of coating liquid and, more preferably, 10% by mass or less. Examples of leveling agents include silicone oils such as dimethyl silicone oil and methylphenyl silicone oil, and polymers or oligomers having perfluoroalkyl group on their side chain. The added amount of the leveling agent should be 3% by mass or less based on the total solids of the coating solution.

The protective layer of the present invention is formed by applying its coating solution on the foregoing photosensitive layer or charge transporting layer, followed by curing, the coating solution containing at least the radically polymerizable compound that bears three or more functional groups and has no charge transporting structure and the radically polymerizable compound that bears one functional group and has a charge transporting structure. If the coating solution has radically polymerizable monomers or compounds dissolved therein, other ingredients may be dissolved into the coating solution prior to application. Where appropriate, the coating solution is diluted in a solvent prior to application. Examples of such a solvent include alcohols such as methanol, ethanol, propanol and butanol; ketones such as acetone, methyl ethyl ketone, methyl isobutyl ketone and cyclohexanone; esters such as ethyl acetate and butyl acetate; ethers such as tetrahydrofuran, dioxane and propylether; halogen compounds such as dichloromethane, dichloroethane, trichloroethane and chlorobenzene; aromatic compounds such as benzene, toluene and xylene; and cellosolves such as methylcellosolve, ethylcellosolve and cellosolve acetate. These solvents may be used singly or in combination. The dilution rate of the coating solution differs depending on the solubilities of the compositions, coating method, and intended thickness of the resultant layer; it may be determined appropriately. Examples of applicable coating methods include dipping coating, spray coating, bead coating, and ring coating.

In the present invention, after application of the coating solution for protective layer, the solution is cured by irradiation with external energy to form a protective layer. The external energy may be heat, light, or radiation. The application of heat energy is carried out by heating the coating sulution either from the coat surface side or the support side using gas (e.g., air or nitrogen), vapor, various heating media, infrared ray, or electronic wave. The heating temperature is preferably 100° C. to 170° C. If the heating temperature is less than 100° C., it may result in low reaction rate to prevent progression of the curing reaction. If the heating temperature is greater than 170° C., it may result in non-uniform curing reaction, possibly causing significant strain, many unreacted residues and/or reaction-terminating ends in the resulting protective layer. For curing reaction to occur thoroughly, it is effective in some cases to perform initial heating at a low temperature of less than 100° C. followed by additional heating at a high temperature of 100° C. or more to complete the reaction. The source of light energy can be selected from UV irradiation lamps such as a high-pressure mercury lamp and metal halide lamp, having main light-emitting wavelength at the UV region, but visible light sources can also be used according to the absorption wavelengths of radically polymerizable components and photopolymerization initiators. A preferred irradiation energy is 50 $mW/cm^2$ or more, preferably 500 $mW/cm^2$ or more and, most preferably, 1,000 $mW/cm^2$ or more. The use of irradiation light of 1,000 $mW/cm^2$ or more significantly increases the rate of polymerization reaction, allowing formation of a more uniform crosslinked surface layer. If less than 50 $mW/cm^2$ is used, the rates of polymerization reaction varies in the coating solution, causing partial wrinkles, many unreacted residues, and/or reaction-terminating ends to result on the surface of the resulting protective layer. In addition, rapid crosslinking increases internals stress to causes cracks and/or film separation. Examples of radiation beam energy include electron beam energy. Among above noted energies, heat energy and light energy are effective and useful in view of simple control of the reaction rate and simplicity of their device.

The thickness of the protective layer of the present invention is preferably from 1 μm to 10 μm and, more preferably, from 2 μm to 8 μm. If the thickness is greater than 10 μm, cracks and/or film separation are more likely to occur as described above. If the thickness is 8 μm or less, the likelihood of the occurrence of such phenomena is further reduced, allowing crosslink density to increase and making it possible to expand the range of choice of available materials and/or curing conditions for increased wear resistance. Meanwhile, the radical polymerization reaction is susceptible to inhibition by oxygen, i.e., the reaction does not proceed at the surface that is in contact with air because radical molecules are trapped by oxygen there. This problem is particularly remarkable where the thickness of the surface layer is less than 1 μm. The protective layer with a thickness of less than 1 μm may exhibit poor wear resistance and may wear out non-uniformly. In addition, upon its formation, ingredients of a lower charge transporting layer may be unfavorably mixed with it. In particular, if the protective layer is too thin, such foreing ingredients expand throughout the protective layer, thereby inhibiting the curing reaction and/or reducing crosslink density. For these reasons, the protective layer of the present invention can exhibit excellent wear resistance and defect resistance when its thickness is 1 μm or more. However, if such a protective layer has been partially scraped away as a result of repetitive use to expose some portions of the lower charge transporting layer, those portions wear out and cause uneven half-tone image density due to non-uniform charge and/or sensitivity distribution. Accordingly, the thickness of the protective layer is preferably 2 μm or more in order to ensure prolonged life and high-quality images.

When an uppermost protective layer is insoluble in an organic solvent in the structure of the photoconductor of the present invention, where the protective layer is placed on a photosensitive layer (i.e., a charge generating layer and a charge transporting layer), excellent wear resistance and defect resistance can be achieved. The solubility of the protective layer in an organic solvent can be evaluated in the following manner: A drop of an organic solvent that dissolves high-molecular substance well (e.g., tetrahydrofuran or dichloromethane) is put on the surface layer of the photoconductor, and after the drop is allowed to dry naturally, the surface of the photoconductor is observed using a stereo microscope. In a photoconductor that has a high solubility in the organic solvent, the organic solvent drop is bowed inward at the center, and bowed outward at the periphery, the drop becomes white or cloudy due to precipitation of charge transporting substance, or the photoconductor surface has wrinkles as a result of swelling and shrinkage. By contrast, such phenomena never appear on a photoconductor that is not soluble in the organic solvent—the organic solvent drop never changes.

To make the protective layer insoluble in organic solvents in the present invention, it is important to (i) select a proper composition and control its proportion in a coating solution for protective layer, to (ii) control the concentration of a diluted coating solution and the concentration of solids in the coating solution, to (iii) select a proper coating method, to (iv) control the curing conditions for the protective layer, and to (v) make a lower charge transporting layer poorly-soluble. However, this cannot be accomplished only by one factor.

When excessive amounts of additives (e.g., binder resin that has no radically polymerizable functional groups, antioxidant, and plasticizer) are contained in the coating solution for protective layer in addition to the foregoing radically polymerizable monomer that bears three or more functional groups but has no charge transporting structure and the foregoing radically polymerizable compound that bears one functional group and has a charge transporting structure, it results in reduced crosslink density and causes phase separation between cured material and the additive(s), making the resultant protective layer more likely to be soluble in organic solvents. It is therefore important to set the total amounts of such additives to 20% by mass or less based on the total amounts of the solids in the coating solution. To ensure high crosslink density, it is also important to set the total amount of radically polymerizable monomers with one or two functional groups, reactive oligomers, and reactive polymers to 20% by mass or less based on the total amount of radically polymerizable monomers with three functional groups. If radically polymerizable compounds that bear two or more functional groups and have a charge transporting structure are contained in excessive amounts, bulky structures are immobilized to the crosslinked structure by multiple bonds to cause strain in the crosslinked structure, increasing the likelihood of formation of an aggregate of fine cured particles. This may cause the protective layer to be soluble in organic solvents. The content of radically polymerizable compounds with two or more functional groups is preferably 10% by mass or less relative to the content of radically polymerizable compounds that bear one functional group and have a charge transporting structure, though depending on the structure of the compounds.

If a solvent with a low evaporation rate is used to dilute the coating solution for protective layer, the residual solvent may prevent curing or may increase the amounts of unfavorable ingredients from lower layers, thus leading to non-uniform curing or reduced curing density. For this reason, the resultant protective layer may be soluble in organic solvents. Specifically, tetrahydrofuran, mixture of tetrahydrofuran and methanol, ethyl acetate, methyl ethyl ketone, ethyl cellosolve, etc., are useful and can be selected according to the coating method employed. Correspondingly, if the content of solids is small for the same reason, it is likely that the protective layer becomes soluble in organic solvents, and therefore, the upper limit of the concentration of such a diluent solvent is specified due to the limitations in film thickness and coating liquid viscosity; it is preferably used in a range of 10% by mass to 50% by mass. For the same reason, for the method of applying the coating solution, methods are preferable that require a small amount of solvent and minimize the period during which the solvent is in contact with the ingredients. Specifically, spray coating and ring coating that controls the amount of coating solution are preferable. It is also effective to use a high-molecular charge transporting substance in a charge transporting layer and to provide an intermediate layer, which is insoluble in a solvent used in the coating solution, between a photosensitive layer (or charge transporting layer) and a protective layer in order to prevent invasion of lower layer's ingredients.

If heat or light irradiation energy is too low upon curing of the protective layer, it results in incomplete curing and increased solubility of the protective layer for organic solvents. Conversely, if the protective layer is cured with high irradiation energy, the curing reaction is likely to proceed non-uniformly, non-crosslinked portions and/or reaction-terminating portions may increase, and an aggregate of fine cured particles may result, thus resulting in increased solubility for organic solvents. In order to make the protective layer insoluble in organic solvents, curing conditions to prevent non-uniform curing are preferable as follows: In a case of thermal curing, temperature is set to 100° C. to 170° C. and curing time is set to 10 minutes to 3 hours; and in a case of UV curing, irradiation energy is set to 50 mW/cm$^2$ or more, more preferably to 500 mW/cm$^2$ or more, and most preferably to 1,000 mW/cm$^2$ or more, and irradiation time is ser to 5 seconds to 5 minutes while increasing temperature by 10° C. or more.

The protective layer constituting the photoconductor of the present invention is made insoluble in organic solvents in the following manner: When acrylate monomers bearing acryloyloxy groups and triaryl amine compounds bearing one acryloyloxy group are contained in a coating solution, the coating solution is composed of the acrylate monomers and triaryl amine compounds in proportions ranging from 7:3 to 3:7, and a polymerization initiator is added to the coating solution in an amount of 3% by mass to 20% by mass based on the total amount of these acrylate compounds, followed by addition of another solvent. For example, when using a triaryl amine doner as a charge transporting substance and polycarbonate resin as binder resin to form a charge transporting layer followed by formation of a protective layer by spraying the coating solution on the charge transporting layer, tetrahydrofuran, 2-butanone, or ethyl acetate is preferably used as a solvent for the coating solution; the amount of the solvent to be used is 3 to 10 times the total amount of acrylate compounds.

Using a spray or the like, the coating solution thus prepared is then applied on a photoconductor that includes an under layer, charge generating layer and charge transporting layer which are sequentially disposed on a support such as an aluminum cylinder. Subsequently, the coating solution is allowed to dry naturally or dried at a relatively low temperature for a short period of time (25° C. to 80° C. for 1 minute to 10 minutes), and cured by irradiation with ultraviolet (UV) or by application of heat.

In a case of UV irradiation, a metal halide lamp is used at an irradiation energy of 50 mW/cm$^2$ or more, preferably 500 mW/cm$^2$ or more and, most preferably 1,000 mW/cm$^2$ or more. The irradiation time is preferably from 5 seconds to 5 minutes. The metal halide lamp is so controlled that the drum temperature is increased by 10° C. or more.

In a case of thermal curing, the heating temperature is preferably 100° C. to 170° C. For example, when an air blasting oven is used as heating means and the heating temperature is set to 150° C., the heating time is from 20 minutes to 3 hours.

After curing, the photoconductor of the invention is produced by additional heating at 100° C. to 150° C. for 10 minutes to 30 minutes for the removal of residual solvent.

<Electrophotographic Photoconductor of Third Embodiment>

The electrophotographic photoconductor of the third embodiment comprises a support, a under layer and a photosensitive layer, the under layer and photosensitive layer being disposed on or over the support, wherein the photosensitive layer comprises a compound represented by the foregoing general formula (1), and wherein the under layer is preferably composed of a conductive layer and a barrier layer.

The barrier layer is formed on the conductive support 1 as a conductive film in order to facilitate provisioin a photosensitive layer 4 thereon, to protect the photosensitive layer 4 from electrical destruction, to cover defects on the surface of the support, etc. This conductive layer not only requires sufficiently low electrical resistance, but must prevent accumulation of charges after repetitive high-speed electrophotographic processes in order to provide stable electrical characteristics.

The conductive film is formed either by means of a dry deposition method, e.g., deposition or sputtering of conductive material, or by dispersing conductive powder into binder resin. For conductive powders, those with a specific resistance of $10^5\Omega\times$cm or less are effectively used; examples include metal powders such as nickel powder, copper powder, silver powder and aluminum powder, conductive metal oxide powders (conductive inorganic pigments) obtained from metal oxides such as iron oxide, tin oxide, antimony oxide, indium oxide and mixtures thereof, carbon black, and fibrous carbon. It is also possible to use a vapor-deposition film containing indium oxide doped with tin, tin oxide or mixture thereof. In each case, the conductive layer preferably has a volume resistance of from $10^5\Omega\times$cm to $10^{10}\Omega\times$cm at an electrical field intensity adopted for photoconductor (approximately $10^5$ V/cm).

By providing the conductive layer of the present invention with a function of preventing the occurrence of moire fringes due to interference of light in a photosensitive layer caused upon optical image writing using coherent light (e.g., laser beam), the effect of the present invention can be further enhanced. In order to achieve this function, it is effective to add material with a high index of refraction to the conductive layer. In addition to the foregoing conductive metal oxides and conductive inorganic pigments, it is also possible to introduce microspheres composed primarily of polydimethylsiloxane or a roughening agent.

Binder resins identical to those used for a barrier layer to be described later can be used for the conductive layer. In view of the fact that a photosensitive layer and a barrier layer are formed on the conductive layer, it is essential that these binder resins never erode when they come in contact with the coating solutions for the barrier layer and the photosensitive layer.

For the binder resins, thermosetting resins are suitably used. Most preferably, alkyd/melamine resin mixtures are used. The mixing ratio of alkyd resin to melamine resin is an important factor that influences the structure and characteristics of the conductive layer; a suitable mixing ratio (i.e., the alkyd/melamine ratio) on a mass basis is 5/5 to 8/2. If too much melamine resin is used, the binder resin shrinks too much upon thermal curing, resulting in defects in the resultant coated film and unfavorably increasing the residual potential of the photoconductor. If too much alkyd resin is used, the residual potential of the photoconductor decreases but the bulk resistance decreases too much, unfavorably increasing background smear.

It is proper to set the thickness of the conductive layer to 1 μm to 20 μm and, more preferably, to 2 μm to 10 μm. If the thickness is less than 1 μm, the conductive layer cannot exhibit sufficient effects. If the thickness is greater than 20 μm, it results in unfavorable accumulation of residual potential and/or reduced film surface characteristics.

The foregoing conductive inorganic pigment or conductive metal oxide is typically prepared by dispersed it in a solvent together with a binder resin using as a ball mill, sand mill, or Attritor, followed by addition of, for example, a curing (crosslinking) agent, solvent, additive and/or curing promoter where appropriate. The coating solution thus prepared is then applied on the substrate by blade coating, dip coating, spray coating, bead coating, or nozzle coating, followed by drying and curing using light or heat.

The function of the barrier layer is to prevent charges, which are induced at an electrode (i.e., conductive support) and have a polarity opposite to that of charges applied upon photoconductor charging, from entering a photosensitive layer via the conductive layer. Specifically, when the photoconductor is to be negatively charged, the barrier layer prevents entry of holes into the photosensitive layer. When the photoconductor is to be positively charged, the barrier layer prevents entry of electrons into the photosensitive layer. Specific examples of the barrier layer include: (1) layers prepared by anodic oxidation, such as an aluminum oxide layer; (2) inorganic insulating layers such as a SiO insulating layer; (3) layers formed of a network of a glassy metal oxide as disclosed in JP-A No.03-191361; (4) layers made of polyphosphazene as disclosed in JP-A No.03-141363; (5) layers made of a reaction product of aminosilane as disclosed in JP-A No.03-101737; (6) layers made of insulating binder resin; and (7) layers made of curable binder resin. Among these, layers made of insulating resin and layers made of curable resin that can be formed by a wet coating process are preferable. Since a photosensitive layer is formed on the barrier layer, it is essential that the barrier layer be made of material or have a structure, which is not eroded by a coating solvent used to prepare the photosensitive layer by a wet coating process.

Suitable resins for use in the charge blocking layer include thermoplastic resins such as polyamide resins, polyester resins, and vinyl chloride/vinyl acetate copolymers, and thermosetting resins prepared by thermally polymerizing a compound having a plurality of active hydrogen atoms (e.g., hydrogen atoms from —OH, —$NH_2$, or —NH) with compound having a plurality of isocyanate groups and/or a compound having a plurality of epoxy groups. Specific examples of the compounds having a plurality of active hydrogen atoms include polyvinyl butyrals, phenoxy resins, phenol resins, polyamides, polyesters, polyethylene glycol, polypropylene glycol, polybutylene glycol and acrylic resins bearing active hydrogen atoms (e.g., hydroxyethyl methacrylate). Specific examples of the compounds having a plurality of isocyanate groups include tolylene diisocyanate, hexamethylene diisocyanate, diphenylmethane diisocyanate, and prepolymers thereof. Specific examples of the compounds having a plurality of epoxy groups include bisphenol A based-epoxy resins. Among these, polyamides are preferable in view of film-formability, environmental stability, and resistance to solvents.

Among these, N-methoxymethylated nylon is most preferable. Polyamide resins inhibit entry of electrons highly effectively and have less influence on the residual potential. Moreover, these polyamide resins are alcohol-soluble but ketone-insoluble, and can produce uniform, thin films even by a dip coating process, exhibiting excellent coating properties. In particular, excellent coating properties are of importance to ensure stable image quality because the under layer needs to be made thin so as to minimize the influences of the residual potential increase and requires uniform thickness.

In general, however, alcohol-soluble resins are strongly humidity dependent—resistance increases under low-humidity environment to cause residual potential increase, and resistance decreases under high-humidity environment to cause charge reduction. N-methoxymethylated nylon, however, provides excellent electrical isolation, is very excellent in terms of its capacity of blocking charges coming from the conductive support, has less influence on the residual potential, less dependent on environmental conditions, and can always ensure stable image quality even when the usage environment of the image forming apparatus changes. Thus, N-methoxymethylated nylon is used most suitably when an under layer is provided. In addition, when N-methoxymethylated nylon is used, the residual potential becomes less dependent on the thickness of the charge blocking layer, reducing influences on residual potential and obtaining an effect of reducing background smear.

The proportion of methoxymethyl groups in N-methoxymethylated nylon is not particularly limited, however, it is preferably 15 mol % or more. The effects brought about by using N-methoxymethylated nylon varies depending on the degree of methoxymethylation. If the proportion of methoxymethyl groups is less than 15 mol %, N-methoxymethylated nylon becomes more humidity dependent, and an alcohol solution thereof becomes clouded, resulting in slight reduction in temporal stability of coating solution in some cases.

In addition, thermosetting resins obtained by thermally polymerizing oil-free alkyd resins with amino resins (e.g., butylated melamine resin), and photocurable resins obtained by reacting unsaturated resins (e.g., unsaturated polyurethane resins and unsaturated polyester resins) with a photopolymerization initiator such as a thioxanthone compound or methylbenzyl formate, can also be used as binder resin.

Furthermore, conductive polymers with rectification properties, and/or electron-accepting or electron-donating resin or compound, selected according to the charge polarity, can also be added to prevent entry of charges from the support.

The barrier layer preferably has a thickness ranging from 0.1 μm to less than 4.0 μm and, more preferably, from 0.3 μm to 1.5 μm. When the barrier layer is too thick, the residual potential of the photoconductor significantly increases particularly under low temperature and low humidity conditions after repetitive selective exposure. If the barrier layer is too thin, its charge blocking effect becomes poor. The barrier layer can additionally include such ingredient(s) as a curing (crosslinking) agent, solvent, additive and/or curing promoter on an as-needed basis. The barrier layer can be formed by applying a coating solution on a base by a normal coating process such as blade coating, dip coating, spray coating, bead coating, or nozzle coating, followed by drying or curing using heat, light, or electron beams.

<Electrophotographic Photoconductor of Fourth Embodiment>

The electrophotographic photoconductor of the fourth embodiment comprises a support, a under layer and a photosensitive layer, the under layer and photosensitive layer being disposed on or over the support, wherein the photosensitive layer comprises a compound represented by the foregoing general formula (1), and wherein the support is preferably a support that includes an anodized layer on its surface.

For simple anodizing treatment, it is preferable to adopt a cylindrical support made of aluminum. As used herein "aluminum" means pure aluminum and aluminum alloys. Specifically, aluminums and aluminum alloys specified in JIS 1000s, 3000s, and 6000s are most preferable.

Next, an anodized film 32 will be described. Anodized films are ones obtained by anodizing various types of metals or alloys in an electrolyte solution. Among such anodized films, an anodized film called "alumite," obtained by anodizing aluminum or an aluminum alloy in an electrolyte solution, is most suitable for the photoconductor of the present invention. The anodizing treatment is carried out in a bath containing an acid such as chromium acid, sulfuric acid, oxalic acid, phosphoric acid, boric acid, or sulfamic acid. Among these acids, sulfuric acid is most preferable. An example of the condition for anodizing treatment includes, but not limited to, the following: sulfuric acid concentration=10-20%; bath temperature=5-25° C.; current density=1-4 A/dm$^2$; electrolysis voltage=5-30V; and treatment time=5-60 minutes. An anodized film prepared in this way is porous and highly electrically insulating, and thus has very non-uniform surface. For this reason, their physical properties are likely to change with time. To avoid this, it is preferable to fill the pores of the anodized film.

Examples of the method of filling pores include a method of immersing the anodized film in an aqueous solution containing nickel fluoride or nickel acetate, a method of immersing the anodized film in boiling water, and a method of exposing the anodized film to a pressurized water vapor. Among these methods, the method of immersing the anodized film in an aqueous solution containing nickel acetate is most preferable. After the pore-filling treatment, the anodized film is subjected to wash treatment. This main purpose is to remove attached metal salts or the like derived from the preceding pore-filling treatment. If the support (anodized film) surface is left with excessive amounts of such compounds, it results not only in reduced quality of another film to be formed on the anodized film, but also in the occurrence of background smear due to remained low-resistance components. Washing may be performed once using pure water; however, washing is generally performed several times. At this point, it is preferable to use as clean a washing solution as possible in the last washing step (i.e., the washing solution is preferably deionized as much as possible). In addition, one of the several washing steps may adopt a physical scrubbing washing using a contacting member.

The thickness of the anodized film thus formed is preferably about 1 μm to 15 μm and, more preferably, about 5 μm to 10 μm. If the thickness of the anodized film is less than 1 μm, it results in insufficient barrier effect as an anodized film. If the thickness is greater than 15 μm, it results in too large time constant as an electrode to cause generation of residual potential and reduction in photoconductor response in some cases.

<Electrophotographic Photoconductor of Fifth Embodiment>

The electrophotographic photoconductor of the fifth embodiment comprises a support, a under layer and a photosensitive layer, the under layer and photosensitive layer being disposed on or over the support, wherein the photosensitive layer comprises a compound represented by the foregoing general formula (1), and wherein the under layer comprises two different metal oxides (T1) and (T2) with different average particle diameters and satisfies the condition $0.2<(D2/D1)\leqq 0.5$ (where D1 is the average particle diameter of the metal oxide (T1) having an average particle diameter larger than that of the other metal oxide (T2), and D2 is the average particle diameter of the metal oxide (T2)).

By using two different metal oxides with different average particle diameters for the under layer, it is possible to make the conductive support invisible well to prevent the generation of moire fringes and to remove pinholes that cause abnormal images. In order for these to happen, it is important that the ratio of average particle diameters of two different metal oxides (T1) and (T2) be such that $0.2<(D2/D1)\leqq 0.5$. If the average particle diameter ratio is outside the range specified by the present invention, i.e., if the ratio of the average particle diameter (D2) of the metal oxide (T2) to the average particle diameter (D1) of the other metal oxide (T1)—one with a larger average particle diameter—is too small ($D2/D1<0.2$), it results in activation of the metal oxide surface to significantly reduce the electrostatic stability of photoconductor. If the ratio of the average particle diameter (D2) of the metal oxide (T2) to the average particle diameter (D1) of the metal oxide (T1) is too large ($D2/D1>0.5$), the capability to hide the conductive support decreases, increasing the likelihood of the occurrence of moire fringes and/or abnormal images. As used herein, the average particle diameter means an average particle diameter obtained from a particle size measurement. for a metal oxide dispersion prepared by vigorously dispersing metal oxide in an aqueous medium.

Furthermore, the average particle diameter (D2) of the metal oxide (T2) —one with a smaller average particle diameter—is also an important factor, and it is important that the condition $0.05\ \mu m<D2<0.20\ \mu m$ be satisfied. When D2 is 0.05 μm or less, the capability to hide the conductive support may be reduced to generate moire fringes. If D2 is 0.20 μm or more, the packing density of metal oxide particles in the under layer is reduced, and thus the effect of preventing background smear cannot be fully brought about.

The proportion of the metal oxide (T2) in the metal oxides (T1) and (T2) on a mass basis is also an important factor. If $T2/(T1+T2)$ is less than 0.2, the packing density of metal oxide particles is not so large, and thus the effect of preventing background smear cannot be fully brought about. If $T2/(T1+T2)$ is greater than 0.8, the capability to hide the conductive support may be reduced to create moire fringes. For this reason, it is important that the condition $0.2\leqq T2(T1+T2)\leqq 0.8$ be satisfied.

The under layer has a function of preventing the occurrence of moire fringes due to interference of light caused upon optical image writing using coherent light (e.g., laser beam). Basically, the under layer has a function of scattering the light for optical writing. In order to achieve this function, it is effective that the under layer contains a material with a high index of refraction. The under layer typically contains a binder resin and a metal oxide which is dispersed in the binder resin. In particular, white metal oxides are suitably used among various metal oxides. Suitable examples thereof include titanium oxide, calcium fluoride, calcium oxide, silicon oxide, magnesium oxide and aluminum oxide. Among these pigments, titanium oxide is preferable because of its high hiding capability. Although the present invention uses two different metal oxides as described above, two identical metal oxides with different average particle diameters may be used.

In addition, the under layer prevents the entry of charges from the support; therefore, it is preferable that the under layer at least have a capacity to transport charges having the same polarity as that of the charges formed on the surface of the photoconductor in order to prevent residual potential increase. For example, in a case of a negatively charged photoconductor, the under layer preferably has an electron conducting capacity. Therefore, it is preferable to use an electron-conducting metal oxide or a conductive metal oxide. Alternatively, the use of conductive material (e.g., acceptors) for the formation of the under layer enhances the effect of the present invention.

In view of the fact that a photosensitive layer (a charge generating layer and a charge transporting layer) is formed on the under layer, it is essential that binder resins used in the under layer never erode when they come in contact with a solvent used for the coating solution for photosensitive layer.

Suitable resins for use in the under layer include thermoplastic resins such as polyamide resins, polyester resins, and vinyl chloride/vinyl acetate copolymers, and thermosetting resins prepared by thermally polymerizing a compound having a plurality of active hydrogen atoms (e.g., hydrogen atoms from —OH, —$NH_2$, or —NH) with a compound having a plurality of isocyanate groups and/or a compound having a plurality of epoxy groups. Specific examples of the compounds having a plurality of active hydrogen atoms include polyvinyl butyrals, phenoxy resins, phenol resins, polyamides, polyesters, polyethylene glycol, polypropylene glycol, polybutylene glycol and acrylic resins bearing active hydrogen atoms (e.g., hydroxyethyl methacrylate). Specific examples of the compounds having a plurality of isocyanate groups include tolylene diisocyanate, hexamethylene diisocyanate, diphenylmethane diisocyanate, and prepolymers thereof. Specific examples of the compounds having a plurality of epoxy groups include bisphenol A based-epoxy resins.

Among these, polyamides are preferable in view of film-formability, environmental stability, and resistance to solvents.

In addition, thermosetting resins obtained by thermally polymerizing oil-free alkyd resins with amino resins (e.g., butylated melamine resin), and photocurable resins obtained by reacting unsaturated resins (e.g., unsaturated polyurethane resins and unsaturated polyester resins) with a photopolymerization initiator such as a thioxanthone compound or methylbenzyl formate, can also be used as binder resin.

For the thermosetting resins, alkyd/melamine resin mixtures are most preferable. The mixing ratio of alkyd resin to melamine resin is an important factor that influences the structure and characteristics of the under layer; a suitable mixing ratio (i.e., the alkyd/melamine ratio) on a mass basis is 5/5 to 8/2. If too much melamine resin is used, the binder resin shrinks too much upon thermal curing, resulting in defects in the resultant coated film and unfavorably increasing the residual potential of the photoconductor. If too much alkyd resin is used, the residual potential of the photoconductor decreases but the bulk resistance decreases too much, unfavorably increasing background smear.

The volume ratio of the metal oxide to the binder resin in the under layer is also an important factor; it is preferably from 1/1 to 3/1. If the volume ratio of metal oxide to binder resin is below 1/1, not only the moire preventing effect decreases, but the residual potential may increase after repeated use. If the volume ratio of metal oxide to binder resin is greater than 3/1, it may result not only in poor binding capacity of binder resin, but also in poor surface characteristics of film to make it difficult to form an upper photosensitive layer thereon. This may cause a serious problem when a multilayer photosensitive layer is adopted, where thin layers like a charge generating layer are formed. In addition, in this case, the binder resin cannot cover the entire surface of inorganic pigment, allowing charge generating substance to come in direct contact with the inorganic pigment particles in some cases to thereby increase the likelihood the prodouction heated carriers, which may result in increased background smear.

The thickness of the under layer is preferably 1 μm to 10 μm and, more preferably, 2 μm to 5 μm. If the thickness is less than 1 μm, the under layer shows reduced effects. If the thickness is greater than 10 μm, it results in unfavorable accumulation of residual potential.

The metal oxide is formed on a base in the following manner: A metal oxide is first dispersed in a solvent together with a binder resin using a dispersion machine such as a ball mill, sand mill, or Attritor, followed by addition of, for example, a curing (crosslinking) agent, solvent, additive and/or curing promoter where appropriate. The coating solution thus prepared is then applied on the base by blade coating, dip coating, spray coating, bead coating, or nozzle coating, followed by drying or curing using light or heat.

<Electrophotographic Photoconductor of Sixth Embodiment>

The electrophotographic photoconductor of the sixth embodiment comprises a support, an intermediate layer and a photosensitive layer, the intermediate layer and photosensitive layer being disposed on or over the support, wherein the intermediate layer comprises a compound represented by the foregoing general formula (1), and wherein the intermediate layer comprises two different metal oxides (T1) and (T2) with different average particle diameters and satisfies the condition $0.2<(D2/D1)\leqq 0.5$ (where D1 is the average particle diameter of the metal oxide (T1) having an average particle diameter larger than that of the other metal oxide (T2), and D2 is the average particle diameter of the metal oxide (T2)).

In general, the intermediate layer is composed primarily of resin. In view of the fact that a coating solution for photosensitive layer is applied on such resin, however, the resin is preferably selected from those that are less soluble in general organic solvents. Examples of such resin are curable resins that form three-dimensional networks upon cured, including water-soluble resins such as polyvinyl alcohol, casein and sodium polyacrylate, alcohol-soluble resins such as copolymer nylons and methoxymethylated nylon, polyurethane resins, melamine resins, phenol resins, alkyd-melamine resins, and epoxy resins. In addition, fine powder pigments obtained from metal oxides such as titanium oxide, silica, alumina, zirconium oxide, tin oxide or indium oxide may also be added to the intermediate layer in order to prevent the occurrence of moire fringes and to reduce the residual potential.

The intermediate layer can be formed using a proper solvent and a proper coating method as can the foregoing photosensitive layer. Furthermore, it is possible to adopt silane coupling agents, titanium coupling agents, and chrome coupling agents for the intermediate layer of the present invention. It is also possible to adopt intermediate layers obtained by anodizing $Al_2O_3$, intermediate layers obtained by vacuum deposition of organic compounds such as polyparaxylylene (parylene) or inorganic compounds such as $SiO_2$, $SnO_2$, $TiO_2$, ITO and $CeO_2$, and known intermediate layers. The proper thickness of the intermediate layer is 0 μm to 5 μm.

The intermediate layer has at least two functions: a function of preventing charges, which are induced at an electrode and have a polarity opposite to that of charges applied upon photoconductor charging, from entering the photosensitive layer; and a function of preventing the occurrence of moire fringes created upon image writing using coherent light such as a laser beam. It is also effective for the photoconductor of the present invention to adopt a function-separated intermediate layer that includes two or more layers each having one of these two functions. A charge blocking layer and a moire preventing layer, which constitute the function-separated intermediate layer, will be described. In a case of a function-separated intermediate layer, the electron transporting agent represented by the general formula (1) is contained in the following charge blocking layer and/or the moire preventing layer.

The function of the charge blocking layer is to prevent charges, which are induced at an electrode (i.e., conductive support) and have a polarity opposite to that of charges applied upon photoconductor charging, from entering the photosensitive layer from the support. Specifically, when the photoconductor is to be negatively charged, the charge blocking layer prevents entry of holes into the photosensitive layer. When the photoconductor is to be positively charged, the charge blocking layer prevents entry of electrons into the photosensitive layer. Specific examples of the charge blocking layer include: (1) layers prepared by anodic oxidation, such as an aluminum oxide layer; (2) inorganic insulating layers such as a SiO insulating layer; (3) layers formed of a network of a glassy metal oxide; (4) layers made of polyphosphazene; (5) layers made of a reaction product of aminosilane; (6) layers made of insulating binder resin; and (7) layers made of curable binder resin. Among these, layers made of insulating resin and layers made of curable resin that can be formed by a wet coating process are preferable. Since both the moire preventing layer and the photosensitive layer are typically formed on the charge blocking layer, it is essential that the charge blocking layer be made of material or have a structure, which is not eroded by coating solvents used to prepare these layers by a wet coating process.

Suitable resins for use in the charge blocking layer include thermoplastic resins such as polyamide resins, polyester resins, and vinyl chloride/vinyl acetate copolymers, and thermosetting resins prepared by thermally polymerizing a compound having a plurality of active hydrogen atoms (e.g., hydrogen atoms from —OH, —$NH_2$, or —NH) with a compound having a plurality of isocyanate groups and/or a compound having a plurality of epoxy groups. Specific examples of the compounds having a plurality of active hydrogen atoms include polyvinyl butyrals, phenoxy resins, phenol resins, polyamides, polyesters, polyethylene glycol, polypropylene glycol, polybutylene glycol and acrylic resins bearing active hydrogen atoms (e.g., hydroxyethyl methacrylate). Specific examples of the compounds having a plurality of isocyanate groups include tolylene diisocyanate, hexamethylene diisocyanate, diphenylmethane diisocyanate, and prepolymers thereof. Specific examples of the compounds having a plurality of epoxy groups include bisphenol A based-epoxy resins.

Among these, polyamides are preferable in view of film-formability, environmental stability, and resistance to solvents, and N-methoxymethylated nylon is most preferable. Polyamide resins inhibit entry of electrons highly effectively and have less influence on the residual potential. Moreover, these polyamide resins are alcohol-soluble but ketone-insoluble, and can produce uniform, thin films even by a dip coating process, exhibiting excellent coating properties. In particular, excellent coating properties are of importance to ensure stable image quality because the under layer needs to be made thin so as to minimize the influences of the residual potential increase and requires uniform thickness.

In general, however, alcohol-soluble resins are strongly humidity dependent—resistance increases under low-humidity environment to cause residual potential increase, and resistance decreases under high-humidity environment to cause charge reduction. N-methoxymethylated nylon, however, provides excellent electrical isolation, is very excellent in terms of its capacity of blocking charges coming from the conductive support, has less influence on the residual potential, less dependent on environmental conditions, and can always ensure stable image quality even when the usage environment of the image forming apparatus changes. Thus, N-methoxymethylated nylon is used most suitably even when an under layer is provided. In addition, when N-methoxymethylated nylon is used, the residual potential becomes less dependent on the thickness of the charge blocking layer, reducing influences on residual potential and obtaining an effect of reducing background smear.

The proportion of methoxymethyl groups in N-methoxymethylated nylon is not particularly limited, however, it is preferably 15 mol % or more. The effects brought about by using N-methoxymethylated nylon varies depending on the degree of methoxymethylation. If the proportion of methoxymethyl groups is less than 15 mol %, N-methoxymethylated nylon becomes more humidity dependent, and an alcohol solution thereof becomes clouded, resulting in slight reduction in temporal stability of coating solution in some cases.

In addition, thermosetting resins obtained by thermally polymerizing oil-free alkyd resins with amino resins (e.g., butylated melamine resin), and photocurable resins obtained by reacting unsaturated resins (e.g., unsaturated polyurethane resins and unsaturated polyester resins) with a photopolymerization initiator such as a thioxanthone compound or methylbenzyl formate, can also be used as binder resin.

Furthermore, conductive polymers with rectification properties, and/or electron-accepting or electron-donating resin or compound, selected according to the charge polarity, can also be added to prevent entry of charges from the support.

The charge blocking layer preferably has a thickness ranging from 0.1 μm to less than 4.0 μm and, more preferably, from 0.3 μm to 1.5 μm. When the charge blocking layer is too thick, the residual potential of the photoconductor significantly increases particularly under low temperature and low humidity conditions after repetitive selective exposure. If the charge blocking layer is too thin, the charge blocking effect becomes poor. The charge blocking layer can additionally include such ingredient(s) as a curing (crosslinking) agent, solvent, additive and/or curing promoter on an as-needed basis. The charge blocking layer can be formed by applying a coating solution on a base by a normal coating process such as blade coating, dip coating, spray coating, bead coating, or nozzle coating, followed by drying or curing using heat or light.

The function of the moire preventing layer is to prevent the occurrence of moire fringes in images due to interference of light caused upon optical image writing using coherent light (e.g., laser beam). Basically, the moire preventing layer scatters the light for optical writing. In order to achieve this function, the moire preventing layer preferably contains a material with a high index of refraction. The moire preventing layer typically contains a binder resin and an inorganic pigment which is dispersed in the binder resin. In particular, white inorganic pigments are suitably used. Suitable examples of the white inorganic pigments include titanium oxide, calcium fluoride, calcium oxide, silica, magnesium oxide and aluminum oxide. Among these pigments, titanium oxide is preferable because of its high hiding capability.

Also in a case where the intermediate layer is composed of the charge blocking layer and the moire preventing layer, the effect of the present invention is significantly brought about when the moire preventing layer contains titanium oxide. In addition, by allowing the moire preventing layer containing titanium oxide to come in contact with a charge generating layer, the effect of the present invention can be further enhanced. Thus, this is the most effective photoconductor configuration.

Since the entry of charges from the support is prevented by means of the charge blocking layer in a photoconductor adopting a function-separated intermediate layer, it is preferable that the moire preventing layer at least have a capacity to transport charges having the same polarity as that of the charges formed on the surface of the photoconductor in order to prevent residual potential increase. For example, in a case of a negatively charged photoconductor, the moire preventing layer preferably has an electron conducting capacity. Therefore, it is preferable to use an electron-conducting inorganic pigment or a conductive inorganic pigment for the moire preventing layer. Alternatively, the use of conductive material (e.g., acceptors) for the formation of the moire preventing layer enhances the effect of the present invention.

Binder resins identical to those used for the charge blocking layer can be used for the moire preventing layer. In view of the fact that a photosensitive layer is formed on the moire preventing layer, it is essential that these binder resins never erode when they come in contact with the coating solution for photosensitive layer.

For the binder resins, thermosetting resins are suitably used. Most preferably, alkyd/melamine resin mixtures are used. The mixing ratio of alkyd resin to melamine resin is an important factor that influences the structure and characteristics of the moire preventing layer; a suitable mixing ratio (i.e., the alkyd/melamine ratio) on a mass basis is 5/5 to 8/2. If too much melamine resin is used, the binder resin shrinks too much upon thermal curing, resulting in defects in the resultant coated film and unfavorably increasing the residual potential of the photoconductor. If too much alkyd resin is used, the residual potential of the photoconductor decreases but the bulk resistance decreases too much, unfavorably increasing background smear.

The volume ratio of the inorganic pigment to the binder resin in the moire preventing layer is also an important factor; it is preferably from 1/1 to 3/1. If this volume ratio of inorganic pigment to binder resin is below 1/1, not only the moire preventing effect decreases, but the residual potential may increase after repeated use. If this volume ratio of inorganic pigment to binder resin is greater than 3/1, it may result not only in poor binding capacity of binder resin, but also in poor surface characteristics of film to make it difficult to form an upper photosensitive layer thereon. This may cause a serious problem when a multilayer photosensitive layer is adopted, where thin layers like a charge generating layer are formed. In addition, in this case, the binder resin cannot cover the entire surface of inorganic pigment, allowing charge generating substance to come in direct contact with the inorganic pigment in some cases to thereby increase the likelihood of the production of heated carrriers, which may result in increased background smear.

By using two different titanium oxides with different average particle diameters for the intermediate layer (moire preventing layer), the conductive support can be effectively hidden by the moire preventing layer and thus the occurrence of moire fringes and the formation of pinholes in the layer can be prevented. In order for this to happen, it is important that the ratio of the average particle diameter between the two different titanium oxides (T1) and (T2) satisfy the condition 0.2<D2/D1≦0.5. If the average particle diameter ratio falls outside the range specified by the present invention, i.e., if the ratio of the average particle diameter (D2) of the metal oxide (T2) to the average particle diameter (D1) of the other metal oxide (T1)—one with a larger average particle diameter—is too small (D2/D1<0.2), it results in activation of the metal oxide surface to significantly reduce the electrostatic stability of photoconductor. If the ratio of the average particle diameter (D2) of the metal oxide (T2) to the average particle diameter (D1) of the metal oxide (T1) is too large (D2/D1>0.5), the capability to hide the conductive support decreases, increasing the likelihood of the occurrence of moire fringes and/or abnormal images. As used herein, the average particle diameter means an average particle diameter obtained from a particle size measurement for a metal oxide dispersion prepared by vigorously dispersing metal oxide in an aqueous medium.

Furthermore, the average particle diameter (D2) of the titanium oxide (T2)—one with a smaller average particle diameter—is also an important factor, and preferably satisfies the condition 0.05 μm<D2<0.20 μm. When D2 is 0.05 μm or less, hiding capability of the moire preventing layer may be reduced to create moire fringes. If D2 is 0.20 μm or more, the packing density of titanium oxide particles in the moire preventing layer is reduced, and thus the effect of preventing background smear cannot be fully brought about.

The proportion of the metal oxide (T2) in the metal oxides (T1) and (T2) on a mass basis is also an important factor. If T2/(T1+T2) is less than 0.2, the packing density of titanium oxide particles is not so large, and thus the effect of preventing background smear cannot be fully brought about. If T2/(T1+T2) is greater than 0.8, the hiding capability of the moire preventing layer may be reduced to create moire fringes. For this reason, it is important that the proportion of the metal oxide (T2) in the metal oxides (T1) and (T2) on a mass basis is such that 0.2≦T2(T1+T2)≦0.8.

The thickness of the moire preventing layer is preferably 1 μm to 10 μm and, more preferably, 2 μm to 5 μm.

If the thickness of the moire preventing layer is less than 1 μm, the moire preventing effect cannot be fully brought about. If the thickness of the moire preventing layer is greater than 10 μm, it undesirably results in increased residual potential.

The moire preventing layer is typically prepared in the following manner: An inorganic pigment is first dispersed in a solvent together with a binder resin using a dispersion machine such as a ball mill, sand mill, or Attritor, followed by addition of, for example, a curing (crosslinking) agent, solvent, additive and/or curing promoter where appropriate. The coating solution thus prepared is then applied on the charge blocking layer by blade coating, dip coating, spray coating, bead coating, or nozzle coating, followed by drying or curing using light or heat.

<Electrophoto Graphic Photoconductor of Seventh Embodiment>

The electrophotographic photoconductor of the seventh embodiment comprises a support, an under layer and a photosensitive layer, the under layer and photosensitive layer being disposed on or over the support, wherein the photosensitive layer comprises a compound represented by the foregoing general formula (1), and wherein the under layer comprises an organic metal compound and a silane coupling agent. The under layer may further contain a binder resin that is compatible both with the organic metal compound and silane coupling agent.

Examples of the organic metal compound are as follows: For compounds having tetravalent metal, zirconium chelate compounds such as zirconium tetraacetylacetonate, zirconium butoxybisacetylacetonate, zirconium tributoxyacetylacetonate, zirconium tetrakisethylacetoacetate, zirconium butoxytrisethylacetoacetate, zirconium tributoxymonoethylacetoacetate, zirconium dibutoxybisethyllactate, bisacetylacetonate bisethylacetoacetate zirconium, monoacetylacetonate trisethylacetoacetate zirconium and bisacetylacetonate bisethyllactate zirconium, and zirconium alkoxides such as zirconium n-butoxide and zirconium n-propoxide are exemplified.

For titanium compounds, titanium orthoesters represented by the following general formula (I), polyortho titanates represented by the following general formula (II), and titanium chelate compounds represented by the following general formula (III) are exemplified.

General Formula (I)

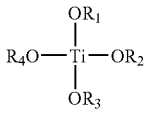

where $R_1$, $R_2$ and $R_3$ each represents a methyl group, ethyl group, n-propyl group, isopropyl group, n-butyl group, isobutyl group, cresyl group, stearyl group, hexyl group, nonyl group, or cetyl group General Formula (II)

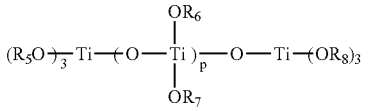

where $R_5$, $R_6$, $R_7$ and $R_8$ each represents a methyl group, ethyl group, n-propyl group, isopropyl group, n-butyl group, isobutyl group, cresyl group, stearyl group, hexyl group, nonyl group, or cetyl group, and p represents an integer of 2 to 10

$$Ti(L)_qX_{4-q}$$ General Formula (III)

where L represents a chelate group, X represents an ester group, and q represents 1 to 4

In addition, examples of ligands include octylene glycol, β-ketones such as acetyl acetone, hydroxyl carboxylic acids such as lactic acid, malic acid, tartaric acid and salicylic acid, ketoesters such as acetoacetates, and ketoalcohols such as diacetone alcohol.

For compounds having trivalent metal, aluminum alkoxides such as aluminum isopropoxide, mono-sec-butoxy aluminum diisopropoxide, aluminum sec-butoxide and aluminum ethoxide; aluminum chelate compounds such as aluminum ethylacetoacetate diisopropoxide, aluminum tris (ethylacetoacetate), aluminum tris(acetylacetonate) and aluminum bisethylacetoacetate monoacetylacetate; indium alkoxides such as indium methoxide, indium ethoxide, indium isopropoxide and indium n-butoxide; antimony alkoxides such as antimony methoxide, antimony ethoxide, antimony isopropoxide and antimony n-butoxide; and boron alkoxides such as boron methoxide and boron n-butoxide are exemplified.

For compounds having divalent metal, manganese(II) bis(acethylacetonate), zinc(II) bis(acethylacetonate), and tin(II) bis(acetylacetonate) are exemplified.

Examples of the silane coupling agent include vinyltrichlorosilane, vinyltriethoxysilane, vinyltris(β-methoxyethoxy)silane, γ-glycidoxypropyltrimethoxysilane, γ-methacryloxypropyltrimethoxysilane, γ-aminopropylmethyldimethoxysilane, γ-chloropropyltrimethoxysilane, γ-mercaptopropyltrimethoxysilane, γ-aminopropyltrimethoxysilane, γ-aminopropyltriethoxysilane, methyltrimethoxysilane, dimethyldimethoxysilane, trimethylmonoethoxysilane, diphenyldimethoxysilane, diphenyldiethoxysilane, monophenyltrimethoxysilane, γ-(2-aminoethyl)aminopropyltrimethoxysilane, γ-(2-aminoethyl)aminopropylmethyldimethoxysilane, and γ-methacryloxypropyltrimethoxysilane.

For the binder resin, for example, polyurethane resins, polyvinylbutyral resins, polyvinylformal resins, or polyvinylacetate resins are used.

In the present invention the under layer contains at least one of each of the foregoing organic metal compounds and silane coupling agents, or contains at least one of each of the foregoing organic metal compounds, silane coupling agents and binder resins. These organic metal compounds, silane coupling agents and binder resins may be used singly or in combination. The content of the silane coupling agent with respect to the organic metal compound can be arbitrarily set within 5% by mass to 95% by mass.

When a binder resin is contained in the under layer of the present invention, it is required that the added amount of the binder resin be 25% by mass or less based on the total amount of the organic metal compound and silane coupling agent. If greater than 25% by mass is used, the coating solution for under layer tends to turn into a gel, and it causes reduction of electrophotographic characteristics of the photoconductor, and particularly at low temperature and low humidity environments, causes reduction in sensitivity and increase in residual potential. If less than 5% by mass is used, it is likely that the resultant under layer has cracks when made thick. For this reason, the most preferable proportion of the binder resin is from 5% by mass to 25% by mass. Although the thickness of the under layer can be arbitrarily set within 0.1 μm to 10 μm, most preferably, it is set within 0.1 μm to 2 μm. The under layer is formed by dissolving the foregoing material into a solvent, diluting the resultant solution, applying the diluted solution onto a conductive support by means of a normal coating method such as blade coating, wire-bar coating, spray coating, dip coating, bead coating, air-knife coating, or curtain coating, and drying the solution at 100° C. to 200° C.

<Electrophotographic Photoconductor of Eighth Embodiment>

The electrophotographic photoconductor of the eighth embodiment comprises a support, a photosensitive layer and a surface protective layer, the photosensitive layer and surface protective layer being disposed on or over the support, wherein the photosensitive layer comprises a compound represented by the foregoing general formula (1), and wherein the surface protective layer comprises at least one of a diamond like carbon and an amorphous carbon, both containing hydrogen.

For the protection of the photosensitive layer, the electrophotographic photoconductor of the present invention includes a protective layer provided on the photosensitive layer. In recent years, daily use of computers has created a demand for printers with high-speed output and small size. It is therefore possible to effectively use the photoconductor of the present invention that is provided with a surface protection layer for increased durability, is of high sensitivity, and free of defects.

The protective layer that can be used in the present invention has a diamond like carbon or an amorphous carbon, both containing hydrogen. The surface protective layer preferably has C—C bonds similar to those of diamond having $sp^3$ hybrid orbitals. The surface protective layer may be a film having a structure similar to graphite that has $sp^2$ hybrid orbitals, or may be an amorphous film. In addition, additive element(s), such as nitrogen, fluorine, boron, phosphorus, chlorine, bromine, and/or iodine may be added to the surface protective layer. The volume resistance of the surface protective layer is preferably $10^9\Omega\times cm$ to $10^{12}\Omega\times cm$ and, more preferably, $10^{10}\Omega\times cm$ to $10^{11}\Omega\times cm$. The Knoop hardness of the surface protective layer is preferably 400 kg/mm$^2$ or more, and the optical transmittance of the surface protective layer is preferably 50% or more for exposure light. The thickness of the surface protective layer is preferably 0.5 μm to 5 μm.

Upon preparation of the surface protective layer, hydrocarbon gas (e.g., methane, ethane, ethylene, or acethylene) is used as a main material while using carrier gas (e.g., $H_2$ or Ar). Any gas that can be gasified under reduced pressure or by application of heat can be used as a gas for supplying additive element(s). For example, $NH_3$, $N_2$ or the like is used for supplying nitrogen, $C_2F_6$, $CH_3F$ for fluorine, $B_2H_6$ or the like for boron, $PH_3$ or the like for phosphorus, $CH_3Cl$, $CH_2Cl_2$, $CHCl_3$, or $CCl_4$ for chlorine, $CH_3Br$ for bromine, $CH_3I$ for iodine, and $NF_3$, $BCl_3$, BBr, $BF_3$, $PF_3$, $PCl_3$, etc., for additive elements. Using these gases the surface protective layer is produced by means of plasma CVD, glow discharge decomposition, photo CVD, or sputtering using graphite or the like as a target. The film deposition method is not particularly limited, however, as a method of forming a film that is composed primarily of carbon and exhibits excellent characteristics as a protective layer, for example, the method disclosed in JP-A No. 58-49609 is known, which is plasma CVD that also features the sputtering effect. Such a method in which a protective film containing carbon as a main component is formed by means of plasma CVD does not require heating of support and thus can achieve film formation at temperatures as low as 150° C. or less. Thus, this method has a merit that there is no problem for the formation of a protective layer on an organic photosensitive layer with low heat resistance.

FIG. 1 is a cross-sectional view showing a configuration of the electrophotographical photoconductor of the present invention, where a charge blocking layer 41, a moire preventing layer 43, and a photosensitive layer 33 are disposed on a conductive support 31.

Figure 2:
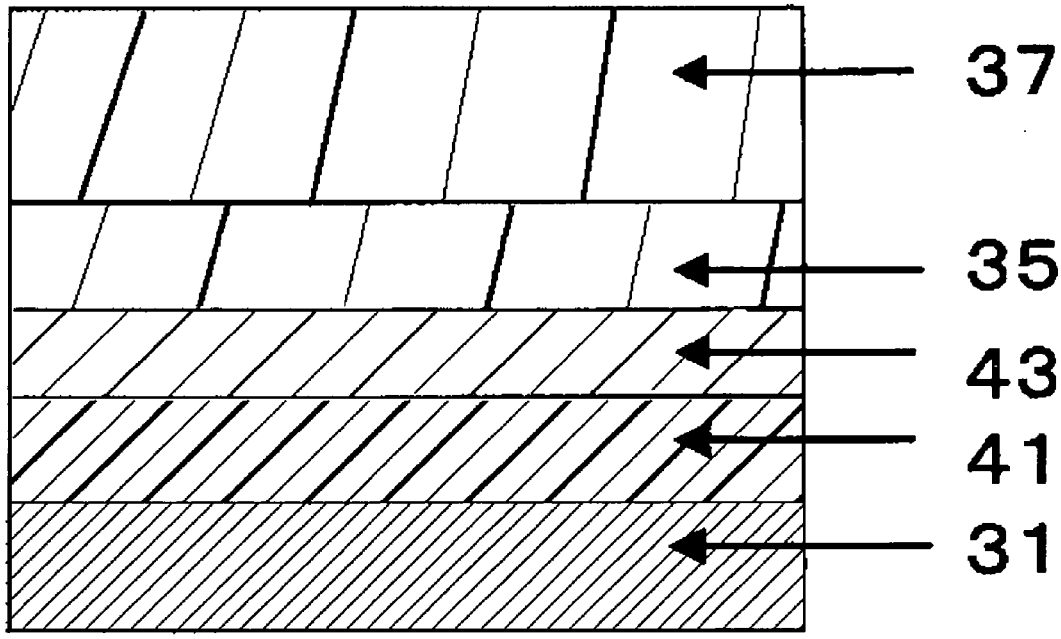
FIG. 2 is a cross-sectional view showing another configuration of the electrophotographical photoconductor of the present invention.

FIG. 2 is a cross-sectional view showing another configuration of the electrophotographical photoconductor of the present invention, where a charge blocking layer 41, a moire preventing layer 43, a charge generating layer 35, and a charge transporting layer 37 are disposed on a conductive support 31.

Figure 3:
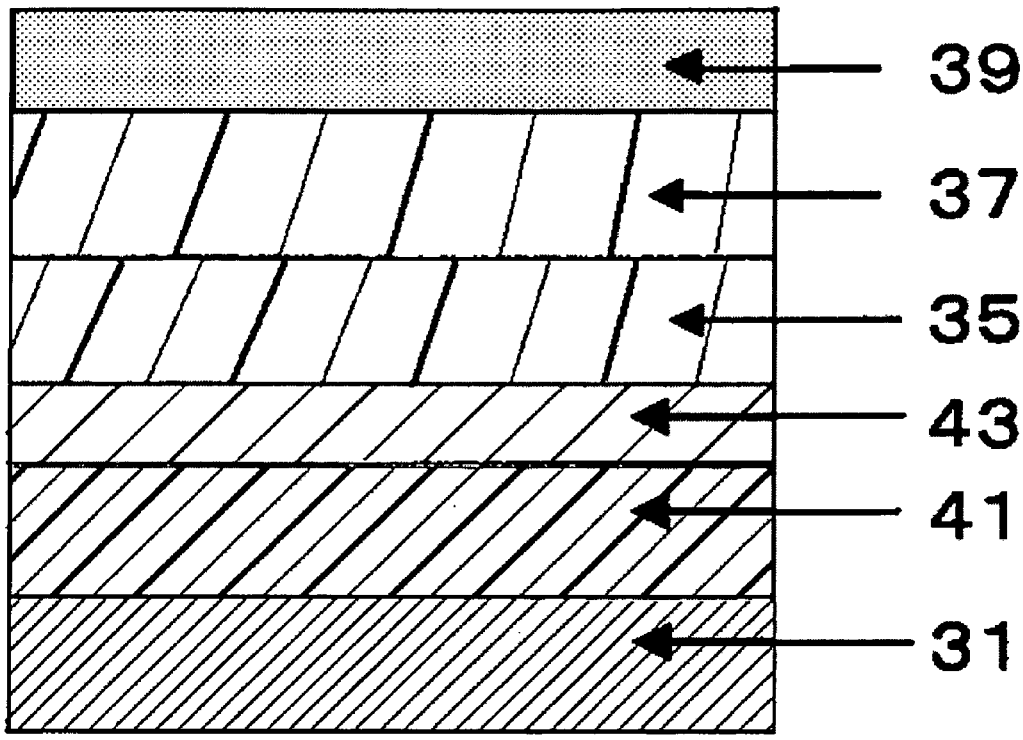
FIG. 3 is a cross-sectional view showing still another configuration of the electrophotographical photoconductor of the present invention.

FIG. 3 is a cross-sectional view showing still another configuration of the electrophotographical photoconductor of the present invention, where a charge blocking layer 41, a moire preventing layer 43, a charge generating layer 35, a charge transporting layer 37, and a protective layer 39 are disposed on a conductive support 31.

For the conductive support, conductive supports with a volume resistance of $10^{10}\Omega\times cm$ or less are used; examples include a conductive support obtained by covering film-shaped or cylindrical plastic or paper with a metal (e.g., aluminum, nickel, chrome, nichrome, copper, gold, silver, or platinum) or with a metal oxide (e.g., tin oxide or indium oxide) by means of vapor deposition or sputtering, and a conductive support obtained by rolling an aluminum plate, aluminum alloy plate, nickel plate, or stainless plate into a tubeby means of extrusion or extraction, and by subjecting the tube to surface treatment such as cutting, superfinishing, and/or polishing). In addition, an endless nickel belt and an endless stainless belt can also be used as the conductive support.

In addition to the foregoing, conductive supports obtained by applying a conductive powder dispersed in suitable binder resin onto the foregoing supports can also be used as the conductor support of the present invention. Examples of such a conductive powder include powders obtained from carbon black and acethylene black, metal powders obtained from such metals as aluminum, nickel, iron, nichrome, copper, zinc and silver, and metal oxide powders such as conductive tin oxide powder and ITO powder. Examples of binder resin to be used together include thermoplastic resins, thermosetting resins or photocurable resins, such as polystyrenes, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene acetate, polyarylate resins, phenoxy resins, polycarbonates, cellulose acetate resins, ethylcellulose resins, polyvinyl butyrals, polyvinyl formals, polyvinyl toluene, poly-N-vinylcarbazole, acrylic resins, silicone resins, epoxy resins, melamine resins, urethane resins, phenol resins, and alkyd resins. Such a conductive layer can be formed by dispersing the conductive powder into a suitable solvent (e.g., tetrahydrofuran, dichloromethane, methyl ethyl ketone, or toluene) together with binder resin to prepare a coating solution and by applying the coating solution onto the conductive support.

Furthermore, the following conductive support can also be used as the conductive support of the present invention: a conductive support obtained by providing a conductive layer on a suitable cylindrical base by means of a heat shrinkable tube in which the foregoing conductive powder is contained in a material such as polyvinyl chloride, polypropylenes, polyesters, polystyrenes, polyvinylidene chloride, polyethylene, chlorinated rubber, or Teflon (trade mark).

Next, the photosensitive layer will be described. The photosensitive layer may be a single-layered photosensitive layer that contains a charge generating substance and a charge transporting substance as shown in FIG. 1, but a multilayered photosensitive layer composed of a charge generating layer and a charge transporting layer is preferable because of its excellent durability and sensitivity. For convenience of explanation, a multilayered photosensitive layer will be first described.

The charge generating layer is one containing a charge generating substance as a main component. The charge generating substance is not particularly limited and can be selected from known materials. Among these, titanyl phthalocyanine that has a maximum peak at least at a Bragg angle 2θ(±0.2°) of 27.2° in its X-ray diffraction spectrum for CuKα X-ray (wavelength=1.542 angstrom) can be effectively used. In particular, the titanyl phthalocyanine crystal disclosed in JP-A No.2001-19871 can be effectively used, which has a maximum peak at least at a Bragg angle 2θ(±0.2°) of 27.2°, main peaks at Bragg angles 2θ(±0.20) of 9.4°, 9.6° and 24.0°, a peak at the smallest Bragg angle 2θ(±10.2°) of 7.3°, and no peaks between 7.3° and 9.4° in its X-ray diffraction spectrum for CuKα X-ray (wavelength=1.542 angstrom). Moreover, the titanyl phthalocyanine crystal disclosed in JP-A Nos.2004-83859 and 2004-78141 can be used most effectively, which features the foregoing crystal characteristics and has no coarse particles because its average particle size is adjusted to 0.25 μm or less upon crystal formation or by filtration.

The charge generating layer is formed by dispersing the charge generating substance in a suitable solvent together with binder resin where appropriate by means of a ball mill, Attritor, sand mill, or sonicator to prepare a coating solution, applying the coating solution onto the conductive support, and drying the solution.

Examples of the binder resin used for the charge generating layer where appropriate include polyamides, polyurethanes, epoxy resins, polyketones, polycarbonates, silicon resins, acrylic resins, polyvinyl butyrals, polyvinyl formals, polyvinyl ketones, polystyrenes, polysulfones, poly-N-vinylcarbazole, polyacrylamides, polyvinyl benzals, polyesters, phenoxy resins, vinyl chloride-vinyl acetate copolymers, polyvinyl acetates, polyphenylene oxides, polyamides, polyvinyl pyridines, cellulose-based resins, casein, polyvinyl alcohols, and polyvinyl pyrrolidones. An appropriate amount of the binder resin is 0 to 500 parts by mass per 100 parts by mass of the charge generating substance and, more preferably, 10 parts by mass to 300 parts by mass.

Examples of solvents used herein include isopropanol, acetone, methyl ethyl ketone, cyclohexanone, tetrahydrofuran, dioxane, ethyl cellosolve, ethyl acetate, methyl acetate, dichloromethane, dichloroethane, monochlorobenzene, cyclohexane, toluene, xylene, and ligroin. For the method of applying the coating solution, dip coating, spray coating, bead coating, nozzle coating, spinner coating, ring coating, etc., can be adopted. The suitable thickness of the charge generating layer is 0.01 μm to 5 μm and, more preferably, 0.1 μm to 2 μm.

The charge transporting layer can be formed by dissolving or dispersing a charge transporting substance and binder resin in a suitable solvent to prepare a coating solution, applying the coating solution onto the charge generating layer, and drying the solution. Where appropriate, a plasticizer, leveling agent, and/or antioxidant may be added.

Charge transporting substances are of two types: hole transporting substances, and electron transporting substances. Examples of hole transporting substances include poly-N-carbazole and derivatives thereof, poly-γ-carbazolylethylglutamate and derivatives thereof, pyrene-formaldehyde condensation products and derivatives thereof, polyvinyl pyrene, polyvinyl phenanthrene, polysilane, oxazole derivatives, oxadiazole derivatives, imidazole derivatives, monoarylamine derivatives, diarylamine derivatives, triarylamine derivatives, stilbene derivatives, α-phenyl stilbene derivatives, benzidine derivatives, diarylmethane derivatives, triarylmethane derivatives, 9-styrylanthracene derivatives, pyrazoline derivatives, divinyl benzene derivatives, hydrazone derivatives, indene derivatives, butadiene derivatives, pyrene derivatives, bisstilbene derivatives, enamine derivatives, and other known materials. These hole transporting substances may be used singly or in combination.

Examples of electron transporting substances include electron accepting substances such as chloranile, bromanile, tetracyanoethylene, tetracyanoquinodimethane, 2,4,7-trinitro-9-fluorolenone, 2,4,5,7-tetranitro-9-fluoroleone, 2,4,5,7-tetranitroxanthone, 2,4,8-trinitrothioxanthone, 2,6,8-trinitro-4H-indeno[1,2-b]thiophene-4-one, 1,3,7-trinitrodibenzothiophene-5,5-dioxide, and benzoquinone derivatives.

Specific examples of the binder resin for use in the charge transporting layer include thermoplastic resins and thermosetting resins, such as polystyrenes, styrene-acrylonitrile copolymers, styrene-butadiene copolymers, styrene-maleic anhydride copolymers, polyesters, polyvinyl chloride, vinyl chloride-vinyl acetate copolymers, polyvinyl acetate, polyvinylidene chloride, polyarylates, phenoxy resins, polycarbonates, cellulose acetate resins, ethyl cellulose resins, polyvinyl butyrals, polyvinyl formals, polyvinyl toluene, poly-N-vinyl carbazole, acrylic resins, silicone resins, epoxy resins, melamine resins, urethane resins, phenolic resins, and alkyd resins.

The amount of the charge transporting substance is 20 parts by mass to 300 parts by mass per 100 parts by mass of binder resin and, more preferably, 40 parts by mass to 150 parts by mass. The thickness of the charge transporting layer is preferably 5 μm to 100 μm.

Examples of solvents used herein include tetrahydrofuran, dioxane, toluene, dichloromethane, monochlorobenzene, dichloroethane, cyclohexanone, methyl ethyl ketone, and acetone. Among these solvents, halogen-free solvents are preferable for reduced load on the environment. Specific examples of such solvents include cyclic ethers such as tetrahydrofuran and dioxane, aromatic hydrocarbons such as toluene and xylene, and derivatives thereof.

In addition, high-molecular electron transporting substances that serve as charge transporting substance and as binder resin are suitably used for the charge transporting layer. A charge transporting layer 8 composed of such high-molecular electron transporting substances has excellent wear resistance. Although known high-molecular electron transporting substances can be used, polycarbonates bearing a triarylamine structure on their main chain and/or side chains are preferable. Among these, high-molecular electron transporting substances represented by the following general formulae (I) to (X) are most preferable.

where $R_1$, $R_2$ and $R_3$ independently represent a halogen atom or substituted or unsubstituted alkyl group, $R_4$ represents a hydrogen atom or substituted or unsubstituted alkyl group, $R_5$ and $R_6$ each represents a substituted or unsubstituted aryl group, "o," "p," and "q" independently represent an integer of 0 to 4, "k" and "j" each represents the relative proportion of species (where $0.1 \leqq k \leqq 1.0$, $0 \leqq j \leqq 0.9$), and "n" is a repeating unit and represents an integer of 5 to 5,000

Note that although the general formula (I) shows a copolymer consisting of alternating two different species, this copolymer may be a random copolymer.

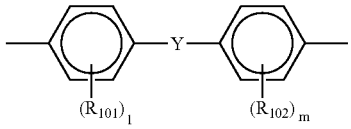

where $R_{101}$ and $R_{102}$ independently represent a halogen atom, substituted or unsubstituted alkyl group or aryl group, "l" and "m" each represents an integer of 0 to 4, Y represents a single bond, straight, branched or cyclic alkylene group of 1 to 12 carbon atoms, —O—, —S—, —SO—, —$SO_2$—, —CO—, —CO—O—Z-O—CO— (where Z represents an aliphatic divalent group) or the following moiety:

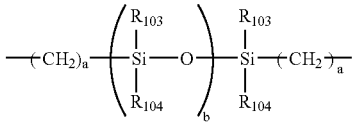

(where "a" represents an integer of 1 to 20, "b" represents an integer of 1 to 2,000, and $R_{103}$ and $R_{104}$ each represents substituted or unsubstituted alkyl group or aryl group), and $R_{101}$, $R_{102}$, $R_{103}$ and $R_{104}$ may be identical or different)

General Formula (I)

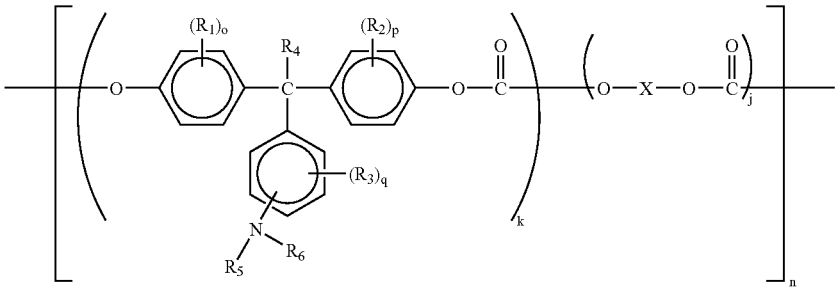

General Formula (II)

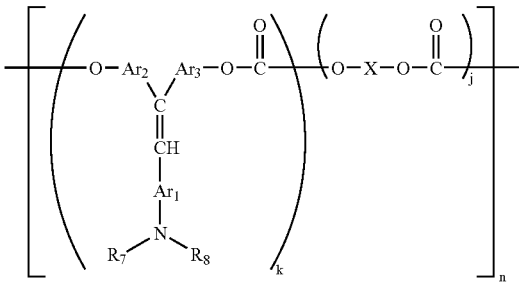

where $R_7$ and $R_8$ each represents a substituted or unsubstituted aryl group, $Ar_1$, $Ar_2$ and $Ar_3$ may be identical or different and each represents an arylene group, and "X," "k," "j" and "n" are identical to those defined in the general formula (I) shown above Note that although the general formula (II) shows a copolymer consisting of alternating two different species, this copolymer may also be a random copolymer General Formula (IV)

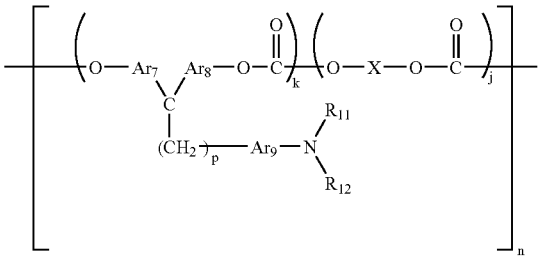

where $R_{11}$ and $R_{12}$ each represents a substituted or unsubstituted aryl group, $Ar_7$, $Ar_8$ and $Ar_9$ may be identical or different and each represents an arylene group, "p" represents an integer of 1 to 5, and "X," "k," "j" and "n" are identical to those defined in the general formula (I) shown above Note that although the general formula (IV) shows a copolymer consisting of alternating two different species, this copolymer may also be a random copolymer.

General Formula (III)

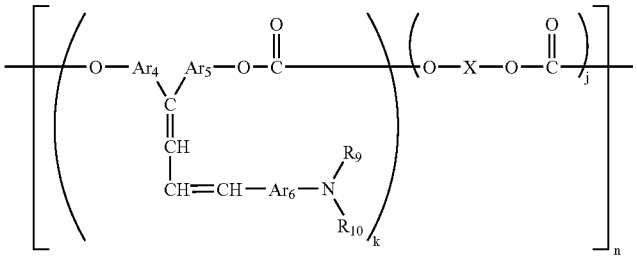

where $R_9$ and $R_{10}$ each represents a substituted or unsubstituted aryl group, $Ar_4$, $Ar_5$ and $Ar_6$ may be identical or different and each represents an arylene group, and "X," "k," "j" and "n" are identical to those defined in the general formula (I) shown above. Note that although the general formula (III) shows a copolymer consisting of alternating two different species, this copolymer may also be a random copolymer General Formula (V)

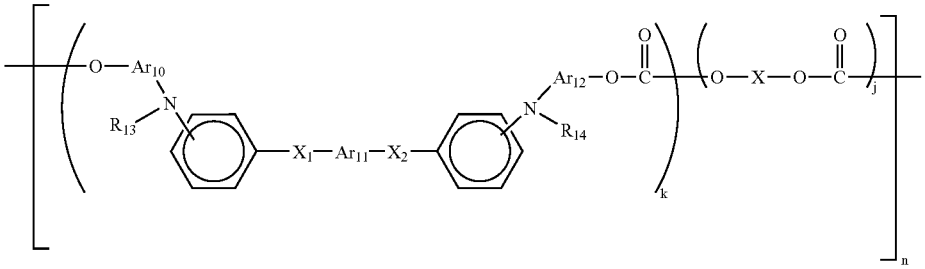

where $R_{13}$ and $R_{14}$ each represents a substituted or unsubstituted aryl group, $Ar_{10}$, $Ar_{11}$ and $Ar_{12}$ may be identical or different and each represents an arylene group, $X_1$ and $X_2$ each represents a substituted or unsubstituted ethylene group or substituted or unsubstituted vinylene group, and "X," "k," "j" and "n" are identical to those defined in the general formula (I) shown above Note that although the general formula (V) shows a copolymer consisting of alternating two different species, this copolymer may also be a random copolymer.

General Formula (VI)

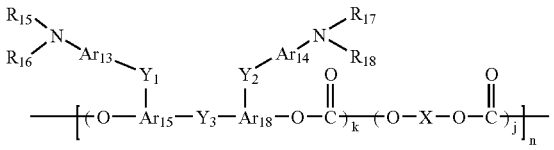

where $R_{15}$, $R_{16}$, $R_{17}$ and $R_{18}$ each represents a substituted or unsubstituted aryl group, $Ar_{13}$, $Ar_{14}$, $Ar_{15}$ and $Ar_{16}$ may be identical or different and each represents an arylene group, $Y_1$, $Y_2$ and $Y_3$ may be identical or different and each represents a substituted or unsubstituted alkylene group, a substituted or unsubstituted cycloalkylene group substituted or unsubstituted alkylene ether group, oxygen atom, sulfur atom or vinylene group, and "X," "k," "j" and "n" are identical to those defined in the general formula (I) shown above Note that although the general formula (VI) shows a copolymer consisting of alternating two different species, this copolymer may also be a random copolymer.

General Formula (VII)

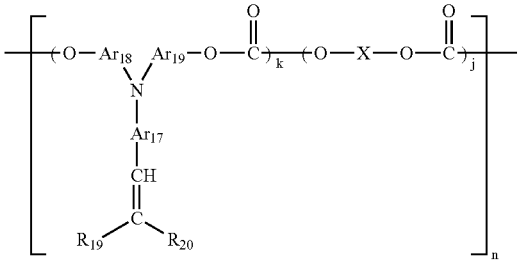

where $R_{19}$ and $R_{20}$ each represents a hydrogen atom, or substituted or unsubstituted aryl group, $R_{19}$ and $R_{20}$ may join together to form a ring, $Ar_{17}$, $Ar_{18}$ and $Ar_{19}$ may be identical or different and each represents an arylene group, and "X," "k," "j" and "n" are identical to those defined in the general formula (I) shown above Note that although the general formula (VII) shows a copolymer consisting of alternating two different species, this copolymer may also be a random copolymer.

where $R_{21}$ represents a substituted or unsubstituted aryl group, $Ar_{20}$, $Ar_{21}$, $Ar_{22}$ and $Ar_{23}$ may be identical or different and each represents an arylene group, and "X," "k," "j" and "n" are identical to those defined in the general formula (I) shown above Note that although the general formula (VIII) shows a copolymer consisting of alternating two different species, this copolymer may also be a random copolymer.

General Formula (IX)

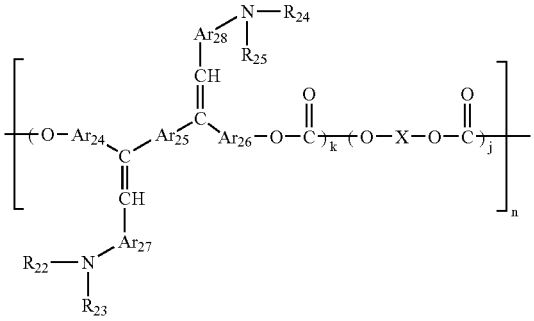

where $R_{22}$, $R_{23}$, $R_{24}$ and $R_{25}$ each represents a substituted or unsubstituted aryl group, $Ar_{24}$, $Ar_{25}$, $Ar_{26}$, $Ar_{27}$ and $Ar_{28}$ may be identical or different and each represents an arylene group, and "X," "k," "j" and "n" are identical to those defined in the general formula (I) shown above. Note that although the general formula (IX) shows a copolymer consisting of alternating two different species, this copolymer may also be a random copolymer.

General Formula (X)

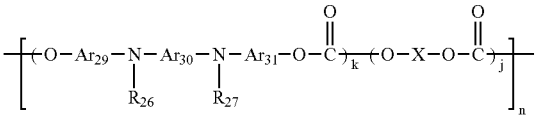

where $R_{26}$ and $R_{27}$ each represents a substituted or unsubstituted aryl group, $Ar_{29}$, $Ar_{30}$ and $Ar_{31}$ may be identical or different and each represents an arylene group, and "X," "k," "j" and "n" are identical to those defined in the general formula (I) shown above Note that although the general formula (X) shows a copolymer consisting of alternating two different species, this copolymer may also be a random copolymer.

In addition to these high-molecular charge transporting substances used to form a charge transporting layer, a polymer obtained in the following manner is also included: Monomers or oligomers bearing electron-donating groups are first deposited as a charge transporting layer and then cured or General Formula (VIII)

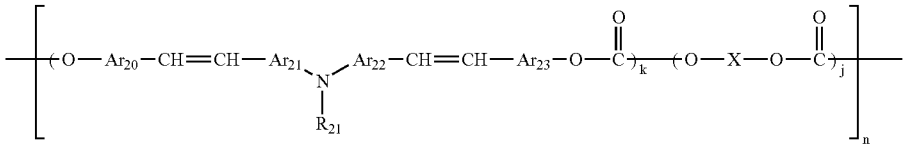

polymerized to form a polymer with a two-dimensional or three-dimensional crosslinked structure.

In addition, a charge transporting layer consisting of crosslinked structure can also be used effectively. For the formation of crosslinked structure, reactive monomers bearing multiple crosslinkable functional groups in one molecular are crosslinked by means of light or heat to form a three dimensional network, which functions as binder resin to provide excellent wear resistance.

For the reactive monomers, it is highly effective to use monomers that have charge transporting capability in their part or entirety. The use of such monomers leads to the formation of charge transporting sites in the polymer network, allowing the charge transporting layer to sufficiently exert its function. For monomers having charge transporting capability, reactive monomers with a triarylamine structure can be used effectively.

A charge transporting layer having such a network has high wear resistance but shrinks much upon its formation by the crosslinking reaction of reactive monomers, causing in some cases cracks therein when made thick. In such a case, a two-layered charge transporting layer may be adopted, in which a charge transporting layer composed of dispersed low-molecular polymers may be used as a lower layer (one closer to the charge generating layer), and a charge transporting layer with crosslinked structure may be used as an upper layer (one closer to the photoconductor surface).

A charge transporting layer composed of polymers bearing electron-donating groups, or polymers having a crosslinked structure, are excellent in wear resistance. In an electrophotographic process charging voltage (voltage at non-exposed portions) is generally constant. For this reason, when the surface layer of a photoconductor has worn out after repetitive use, the electric field intensity at the worn-out part of the photoconductor accordingly increases. Because the frequency of the occurrence of background smear increases with increasing electric field intensity, higher wear resistance of photoconductor is advantageous to eliminate the occurrence of background smear. A charge transporting layer composed of polymers bearing electron-donating groups shows excellent film-formability because the polymer itself is a high-molecular compound, and thus can achieve dense charge transporting sites and excellent charge transporting capability compared to a charge transporting layer composed of low-molecular dispersed polymers. Thus, it is expected that a photoconductor having a charge transporting layer that uses high-molecular charge transporting substances can achieve fast response.

Examples of other polymers bearing electron-donating groups include copolymers of known monomers, graft polymers, star polymers, and crosslinked polymers bearing electron-donating groups as disclosed, for example, in JP-A Nos.03-109406, 2000-206723, and 2001-34001.

In the present invention, a plasticizer and/or leveling agent may be added to the charge transporting layer. Plasticizers that are used for general resins such as dibutyl phthalate and dioctyl phthalate can be used without modification, and the proper amount of such a plasticizer is about 0% by mass to 30% by mass based on the total amount of binder resin. Examples of such a leveling agent include silicone oils such as dimethylsilicone oil and methylphenylsilicone oil, and polymers and oligomers both having a perfluoroalkyl group on their side chain, and the proper amount of such a leveling agent is about 0% by mass to 1% by mass based on the total amount of binder resin.

A multilayered photosensitive layer has been described above, however, the present invention may adopt a single-layered photosensitive layer. A single-layered photosensitive layer is formed by providing a single layer containing at least the foregoing charge transporting substance and binder resin. Binder resins listed in the description of the charge generating layer and charge transporting layer can be employed. In addition, combined use of a charge transporting substance can provide high photosensitivity, high carrier transporting capability, and low residual potential. The charge transporting substance is selected from hole transporting substances and electron transporting substances, depending on the polarity of electrical charges to be applied on the surface of the photoconductor. Moreover, the foregoing high-molecular electron transporting substances are also suitable for a single-layered photosensitive layer because they have functions of binder resin and charge transporting substance.

For the protection of the photosensitive layer, the electrophotographic photoconductor of the present invention may include a protective layer provided on the photosensitive layer. Daily use of computers has created a demand for printers with high-speed output and small size. It is therefore possible to effectively use the photoconductor of the present invention that is provided with a surface protection layer for increased durability, is of high sensitivity, and free of defects.

For the protective layer applicable to the present invention, protective layers with dispersed filler as disclosed in JP-A No.2002-278120 and the like, photocrosslinked protective layers as disclosed in JP-A No.2005-115353 and the like, and charge-admitting layers as disclosed in JP-A No.2002-31911 and the like can be used.

(Image Formation Apparatus and Image Formation Method)

The image forming method of the present invention comprises a latent electrostatic image forming step, a developing step, a transferring step and a fixing step, and further comprises additional step(s) such as a charge removing step, a cleaning step, a recycling step and/or a controlling step, which are optionally selected as needed.

The image forming apparatus of the present invention comprises an electrophotographic photoconductor, a latent electrostatic image forming unit, a developing unit, a transferring unit and a fixing unit, and further comprises additional unit(s) such as a charge eliminating unit, a cleaning unit, a recycling unit and/or a controlling unit, which are optionally selected as needed.

The latent electrostatic image forming step is a step of forming a latent electrostatic image on an electrophotographic photoconductor.

For this electrophotographic photoconductor, the electrophotographic photoconductor of the present invention is used.

The formation of the latent electrostatic image is achieved by, for example, exposing the electrophotographic photoconductor imagewisely after equally charging its entire surface. This step is performed by means of the latent electrostatic image forming unit. The latent electrostatic image forming unit comprises a charging device configured to equally charge the surface of the electrophotographic photoconductor, and an exposing device configured to imagewisely expose the surface of the electrophotographic photo conductor.

The charging step is achieved by, for example, applying voltage to the surface of the electrophotographic photoconductor by means of the charging device.

The charging device (charger) is not particularly limited and can be appropriately selected depending on the intended purpose; examples include known contact-charging devices equipped with a conductive or semiconductive roller, blush, film or rubber blade; and known non-contact-charging devices utilizing corona discharge such as corotron or scorotoron.

The exposure step is achieved by, for example, selectively exposing the surface of the electrophotographic photoconductor by means of the exposing device.

The exposing device is not particularly limited as long as it is capable of performing image-wise exposure on the surface of the charged electrophotographic photoconductor by means of the charging device, and may be appropriately selected depending on the intended use; examples include various exposing devices, such as optical copy devices, rod-lens-eye devices, optical laser devices, and optical liquid crystal shatter devices.

Note in the present invention that a backlight system may be employed for exposure, where image-wise exposure is performed from the back side of the electrophotographic photoconductor.

-Developing and Developing Unit-

The developing step is a step of developing the latent electrostatic image using a toner or developer to form a visible image.

The formation of the visible image can be achieved, for example, by developing the latent electrostatic image using the toner or developer. This is performed by means of the developing unit.

The developing unit is not particularly limited as long as it is capable of development by means of a toner or developer, and can be appropriately selected from known developing units depending on the intended purpose; suitable examples include those having at least a developing device, which is capable of housing the toner or developer therein and is capable of directly or indirectly applying the toner or developer to the latent electrostatic image. A developing device equipped with a toner container is more preferable.

The developing device may be of dry developing type or wet developing type, and may be designed either for monochrome or multiple-color; suitable examples include those having an agitation unit for agitating the toner or developer to provide electrical charges by frictional electrification, and a rotatable magnet roller.

In the developing device the toner and carrier are mixed together and the toner is charged by friction, allowing the rotating magnetic roller to bear toner particles in such a way that they stand on its surface. In this way a magnetic blush is formed. Since the magnet roller is arranged in the vicinity of the photoconductor, some toner particles on the magnetic roller that constitute the magnetic blush electrically migrate to the surface of the photoconductor. As a result, a latent electrostatic image is developed by means of the toner, forming a visible image, or a toner image, on the surface of the photoconductor.

The developer contained in the developing device may be either a one-component developer or a two-component developer.

-Transferring and Transferring Unit-

The transferring step is a step of transferring the visible image to a recording medium. A preferred embodiment of transferring involves two steps: primary transferring in which the visible image is transferred to an intermediate transferring medium; and secondary transferring in which the visible image transferred to the intermediate transferring medium is transferred to a recording medium. A more preferable embodiment of transferring involves two steps: primary transferring in which a visible image is transferred to an intermediate transferring medium to form a complex image thereon by means of toners of two or more different colors, preferably full-color toners; and secondary transferring in which the complex image is transferred to a recording medium.

The transferring step is achieved by, for example, charging photoconductor by means of a transfer charging unit. This transferring step is performed by means of the transferring unit. A preferable embodiment of the transferring unit has two units: a transferring unit configured to transfer a visible image to an intermediate transferring medium to form a complex image; and a secondary transferring unit configured to transfer the complex image to a recording medium.

The intermediate transferring medium is not particularly limited and can be selected from conventional transferring media depending on the intended purpose; suitable examples include transferring belts.

The transferring unit (i.e., the primary and secondary transferring units) preferably comprises a transferring device configured to charge and separate the visible image from the photoconductor and transfer it to the recording medium. The number of the transferring device to be provided may be either 1 or more.

Examples of the transferring device include corona transferring devices utilizing corona discharge, transferring belts, transferring rollers, pressure-transferring rollers, and adhesion-transferring devices.

The recording medium is not particularly limited and can be appropriately selected from known recording media (recoding paper).

The fixing step is a step of fixing a transferred visible image to a recording medium by means of the fixing unit. Fixing may be performed every time after each different toner has been transferred to the recording medium or may be performed in a single step after all different toners have been transferred to the recording medium.

The fixing unit is not particularly limited and can be appropriately selected depending on the intended purpose; examples include a heating-pressurizing unit. The heating-pressurizing unit is preferably a combination of a heating roller and a pressurizing roller, or a combination of a heating roller, a pressurizing roller, and an endless belt, for example. In general, heating treatment by means of the heating-pressurizing unit is preferably performed at a temperature of 80° C. to 200° C.

Note in the present invention that a known optical fixing unit may be used in combination with or instead of the fixing step and fixing unit, depending on the intended purpose.

The charge removing step is a step of applying a bias to the charged electrogphotoraphic photoconductor for removal of charges. This is suitably performed by means of the charge eliminating unit.

The charge removing unit is not particularly limited as long as it is capable of applying a charge-removing bias to the electrogphotoraphic photoconductor, and can be appropriately selected from conventional charge eliminating units depending on the intended purpose. A suitable example thereof is a charge removing lamp and the like.

The cleaning step is a step of removing toner particles remained on the electrogphotoraphic photoconductor. This is suitably performed by means of the cleaning unit.

The cleaning unit is not particularly limited as long as it is capable of removing such toner particles from the latent electrostatic image bearing member, and can be suitably selected from conventional cleaners depending on the intended use; examples include a magnetic blush cleaner, a electrostatic brush cleaner, a magnetic roller cleaner, a blade cleaner, a blush cleaner, and a wave cleaner The recycling step is a step of recovering the toner particles removed through the cleaning step to the developing unit. This is suitably performed by means of the recycling unit.

The recycling unit is not particularly limited, and can be appropriately selected from conventional conveyance systems.

The controlling step is a step of controlling the foregoing steps. This is suitably performed by means of the controlling unit.

The controlling unit is not particularly limited as long as the operation of each step can be controlled, and can be appropriately selected depending on the intended use. Examples thereof include equipment such as sequencers and computers.

Next, the image forming apparatus of the present invention will be described in detail with reference to the drawings.

Figure 4:
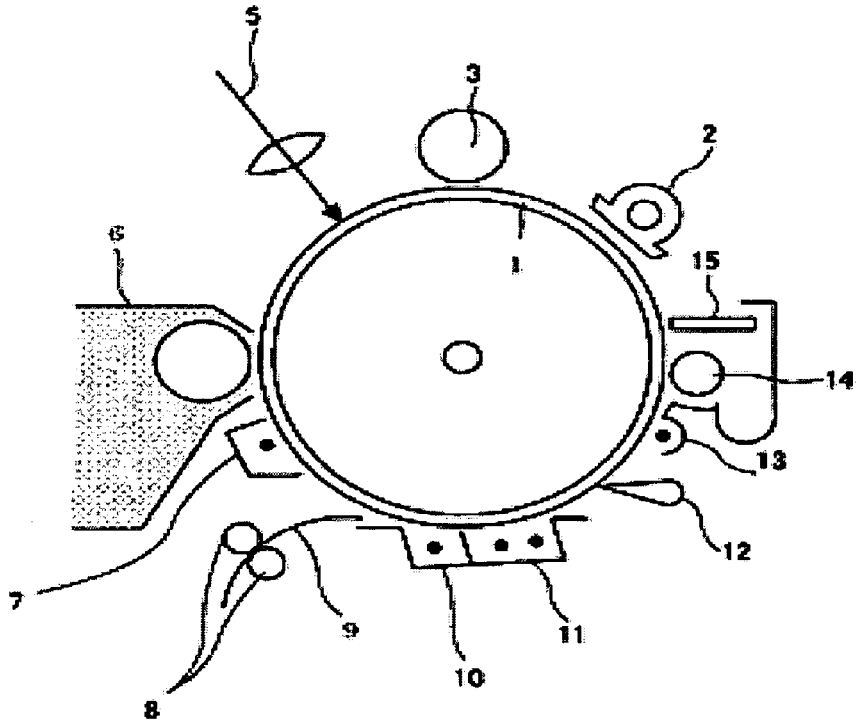
FIG. 4 is a schematic view for explaining the image forming process and image forming apparatus of the present invention.

FIG. 4 is a schematic view for explaining the image forming process and image forming apparatus of the present invention. A modification shown below is also within the scope of the present invention.

In a photoconductor 1 shown in FIG. 4, at least a specific under layer and photosensitive layer are disposed on or over a conductive support, and the photosensitive layer contains an electron transporting agent represented by the foregoing general formula (1). The photoconductor has a drum-like shape, however, it may have a sheet-like shape or endless belt-like shape. In addition, such known chargers as a corotron, a scorotron, a solid state charger, a solid state charger, a charging roller, and a transfer charger are used for a charging roller 3, a pre-transfer charger 7, a transfer charger 10, a separation charger 11, and a pre-cleaning charger 13.

Among these chargers, contact chargers and non-contact charger are most preferable. Contact chargers have the advantage that high charging efficiency is achieved and thus generation of ozone is minimized, and that miniaturization of apparatus can be realized. As used herein a contacting charging member means a charging member that comes in contact with the surface of a photoconductor; examples include a charging roller, a charging blade, and a charging brush. Among these, a charging roller and charging brush are preferable.

Figure 5:
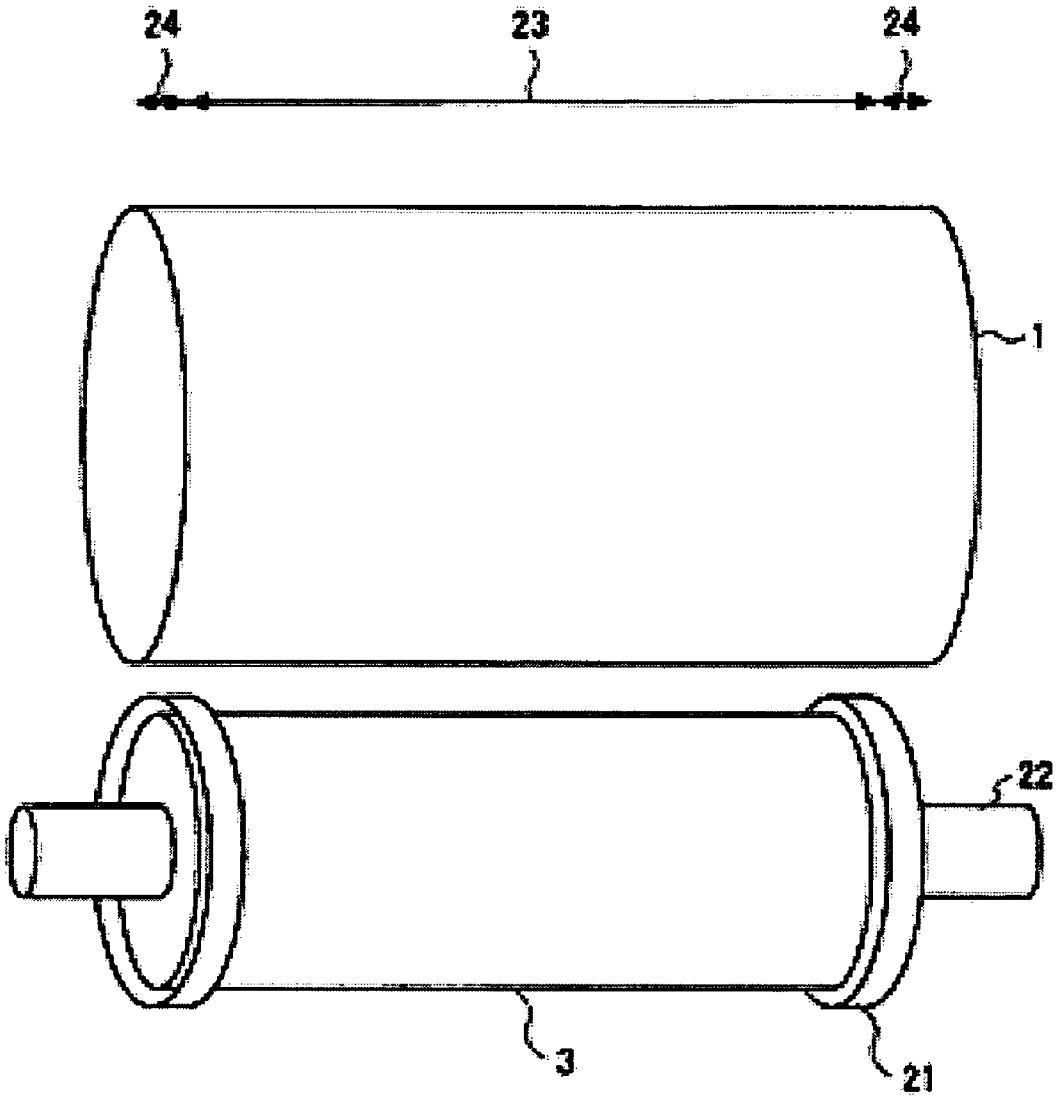
FIG. 5 shows an example of a non-contact charging mechanism in which clearance-forming members are disposed at both ends of a charging member.

An adjacently arranged charging member is one arranged near a photoconductor so as not to abut the photoconductor, with a clearance of 200 μm or less being provided between the photoconductor surface and the member surface. This is different from such known chargers as a corotron and scorotron by the distance of clearance. The adjacently arranged charging member of the present invention may be of any shape as long as it has a mechanism capable of appropriately controlling its distance from the photoconductor surface. For example, the rotating shafts of both the photoconductor and the charging member are mechanically fixed to provide an appropriate clearance between them. Particularly, the clearance can be stably maintained by using an charge roller-shaped charging member, arranging clearance-forming members on both ends of the charging member at non-image forming areas, and allowing only these portions to abut the photoconductor surface to cause an image forming area to be separated from the charging member surface. Alternatively, the clearance can be stably maintained by arranging clearance-forming members on both ends of the photoconductor at non-image forming portions and allowing only these portions to abut the charging member surface to cause the image forming area to be separated from the charging member surface. In particular, the methods described in JP-A Nos.2002-148904 and 2002-148905 can be used preferably. One example of an adjacent charging mechanism having clearance-forming members arranged on a charging member is shown in FIG. 5. This strategy is suitably employed because of the following advantages—the amount of generated ozone is small because of high charging efficiency, miniaturization of apparatus can be achieved, strains due to toner or the like never appear, and the photoconductor never wear out as a result of contact with the charging member. In addition, AC superposition current is used for the charging of the photoconductor, and thus unequal charging is less likely to occur.

When such a contact charger or a non-contact charger is used, a photoconductor may be susceptible to insulation breakdown. However, since the photoconductor of the present invention includes an intermediate layer consisting of a charge blocking layer and a moire preventing layer and the charge blocking layer contains no coarse particles of charge generating substance, the photoconductor has a high breakdown voltage, thereby making the most of the merit of the charging member, that is, prevention of unequal charging.

A photoconductor is charged by means of such a charging member described above. In a general image forming apparatus, the electrical field intensity for the photoconductor is set low (40 V/μm or less, more preferably 30 V/μm or less) because background smear derived from the photoconductor is likely to occur. This is because the likelihood of background smear is dependent on the electric field intensity—the likelihood increases with increasing electric field intensity. Reducing the electric field intensity for the photoconductor, however, causes reduction in the photocarrier generation efficiency and photosensitivity. In addition, this causes reduction in the electric field intensity between the photoconductor surface and conductive support and thereby the paths in which photocarriers that have been generated in the photosensitive layer travel tend to deviate from straight, causing the photocarriers to diffuse in different directions due to the Coulomb repelling forces to reduce the image resolution. The electrophotographic photoconductor of the present invention, by contrast, can remarkably reduce the likelihood of the occurrence of background smear, eliminating the need to lower the electrical intensity more than necessary—the photoconductor can be used at an electrical intensity of 40 V/μm or more. For this reason, it is made possible to ensure sufficient gain amount for light attenuation, allowing development of a latent electrostatic image without reducing image resolution.

Light sources that can provide high brightness (e.g., a light emitting diode (LED), semiconductor laser (LD), and electroluminescence (EL)) can be used for an image exposure part 5.

As light sources for a charge removing lamp 2 and the like, general light emitting sources can be employed; examples include fluorescent lamps, tungsten lamps, halogen lamps, mercury vapor lamps, sodium lamps, light emitting diodes (LEDs), semiconductor lasers (LDs), electroluminescences (ELs) and the like. For a light source to emit light of desired wavelength, various filters such as a sharp cut filter, band pass filter, near infrared cut filter, dichroic filer, interference filter, and color temperature conversion can be used.

Among these light sources, light emitting diodes and semiconductor lasers are preferable because since they provide high-energy light with a wavelength of as long as 600 nm to 800 nm, the foregoing phthalocyanine pigment, a charge transporting substance, is highly sensitive to that light. These light sources are used in the transferring step, charge removing step, cleaning step or pre-exposure step in addition to the steps shown in FIG. 4, whereby the photoconductor is irradiated with light.

A toner image that has been developed on the photoconductor 1 by means of a developing unit 6 is transferred to a transfer paper 9. At this point, not all toner particles are transferred to the transfer paper 9, but some remains on the photoconductor 1. The toner particles remained on the photoconductor 1 are removed from the photoconductor 1 by means of a fur brush 14 and a cleaning blade 15. Cleaning is sometimes carried out using only a cleaning brush. As the cleaning brush, known brushes including a fur brush and a magnetic fur brush may be used.

When an electrophotographic photoconductor is positively charged, a positive electrostatic latent image is formed on the surface of the photoconductor upon selective exposure. If this image is developed with a negative toner or voltage-detecting fine particles, a positive image is formed. Alternatively, when the electrophotographic photoconductor is negatively charged, a negative electrostatic latent image is formed on the surface of the photoconductor upon selective exposure. If this image is developed with a positive toner or voltage-detecting fine particles, a negative image is formed. This developing means may use a known method, and charge removing means may also use a known method.

Figure 6:
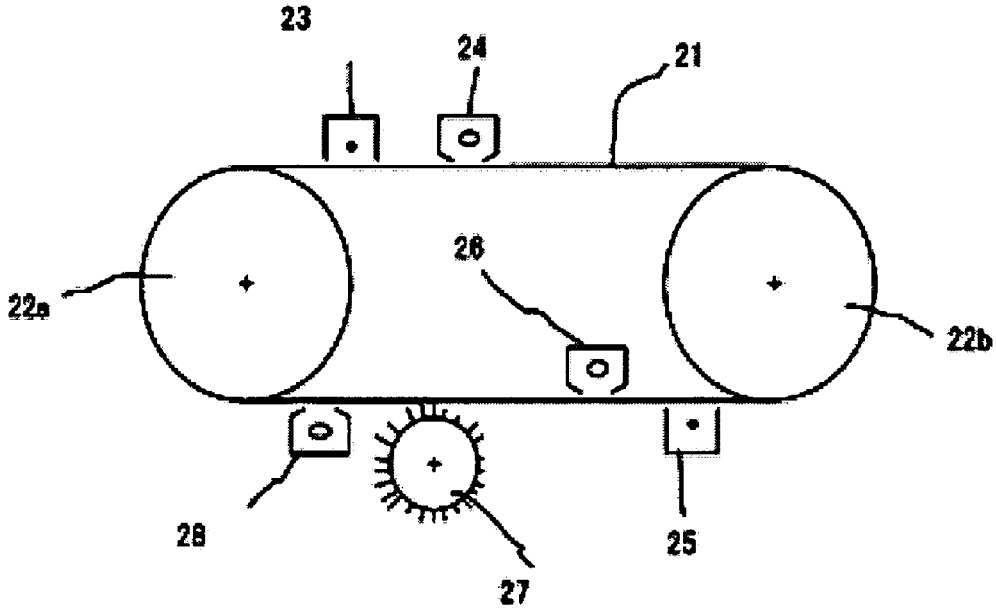
FIG. 6 shows another example of the electrophotographic process according to the present invention.

FIG. 6 shows another example of the electrophotographic process of the present invention. In a photoconductor 21 at least a specific under layer and photosensitive layer are disposed on or over a conductive support, and the photosensitive layer contains an electron transporting agent represented by the foregoing general formula (1). Driven by drives 22*a* and 22*b*, a charging step, an exposure step, a development step (not shown), a transferring step, a pre-cleaning exposure step, a cleaning step, and a charge removing step are carried out over and over again by means of a charger 23, a light source 24, a charger 25, a light source 26, a brush 27 and a light source 28, respectively.

The electrophotographic process thus described is just an embodiment of the present invention. It is, of course, possible to adopt another embodiment. For example, although pre-cleaning exposure is carried out from the support side in FIG. 6, this may be carried out from the photosensitive layer side. In addition, application of charge removing light may be carried out from the support side.

In FIG. 6 the selective exposure step, pre-cleaning exposure step, and charge removing exposure step are shown as exposure steps, however, a pre-transferring exposure step, a pre-selective exposure step, and several other known exposure steps may be carried out for the irradiation of the photo conductor.

Figure 8:
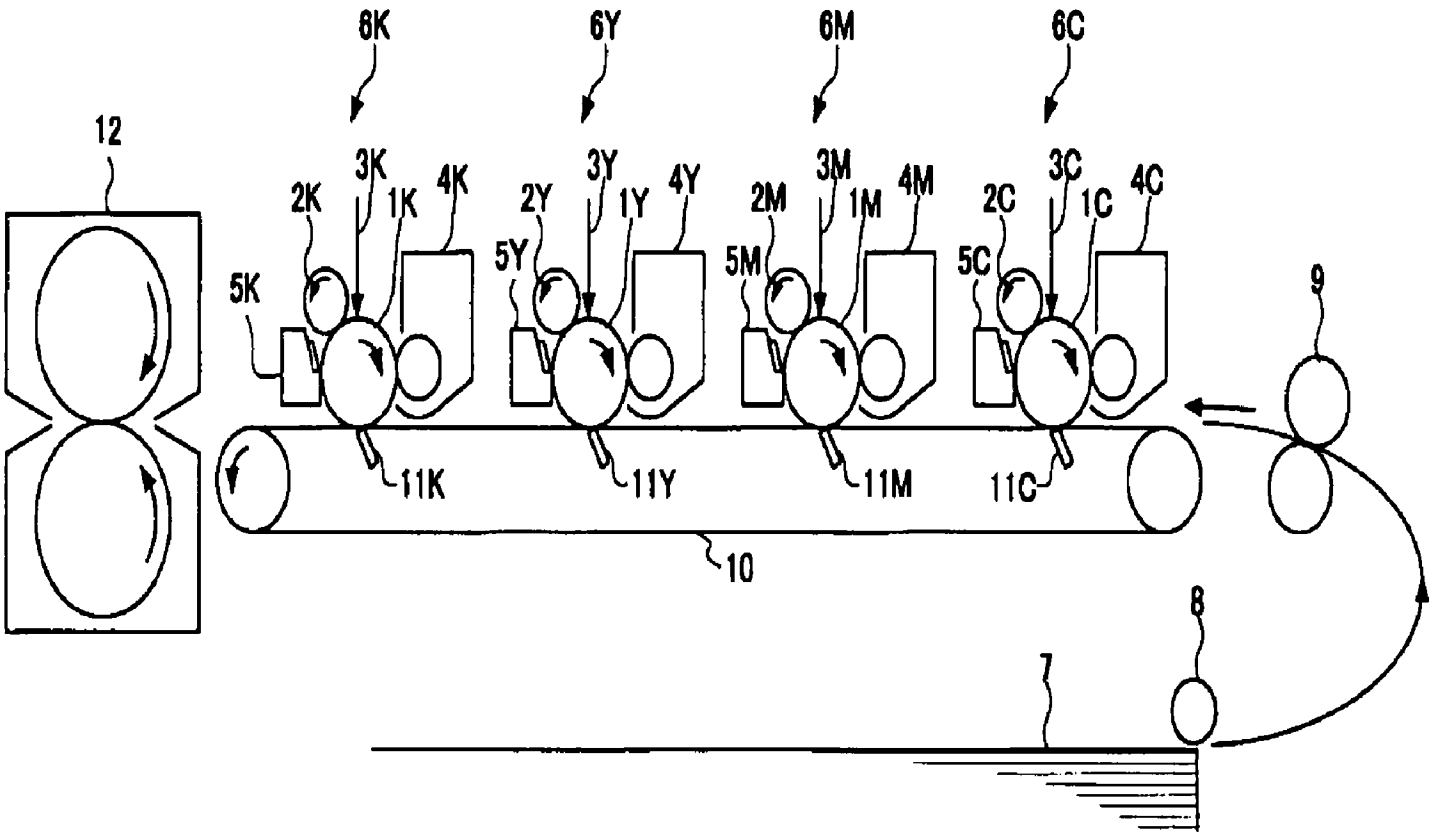
FIG. 8 is a schematic view for explaining a tandem-type full color electrophotographic apparatus of the present invention.

FIG. 8 is a schematic view for explaining a tandem-type full color electrophotographic apparatus of the present invention, and a modification as shown below is also within the scope of the present invention.

In FIG. 8 reference numbers 1C, 1M, 1Y and 1K each represents a drum-shaped photoconductor, where at least a specific under layer and photosensitive layer are disposed on or over a conductive support. The photosensitive layer contains an electron transporting agent represented by the foregoing general formula (1).

The photoconductors 1C, 1M, 1Y and 1K are rotated in the direction of arrow in the drawing. At least charging members 2C, 2M, 2Y and 2K, developing members 4C, 4M, 4Y and 4K, and cleaning members 5C, 5M, 5Y and 5K are arranged around them, respectively. The charging members 2C, 2M, 2Y and 2K each constitutes a charging device for even charging of the corresponding photoconductor. Laser beams 3C, 3M, 3Y and 3K are emitted from exposing members (not shown), passing between the charging members 2C, 2M, 2Y and 2K and the developing members 4C, 4M, 4Y and 4K toward the photoconductors 1C, 1M, 1Y and 1K to form electrostatic latent images thereon. Four image forming elements (units) 6C, 6M, 6Y and 6K having the photoconductors 1C, 1M, 1Y and 1K as center components are arranged along a transferring belt 10, a transfer material-carrying means. The transferring belt 10 is in contact with the photoconductors 1C, 1M, 1Y and 1K at a position between the developing members 4C, 4M, 4Y and 4K and the cleaning members 5C, 5M, 5Y and 5K of the image forming unit 6C, 6M, 6Y and 6K. Transfer brushes 11C, 11M, 11Y and 11K for applying a transfer bias are arranged on the backside of the transferring belt 10 at positions corresponding to the photoconductors 1C, 1M, 1Y and 1K. The image forming elements 6C, 6M, 6Y and 6K have similar configurations but differ in the color of toner contained.

In the color electrophotographic apparatus with the configuration shown in FIG. 8, an image forming operation is performed in the following manner: In the image forming elements 6C, 6M, 6Y and 6K, the photoconductors 1C, 1M, 1Y are 1K are charged by means of the charging member 2C, 2M, 2Y and 2K that are rotating in the direction of arrow (i.e., the direction in which the photoconductors rotate), and electrostatic latent images corresponding to each color are formed by means of laser beams 3C, 3M, 3Y and 3K at exposure portions of the photoconductors (not shown). The latent images are developed by means of the developing members 4C, 4M, 4Y and 4K to form toner images. The developing members 4C, 4M, 4Y and 4K develop latent electrostatic images using toners of different colors—C (cyan), M (magenta), Y (yellow), and K (black). The toner images formed on the four photoconductors 1C, 1M, 1Y and 1K are superimposed on a transfer paper. The transfer paper 7 is fed from a tray by a feed roll 8, stopped in a pair of resist rollers 9 on a temporary basis, and sent to the transferring belt at a time when an image is formed on the photoconductor. The transfer paper 7 that is held on the transferring belt 10 is transferred, and each toner image is transferred thereon at a position (transfer portion) contacting with corresponding photoconductor. The toner images on the photoconductors are transferred onto the transfer paper 7 by the electric field created by the potential difference between the transfer biases applied to the transfer brushes 11C, 11M, 11Y and 11K and the photoconductors 1C, 1M, 1Y and 1K. The recording paper 7 having the four color toner images superimposed thereon after passing through the four transfer portions is then transferred to a fixing device 12 for the fixing of toner, and ejected to an output tray (not shown). In addition, toner particles that have not been transferred to the recording paper 7 but left on the photoconductors 1C, 1M, 1Y and 1K are recovered by cleaning devices 5C, SM, 5Y and 5K. Note in FIG. 8 that the image forming elements are arranged in order of C (cyan), M (magenta), Y (yellow) and K (black) from upstream to downstream of the direction in which the transfer paper is transferred, but the order in which they are arranged is not particularly limited; they may be arranged in any order. Upon formation of a monochrome document, it is particularly effective for the present invention to provide a mechanism by which operations of image forming elements other than black (i.e., 6C, 6M and 6Y) are suspended. Although the charging member is in contact with the photoconductor in FIG. 8, a clearance (about 10 μm to 200 μm) can be provided between them by adopting a charging mechanism like that shown in FIG. 5. By this, it is possible to reduce the wear volume of these members and to reduce the occurrence of toner filming on the charging member.

The image forming units described above may be fixed inside a copier, a facsimile machine, or a printer, however, each electrophotographic element may be incorporated into such a device in a form of a process cartridge.

Figure 12:
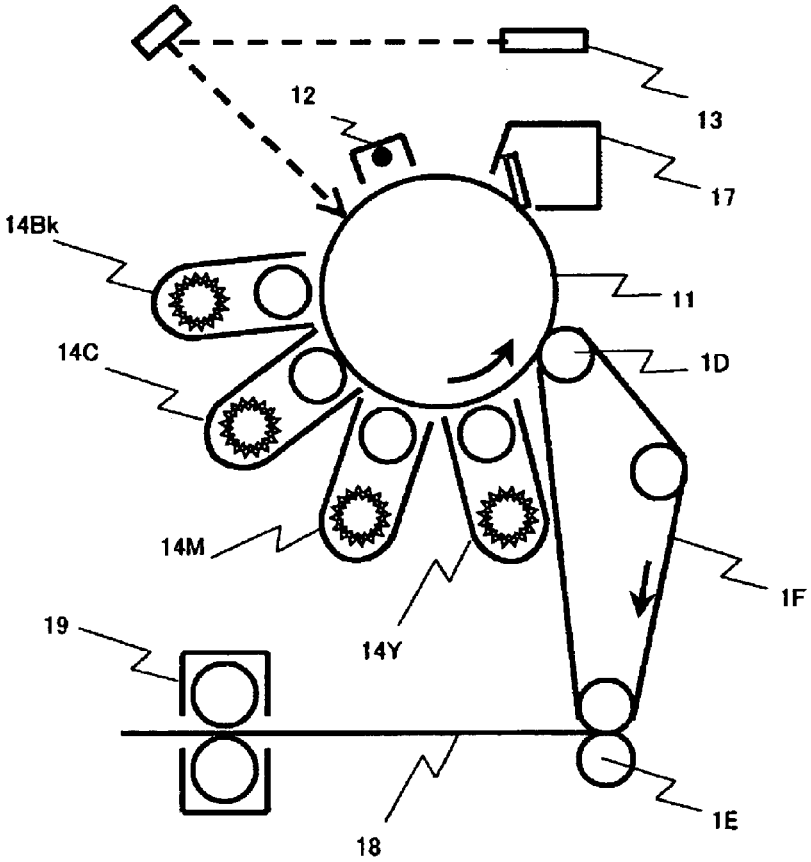
FIG. 12 is a schematic cross-sectional view of another example of the image forming apparatus according to the present invention.

FIG. 12 illustrates another example of the image forming apparatus of the present invention. In this image forming apparatus, a charging unit 12, an exposure unit 13, developing units 14Bk, 14C, 14M and 14Y for black (Bk) toner, cyan (C) toner, magenta (M) toner and yellow (Y) toner, an intermediate transferring belt 1F (an intermediate transferring member), and a cleaning unit 17 are sequentially arranged around a photoconductor 11. Note that subscripts Bk, C, M and Y correspond to their toner color, and are omitted where appropriate.

The photoconductor 11 is an electrophotographic photoconductor that satisfies the requirements of the present invention. The developing units 14Bk, 14C, 14M and 14Y can be separately controlled, so that only the developing unit corresponding to the intended color is driven. The toner image formed on the photoconductor 11 is transferred onto the intermediate transferring belt 1F by means of a first transfer means 1D disposed inside the intermediate transferring belt 1F. The first transfer means 1D is so arranged that it can be in contact with or separated from the photoconductor 11, allowing the intermediate transferring belt 1F to abut the photoconductor 11 only during a transfer operation. A toner image for each color is formed, and the toner images superimposed on the intermediate transferring belt 1F are then transferred onto a recording medium 18 at a time by means of a second transfer unit 1E, and fixed to the recording medium 18 by means of a fixing unit 19 to form an image thereon. The second transfer unit 1E is so arranged that it can be in contact with or separate from the intermediate transferring belt 1F, and is allowed to abut the intermediate transferring belt 1F only during a transfer operation.

In an electrophotographic apparatus using a transfer drum, toner images of different colors are sequentially transferred onto a transfer material that has been attached to the transfer drum by static electricity. For this reason, there is a limitation for the transfer material in that images cannot be printed out on thick paper. In an electrophotographic apparatus using an intermediate transferring setup as shown in FIG. 12, by contrast, there are no limitations for the transfer material because different toner images are superimposed on the intermediate transferring belt 1F. This intermediate transferring setup is not limited to the electrophotographic apparatus shown in FIG. 12. It can be applied to a later-described electrophotographic apparatus shown in FIG. 13 (a specific example is shown in FIG. 14).

Figure 13:
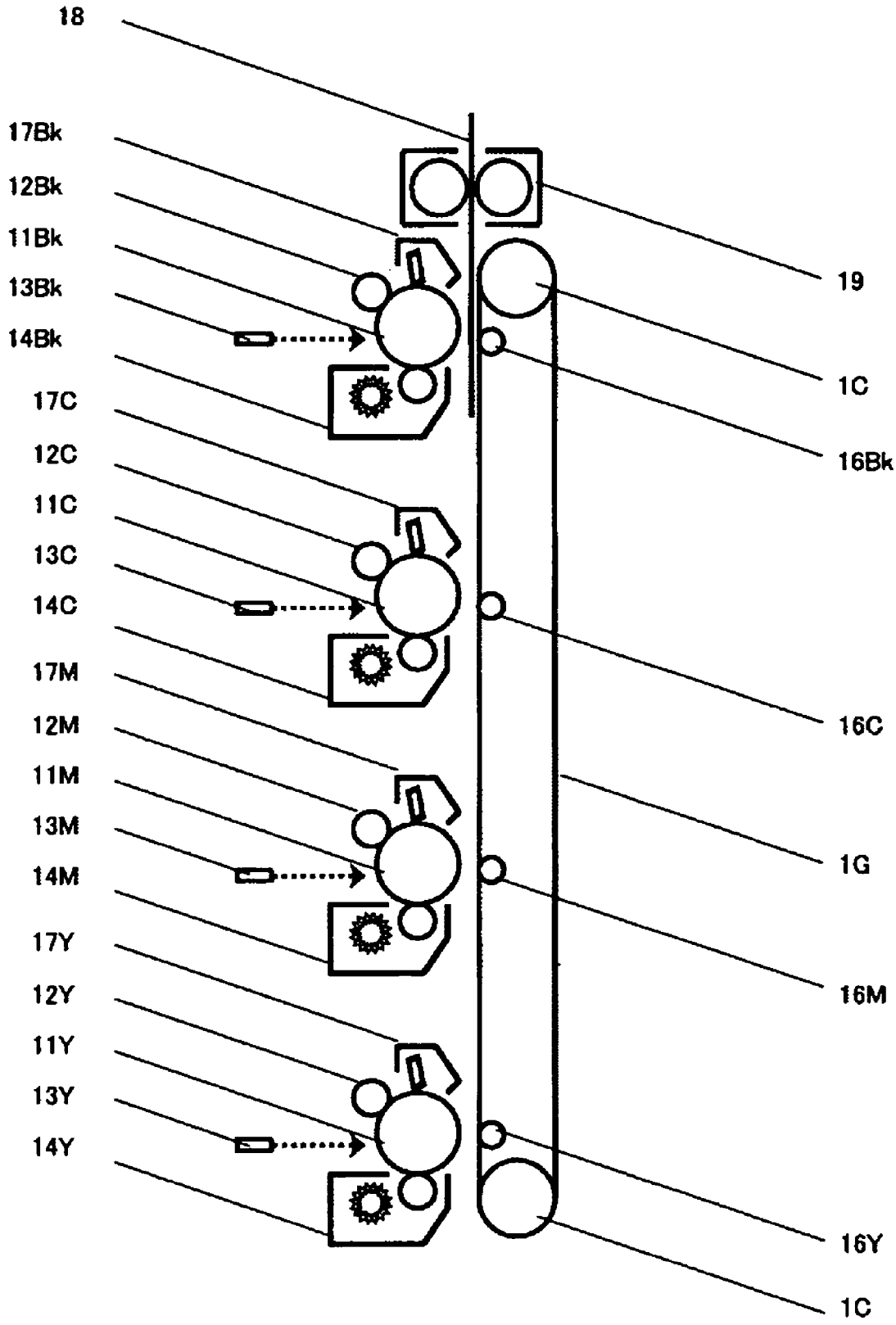
FIG. 13 is a schematic cross-sectional view of another example of the electrophotographic apparatus according to the present invention.
Figure 14:
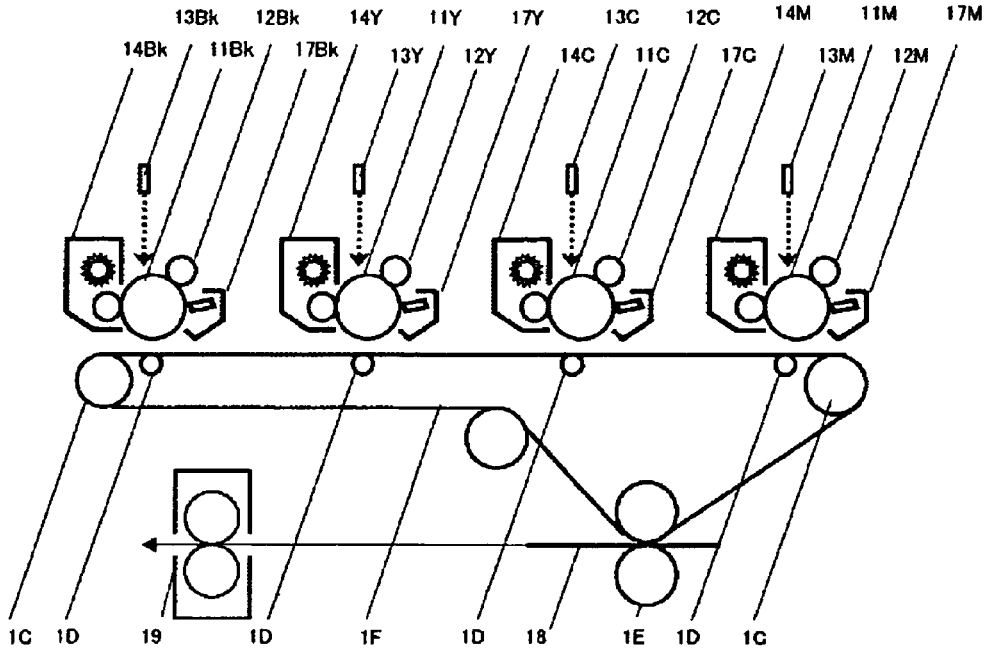
FIG. 14 is a schematic cross-sectional view of still another example of the electrophotographic apparatus according to the present invention.

FIG. 13 illustrates still another example of the electrophotographic apparatus of the present invention. This electrophotographic apparatus adopts toners of four different colors—yellow (Y), magenta (M), cyan (C), and black (Bk), and an image forming part is provided for each color. In addition, a photoconductor is provided for each color (i.e., photoconductors 11Y, 11M, 11C and 11Bk). The photoconductor used in the electrophotographic apparatus is a photoconductor that satisfies the requirements of the present invention. Charging units 12Y, 12M, 12C and 12Bk, exposure units (13Y, 13M, 13C and 13Bk), developing units (14Y, 14M, 14C and 14Bk), cleaning units (17Y, 17M, 17C. and 17Bk), etc., are arranged around the photoconductors 11Y, 11M, 11C and 11Bk, respectively. A transferring belt 1G, a transfer material bearing member that comes in contact with the transfer positions of the linearly arranged photoconductors 11Y, 11M, 11C and 11Bk, is wrapped around driving units 1C. Transfer units 16Y, 16M, 16C and 16Bk are arranged across the transferring belt 1G from the photoconductors 11Y, 11M, 11C and 11Bk at positions corresponding to their transfer positions.

(Process Cartridge)

Figure 7:
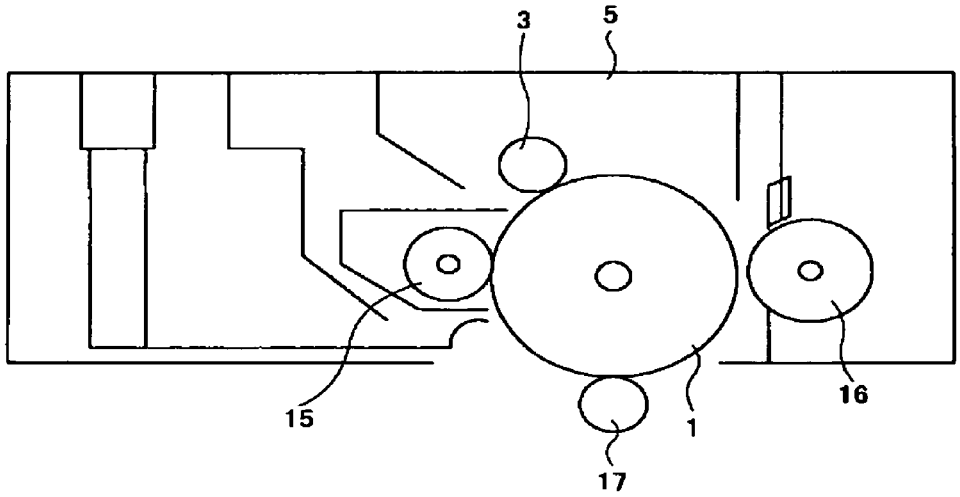
FIG. 7 shows an example of a general process cartridge.

The image forming units described above may be fixed inside a copier, a facsimile machine, or a printer, however, each may be incorporated in a form of a process cartridge. "Process cartridge" means a single device or component that incorporates therein a photoconductor and includes other units such as a charging unit, an exposure unit, a developing unit, a transferring unit, a cleaning unit, a charge removing unit, etc. There are a number of configurations (e.g., shape) for the process cartridge; a general example is shown in FIG. 7. The photoconductor 1 includes at least a specific under layer and photosensitive layer disposed on or over a conductive support, and the photosensitive layer contains a compound represented by the foregoing general formula (1).

The process cartridge of the present invention comprises an electrophotographic photoconductor for bearing a latent electrostatic image thereon, and a developing unit configured to develop the latent electrostatic image by use of a developer to form a visible image, and further comprises additional unit(s) selected on an as-needed basis.

The developing unit comprises a developer container for containing therein the toner or developer of the present invention, and a developer bearing member for bearing and transferring the toner of developer contained in the container. The developing unit may further comprise, for example, a thickness-regulating member for regulating the thickness of the toner layer carried by the bearing member.

Hereinafter, Examples of the present invention will be described, which however shall not be construed as limiting the invention thereto. Note that "part(s)" means "part(s) by mass" unless otherwise indicated.

SYNTHESIS EXAMPLE 1

-Synthesis of Compound 1-

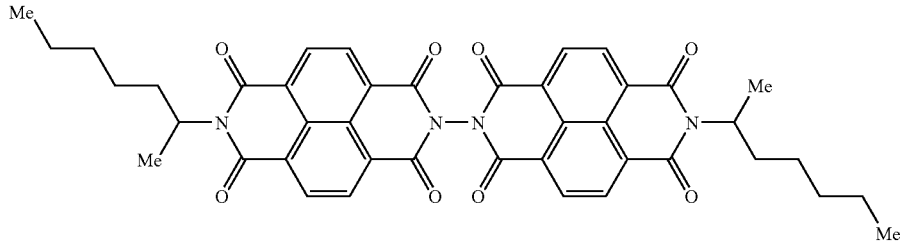

Structural Formula (2)

<First Step>

To a 200 ml four-neck flask was added 5.0 g (18.6 mmol) of 1,4,5,8-naphthalelentetracarboxylic acid dianhydride and 50 ml of DMF, and heated to reflux. A mixture of 2.14 g (18.6 mmol) of 2-aminoheptane and 25 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography, and the recovered product was re-crystallized using toluene/hexane to produce 2.14 g of Monoimide A (yield=31.5%).

(Second Step)

To a 100 ml four-necked flask was added 2.0 g (5.47 mmol) of Monoimide A, 0.137 g of (2.73 mmol) of hydrazine monohydrate, 10 mg of p-toluene sulfonic acid and 50 ml of toluene, and heated to reflux for 5 hours. Thereafter, the flask was cooled and the mixture was concentrated under vacuum. The resultant residue was subjected to silica gel column chromatography, and the recovered product was re-crystallized using toluene/ethyl acetate to produce 0.668 g of Compound 1 represented by the structural formula (2) (yield=33.7%). Identification of this product was made by Field Desorption Mass Spectroscopy (FD-MS), and it was revealed that the product was the compound of interest on the basis of the peak observed at M/z of 726. Elemental analysis of this compound was as follows: carbon=69.41%, hydrogen=5.27%, nitrogen=7.71% (calculated values) versus carbon=69.52%, hydrogen=5.09%, nitrogen=7.93% (found values).

SYNTHESIS EXAMPLE 2

<First Step>

To a 200 ml four-neck flask was added 10 g (37.3 mmol) of 1,4,5,8-naphthalelentetracarboxylic acid dianhydride, 0.931 g of (18.6 mmol) of hydrazine monohydrate, 20 mg of p-toluene sulfonic acid, and 100 ml of toluene, and heated to reflux for 5 hours. Thereafter, the flask was cooled and the mixture was concentrated under vacuum. The resultant residue was subjected to silica gel column chromatography, and the recovered product was re-crystallized using toluene/ethyl acetate to produce 2.84 g of Dimer C (yield=28.7%).

(Second Step)

To a 100 ml four-necked flask was added 2.5 g (4.67 mmol) of Dimer C and 30 ml of DMF, and heated to reflux. A mixture of 0.278 g (4.67 mmol) of 2-aminopropane and 10 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography to produce 0.556 g of Monoimide C (yield=38.5%).

(Third Step)

To a 50 ml four-necked flask was added 0.50 g (1.62 mmol) of Monoimide C and 10 ml of DMF, and heated to reflux. A mixture of 0.186 g (1.62 mmol) of 2-aminoheptane and 5 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography, and the recovered product was re-crystallized using toluene/hexane to produce 0.243 g of Compound 2 represented by the structural formula (3) (yield=22.4%). Identification of this product was made by Field Desorption Mass Spectroscopy (FD-MS), and it was revealed that the product was the compound of interest on the basis of the peak observed at M/z of 670. Elemental analysis of this compound was as follows: carbon=68.05%, hydrogen=4.51%, nitrogen=8.35% (calculated values) versus. carbon=68.29%, hydrogen=4.72%, nitrogen=8.33% (found values).

Structural Formula (3)

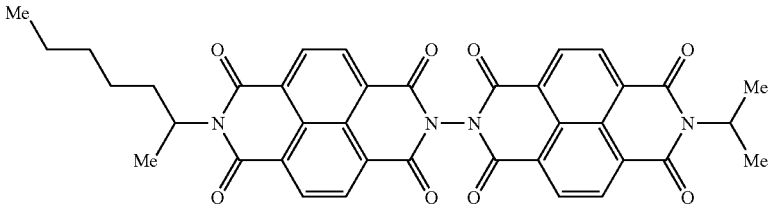

SYNTHESIS EXAMPLE 3

-Synthesis of Compound 3-

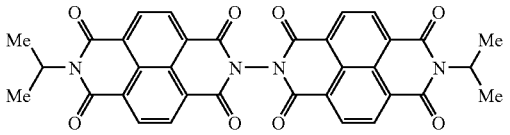

Structural Formula (4)

<First Step>

To a 200 ml four-neck flask was added 5.0 g (18.6 mmol) of 1,4,5,8-naphthalelentetracarboxylic acid dianhydride and 50 ml of DMF, and heated to reflux. A mixture of 1.10 g (18.6 mmol) of 2-aminopropane and 25 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography, and the recovered product was re-crystallized using toluene/hexane to produce 2.08 g of Monoimide B (yield=36.1%).

(Second Step)

To a 100 ml four-necked flask was added 2.0 g (6.47 mmol) of Monoimide B, 0.162 g of (3.23 mmol) of hydrazine monohydrate, 10 mg of p-toluene sulfonic acid, and 50 ml of toluene, and heated to reflux for 5 hours. Thereafter, the flask was cooled and the mixture was concentrated under vacuum. The resultant residue was subjected to silica gel column chromatography, and the recovered product was re-crystallized using toluene/ethyl acetate to produce 0.810 g of Compound 3 represented by the structural formula (4) (yield=37.4%). Identification of this product was made by Field Desorption Mass Spectroscopy (FD-MS), and it was revealed that the product was the compound of interest on the basis of the peak observed at M/z of 614. Elemental analysis of this compound was as follows: carbon=66.45%, hydrogen=3.61%, nitrogen=9.12% (calculated values) versus carbon=66.28%, hydrogen=3.45%, nitrogen=9.33% (found values).

SYNTHESIS EXAMPLE 4

-Synthesis of Compound 4-

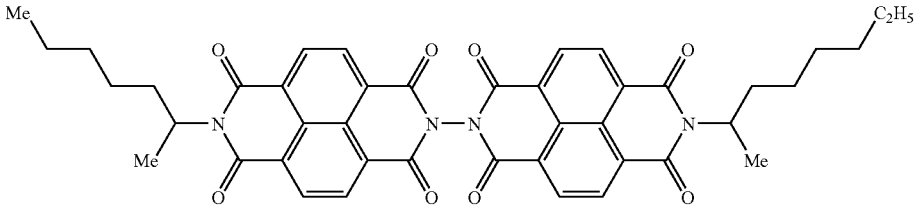

Structural Formula (5)

<First Step>

To a 200 ml four-neck flask was added 5.0 g (9.39 mmol) of Dimer C and 50 ml of DMF, and heated to reflux. A mixture of 1.08 g (9.39 mmol) of 2-aminoheptane and 25 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography to produce 1.66 g of Monoimide D (yield=28.1%).

(Second Step)

To a 100 ml four-necked flask was added 1.5 g (2.38 mmol) of Monoimide D and 50 ml of DMF, and heated to reflux. A mixture of 0.308 g (2.38 mmol) of 2-aminooctane and 10 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography, and the recovered product was re-crystallized using toluene/hexane to produce 0.328 g of Compound 4 represented by the structural formula (5) (yield=18.6%). Identification of this product was made by Field Desorption Mass Spectroscopy (FD-MS), and it was revealed that the product was the compound of interest on the basis of the peak observed at M/z of 740. Elemental analysis of this compound was as follows: carbon=69.72%, hydrogen=5.44%, nitrogen=7.56% (calculated values) versus carbon=69.55%, hydrogen=5.26%, nitrogen=7.33% (found values).

SYNTHESIS EXAMPLE 5

-Synthesis of Compound 5-

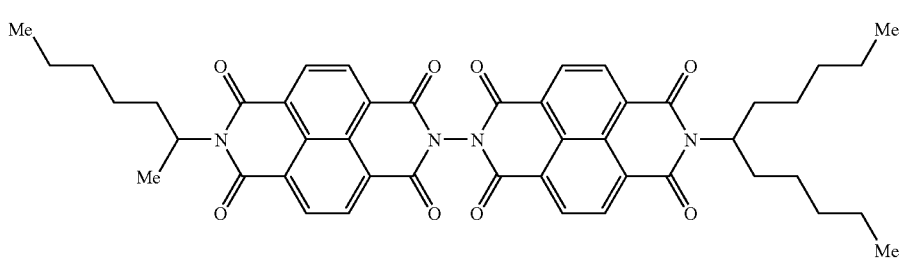

Structural Formula (6)

<First Step>

To a 200 ml four-neck flask was added 5.0 g (9.39 mmol) of Dimer C and 50 ml of DMF, and heated to reflux. A mixture of 1.08 g (9.39 mmol) of 2-aminoheptane and 25 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography to produce 1.66 g of Monoimide D (yield=28.1%).

(Second Step)

To a 100 ml four-necked flask was added 1.5 g (2.38 mmol) of Monoimide D and 50 ml of DMF, and heated to reflux. A mixture of 0.408 g (2.38 mmol) of 2-aminundecane and 10 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography, and the recovered product was re-crystallized using toluene/hexane to produce 0.276 g of Compound 5 represented by the structural formula (6) (yield=14.8%). Identification of this product was made by Field Desorption Mass Spectroscopy (FD-MS), and it was revealed that the product was the compound of interest on the basis of the peak observed at M/z of 782. Elemental analysis of this compound was as follows: carbon=70.57%, hydrogen=5.92%, nitrogen=7.16% (calculated values) versus carbon=70.77%, hydrogen=6.11%, nitrogen=7.02% (found values).

PIGMENT SYNTHESIS EXAMPLE 1

-Synthesis of Titanyl Phthalocyanine Crystal-

A pigment was prepared in accordance with the method disclosed in JP-A No.2001-19871. More specifically, 29.2 g of 1,3-diiminoisoindoline was mixed with 200 ml of sulfolane, and 20.4 g of titanium tetrabutoxide was added dropwise to the mixture under nitrogen flow. Thereafter, the resultant mixture was gradually heated to 180° C., allowing reaction to take place for 5 hours at 170° C. to 180° C. with agitation. After cooled down, the resulting precipitate was recovered by filtration, washed with chloroform until it became blue, washed with methanol for several times, washed with 80° C. hot water for several times, and dried to produce coarse titanyl phthalocyanine particles. The coarse titanyl phthalocyanine particles were dissolved in 20 volumes of concentrated sulfuric acid, and the resulting mixture was added dropwise to 100 volumes of ice water with agitation. The crystals thus precipitated were recovered by filtration and repeatedly washed with the same wash solution (ion-exchanged water, pH=7.0, specific conductivity=1.0 μS/cm) until the solution became neutral (Note: the ion-exchanged water after washing had a pH value of 7.0 and specific conductivity of 2.6 μS/cm). In this way a wet cake (aqueous paste) of a titanyl phthalocyanine pigment was obtained, and 40 g of the titanyl phthalocyanine pigment was dissolved into 200 g of tetrahydrofuran and agitated for 4 hours. The resultant product was recovered by filtration and dried to produce a titanyl phthalocyanine powder (hereinafter referred to as "Pigment 1").

The concentration of the solids of the wet cake was 15% by mass. A crystal conversion solvent was used in an amount 33 times the mass of the wet cake. Note that no halogen-containing compounds are used for the starting materials used in Pigment Synthesis Example 1.

Figure 9:
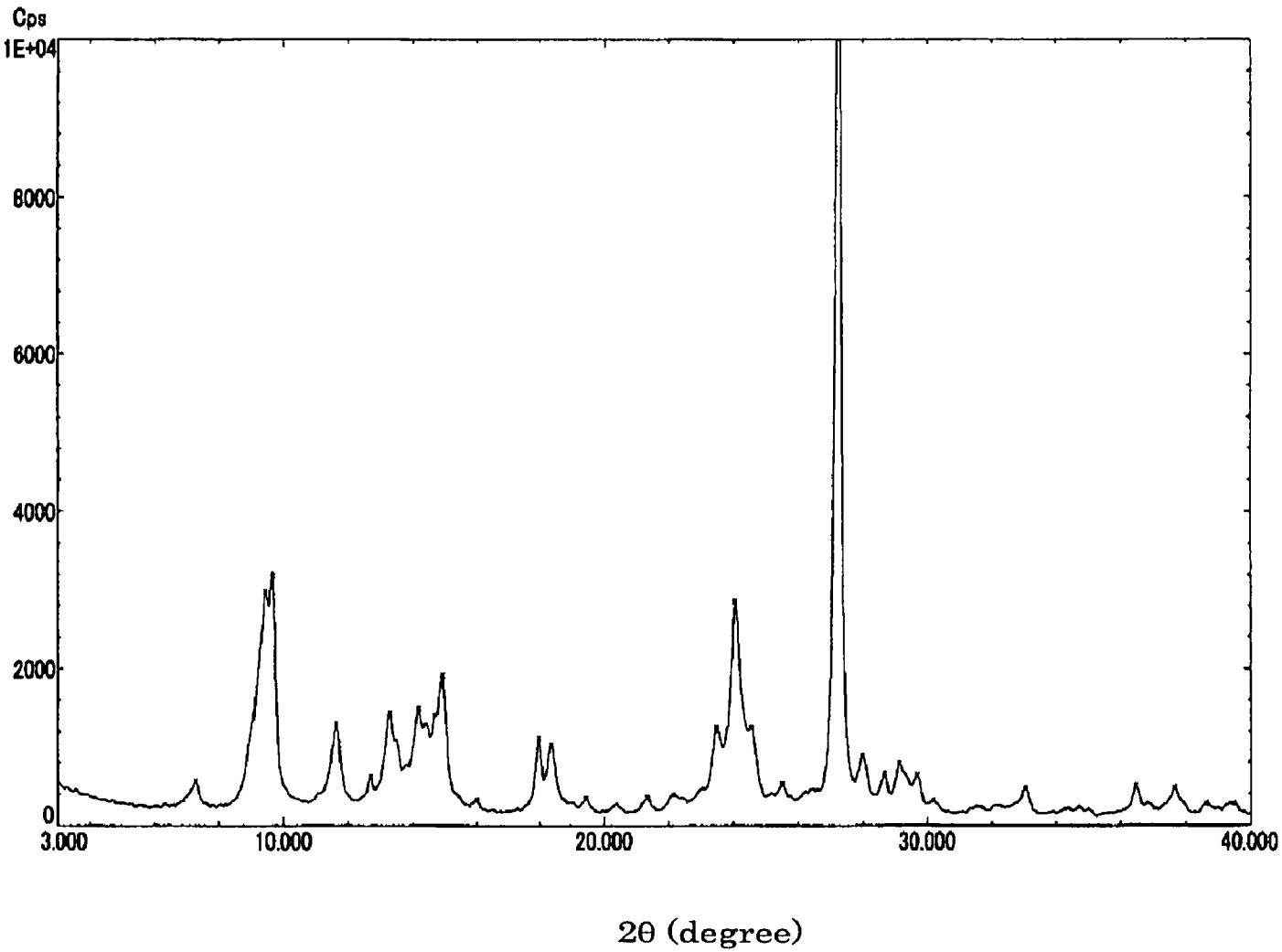
FIG. 9 shows an X-ray diffraction spectrum of Pigment 1, titanyl phthalocyanine powder, prepared in Pigment Synthesis Example 1.

The X ray-diffraction spectrum of the obtained titanyl phthalocyanine powder determined under the following condition revealed that the obtained titanyl phthalocyanine powder has a maximum peak at least at a Bragg angle 2θ(±0.2°) of 27.2°, a peak at the smallest Bragg angle 2θ(±0.2°) of 7.3°, and no peaks between 7.3° and 9.4° and at 26.3° in its X-ray diffraction spectrum for CuKα X-ray (wavelength=1.542 angstrom). The results are shown in FIG. 9.

Figure 10:
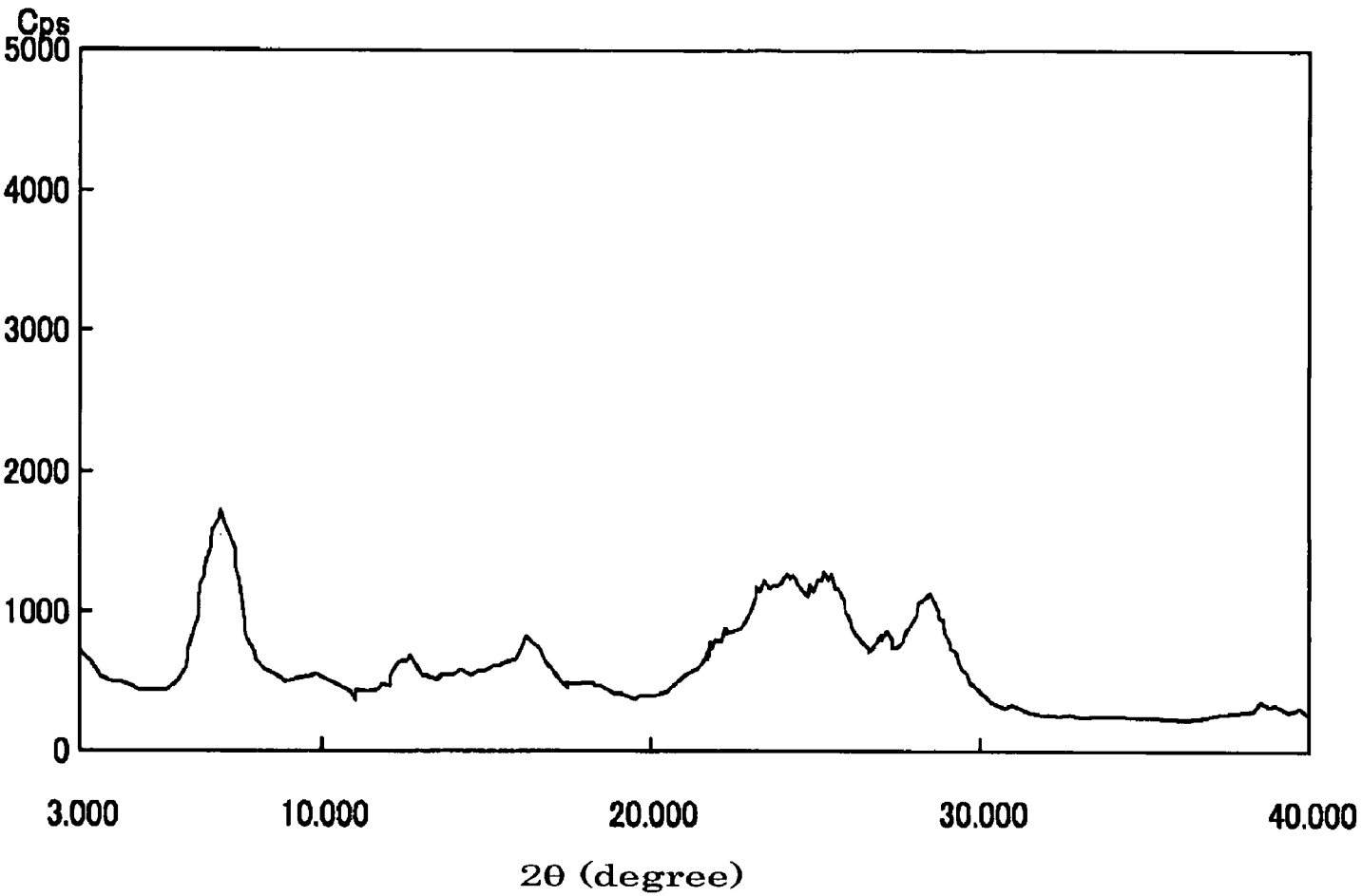
FIG. 10 shows an X-ray diffraction spectrum of low-crystalline titanyl phthalocyanine powder prepared in Pigment Synthesis Example 1.

An aliquot of the aqueous paste prepared in Pigment Synthesis Example 1 was dried for 2 days at 80° C. under reduced pressure (5 mmHg) to produce a low-crystallinity titanyl phthalocyanine powder. The X-ray diffraction spectrum of the dried powder of the aqueous paste is shown in FIG. 10.

<Measurement Condition for X-Ray Diffraction Spectrum>

X-ray lamp: Cu
Voltage: 50 kV
Current: 30 mA
Scan speed: 2°/min
Scan range: 3° to 40°
Time constant: 2 seconds

PIGMENT SYNTHESIS EXAMPLE 2

-Synthesis of Titanyl Phthalocyanine Crystal-

An aqueous paste of a titanyl phthalocyanine pigment was prepared in accordance with the method described in Pigment Synthesis Example 1, and subjected to crystal conversion in the manner described below to produce a titanyl phthanylcyanine crystal having primary particles smaller than those of the titanyl phthanylcyanine crystal prepared in Pigment Synthesis Example 1.

In accordance with Example 1 of JP-A No.2004-83859, 400 parts of tetrahydrofuran was added to 60 parts of the aqueous paste prepared in Pigment Synthesis Example 1, an aqueous paste of titanyl phthanylcyanine prior to crystal conversion, and vigorously stirred using a homomixer (MARKIIf, KENIS, Ltd.) at 2,000 rpm at room temperature until the color of the paste changed from navy blue to light blue (about 20 minutes after initiation of stirring), followed by immediate filtration under vacuum. The crystals on the filtration device were washed with tetrahydrofuran to produce a wet cake of the pigment. The wet cake was then dried for 2 days at 70° C. under reduced pressure (5 mmHg) to produce 8.5 parts of a titanyl phthalocyanine crystal (hereinafter referred to as "Pigment 2"). Note that no halogen-containing compounds are used for the starting materials used in Pigment Synthesis Example 2. The concentration of the solids of the wet cake was 15% by mass. A crystal conversion solvent was used in an amount 44 times the mass of the wet cake.

An aliquot of the aqueous paste of titanyl phthalocyanine prepared in Pigment Synthesis Example 1, an aqueous paste of titanyl phthanylcyanine prior to crystal conversion, was diluted with ion-exchanged water to a concentration of approximately 1% by mass, and scooped up with a conductivity-treated copper net, followed by measurement of particle diameter using a transmission electron microscope (TEM) (H-9000NAR, Hitachi, Ltd.) at a magnification of 75,000×. The average particle diameter was determined in the manner described above.

From a TEM picture of the observed TEM image, the size of the major axis of each of randomly selected 30 titanyl phthalocyanine particles (close to needle shape) was measured. The arithmetic average of the major axes of these 30 particles was then calculated, and defined as an average particle diameter. The average particle diameter of the aqueous paste prepared in Pigment Synthesis Example 1 calculated in this way was 0.06 μm.

Each of the crystal-converted titanyl phthalocyanine crystals prepared in Pigment Synthesis Examples 1 and 2 was diluted with tetrahydrofuran to a concentration of approximately 1% by mass, and observation of their particles was made as described above. The average particle diameter of each pigment is shown in Table 1.

TABLE 1

| | Average Particle Diameter (μm) | Remarks |
|---|---|---|
| Pigment Synthesis Example 1 (Pigment 1) | 0.31 | Large particles of 0.3-0.4 μm diameter are included |
| Pigment Synthesis Example 2 (Pigment 2) | 0.12 | Pigment's crystals are almost identical in size |

In the titanyl phthalocyanine crystals prepared in Pigment Synthesis Examples 1 and 2, not all of the crystals were identical in shape; there were triangle crystals and square crystals. For this reason, calculation was made using a maximum diagonal length of a crystal as its major axis.

The X-ray diffraction spectrum of Pigment 2 prepared in Pigment Synthesis Example 2 was determined in a manner similar to that described above. It was found that the X-ray diffraction spectrum of Pigment 2 was identical to that of Pigment 1 prepared in Pigment Synthesis Example 1.

EXAMPLE 1-1

An aluminum cylinder of 340 mm length and 30 mm diameter (JIS1050) was adopted as a conductive support, and the following coating solution for charge blocking layer, coating solution for moire preventing layer, coating solution for charge generating layer, and coating solution for charge transporting layer were sequentially applied on the conductive support and dried to produce a photoconductor provided with a charge blocking layer of 0.5 μm thickness, a moire preventing layer of 3.5 μm thickness, a charge generating layer of 0.3 μm thickness, and a charge transporting layer of 25 μm thickness (hereinafter referred to as "Photoconductor 1").

| <Coating solution for charge blocking layer> | |
|---|---|
| N-methoxymethylated nylon (FR101, Namariichi Co., Ltd.) | 5 Parts |
| Methanol | 70 Parts |
| n-Butanol | 30 Parts |

| <Coating solution for moire preventing layer> | |
|---|---|
| Titanium oxide (CR-EL, Ishihara Sangyo Kaisha, Ltd. Average particle diameter = 0.25 μm) | 84 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |
| Compound 1 prepared in Synthesis Example 1 | 1 Part |

A commercially available bead mill using PSZ balls of 0.5 mm diameter was adopted, and 2-butanone in which both polyvinyl butyral and Compound 1 are dissolved and the pigment were all placed in the bead mill, performing a dispersing operation for 30 minutes at a rotor speed of 1,200 rpm to prepare a dispersion.

| <Coating solution for charge transporting layer> | |
|---|---|
| Charge transporting substance represented by the following structural formula | 7 Parts |

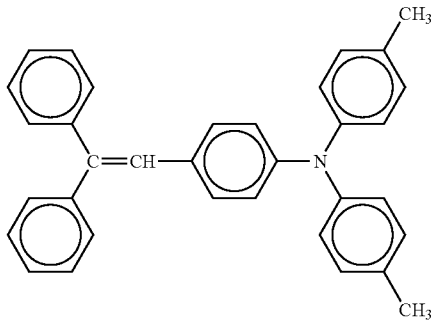

-continued

| <Coating solution for charge transporting layer> | |
|---|---|
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

EXAMPLE 1-2

A photoconductor was prepared in a manner similar to that described in Example 1-1, with the thickness of the charge blocking layer set to 0.3 μm (hereinafter referred to as "Photoconductor 2").

EXAMPLE 1-3

A photoconductor was prepared in a manner similar to that described in Example 1-1, with the thickness of the charge blocking layer set to 1.5 μm (hereinafter referred to as "Photoconductor 3").

EXAMPLE 1-4

A photoconductor was prepared in a manner similar to that described in Example 1-1, with the thickness of the charge blocking layer set to 4.0 μm (hereinafter referred to as "Photoconductor 4").

EXAMPLE 1-5

A photoconductor was prepared in a manner similar to that described in Example 1-1, with the thickness of the charge blocking layer set to 0.1 μm (hereinafter referred to as "Photoconductor 5").

EXAMPLE 1-6

A photoconductor was prepared in a manner similar to that described in Example 1-1, with ingredients to be contained in the coating solution for charge blocking layer changed to those shown below (hereinafter referred to as "Photoconductor 6").

| <Coating solution for charge blocking layer> | |
|---|---|
| Alcohol-soluble nylon (Amilan CM8000, Toray Industries, Inc.) | 4 Parts |
| Methanol | 70 Parts |
| n-Butanol | 30 Parts |

EXAMPLE 1-7

A photoconductor was prepared in a manner similar to that described in Example 1-1, with Compound 2 prepared in Synthesis Example 2 used instead of Compound 1 prepared in Synthesis Example 1 (hereinafter referred to as "Photoconductor 7").

EXAMPLE 1-8

A photoconductor was prepared in a manner similar to that described in Example 1-1, with Compound 3 prepared in Synthesis Example 3 used instead of Compound 1 prepared in Synthesis Example 1 (hereinafter referred to as "Photoconductor 8").

EXAMPLE 1-9

A photoconductor was prepared in a manner similar to that described in Example 1-1, with Pigment 2 used instead of Pigment 1 in the coating solution for photosensitive layer (hereinafter referred to as "Photoconductor 9").

COMPARATIVE EXAMPLE 1-1

A photoconductor was prepared in a manner similar to that described in Example 1-1, with no moire preventing layer being provided (hereinafter referred to as "Photoconductor 10").

COMPARATIVE EXAMPLE 1-2

A photoconductor was prepared in a manner similar to that described in Example 1-1, with no charge blocking layer being provided (hereinafter referred to as "Photoconductor 11").

COMPARATIVE EXAMPLE 1-3

A photoconductor was prepared in a manner similar to that described in Example 1-1, with Compound 1 prepared in Synthesis Example 1 not being used for the coating solution for charge generating layer (hereinafter referred to as "Photoconductor 12").

COMPARATIVE EXAMPLE 1-4

A photoconductor was prepared in a manner similar to that described in Example 1-1, with the compound represented by the following structural formula used instead of Compound 1 prepared in Synthesis Example 1 for the coating solution for charge generating layer (hereinafter referred to as "Photoconductor 13").

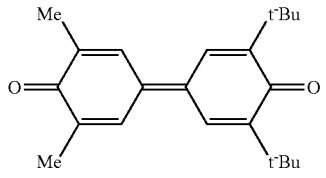

where Me represents methyl, and t-Bu represents t-butyl

COMPARATIVE EXAMPLE 1-5

A photoconductor was prepared in a manner similar to that described in Example 1-1, with the compound represented by the following structural formula used instead of Compound 1 prepared in Synthesis Example 1 for the coating solution for charge generating layer (hereinafter referred to as "Photoconductor 14").

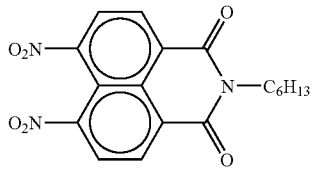

EXAMPLE 1-10

Photoconductor 1 prepared above was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 30,000-sheet continuous printing of an A4-size document was carried out that has uniformly distributed characters accounting for 6% of the entire front surface.

Photoconductor's surface potential (non-exposed part potential): −900V

Development bias: −650V

Exposed part surface potential at a development site: −120V

Evaluation was made by measuring the non-exposed part potential before and after 30,000-sheet continuous printing in the following manner: A surface electrometer was placed on the development site shown in FIG. 4, development bias was fixed such that Photoconductor 1 was charged to −900V at an initial state, and the non-exposed part surface potential at the development site was measured using the surface electrometer. The evaluation was made for the first and second rotations of the photoconductor to determine ΔVD—non-exposed part surface potential for the second rotation minus non-exposed part surface potential for the first rotation. In addition, a white solid image was printed out before and after the 30,000-sheet continuous printing for the evaluation of background smear on a scale of A to D, where A=excellent, B=good, C=bad, and D=poor. Furthermore, single-dot images were also printed out for the determination of the occurrence of a moire fringe. The results are shown in Table 1-1.

EXAMPLES 1-11 to 1-18, AND COMPARATIVE EXAMPLES 1-6 TO 1-10

Evaluations similar to that for Example 1-10 were made except that Photoconductors 2 to 14 were used instead of Photoconductor 1. The results are also shown in Table 1-1.

TABLE 1-1

| | | ΔVD(V) | | Background smear | | |
|---|---|---|---|---|---|---|
| | Photoconductor | Before printing | After 30,000-sheet printing | Before printing | After 30,000-sheet | Remarks |
| Ex. 1-10 | 1 | 0 | 20 | B to A | B | |
| Ex. 1-11 | 2 | 0 | 10 | B | B | |
| Ex. 1-12 | 3 | 0 | 30 | B to A | B to A | |
| Ex. 1-13 | 4 | 0 | 40 | A | A | |
| Ex. 1-14 | 5 | 0 | 0 | B | C to B | |
| Ex. 1-15 | 6 | 0 | 40 | B to A | B | |
| Ex. 1-16 | 7 | 0 | 25 | B to A | B | |
| Ex. 1-17 | 8 | 0 | 30 | B to A | B | |
| Ex. 1-18 | 9 | 0 | 20 | A | B to A | |
| Compara. Ex. 1-6 | 10 | 0 | 10 | B to A | B | Moire fringe occurred |
| Compara. Ex. 1-7 | 11 | 0 | 0 | B | D to C | |
| Compara. Ex. 1-8 | 12 | 0 | 120 | B to A | B | |
| Compara. Ex. 1-9 | 13 | 0 | 70 | B to A | B | |
| Compara. Ex. 1-10 | 14 | 0 | 90 | B to A | B | |

EXAMPLE 1-19

Photoconductor 1 thus prepared was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a contacting roller charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 30,000-sheet continuous printing of an A4-size document was carried out that has uniformly distributed characters accounting for 6% of the entire front surface.

Photoconductor's surface potential (non-exposed part potential): −700V

Development bias: −500V

Exposed part surface potential at a development site: −100V

Figure 11:
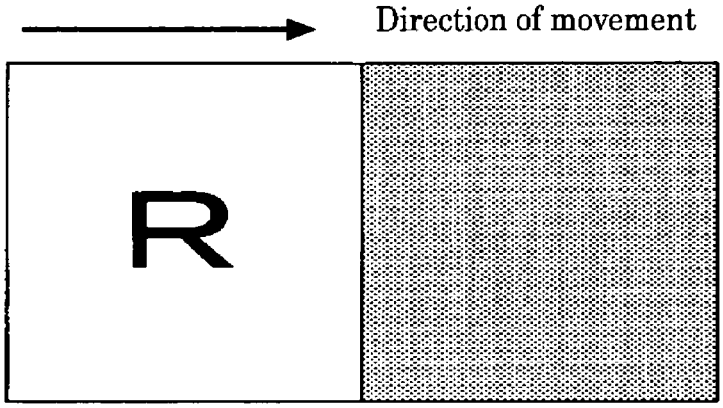
FIG. 11 is a view for explaining an image printed out from an image forming apparatus in, for example, Example 1-19.

An image shown in FIG. 11 was printed out before and after the 30,000-sheet continuous printing for the evaluation of the level of ghost image at the half-tone area on a scale of A to D, where A=excellent, B=good, C=bad, and D=poor.

A white solid image was printed out before and after the 30,000-sheet continuous printing for the evaluation of background smear on a scale of A to D, where A=excellent, B=good, C=bad, and D=poor.

Furthermore, the ISO/JIS-SCID N1 pattern (portrait) was printed out after the 30,000-sheet continuous printing for the evaluation of the color reproducibility on a scale of A to D, where A=excellent, B=good, C=bad; and D=poor.

EXAMPLES 1-20 to 1-27, AND COMPARATIVE EXAMPLES 1-11 TO 1-15

Evaluations similar to that for Example 1-19 were made except that Photoconductors 2 to 14 were used instead of Photoconductor 1. The results are also shown in Table 1-2.

TABLE 1-2

| | | Ghost image | | Background smear | | | |
|---|---|---|---|---|---|---|---|
| | Photoconductor | Before printing | After 30,000-sheet printing | Before printing | After 30,000-sheet printing | Color balance | Remarks |
| Ex. 1-19 | 1 | A | B | B to A | B | B | |
| Ex. 1-20 | 2 | A | B to A | B | B | B to A | |
| Ex. 1-21 | 3 | A | B | B to A | B to A | B | |
| Ex. 1-22 | 4 | A | C to B | A | A | C to B | |
| Ex. 1-23 | 5 | A | B to A | B | C to B | B to A | |
| Ex. 1-24 | 6 | A | C to B | B to A | B | C to B | |
| Ex. 1-25 | 7 | A | B | B to A | B | B | |
| Ex. 1-26 | 8 | A | B | B to A | B | B | |
| Ex. 1-27 | 9 | A | B to A | A | B to A | B | |
| Compara. Ex. 1-11 | 10 | A | C to B | B to A | B | C to B | Moire fringe occurred |
| Compara. Ex. 1-12 | 11 | A | B to A | B | D to C | B to A | |
| Compara. Ex. 1-13 | 12 | A | D to C | B to A | B | D to C | |
| Compara. Ex. 1-14 | 13 | A | C | B to A | B | C | |
| Compara. Ex. 1-15 | 14 | A | C | B to A | B | C | |

As has been specifically described above, by using an electrophotographic photoconductor that includes at least an under layer and a photosensitive layer wherein the under layer is composed of a charge blocking layer and a moire preventing layer and wherein the photosensitive layer contains a compound (electron transporting agent) represented by the foregoing general formula (1), it is made possible to provide an electrophotographic photoconductor that generates minimum abnormal images and features small variations in electrostatic characteristics after repetitive use of an image forming apparatus and/or under different usage environments.

In addition, this electrophotographic photoconductor can provide an image forming apparatus and full-color image forming apparatus that can also achieve stable image output, and a very easy-to-use process cartridge.

EXAMPLE 2-1

An aluminum cylinder of 340 mm length and 30 mm diameter (JIS1050) was adopted as a conductive support, and the following coating solution for intermediate layer, coating solution for charge generating layer and coating solution for charge transporting layer were sequentially applied on the conductive support and dried to produce a photoconductor provided with an intermediate layer of 3.5 μm thickness, a charge generating layer of 0.3 μm thickness, and a charge transporting layer of 20 μm thickness. Moreover, a protective layer of 5 μm thickness is arranged on the charge transporting layer through the procedure described below (this photoconductor will be referred to as "Photoconductor 1").

| <Coating solution for intermediate layer> | |
|---|---|
| Titanium oxide (CR-EL, Ishihara Sangyo Kaisha, Ltd. Average particle diameter = 0.25 μm) | 84 Parts |
| Alkyd resin (BEKKOLITE M6401-50-S, Dainippon Ink & Chemicals, Inc., solid content = 50%) | 33.6 Parts |

-continued

| <Coating solution for intermediate layer> | |
|---|---|
| Melamine resin (SUPER BEKKAMIN L-121-60, Dainippon Ink & Chemicals, Inc., solid content = 60%) | 18.7 Parts |
| 2-Butanone | 100 Parts |

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |
| Compound 1 prepared in Synthesis Example 1 | 1 Part |

A commercially available bead mill using PSZ balls of 0.5 mm diameter was adopted, and 2-butanone in which both polyvinyl butyral and Compound 1 are dissolved and the pigment were all placed in the bead mill, performing a dispersing operation for 30 minutes at a rotor speed of 1,200 rpm to prepare a dispersion.

| <Coating solution for charge transporting layer> | |
|---|---|
| Charge transporting substance represented by the following structural formula | 7 Parts |

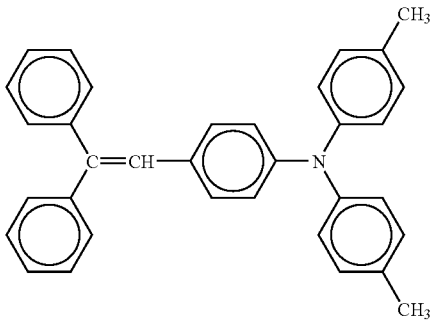

| | |
|---|---|
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

| <Coating solution for protective layer > | |
|---|---|
| Radically polymerizable monomer that bears three or more functional groups and has no charge transporting structure (Trimethylolpropane triacrylate: molecular weight = 296, a trifunctional compound, molecular weight-to-number of functional group ratio = 99, (KAYARAD TMPTA, Nippon Kayaku Co., Ltd.)) | 10 Parts |
| Radically polymerizable compound represented by the following structural formula, which bears one functional group and has a charge transporting structure | 10 Parts |

(Compound No. 54)

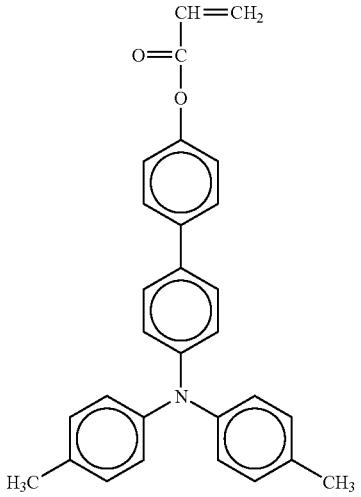

-continued

| <Coating solution for protective layer > | |
|---|---|
| Photoinitiator 1: 1-hydroxycyclohexylphenylketone (Irgacure 184, Chiba Specialty Chemicals Co., Ltd.) | 1 Part |
| Tetrahydrofuran | 100 Parts |

The protective layer was prepared by applying the coating solution onto the photoconductor by spray coating, allowing the solution to dry naturally for 20 minutes, and irradiating the photoconductor with light under the following condition: metal halide lamp=160 W/cm, exposure intensity=500 mW/cm$^2$, and exposure time=60 seconds.

EXAMPLE 2-2

A photoconductor was prepared in a manner similar to that described in Example 2-1, with the intermediate layer changed to one composed of a charge blocking layer and a moire preventing layer (hereinafter referred to as "Photoconductor 2"). A charge blocking layer of 0.5 μm thickness and a moire preventing layer of 3.5 μm thickness were formed by applying their coating solutions containing the following ingredients onto the photoconductor, followed by drying.

| <Coating solution for charge blocking layer> | |
|---|---|
| N-methoxymethylated nylon (FR101, Namariichi Co., Ltd.) | 5 Parts |
| Methanol | 70 Parts |
| n-Butanol | 30 Parts |

| <Coating solution for moire preventing layer> | |
|---|---|
| Titanium oxide (CR-EL, Ishihara Sangyo Kaisha, Ltd. Average particle diameter = 0.25 μm) | 126 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

EXAMPLE 2-3

A photoconductor was prepared in a manner similar to that described in Example 2-2, with ingredients for the coating solutions for charge generating layer and charge blocking layer changed to those described below (hereinafter referred to as "Photoconductor 3").

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |

A commercially available bead mill using PSZ balls of 0.5 mm diameter was adopted, and 2-butanone in which polyvinyl butyral is dissolved and the pigment were all placed in the bead mill, performing a dispersing operation for 30 minutes at a rotor speed of 1,200 rpm to prepare a dispersion.

| <Coating solution for charge blocking layer> | |
|---|---|
| N-methoxymethylated nylon (FR101, Namariichi Co., Ltd.) | 5 Parts |
| Compound 1 prepared in Synthesis Example 1 | 1 Part |
| Methanol | 70 Parts |
| n-Butanol | 30 Parts |

EXAMPLE 2-4

A photoconductor was prepared in a manner similar to that described in Example 2-3, with Compound 1 prepared in Synthesis Example 1 changed to Compound 2 prepared in Synthesis Example 2 (hereinafter referred to as "Photoconductor 4").

EXAMPLE 2-5

A photoconductor was prepared in a manner similar to that described in Example 2-3, with Compound 1 prepared in Synthesis Example 1 changed to Compound 3 prepared in Synthesis Example 3 (hereinafter referred to as "Photoconductor 5").

EXAMPLE 2-6

A photoconductor was prepared in a manner similar to that described in Example 2-3, with Compound 1 prepared in Synthesis Example 1 changed to Compound 4 prepared in Synthesis Example 4 (hereinafter referred to as "Photoconductor 6").

EXAMPLE 2-7

A photoconductor was prepared in a manner similar to that described in Example 2-3, with Compound 1 prepared in Synthesis Example 1 changed to Compound 5 prepared in Synthesis Example 5 (hereinafter referred to as "Photoconductor 7")

EXAMPLE 2-8

A photoconductor was prepared in a manner similar to that described in Example 2-1, with the coating solution for charge transporting layer changed to that described below (hereinafter referred to as "Photoconductor 8").

| <Coating solution for charge transporting layer> | |
|---|---|
| High-molecular charge transporting substance represented by the following structural formula (weight-average molecular weight = 140,000) | 17 Parts |
| Tetrahydrofuran | 150 Parts |
| Silicone oil (KF50-100CS, Shin-Etsu Chemical Co., Ltd.) | 0.01 Part |

EXAMPLE 2-9

A photoconductor was prepared in a manner similar to that described in Example 2-1, with Pigment 2 used instead of Pigment 1 (hereinafter referred to as "Photoconductor 9").

EXAMPLE 2-10

An aluminum cylinder of 340 mm length and 30 mm diameter (JIS1050) was adopted as a conductive support, and the following coating solution for photosensitive layer was applied thereon and dried for 20 minutes at 120° C. to form a photosensitive layer of 25 μm thickness. In addition, a protective layer of 5 μm thickness was formed. In this way a photoconductor was fabricated (hereinafter referred to as "Photoconductor 10").

| <Dispersion> | |
|---|---|
| Titanyl phthalocyanine pigment prepared in Pigment Synthesis Example 1 | 3 Parts |
| Cyclohexanone | 97 Parts |

Titanyl phthalocyanine pigment was dispersed in cyclohexanone in a glass pot provided with PSZ balls of 0.5 mm diameter for 5 hours at 100 rpm to prepare a dispersion.

<Coating Solution for Photosensitive Layer>

Using the dispersion prepared above, a coating solution for photosensitive layer with the following ingredients was prepared.

| | |
|---|---|
| The foregoing dispersion | 60 Parts |
| Charge transporting substance represented by the following structural formula | 25 Parts |

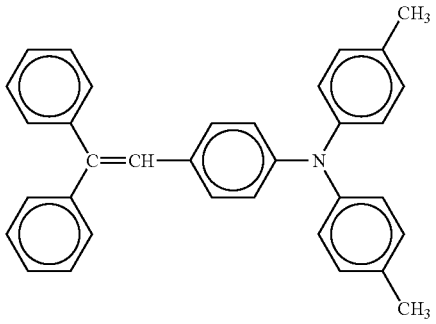

| | |
|---|---|
| Compound 1 prepared in Synthesis Example 1 | 25 Parts |
| Z-polycarbonate resin (PANLITE TS2040, Teijin Chemicals, Ltd.) | 50 Parts |
| Silicone oil (KF50-100CS, Shin-Etsu Chemical Co., Ltd.) | 0.01 Part |
| Tetrahydrofuran | 350 Parts |

| <Coating solution for protective layer> | |
|---|---|
| Radically polymerizable monomer that bears three or more functional groups and has no charge transporting structure (Trimethylolpropane triacrylate: molecular weight = 296, a trifunctional compound, molecular weight-to-number of functional group ratio = 99, (KAYARAD TMPTA, Nippon Kayaku Co., Ltd.)) | 10 Parts |
| Radically polymerizable compound represented by the following structural formula, which bears one functional group and has a charge transporting structure | 10 Parts |

-continued

<Coating solution for protective layer>

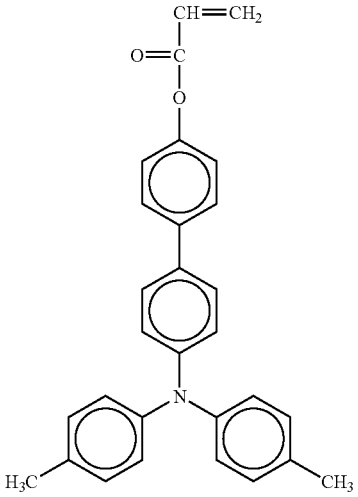

(Compound No.54)

| | |
|---|---|
| Photoinitiator 1: 1-hydroxycyclohexylphenylketone (Irgacure 184, Chiba Specialty Chemicals Co., Ltd.) | 1 Part |
| Tetrahydrofuran | 100 Parts |

The protective layer was prepared by applying the coating solution onto the photoconductor by spray coating, allowing the solution to dry naturally for 20 minutes, and irradiating the photoconductor with light under the following condition: metal halide lamp=160 W/cm, exposure intensity=500 mW/cm$^2$, and exposure time=60 seconds.

COMPARATIVE EXAMPLE 2-1

A photoconductor was prepared in a manner similar to that described in Example 2-1, with no protective layer provided on the photoconductor (hereinafter referred to as "Photoconductor 11").

COMPARATIVE EXAMPLE 2-2

A photoconductor was prepared in a manner similar to that described in Example 2-1, with Compound 1 prepared in Synthesis Example 1 not being used (hereinafter referred to as "Photoconductor 12").

COMPARATIVE EXAMPLE 2-3

A photoconductor was prepared in a manner similar to that described in Example 2-3, with the compound represented by the following structural formula used instead of Compound 1 prepared in Synthesis Example 1 (hereinafter referred to as "Photoconductor 13").

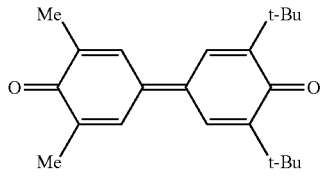

COMPARATIVE EXAMPLE 2-4

A photoconductor was prepared in a manner similar to that described in Example 2-3, with the compound represented by the following structural formula used instead of Compound 1 prepared in Synthesis Example 1 (hereinafter referred to as "Photoconductor 14").

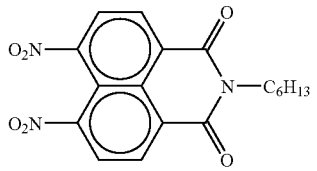

EXAMPLE 2-11

Photoconductor 1 prepared above was attached to a process cartridge like that shown in FIG. 7, and the process cartridge was attached to an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 50,000-sheet continuous printing of an A4-size document was carried out that has uniformly distributed characters accounting for 6% of the entire front surface.

Photoconductor's surface potential (non-exposed part potential): −900V

Development bias: −650V

Exposed-part surface potential at a development site: −100V

Evaluation was made by measuring the non-exposed part potential before and after the 50,000-sheet continuous printing in the following manner: A surface electrometer was placed on the development site shown in FIG. 4, development bias was fixed such that Photoconductor 1 was charged to −900V at an initial state, and the non-exposed part surface potential at the development site was measured using the surface electrometer. The evaluation was made for the first and second rotations of the photoconductor to determine ΔVD—non-exposed part surface potential for the second rotation minus non-exposed part surface potential for the first rotation.

The exposed part potential was also measured before and after the 50,000-sheet continuous printing in the following manner: A surface electrometer was placed on the development site shown in FIG. 4, development bias was fixed such that Photoconductor 1 was charged to −900V at an initial state, and the exposed part surface potential at the development site was measured using the surface electrometer.

Furthermore, a white solid image was printed out after the 50,000-sheet continuous printing to evaluate background smear on a scale of A to D, where A=excellent, B=good, C=bad, and D=poor.

The difference in the thickness of the photoconductor before and after this test, i.e., the wear volume of the photoconductor, was evaluated. Herein, the photoconductor thickness is the average of the photoconductor thicknesses measured at 1 cm intervals along its longitudinal direction, excluding 5 cm from each end.

The results are shown in Table 2-1.

EXAMPLES 2-12 to 2-20, AND COMPARATIVE EXAMPLES 2-5 TO 2-8

Evaluations similar to that for Example 2-11 were made except that Photoconductors 2 to 14 were used instead of Photoconductor 1. The results are also shown in Table 2-1.

TABLE 2-1

| | | ΔVD(−V) | | Exposed part potential (−V) | | | |
|---|---|---|---|---|---|---|---|
| | Photoconductor | Before printing | After 50,000-sheet printing | Before printing | After 50,000-sheet printing | Bakcground smear | Wear volume (μm) |
| Ex. 2-11 | 1 | 0 | 30 | 100 | 120 | B to A | 1.7 |
| Ex. 2-12 | 2 | 0 | 40 | 110 | 135 | A | 1.8 |
| Ex. 2-13 | 3 | 0 | 25 | 110 | 130 | A | 1.7 |
| Ex. 2-14 | 4 | 0 | 35 | 115 | 140 | B to A | 1.8 |
| Ex. 2-15 | 5 | 0 | 35 | 115 | 140 | B to A | 1.7 |
| Ex. 2-16 | 6 | 0 | 25 | 110 | 125 | A | 1.8 |
| Ex. 2-17 | 7 | 0 | 30 | 115 | 135 | A | 1.8 |
| Ex. 2-18 | 8 | 0 | 30 | 100 | 115 | A | 1.8 |
| Ex. 2-19 | 9 | 0 | 30 | 90 | 110 | A | 1.7 |
| Ex. 2-20 | 10 | 0 | 30 | 105 | 115 | A | 1.7 |
| Compara. Ex. 2-5 | 11 | 0 | 10 | 100 | 115 | D | 8.0 |
| Compara. Ex. 2-6 | 12 | 0 | 120 | 100 | 130 | B | 1.7 |
| Compara. Ex. 2-7 | 13 | 0 | 80 | 100 | 140 | B | 1.8 |
| Compara. Ex. 2-8 | 14 | 0 | 100 | 100 | 145 | B | 1.7 |

EXAMPLE 2-21

Photoconductor 1 prepared above was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 50,000-sheet continuous printing of an A4-size document was carried out that has uniformly distributed characters accounting for 6% of the entire front surface.

Photoconductor's surface potential (non-exposed part potential): −700V

Development bias: −500V

Exposed part surface potential at a development site: −100V

An image shown in FIG. 11 was printed out before and after the 50,000-sheet continuous printing for the evaluation of the level of ghost image at the half-tone area on a scale of A to D, where A=excellent, B=good, C=bad, and D=poor.

A white solid image was printed out before and after the 50,000-sheet continuous printing for the evaluation of background smear on a scale of A to D, where A=excellent, B=good, C=bad, and D=poor.

Furthermore, the ISO/JIS-SCID N1 pattern (portrait) was printed out after the 50,000-sheet continuous printing for the evaluation of the color reproducibility on a scale of A to D, where A=excellent, B=good, C=bad, and D=poor.

The results are shown in Table 2-2.

EXAMPLES 2-22 to 2-30, AND COMPARATIVE EXAMPLES 2-9 TO 2-12

Evaluations similar to that for Example 2-21 were made except that Photoconductors 2 to 14 were used instead of Photoconductor 1. The results are also shown in Table 2-2.

TABLE 2-2

| | | Ghost image | | Background smear | | |
|---|---|---|---|---|---|---|
| | Photo-conductor | Before printing | After 50,000-sheet printing | Before printing | After 50,000-sheet printing | Color balance |
| Ex. 2-21 | 1 | A | B to A | A | B to A | B to A |
| Ex. 2-22 | 2 | A | B | A | A | B |
| Ex. 2-23 | 3 | A | A | A | A | A |
| Ex. 2-24 | 4 | A | B to A | A | B to A | B to A |
| Ex. 2-25 | 5 | A | B to A | A | B to A | B to A |
| Ex. 2-26 | 6 | A | A | A | A | A |
| Ex. 2-27 | 7 | A | A | A | A | A |
| Ex. 2-28 | 8 | A | B to A | A | A | A |
| Ex. 2-29 | 9 | A | B to A | A | A | A |
| Ex. 2-30 | 10 | A | B to A | A | B to A | B to A |
| Compara. Ex. 2-9 | 11 | A | A | B to A | D | D to C |
| Compara. Ex. 2-10 | 12 | A | D | A | B | D |
| Compara. Ex. 2-11 | 13 | A | D to C | A | B | D to C |
| Compara. Ex. 2-12 | 14 | A | D to C | A | B | D to C |

It can be learned that Photoconductors 1 to 10 of the present invention offered stable electrostatic characteristics and excellent image characteristics (e.g., background smear, ghost image, and color balance) even after a long time endurance test. That is, photoconductors that can offer excellent electrophotographic characteristics and wear resistance over a long period time were provided. By contrast, the wear volume of Photoconductor 11 that has no protective layer was large, and the electrostatic characteristics and image characteristics of Photoconductors 12 to 14, neither of which contain a compound represented by the foregoing general formula (1), failed to last for a long period of time.

It has therefore been established that it is possible to provide a photoconductor that can ensure high durability, stable electrical characteristics and long-term output of high-quality images, by using a photoconductor that includes a conductive support, and at least a photosensitive layer and a surface protective layer disposed on or over the conductive support, wherein the photosensitive layer contains a compound represented by the foregoing general formula (1) and wherein the surface protective layer is one obtained by curing a radically polymerizable compound that bears three or more functional groups and has no charge transporting structure and a radically polymerizable compound that bears one functional group and has a charge transporting structure, and that an image forming process, image forming apparatus and process cartridge that use the photoconductor of the present invention are of high performance and high reliability.

EXAMPLE 3-1

An aluminum cylinder of 340 mm length and 30 mm diameter (JIS1050) was adopted as a conductive support, and the following coating solution for conductive layer, coating solution for barrier layer, and coating solution for photosensitive layer were sequentially applied on the conductive support and dried to produce a photoconductor provided with a conductive layer of 10 μm thickness, a barrier layer of 0.5 μm thickness, and photosensitive layer of 20 μm thickness (hereinafter referred to as "Photoconductor 1").

| <Coating solution for conductive layer> | |
|---|---|
| Tin oxide-antimony oxide powder (specific resistance = $10^6$ Ω × cm, average primary particle diameter = 0.4 μm) | 140 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

| <Coating solution for barrier layer> | |
|---|---|
| N-methoxymethylated nylon (FR101, Namariichi Co., Ltd.) | 5 Parts |
| Methanol | 70 Parts |
| n-Butanol | 30 Parts |

<Coating Solution for Photosensitive Layer>

As a charge generating substance, 30 parts of Pigment 1 was dispersed into 970 parts of cyclohexanone using a ball mill for 2 hours to prepare a dispersion of charge generating substance. Separately, 49 parts of Z-polycarbonate resin (viscosity-average molecular weight=40,000, Teijin Chemicals, Ltd.), 20 parts of Compound 1 prepared in Synthesis Example 1, 29.5 parts of the compound represented by the following structural formula, and 0.1 part of silicone oil (KF50-100CS, Shin-Etsu Chemical Co., Ltd.) were dissolved into 340 parts of tetrahydrofuran. To the resultant mixture was added 66.6 parts of the foregoing dispersion of charge generating substance, and stirred to prepare a coating solution for photosensitive layer.

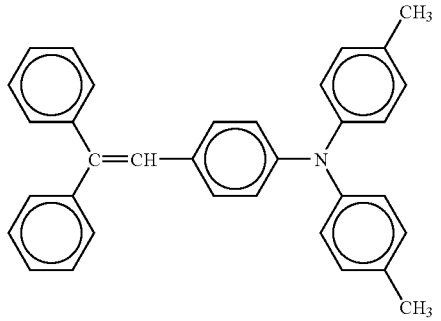

EXAMPLE 3-2

A photoconductor was prepared in a manner similar to that described in Example 3-1, with the thickness of the barrier layer set to 0.3 μm (hereinafter referred to as "Photoconductor 2").

EXAMPLE 3-3

A photoconductor was prepared in a manner similar to that described in Example 3-1, with the thickness of the barrier layer set to 1.5 μm (hereinafter referred to as "Photoconductor 3").

EXAMPLE 3-4

A photoconductor was prepared in a manner similar to. that described in Example 3-1, with the thickness of the barrier layer set to 4.0 μm (hereinafter referred to as "Photoconductor 4").

EXAMPLE 3-5

A photoconductor was prepared in a manner similar to that described in Example 3-1, with the thickness of the barrier layer set to 0.1 μm (hereinafter referred to as "Photoconductor 5").

EXAMPLE 3-6

A photoconductor was prepared in a manner similar to that described in Example 3-1, with ingredients for the coating solution for barrier layer changed to those described below (hereinafter referred to as "Photoconductor 6").

| <Coating solution for barrier layer> | |
|---|---|
| Alcohol-soluble nylon (Amilan CM8000, Toray Industries, Inc.) | 4 Parts |
| Methanol | 70 Parts |
| n-Butanol | 30 Parts |

EXAMPLE 3-7

A photoconductor was prepared in a manner similar to that described in Example 3-1, with Compound 2 prepared in Synthesis Example 2 used instead of Compound 1 prepared in Synthesis Example 1 (hereinafter referred to as "Photoconductor 7").

EXAMPLE 3-8

A photoconductor was prepared in a manner similar to that described in Example 3-1, with Compound 3 prepared in Synthesis Example 3 used instead of Compound 1 prepared in Synthesis Example 1 (hereinafter referred to as "Photoconductor 8").

EXAMPLE 3-9

A photoconductor was prepared in a manner similar to that described in Example 3-1, with Pigment 2 used instead of Pigment 1 for the coating solution for photosensitive layer (hereinafter referred to as "Photoconductor 9").

COMPARATIVE EXAMPLE 3-1

A photoconductor was prepared in a manner similar to that described in Example 3-1, with no conductive layer being provided (hereinafter referred to as "Photoconductor 10").

COMPARATIVE EXAMPLE 3-2

A photoconductor was prepared in a manner similar to that described in Example 3-1, with no barrier layer being provided (hereinafter referred to as "Photoconductor 11").

COMPARATIVE EXAMPLE 3-3

A photoconductor was prepared in a manner similar to that described in Example 3-1, with Compound 1 (Charge Transporting Agent 1) not being used for the coating solution for photosensitive layer (hereinafter referred to as "Photoconductor 12").

COMPARATIVE EXAMPLE 3-4

A photoconductor was prepared in a manner similar to that described in Example 3-1, with the compound represented by the following structural formula used instead of Compound 1 (hereinafter referred to as "Photoconductor 13").

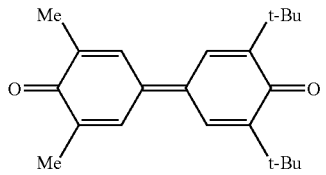

COMPARATIVE EXAMPLE 3-5

A photoconductor was prepared in a manner similar to that described in Example 3-1, with the compound represented by the following structural formula used instead of Compound 1 (hereinafter referred to as "Photoconductor 14").

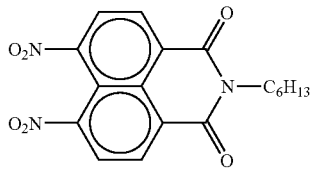

EXAMPLE 3-10

An aluminum cylinder of 340 mm length and 30 mm diameter (JIS1050) was adopted as a conductive support, and the following coating solution for conductive layer, coating solution for barrier layer, coating solution for charge generating layer, and coating solution for charge transporting layer were sequentially applied on the conductive support and dried to produce a photoconductor provided with a conductive layer of 10 μm thickness, a barrier layer of 0.5 μm thickness, a charge generating layer of 0.3 μm thickness, and a charge transporting layer of 20 μm thickness (hereinafter referred to as "Photoconductor 15").

| <Coating solution for conductive layer> | |
|---|---|
| Tin oxide-antimony oxide powder (specific resistance = $10^6$ Ω × cm, average primary particle diameter = 0.4 μm) | 140 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

| <Coating solution for barrier layer> | |
|---|---|
| N-methoxymethylated nylon (FR101, Namariichi Co., Ltd.) | 5 Parts |
| Methanol | 70 Parts |
| n-Butanol | 30 Parts |

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |

A commercially available bead mill using PSZ balls of 0.5 mm diameter was adopted, and 2-butanone in which polyvinyl butyral is dissolved and the pigment were all placed in the bead mill, performing a dispersing operation for 30 minutes at a rotor speed of 1,200 rpm to prepare a dispersion. The particle size distribution of the pigment particles in this dispersion was measured using a particle size analyzer (CAPA-700, Horiba, Ltd.), and the average particle diameter of the pigment particles was determined to be 0.30 μm, with standard deviation of 0.19 μm.

| <Coating solution for charge transporting layer> | |
|---|---|
| Compound 1 prepared in Synthesis Example 1 | 9 Parts |
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of Compound 1 and silicone oil, allowing these ingredients to completely dissolve. In this way a coating solution for charge transporting layer was prepared.

COMPARATIVE EXAMPLE 3-6

A photoconductor was prepared in a manner similar to that described in Example 3-10, with no conductive layer being provided (hereinafter referred to as "Photoconductor 16").

COMPARATIVE EXAMPLE 3-7

A photoconductor was prepared in a manner similar to that described in Example 3-10, with no barrier layer being provided (hereinafter referred to as "Photoconductor 17").

COMPARATIVE EXAMPLE 3-8

A photoconductor was prepared in a manner similar to that described in Example 3-10, with the compound represented by the following structural formula used instead of Compound 1 for the coating solution for charge transporting layer (hereinafter referred to as "Photoconductor 18").

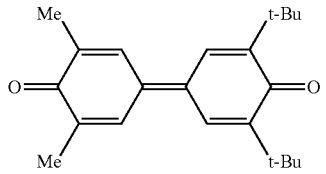

COMPARATIVE EXAMPLE 3-9

A photoconductor was prepared in a manner similar to that described in Example 3-10, with the compound represented by the following structural formula used instead of Compound 1 for the coating solution for charge transporting layer (hereinafter referred to as "Photoconductor 19").

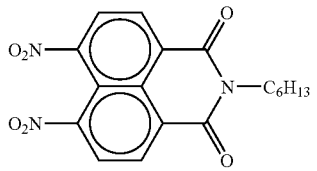

EXAMPLE 3-11

Photoconductor 1 thus prepared was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): +500V

Development bias: +350V

Exposed part surface potential at a development site: +70V

Evaluation was made by measuring the exposed part potential before and after 10,000-sheet continuous printing in the following manner: A surface electrometer was placed on the development site shown in FIG. 4, Photoconductor 1 was charged to +500V, exposure was performed to create a solid image using the semiconductor laser, and both the non-exposed part surface potential and exposed part potential at the development site were measured using the surface electrometer. The results are shown in Table 3-1.

In addition, a white solid image was printed out after the 10,000-sheet continuous printing for the evaluation of background smear on a scale of A to D, where A=excellent, B=good, C=bad, and D=poor. The results are also shown in Table 3-1.

EXAMPLES 3-12 to 3-20, AND COMPARATIVE EXAMPLES 3-10 TO 3-18

Evaluations similar to that for Example 3-11 were made except that Photoconductors 2 to 19 were used instead of Photoconductor 1. As a process condition, photoconductor's surface potential (non-exposed part potential) was set to +500V, and development bias was set to +350V. Exposure level was so adjusted that the exposed part potential of photoconductor at an initial state was +70V as in Example 3-11. At these settings, the exposed part surface potential was measured before and after the endurance test. The results are shown in Table 3-1.

TABLE 3-1

| | | Exposed part potential (V) | | Background smear | | |
|---|---|---|---|---|---|---|
| | Photo-con-ductor | Before printing | After 10,000-sheet printing | Before printing | After 10,000-sheet printing | Remarks |
| Ex. 3-11 | 1 | 70 | 90 | B to A | B | |
| Ex. 3-12 | 2 | 65 | 80 | B | B | |
| Ex. 3-13 | 3 | 70 | 100 | B to A | B to A | |
| Ex. 3-14 | 4 | 80 | 120 | A | A | |
| Ex. 3-15 | 5 | 60 | 75 | B | B to C | |
| Ex. 3-16 | 6 | 70 | 120 | B to A | B | |
| Ex. 3-17 | 7 | 80 | 110 | B to A | B | |
| Ex. 3-18 | 8 | 80 | 120 | B to A | B | |
| Ex. 3-19 | 9 | 60 | 80 | A | B to A | |
| Compara. Ex. 3-10 | 10 | 70 | 100 | B to A | B | Moire fringe occurred |
| Compara. Ex. 3-11 | 11 | 60 | 80 | B | D to C | |
| Compara. Ex. 3-12 | 12 | 70 | 140 | B to A | B | |
| Compara. Ex. 3-13 | 13 | 90 | 170 | B to A | B | |
| Compara. Ex. 3-14 | 14 | 80 | 140 | B to A | B | |
| Ex. 3-20 | 15 | 80 | 100 | B to A | B | |
| Compara. Ex. 3-15 | 16 | 80 | 110 | B to A | B | Moire fringe occurred |
| Compara. Ex. 3-16 | 17 | 70 | 90 | B | D to C | |
| Compara. Ex. 3-17 | 18 | 80 | 150 | B to A | B | |
| Compara. Ex. 3-18 | 19 | 100 | 180 | B to A | B | |

EXAMPLE 3-21

An aluminum cylinder of 340 mm length and 30 mm diameter (JIS1050) was adopted as a conductive support, and the following coating solution for conductive layer, coating solution for barrier layer, coating solution for charge generating layer, and coating solution for charge transporting layer were sequentially applied on the conductive support and dried to produce a photoconductor provided with a conductive layer of 10 μm thickness, a barrier layer of 0.5 μm thickness, a charge generating layer of 0.3 μm thickness, and charge transporting layer of 20 μm thickness (hereinafter referred to as "Photoconductor 20").

| <Coating solution for conductive layer> | |
|---|---|
| Tin oxide-antimony oxide powder (specific resistance = $10^6\Omega \times$ cm, average primary particle diameter = 0.4 μm) | 140 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

| <Coating solution for barrier layer> | |
|---|---|
| N-methoxymethylated nylon (FR101, Namariichi Co., Ltd.) | 5 Parts |
| Methanol | 70 Parts |
| n-Butanol | 30 Parts |

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |
| Compound 1 prepared in Synthesis Example 1 | 1 Part |

A commercially available bead mill using PSZ balls of 0.5 mm diameter was adopted, and 2-butanone in which both polyvinyl butyral and Compound 1 are dissolved and the pigment were all placed in the bead mill, performing a dispersing operation for 30 minutes at a rotor speed of 1,200 rpm to prepare a dispersion.

<Coating solution for charge transporting layer>

| | |
|---|---|
| Charge transporting substance represented by the following structural formula | 7 Parts |

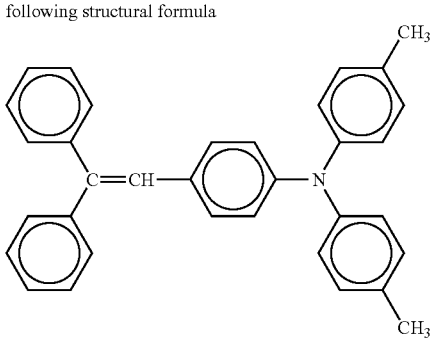

| | |
|---|---|
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

COMPARATIVE EXAMPLE 3-19

A photoconductor was prepared in a manner similar to that described in Example 3-21, with Compound 1 prepared in Synthesis Example 1 not being used for the coating solution for charge generating layer (hereinafter referred to as "Photoconductor 21").

EXAMPLE 3-22

Photoconductor 20 prepared above was attached to an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): −900V

Development bias: −650V

Exposed-part surface potential at a development site: −110V

Evaluation was made by measuring the non-exposed part potential before and after the 10,000-sheet continuous printing in the following manner: A surface electrometer was placed on the development site shown in FIG. 4, development bias was fixed such that Photoconductor 20 was charged to −900V at an initial state, and the non-exposed part surface potential at the development site was measured using the surface electrometer. The evaluation was made for the first and second rotations of Photoconductor 20. The results are shown in Table 3-2.

COMPARATIVE EXAMPLE 3-20

Evaluation similar to that for Example 3-22 was made except that Photoconductor 21 was used instead of Photoconductor 20.

TABLE 3-2

| | | Non-exposed part potential before printing (−V) | | Non-exposed part potential after 10,00-sheet printing (−V) | |
|---|---|---|---|---|---|
| | Photoconductor | First rotation | Second rotation | First rotation | Second rotation |
| Ex. 3-22 | 20 | 900 | 900 | 880 | 900 |
| Compara. Ex. 3-20 | 21 | 900 | 900 | 750 | 890 |

EXAMPLE 3-23

Photoconductor 1 prepared above was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a non-contacting roller charger like that shown in FIG. 5 is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): +500V

Development bias: +350V (negative/positive development)

Surface potential after removing of charges (non-exposed part): +80V

Evaluation was made by measuring the exposed part potential after 10,000-sheet continuous printing in the following manner: A surface electrometer was placed on the development site shown in FIG. 8, Photoconductor 1 was charged to +500V, exposure was performed to create a solid image using the semiconductor laser, and the exposed part potential at the development site was measured using the surface electrometer.

Furthermore, the ISO/JIS-SCID N1 pattern (portrait) was printed out after the 10,000-sheet continuous printing for the evaluation of the color reproducibility on a scale of A to D, where A=excellent, B=good, C=bad, and D=poor.

In addition, a white solid image was printed out after the 10,000-sheet continuous printing for the evaluation of background smear. The results thus obtained are shown in Table 3-3.

EXAMPLES 3-24 to 3-32, AND COMPARATIVE EXAMPLES 3-21 TO 3-29

Evaluations similar to that for Example 3-23 were made except that Photoconductors 2 to 19 were used instead of Photoconductor 1. As a process condition, photoconductor's surface potential (non-exposed part potential) was set to +500V, and development bias was set to +350V. Exposure level was so adjusted that the exposed part potential of photoconductor at an initial state was +80V as in Example 3-23. At these settings, the exposed part surface potential was measured before and after the endurance test. The results are shown in Table 3-3.

TABLE 3-3

| | | Exposed part potential (V) | | Color reproducibility | Background smear |
|---|---|---|---|---|---|
| | Photoconductor | Before printing | After 10,000-sheet printing | After 10,000-sheet printing | After 10,000-sheet printing |
| Ex. 3-23 | 1 | 80 | 100 | B to A | B |
| Ex. 3-24 | 2 | 75 | 90 | B to A | B |
| Ex. 3-25 | 3 | 80 | 110 | B to A | B to A |
| Ex. 3-26 | 4 | 90 | 130 | B | A |
| Ex. 3-27 | 5 | 70 | 85 | B | B to C |
| Ex. 3-28 | 6 | 80 | 130 | C to B | B |
| Ex. 3-29 | 7 | 90 | 120 | B to A | B |
| Ex. 3-30 | 8 | 90 | 130 | B to A | B |
| Ex. 3-31 | 9 | 70 | 90 | B to A | B to A |
| Compara. Ex. 3-21 | 10 | 80 | 110 | C | B |
| Compara. Ex. 3-22 | 11 | 70 | 90 | B | D to C |
| Compara. Ex. 3-23 | 12 | 80 | 150 | D to C | B |
| Compara. Ex. 3-24 | 13 | 100 | 180 | D to C | B |
| Compara. Ex. 3-25 | 14 | 90 | 150 | D to C | B |
| Ex. 3-32 | 15 | 90 | 110 | B to A | B |
| Compara. Ex. 3-26 | 16 | 90 | 120 | C | B |
| Compara. Ex. 3-27 | 17 | 80 | 100 | B | D to C |
| Compara. Ex. 3-28 | 18 | 90 | 160 | D to C | B |
| Compara. Ex. 3-29 | 19 | 110 | 190 | D to C | B |

As has been specifically described above, by using an electrophotographic photoconductor that includes at least an under layer and a photosensitive layer wherein the under layer is composed of a conductive layer and a barrier layer and wherein the photosensitive layer contains a compound represented by the foregoing general formula (1), it is made possible to provide an electrophotographic photoconductor that generates minimum abnormal images and features small variations in electrostatic characteristics after repetitive use of an image forming apparatus and/or under different usage environments.

In addition, this electrophotographic photoconductor can provide an image forming apparatus and full-color image forming apparatus that can also achieve stable image output, and a very easy-to-use process cartridge.

EXAMPLE 4-1

An aluminum cylinder of 340 mm length and 30 mm diameter (JIS1050) was adopted as a conductive support. This conductive support was then subjected to anodizing treatment, and the following coating solution for photosensitive layer was sequentially applied thereon followed by drying. In this way a photoconductor provided with a photosensitive layer of 20 μm thickness was obtained (hereinafter referred to as "Photoconductor 1").

-Anodizing Treatment-

The surface of the conductive support was mirror-polished, followed by degreasing operation and water washing. The conductive support was then soaked in an electrolyte bath containing 15 vol % of sulfuric acid (liquid temperature=20° C.) for anodizing treatment for 30 minutes at 15V. The conductive support was washed with water, and soaked in a 7% aqueous solution of nickel acetate (liquid temperature=50° C.) for pore-filling treatment. After pure water washing, an anodized film (anodized aluminum, or "alumite") of 6 μm thickness was formed on the conductive support.

<Coating Solution for Photosensitive Layer>

As a charge generating substance, 30 parts of Pigment 1 was dispersed into 970 parts of cyclohexanone using a ball mill for 2 hours to prepare a dispersion of charge generating substance. Separately, 49 parts of Z-polycarbonate resin (viscosity-average molecular weight=40,000, Teijin Chemicals, Ltd.), 20 parts of Compound 1 prepared in Synthesis Example 1, 29.5 parts of the compound represented by the following structural formula, and 0.1 part of silicone oil (KF50-100CS, Shin-Etsu Chemical Co., Ltd.) were dissolved into 340 parts of tetrahydrofuran. To the resultant mixture was added 66.6 parts of the foregoing dispersion of charge generating substance, and stirred to prepare a coating solution for photosensitive layer.

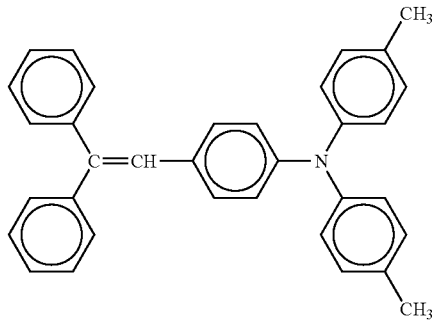

EXAMPLE 4-2

A photoconductor was prepared in a manner similar to that described in Example 4-1, with the thickness of the anodized film set to 1 μm by changing the anodizing treatment time (hereinafter referred to as "Photoconductor 2").

EXAMPLE 4-3

A photoconductor was prepared in a manner similar to that described in Example 4-1, with the thickness of the anodized film set to 15 μm by changing the anodizing treatment time (hereinafter referred to as "Photoconductor 3").

EXAMPLE 4-4

A photoconductor was prepared in a manner similar to that described in Example 4-1, with the thickness of the anodized film set to 18 μm by changing the anodizing treatment time (hereinafter referred to as "Photoconductor 4").

EXAMPLE 4-5

A photoconductor was prepared in a manner similar to that described in Example 4-1, with Compound 2 prepared in Synthesis Example 2 used instead of Compound 1 prepared in Synthesis Example 1 (hereinafter referred to as "Photoconductor 5").

EXAMPLE 4-6

A photoconductor was prepared in a manner similar to that described in Example 4-1, with Compound 3 prepared in Synthesis Example 3 used instead of Compound 1 prepared in Synthesis Example 1 (hereinafter referred to as "Photoconductor 6").

EXAMPLE 4-7

A photoconductor was prepared in a manner similar to that described in Example 4-1, with no pore-filling treatment that uses an aqueous solution of nickel acetate conducted in the anodizing treatment (hereinafter referred to as "Photoconductor 7").

EXAMPLE 4-8

A photoconductor was prepared in a manner similar to that described in Example 4-1, with Pigment 2 used instead of Pigment 1 (hereinafter referred to as "Photoconductor 8").

COMPARATIVE EXAMPLE 4-1

A photoconductor was prepared in a manner similar to that described in Example 4-1, with no anodizing treatment conducted for the aluminum support (hereinafter referred to as "Photoconductor 9").

COMPARATIVE EXAMPLE 4-2

A photoconductor was prepared in a manner similar to that described in Example 4-1, with no anodizing treatment being conducted for the aluminum support and with an intermediate layer of 0.3 μm thickness containing the following ingredients being provided between the conductive support and the photosensitive layer (hereinafter referred to as "Photoconductor 10").

| <Coating solution for intermediate layer> | |
|---|---|
| Alcohol-soluble nylon (Amilan CM8000, Toray Industries, Inc.) | 4 Parts |
| Methanol | 70 Parts |
| n-Butanol | 30 Parts |

Alcohol-soluble nylon was dissolved in a mixture of methanol and n-butanol to prepare a coating solution for intermediate layer.

COMPARATIVE EXAMPLE 4-3

A photoconductor was prepared in a manner similar to that described in Example 4-1, with Compound 1 not being used for the coating solution for photosensitive layer (hereinafter referred to as "Photoconductor 11").

COMPARATIVE EXAMPLE 4-4

A photoconductor was prepared in a manner similar to that described in Example 4-1, with the compound represented by the following structural formula used instead of Compound 1 (hereinafter referred to as "Photoconductor 12").

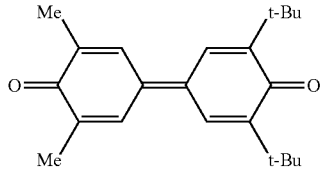

COMPARATIVE EXAMPLE 4-5

A photoconductor was prepared in a manner similar to that described in Example 4-1, with the compound represented by the following structural formula used instead of Compound 1 (hereinafter referred to as "Photoconductor 13").

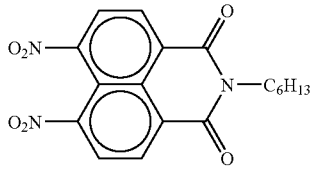

EXAMPLE 4-9

An aluminum cylinder of 340 mm length and 30 mm diameter (JIS1050) was adopted as a conductive support. The conductive support was subjected to anodizing treatment described below, and the following coating solution for charge generating layer and coating solution for charge transporting layer were sequentially applied on the conductive support and dried to produce a photoconductor provided with a charge generating layer of 0.3 μm thickness and a charge transporting layer of 20 μm thickness (hereinafter referred to as "Photoconductor 14").

-Anodizing Treatment-

The surface of the conductive support was mirror-polished, followed by degreasing operation and water washing. The conductive support was then soaked in an electrolyte bath containing 15 vol % of sulfuric acid (liquid temperature=20° C.) for anodizing treatment for 30 minutes at 15V. The conductive support was washed with water, and soaked in a 7% aqueous solution of nickel acetate (liquid temperature=50° C.) for pore-filling treatment. After pure water washing, an anodized film (anodized aluminum, or "alumite") of 6 μm thickness was formed on the conductive support.

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |

A commercially available bead mill using PSZ balls of 0.5 mm diameter was adopted, and 2-butanone in which polyvinyl butyral is dissolved and the pigment were both placed in the bead mill, performing a dispersing operation for 30 minutes at a rotor speed of 1,200 rpm to prepare a dispersion. The particle size distribution of the pigment particles in this dispersion was measured using a particle size analyzer (CAPA-700, Horiba, Ltd.), and the average particle diameter of the pigment particles was determined to be 0.30 μm, with standard deviation of 0.19 μm.

| <Coating solution for charge transporting layer> | |
|---|---|
| Compound 1 prepared in Synthesis Example 1 | 9 Parts |
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of Compound 1 and silicone oil, allowing these ingredients to completely dissolve. In this way a coating solution for charge transporting layer was prepared.

COMPARATIVE EXAMPLE 4-6

A photoconductor was prepared in a manner similar to that described in Example 4-9, with no anodizing treatment conducted for the aluminum support (hereinafter referred to as "Photoconductor 15").

COMPARATIVE EXAMPLE 4-7

A photoconductor was prepared in a manner similar to that described in Example 4-9, with the compound represented by the following structural formula used instead of Compound 1 for the coating solution for charge transporting layer (hereinafter referred to as "Photoconductor 16").

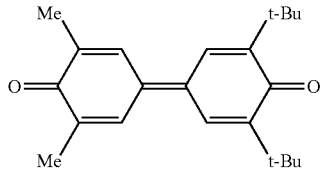

COMPARATIVE EXAMPLE 4-8

A photoconductor was prepared in a manner similar to that described in Example 4-9, with the compound represented by the following structural formula used instead of Compound 1 for the coating solution for charge transporting layer (hereinafter referred to as "Photoconductor 17").

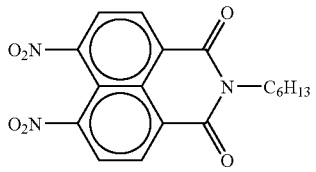

EXAMPLE 4-10

Photoconductor 1 prepared above was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): +500V

Development bias: +350V

Exposed part surface potential at a development site: +60V

Evaluation was made by measuring the exposed part potential after 10,000-sheet continuous printing in the following manner: A surface electrometer was placed on the development site shown in FIG. 4, Photoconductor 1 was charged to +500V, exposure was performed to create a solid image using the semiconductor laser, and the exposed part potential at the development site was measured using the surface electrometer. In addition, a white solid image was printed out after the 10,000-sheet continuous printing for the evaluation of background smear on a scale of A to D, where A=excellent, B=good, C=bad, and D=poor. The results are shown in Table 4-1.

EXAMPLES 4-11 to 4-18, AND COMPARATIVE EXAMPLES 4-9 TO 4-16

Evaluations similar to that for Example 4-10 were made except that Photoconductors 2 to 17 were used instead of Photoconductor 1. As a process condition, photoconductor's surface potential (non-exposed part potential) was set to +500V, and development bias was set to +350V. Exposure level was so adjusted that the exposed part potential of photoconductor at an initial state was +60V as in Example 4-10. At these settings, the exposed part surface potential was measured before and after the endurance test. The results are shown in Table 4-1.

TABLE 4-1

| | | Exposed part potential (V) | | Background smear | |
|---|---|---|---|---|---|
| | Photoconductor | Before printing | After 10,000-sheet printing | Before printing | After 10,000-sheet printing |
| Ex. 4-10 | 1 | 60 | 80 | B to A | B |
| Ex. 4-11 | 2 | 60 | 70 | B | C to B |
| Ex. 4-12 | 3 | 70 | 90 | A | A |
| Ex. 4-13 | 4 | 70 | 130 | A | A |
| Ex. 4-14 | 5 | 60 | 100 | B to A | B |
| Ex. 4-15 | 6 | 70 | 110 | B to A | B |
| Ex. 4-16 | 7 | 60 | 80 | B | C to B |
| Ex. 4-17 | 8 | 50 | 70 | A | A |
| Compara. Ex. 4-9 | 9 | 60 | 70 | C to B | D |
| Compara. Ex. 4-10 | 10 | 60 | 130 | B | D to C |
| Compara. Ex. 4-11 | 11 | 80 | 160 | B to A | B |
| Compara. Ex. 4-12 | 12 | 70 | 130 | B to A | B |
| Compara. Ex. 4-13 | 13 | 80 | 150 | B to A | B |
| Ex. 4-18 | 14 | 60 | 80 | B to A | B |
| Compara. Ex. 4-14 | 15 | 60 | 70 | C to B | D |
| Compara. Ex. 4-15 | 16 | 70 | 150 | B to A | B |
| Compara. Ex. 4-16 | 17 | 80 | 160 | B to A | B |

EXAMPLE 4-19

An aluminum cylinder of 340 mm length and 30 mm diameter (JIS1050) was adopted as a conductive support. The conductive support was subjected to anodizing treatment described below, and the following coating solution for charge generating layer and coating solution for charge transporting layer were sequentially applied on the conductive support and dried to produce a photoconductor provided with a charge generating layer of 0.3 μm thickness and a charge transporting layer of 20 μm thickness (hereinafter referred to as "Photoconductor 18").

-Anodizing Treatment-

The surface of the conductive support was mirror-polished, followed by degreasing operation and water washing. The conductive support was then soaked in an electrolyte bath containing 15 vol % of sulfuric acid (liquid temperature=20° C.) for anodizing treatment for 30 minutes at 15V. The conductive support was washed with water, and soaked in a 7% aqueous solution of nickel acetate (liquid temperature=50° C.) for pore-filling treatment. After pure water washing, an anodized film (anodized aluminum, or "anodized aluminum, or "alumite") of 6 μm thickness was formed on the conductive support.

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |
| Compound 1 prepared in Synthesis Example 1 | 1 Part |

A commercially available bead mill using PSZ balls of 0.5 mm diameter was adopted, and 2-butanone in which both polyvinyl butyral and Compound 1 are dissolved and the pigment were all placed in the bead mill, performing a dispersing operation for 30 minutes at a rotor speed of 1,200 rpm to prepare a dispersion.

<Coating solution for charge transporting layer>

Charge transporting substance represented by the following structural formula — 7 Parts

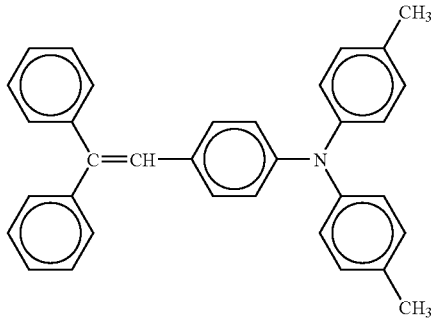

| | |
|---|---|
| Z-polycarbonate resin (PANLITE TS2040, Teijin Chemicals, Ltd.) | 10 Parts |
| Tetrahydrofuran | 120 Parts |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

COMPARATIVE EXAMPLE 4-17

A photoconductor was prepared in a manner similar to that described in Example 4-17, with Compound 1 not being used for the coating solution for charge generating layer (hereinafter referred to as "Photoconductor 19").

EXAMPLE 4-20

Photoconductor 18 thus prepared was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): −900V

Development bias: −650V

Exposed part surface potential at a development site: −110V

Evaluation was made by measuring the non-exposed part potential before and after the 10,000-sheet continuous printing in the following manner: A surface electrometer was placed on the development site shown in FIG. 4, development bias was fixed such that Photoconductor 18 was charged to −900V at an initial state, and the non-exposed part surface potential at the. development site was measured using the surface electrometer. The evaluation was made for the first and second rotations of Photoconductor 18. The results are shown in Table 4-2.

COMPARATIVE EXAMPLE 4-18

Evaluation similar to that for Example 4-20 was made except that Photoconductor 19 was used instead of Photoconductor 18. The results are also shown in Table 4-2.

TABLE 4-2

| | | Non-exposed part potential before printing (−V) | | Non-exposed part potential after 10,00-sheet printing (−V) | |
|---|---|---|---|---|---|
| | Photoconductor | First rotation | Second rotation | First rotation | Second rotation |
| Ex. 4-20 | 18 | 900 | 900 | 880 | 900 |
| Compara. Ex. 4-18 | 19 | 900 | 900 | 760 | 890 |

EXAMPLE 4-21

Photoconductor 1 prepared above was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a non-contacting roller charger like that shown in FIG. 5 is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): +500V

Development bias: +350V (negative/positive development)

Surface potential after removing of charges (non-exposed part): +80V

Evaluation was made by measuring the exposed part potential after 10,000-sheet continuous printing in the following manner: A surface electrometer was placed on the development site shown in FIG. 8, Photoconductor 1 was charged to +500V, exposure was performed to create a solid image using the semiconductor laser, and the exposed part potential at the development site was measured using the surface electrometer.

Furthermore, the ISO/JIS-SCID N1 pattern (portrait) was printed out after the 10,000-sheet continuous printing for the evaluation of the color reproducibility on a scale of A to D, where A=excellent, B=good, C=bad, and D=poor.

In addition, a white solid image was printed out after the 10,000-sheet continuous printing for the evaluation of background smear. The results thus obtained are shown in Table 4-3.

EXAMPLES 4-22 to 29, AND COMPARATIVE EXAMPLES 4-19 TO 4-26

Evaluations similar to that for Example 4-21 were made except that Photoconductors 2 to 17 were used instead of Photoconductor 1. As a process condition, photoconductor's surface potential (non-exposed part potential) was set to +500V, and development bias was set to +350V. Exposure level was so adjusted that the exposed part potential of photoconductor at an initial state was +80V as in Example 4-20. At these settings, the exposed part surface potential was measured before and after the endurance test. The results are shown in Table 4-3.

TABLE 4-3

| | | Exposed part potential (V) | | Color reproducibility | Background smear |
|---|---|---|---|---|---|
| | Photoconductor | Before printing | After 10,000-sheet printing | After 10,000-sheet printing | After 10,000-sheet printing |
| Ex. 4-21 | 1 | 80 | 100 | B to A | B |
| Ex. 4-22 | 2 | 80 | 90 | B | C to B |
| Ex. 4-23 | 3 | 90 | 110 | B | A |
| Ex. 4-24 | 4 | 90 | 150 | A | A |
| Ex. 4-25 | 5 | 80 | 120 | B to A | B |
| Ex. 4-26 | 6 | 90 | 130 | B to a | B |
| Ex. 4-27 | 7 | 80 | 100 | B to A | C to B |
| Ex. 4-28 | 8 | 70 | 90 | A | A |
| Compara. Ex. 4-19 | 9 | 80 | 90 | B | D |
| Compara. Ex. 4-20 | 10 | 80 | 150 | C | D to C |
| Compara. Ex. 4-21 | 11 | 100 | 180 | D to C | B |
| Compara. Ex. 4-22 | 12 | 90 | 150 | C | B |
| Compara. Ex. 4-23 | 13 | 100 | 170 | D to C | B |
| Ex. 4-29 | 14 | 80 | 100 | B to A | B |
| Compara. Ex. 4-24 | 15 | 80 | 90 | B to A | D |
| Compara. Ex. 4-25 | 16 | 90 | 170 | D to C | B |
| Compara. Ex. 4-26 | 17 | 100 | 180 | D to C | B |

As has been specifically described above, by using an electrophotographic photoconductor that includes at least a photosensitive layer on a conductive support wherein the conductive support is an anodized support and wherein the photosensitive layer contains a compound (electron transporting agent) represented by the foregoing general formula (1), it is made possible to provide an electrophotographic photoconductor that generates minimum abnormal images and features small variations in electrostatic characteristics after repetitive use of an image forming apparatus and/or under different usage environments.

In addition, this electrophotographic photoconductor can provide an image forming apparatus and full-color image forming apparatus that can achieve stable image output, and a very easy-to-use process cartridge.

EXAMPLE 5-1

An aluminum cylinder of 340 mm length and 30 mm diameter (JIS1050) was adopted as a conductive support, and the following coating solution for under layer, coating solution for charge generating layer, and coating solution for charge transporting layer were sequentially applied on the conductive support and dried to produce a photoconductor provided with an under layer of 3.5 μm thickness, a charge generating layer of 0.3 μm thickness, and a charge transporting layer of 25 μm thickness (hereinafter referred to as "Photoconductor 1").

| (Coating solution for under layer) | |
|---|---|
| Titanium oxide (T1) (CR-EL, Ishihara Sangyo Co., Ltd., average particle diameter (D1) = 0.25 μm) | 42 Parts |
| Titanium oxide (T2) (PT-401M, Ishihara Sangyo Co., Ltd., average particle diameter (D2) = 0.07 μm) | 42 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.28, and the proportion of titanium oxide (T2) in titanium oxides (T1) and (T2), (T2/(T1 + T2)), on a mass basis is 0.5.

(Coating Solution for Charge Generating Layer)

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |
| Compound 1 prepared in Synthesis Example 1 | 1 Part |

A commercially available bead mill using PSZ balls of 0.5 mm diameter was adopted, and 2-butanone in which both polyvinyl butyral and Compound 1 are dissolved and the pigment were all placed in the bead mill, performing a dispersing operation for 30 minutes at a rotor speed of 1,200 rpm to prepare a dispersion.

| <Coating solution for charge transporting layer> | |
|---|---|
| Charge transporting substance represented by the following structural formula | 7 Parts |

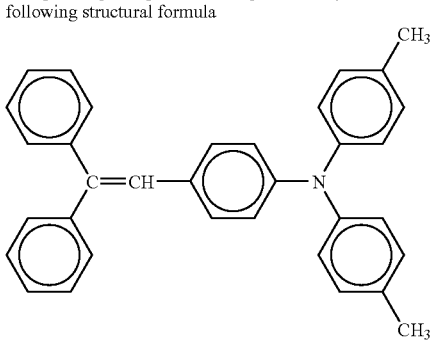

-continued

| <Coating solution for charge transporting layer> | |
|---|---|
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

EXAMPLE 5-2

A photoconductor was prepared in a manner similar to that described in Example 5-1, with the amounts of titanium oxides in the coating solution for under layer changed as follows (hereinafter referred to as "Photoconductor 2").

| (Coating solution for under layer) | |
|---|---|
| Titanium oxide (T1) (CR-EL, Ishihara Sangyo Co., Ltd., average particle diameter (D1) = 0.25 μm) | 75.6 Parts |
| Titanium oxide (T2) (PT-401M, Ishihara Sangyo Co., Ltd., average particle diameter (D2) = 0.07 μm) | 8.4 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.28, and the proportion of titanium oxide (T2) in titanium oxides (T1) and (T2), (T2/(T1 + T2)), on a mass basis is 0.1.

EXAMPLE 5-3

A photoconductor was prepared in a manner similar to that described in Example 5-1, with the amounts of titanium oxides in the coating solution for under layer changed as follows (hereinafter referred to as "Photoconductor 3").

| (Coating solution for under layer) | |
|---|---|
| Titanium oxide (T1) (CR-EL, Ishihara Sangyo Co., Ltd., average particle diameter (D1) = 0.25 μm) | 8.4 Parts |
| Titanium oxide (T2) (PT-401M, Ishihara Sangyo Co., Ltd., average particle diameter (D2) = 0.07 μm) | 75.6 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.28, and the proportion of titanium oxide (T2) in titanium oxides (T1) and (T2), (T2/(T1 + T2)), on a mass basis is 0.9.

EXAMPLE 5-4

A photoconductor was prepared in a manner similar to that described in Example 5-1, with Compound 2 prepared in Synthesis Example 2 used instead of Compound 1 prepared in Synthesis Example 1 (hereinafter referred to as "Photoconductor 4").

EXAMPLE 5-5

A photoconductor was prepared in a manner similar to that described in Example 5-1, with Compound 3 prepared in Synthesis Example 3 used instead of Compound 1 prepared in Synthesis Example 1 (hereinafter referred to as "Photoconductor 5").

EXAMPLE 5-6

A photoconductor was prepared in a manner similar to that described in Example 5-1, with Pigment 2 used instead of Pigment 1 (hereinafter referred to as "Photoconductor 6").

COMPARATIVE EXAMPLE 5-1

A photoconductor was prepared in a manner similar to that described in Example 5-1, with ingredients for the coating solution for under layer changed to those described below (hereinafter referred to as "Photoconductor 7").

| (Coating solution for under layer) | |
|---|---|
| Titanium oxide (CR-EL, Ishihara Sangyo Co., Ltd., average particle diameter = 0.25 μm) | 84 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

COMPARATIVE EXAMPLE 5-2

A photoconductor was prepared in a manner similar to that described in Example 5-1, with ingredients for the coating solution for under layer changed to those described below (hereinafter referred to as "Photoconductor 8").

| (Coating solution for under layer) | |
|---|---|
| Titanium oxide (T1) (CR-EL, Ishihara Sangyo Co., Ltd., average particle diameter (D1) = 0.25 μm) | 42 Parts |
| Titanium oxide (T2) (TTO-F1, Ishihara Sangyo Co., Ltd., average particle diameter (D2) = 0.04 μm) | 42 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.16, and the proportion of titanium oxide (T2) in titanium oxides (T1) and (T2), (T2/(T1 + T2)), on a mass basis is 0.5.

COMPARATIVE EXAMPLE 5-3

A photoconductor was prepared in a manner similar to that described in Example 5-1, with ingredients for the coating solution for under layer changed to those described below (hereinafter referred to as "Photoconductor 9").

| (Coating solution for under layer) | |
|---|---|
| Titanium oxide (T1) (CR-EL, Ishihara Sangyo Co., Ltd., average particle diameter (D1) = 0.25 μm) | 42 Parts |
| Titanium oxide (T2) (A-100, Ishihara Sangyo Co., Ltd., average particle diameter (D2) = 0.15 μm) | 42 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.6, and the proportion of titanium oxide (T2) in titanium oxides (T1) and (T2), (T2/(T1 + T2)), on a mass basis is 0.5.

COMPARATIVE EXAMPLE 5-4

A photoconductor was prepared in a manner similar to that described in Example 5-1, with no under layer being provided (hereinafter referred to as "Photoconductor 10").

COMPARATIVE EXAMPLE 5-5

A photoconductor was prepared in a manner similar to that described in Example 5-1, with Compound 1 prepared in Synthesis Example 1 not being used for the coating solution for charge generating layer (hereinafter referred to as "Photoconductor 11").

COMPARATIVE EXAMPLE 5-6

A photoconductor was prepared in a manner similar to that described in Example 5-1, with the compound represented by the following structural formula used instead of Compound 1 prepared in Synthesis Example 1 (hereinafter referred to as "Photoconductor 12").

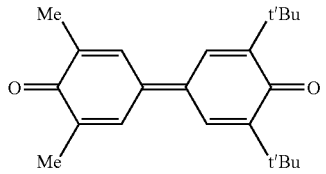

COMPARATIVE EXAMPLE 5-7

A photoconductor was prepared in a manner similar to that described in Example 5-1, with the compound represented by the following structural formula used instead of Compound 1 prepared in Synthesis Example 1 (hereinafter referred to as "Photoconductor 13").

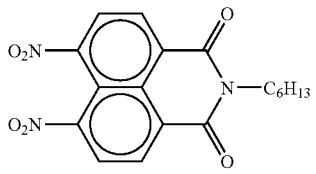

EXAMPLE 5-7

Photoconductor 1 prepared above was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 30,000-sheet continuous printing of an A4-size document was carried out that has uniformly distributed characters accounting for 6% of the entire front surface.

Photoconductor's surface potential (non-exposed part potential): −900V

Development bias: −650V

Exposed part surface potential at a development site: −120V

Evaluation was made by measuring the non-exposed part potential before and after 30,000-sheet continuous printing in the following manner: A surface electrometer was placed on the development site shown in FIG. 4, development bias was fixed such that Photoconductor 1 was charged to −900V at an initial state, and the non-exposed part surface potential at the development site was measured using the surface electrometer. The evaluation was made for the first and second rotations of the photoconductor to determine ΔVD—non-exposed part surface potential for the second rotation minus non-exposed part surface potential for the first rotation. In addition, a white solid image was printed out before and after the 30,000-sheet continuous printing for the evaluation of background smear on a scale of A to D, where A=excellent, B=good, C=bad, and D=poor. Furthermore, single-dot images were also printed out for the determination of the occurrence of a moire fringe. The results are shown in Table 5-1.

EXAMPLES 5-8 to 5-12, AND COMPARATIVE EXAMPLES 5-8 TO 5-14

Evaluations similar to that for Example 5-7 were made except that Photoconductors 2 to 13 were used instead of Photoconductor 1. The results are also shown in Table 5-1.

TABLE 5-1

| | | ΔVD(V) | | Background smear | | |
|---|---|---|---|---|---|---|
| | Photoconductor | Before printing | After 30,000-sheet printing | Before printing | After 30,000-sheet printing | Remarks |
| Ex. 5-7 | 1 | 0 | 20 | B to A | B | |
| Ex. 5-8 | 2 | 0 | 20 | B | B | |
| Ex. 5-9 | 3 | 0 | 20 | B to A | B | Slight moire fringe (no practical problem) |
| Ex. 5-10 | 4 | 0 | 30 | B to A | B | |
| Ex. 5-11 | 5 | 0 | 30 | B to A | B | |
| Ex. 5-12 | 6 | 0 | 15 | | B to A | |
| Compara. Ex. 5-8 | 7 | 0 | 25 | A | D to C | |
| Compara. Ex. 5-9 | 8 | 0 | 50 | B to A | B | |
| Compara. Ex. 5-10 | 9 | 0 | 20 | B to A | B to A | Moire fringe occurred |
| Compara. Ex. 5-11 | 10 | 0 | 20 | C to B | D | |
| Compara. Ex. 5-12 | 11 | 0 | 120 | B to A | B | |
| Compara. Ex. 5-13 | 12 | 0 | 70 | B to A | B | |
| Compara. Ex. 5-14 | 13 | 0 | 90 | B to A | B | |

EXAMPLE 5-13

Photoconductor 1 prepared above was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a contacting roller charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 30,000-sheet continuous printing of an A4-size document was carried out that has uniformly distributed characters accounting for 6% of the entire front surface.

Photoconductor's surface potential (non-exposed part potential): −700V

Development bias: −500V

Exposed part surface potential at a development site: −100V

An image shown in FIG. 11 was printed out before and after the 30,000-sheet continuous printing for the evaluation of the level of ghost image at the half-tone area on a scale of A to D, where A=excellent, B=good, C=bad, and D=poor.

A white solid image was printed out before and after the 30,000-sheet continuous printing for the evaluation of background smear on a scale of A to D, where A=excellent, B=good, C=bad, and D=poor.

Furthermore, the ISO/JIS-SCID N1 pattern (portrait) was printed out after the 30,000-sheet continuous printing for the evaluation of the color reproducibility on a scale of A to D, where A=excellent, B=good, C=bad, and D=poor. The results are shown in Table 5-2.

EXAMPLES 5-14 to 5-18, AND COMPARATIVE EXAMPLES 5-15 TO 5-21

Evaluations similar to that for Example 5-13 were made except that Photoconductors 2 to 13 were used instead of Photoconductor 1. The results are also shown in Table 5-2.

TABLE 5-2

| | | Ghost image | | Background smear | | | |
|---|---|---|---|---|---|---|---|
| | Photoconductor | Before printing | After 30,000-sheet printing | Before printing | After 30,000-sheet printing | Color balance | Remarks |
| Ex. 5-13 | 1 | A | B to A | B to A | B | B to A | |
| Ex. 5-14 | 2 | A | B to A | B | B | B | |
| Ex. 5-15 | 3 | A | B to A | B to A | B | B | Slight moire fringe (no practical problem) |
| Ex. 5-16 | 4 | A | B | B to A | B | B | |
| Ex. 5-17 | 5 | A | B | B to A | B | B | |
| Ex. 5-18 | 6 | A | B to A | A | B to A | B to A | |
| Compara. Ex. 5-15 | 7 | A | B to A | B to A | D to C | B | |
| Compara. Ex. 5-16 | 8 | A | C | B to A | B | C to B | |
| Compara. Ex. 5-17 | 9 | A | B | B to A | B to A | B | |
| Compara. Ex. 5-18 | 10 | A | B to A | C to B | D | C to B | Moire fringe occurred |
| Compara. Ex. 5-19 | 11 | A | D | B to A | B | D to C | |
| Compara. Ex. 5-20 | 12 | A | C | B to A | B | C | |
| Compara. Ex. 5-21 | 13 | A | D to C | B to A | B | D to C | |

As has been specifically described above, by using an electrophotographic photoconductor that includes at least an under layer and a photosensitive layer wherein the under layer contains two different titanium oxides (T1) and (T2) with different average particle diameters that satisfy the condition $0.2<(D2/D1)\leqq 0.5$ (where D1 represents the average particle diameter of titanium oxide (T1) with a larger particle diameter, and D2 represents the average particle diameter of the other titanium oxide (T2)) and wherein the photosensitive layer contains a compound (electron transporting agent) represented by the foregoing general formula (1), it is made possible to provide an electrophotographic photoconductor that generates minimum abnormal images and features small variations in electrostatic characteristics after repetitive use of an image forming apparatus and/or under different usage environments.

In addition, this electrophotographic photoconductor can provide an image forming apparatus and full-color image forming apparatus that can also achieve stable image output, and a very easy-to-use process cartridge.

EXAMPLE 6-1

An aluminum cylinder of 340 mm length and 30 mm diameter (JIS1050) was adopted as a conductive support, and the following coating solution for intermediate layer, coating solution for charge generating layer, and coating solution for charge transporting layer were sequentially applied on the conductive support and dried to produce a photoconductor provided with an intermediate layer of 3.5 μm thickness, a charge generating layer of 0.3 μm thickness, and a charge transporting layer of 25 μm thickness (hereinafter referred to as "Photoconductor 1").

| (Coating solution for intermediate layer) | |
|---|---|
| Titanium oxide (CR-EL, Ishihara Sangyo Co., Ltd., average particle diameter = 0.25 μm) | 84 Parts |
| Compound 1 (Electron Transporting Agent 1) prepared above | 20 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

(Coating Solution for Charge Generating Layer)

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |

A commercially available bead mill using PSZ balls of 0.5 mm diameter was adopted, and 2-butanone in which polyvinyl butyral is dissolved and the pigment were placed in the bead mill, performing a dispersing operation for 30 minutes at a rotor speed of 1,200 rpm to prepare a dispersion.

| <Coating solution for charge transporting layer> | |
|---|---|
| Charge transporting substance represented by the following structural formula | 7 Parts |

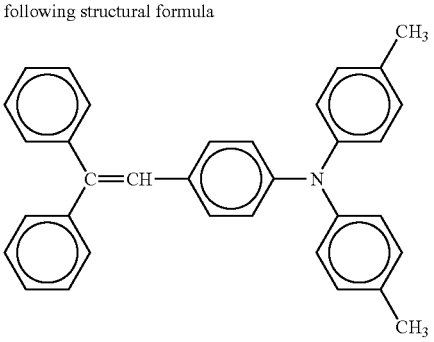

| | |
|---|---|
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

EXAMPLE 6-2

A photoconductor was prepared in a manner similar to that described in Example 6-1, with ingredients for the coating solution for intermediate layer changed to those described below (hereinafter referred to as "Photoconductor 2").

| (Coating solution for intermediate layer) | |
|---|---|
| Titanium oxide (T1) (CR-EL, Ishihara Sangyo Co., Ltd., average particle diameter (D1) = 0.25 μm) | 42 Parts |
| Titanium oxide (T2) (PT-401M, Ishihara Sangyo Co., Ltd., average particle diameter (D2) = 0.07 μm) | 42 Parts |
| Compound 1 in Synthesis Example 1 | 20 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.28, and the proportion of titanium oxide (T2) in titanium oxides (T1) and (T2), (T2/(T1+T2)), on a mass basis is 0.5.

EXAMPLE 6-3

A photoconductor was prepared in a manner similar to that described in Example 6-1, with the amounts of titanium oxides in the coating solution for intermediate layer changed as follows (hereinafter referred to as "Photoconductor 3").

| (Coating solution for intermediate layer) | |
|---|---|
| Titanium oxide (T1) (CR-EL, Ishihara Sangyo Co., Ltd., average particle diameter (D1) = 0.25 μm) | 75.6 Parts |
| Titanium oxide (T2) (PT-401M, Ishihara Sangyo Co., Ltd., average particle diameter (D2) = 0.07 μm) | 8.4 Parts |
| Compound 1 in Synthesis Example 1 | 20 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.28, and the proportion of titanium oxide (T2) in titanium oxides (T1) and (T2), (T2/(T1 + T2)), on a mass basis is 0.1.

EXAMPLE 6-4

A photoconductor was prepared in a manner similar to that described in Example 6-1, with the amounts of titanium oxides in the coating solution for intermediate layer changed as follows (hereinafter referred to as "Photoconductor 4").

| (Coating solution for intermediate layer) | |
|---|---|
| Titanium oxide (T1) (CR-EL, Ishihara Sangyo Co., Ltd., average particle diameter (D1) = 0.25 μm) | 8.4 Parts |
| Titanium oxide (T2) (PT-401M, Ishihara Sangyo Co., Ltd., average particle diameter (D2) = 0.07 μm) | 75.6 Parts |
| Compound 1 in Synthesis Example 1 | 20 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.28, and the proportion of titanium oxide (T2) in titanium oxides (T1) and (T2), (T2/(T1 + T2)), on a mass basis is 0.9.

EXAMPLE 6-5

A photoconductor was prepared in a manner similar to that described in Example 6-1, with ingredients for the coating solution for intermediate layer changed to those described below (hereinafter referred to as "Photoconductor 5").

| (Coating solution for intermediate layer) | |
|---|---|
| Titanium oxide (T1) (CR-EL, Ishihara Sangyo Co., Ltd., average particle diameter (D1) = 0.25 μm) | 42 Parts |
| Titanium oxide (T2) (TTO-F1, Ishihara Sangyo Co., Ltd., average particle diameter (D2) = 0.04 μm) | 42 Parts |
| Compound 1 in Synthesis Example 1 | 20 Parts |
| Alkyd resin (BEKKOLITE M6401-50-S, Dainippon Ink & Chemicals, Inc., solid content = 50%) | 33.6 Parts |

-continued

| (Coating solution for intermediate layer) | |
|---|---|
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.16, and the proportion of titanium oxide (T2) in titanium oxides (T1) and (T2), (T2/(T1 + T2)), on a mass basis is 0.5.

EXAMPLE 6-6

A photoconductor was prepared in a manner similar to that described in Example 6-1, with ingredients for the coating solution for intermediate layer changed to those described below (hereinafter referred to as "Photoconductor 6").

| (Coating solution for intermediate layer) | |
|---|---|
| Titanium oxide (T1) (CR-EL, Ishihara Sangyo Co., Ltd., average particle diameter (D1) = 0.25 μm) | 42 Parts |
| Titanium oxide (T2) (A-100, Ishihara Sangyo Co., Ltd., average particle diameter (D2) = 0.15 μm) | 42 Parts |
| Compound 1 in Synthesis Example 1 | 20 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

Note that the average particle ratio (D2/D1) is 0.6, and the mass ratio of T2 to total mass, (T2/(T1 + T2)), is 0.5.

EXAMPLE 6-7

A photoconductor was prepared in a manner similar to that described in Example 6-1, with the following coating solution for charge blocking layer and coating solution for moire preventing layer applied to form an intermediate layer composed of a charge blocking layer of 0.5 μm thickness and a moire preventing layer of 3.5 μm thickness (hereinafter referred to as "Photoconductor 7").

| <Coating solution for charge blocking layer> | |
|---|---|
| N-methoxymethylated nylon (FR101, Namariichi Co., Ltd.) | 5 Parts |
| Compound 1 in Synthesis Example 1 | 1 Part |
| Methanol | 70 Parts |
| n-Butanol | 30 Parts |

| <Coating solution for moire preventing layer> | |
|---|---|
| Titanium oxide (CR-EL, Ishihara Sangyo Kaisha, Ltd. Average particle diameter = 0.25 μm) | 84 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

EXAMPLE 6-8

A photoconductor was prepared in a manner similar to that described in Example 6-7, with the thickness of the charge blocking layer set to 0.3 μm (hereinafter referred to as "Photoconductor 8").

EXAMPLE 6-9

A photoconductor was prepared in a manner similar to that described in Example 6-7, with the thickness of the charge blocking layer set to 1.0 μm (hereinafter referred to as "Photoconductor 9").

EXAMPLE 6-10

A photoconductor was prepared in a manner similar to that described in Example 6-7, with the thickness of the charge blocking layer set to 2.0 μm (hereinafter referred to as "Photoconductor 10").

EXAMPLE 6-11

A photoconductor was prepared in a manner similar to that described in Example 6-7, with the thickness of the charge blocking layer set to 0.1 μm (hereinafter referred to as "Photoconductor 11").

EXAMPLE 6-12

A photoconductor was prepared in a manner similar to that described in Example 6-7, with ingredients in the coating solution for charge blocking layer changed to those described below (hereinafter referred to as "Photoconductor 12").

| <Coating solution for charge blocking layer> | |
|---|---|
| Alcohol-soluble nylon (Amilan CM8000, Toray Industries, Inc.) | 4 Parts |
| Compound 1 in Synthesis Example 1 | 1 Part |
| Methanol | 70 Parts |
| n-Butanol | 30 Parts |

EXAMPLE 6-13

A photoconductor was prepared in a manner similar to that described in Example 6-1, with Compound 2 prepared in Synthesis Example 2 used instead of Compound 1 prepared in Synthesis Example 1 (hereinafter referred to as "Photoconductor 13").

EXAMPLE 6-14

A photoconductor was prepared in a manner similar to that described in Example 6-1, with Compound 3 prepared in Synthesis Example 3 used instead of Compound 1 prepared in Synthesis Example 1 (hereinafter referred to as "Photoconductor 14").

EXAMPLE 6-15

A photoconductor was prepared in a manner similar to that described in Example 6-1, with Pigment 2 used instead of Pigment 1 (hereinafter referred to as "Photoconductor 15").

COMPARATIVE EXAMPLE 6-1

A photoconductor was prepared in a manner similar to that described in Example 6-1, with Compound 1 prepared in Synthesis Example 1 not being used for the coating solution for intermediate layer (hereinafter referred to as "Photoconductor 16").

COMPARATIVE EXAMPLE 6-2

A photoconductor was prepared in a manner similar to that described in Example 6-7, with Compound 1 prepared in Synthesis Example 1 not being used for the coating solution for charge blocking layer (hereinafter referred to as "Photoconductor 17").

COMPARATIVE EXAMPLE 6-3

A photoconductor was prepared in a manner similar to that described in Example 6-1, with the compound represented by the following structural formula used instead of Compound 1 prepared in Synthesis Example (hereinafter referred to as "Photoconductor 18").

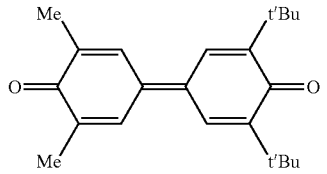

COMPARATIVE EXAMPLE 6-4

A photoconductor was prepared in a manner similar to that described in Example 6-1, with the compound represented by the following structural formula used instead of Compound 1 prepared in Synthesis Example (hereinafter referred to as "Photoconductor 19").

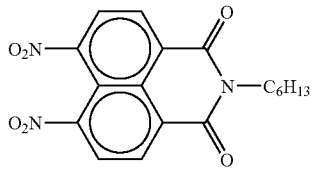

EXAMPLE 6-16

Photoconductor 1 prepared above was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 30,000-sheet continuous printing of an A4-size document was carried out that has uniformly distributed characters accounting for 6% of the entire front surface.

Photoconductor's surface potential (non-exposed part potential): −900V

Development bias: −650V

Exposed part surface potential at a development site: −120V

Evaluation was made by measuring the non-exposed part potential before and after 30,000-sheet continuous printing in the following manner: A surface electrometer was placed on the development site shown in FIG. 4, development bias was fixed such that Photoconductor 1 was charged to −900V at an initial state, and the non-exposed part surface potential at the development site was measured using the surface electrometer. The evaluation was made for the first and second rotations of the photoconductor to determine ΔVD—non-exposed part surface potential for the second rotation minus non-exposed part surface potential for the first rotation. In addition, a white solid image was printed out before and after the 30,000-sheet continuous printing for the evaluation of background smear on a scale of A to D, where A=excellent, B=good, C=bad, and D=poor. Furthermore, single-dot images were also printed out for the determination of the occurrence of a moire fringe. The results are shown in Table 6-1.

EXAMPLES 6-17 to 6-30, AND COMPARATIVE EXAMPLES 6-5 TO 6-8

Evaluations similar to that for Example 6-16 were made except that Photoconductors 2 to 19 were used instead of Photoconductor 1. The results are also shown in Table 6-1.

TABLE 6-1

| | | ΔVD(V) | | Background smear | | |
|---|---|---|---|---|---|---|
| | Photoconductor | Before printing | After 30,000-sheet printing | Before printing | After 30,000-sheet printing | Remarks |
| Ex. 6-16 | 1 | 0 | 20 | B to A | C to B | |
| Ex. 6-17 | 2 | 0 | 20 | A | B to A | |
| Ex. 6-18 | 3 | 0 | 20 | B to A | C to B | Slight moire fringe (no practical problem) |
| Ex. 6-19 | 4 | 0 | 20 | B to A | B | |
| Ex. 6-20 | 5 | 0 | 40 | B to A | B | |
| Ex. 6-21 | 6 | 0 | 20 | B to A | B | Slight moire fringe (no practical problem) |

TABLE 6-1-continued

| | Photoconductor | ΔVD(V) Before printing | ΔVD(V) After 30,000-sheet printing | Background smear Before printing | Background smear After 30,000-sheet printing | Remarks |
|---|---|---|---|---|---|---|
| Ex. 6-22 | 7 | 0 | 30 | A | B to A | |
| Ex. 6-23 | 8 | 0 | 25 | B to A | B | |
| Ex. 6-24 | 9 | 0 | 40 | A | B to A | |
| Ex. 6-25 | 10 | 0 | 55 | A | A | |
| Ex. 6-26 | 11 | 0 | 20 | B to A | C to B | |
| Ex. 6-27 | 12 | 0 | 45 | A | B to A | |
| Ex. 6-28 | 13 | 0 | 35 | B to A | C to B | |
| Ex. 6-29 | 14 | 0 | 35 | B to A | C to B | |
| Ex. 6-30 | 15 | 0 | 20 | A | B to A | |
| Compara. Ex. 6-5 | 16 | 0 | 120 | B to A | C to B | |
| Compara. Ex. 6-6 | 17 | 0 | 150 | A | B to A | |
| Compara. Ex. 6-7 | 18 | 0 | 70 | B to A | C to B | |
| Compara. Ex. 6-8 | 19 | 0 | 90 | B to A | C to B | |

EXAMPLE 6-31

Photoconductor 1 prepared above was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a contacting roller charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 30,000-sheet continuous printing of an A4-size document was carried out that has uniformly distributed characters accounting for 6% of the entire front surface.

Photoconductor's surface potential (non-exposed part potential): −700V

Development bias: −500V

Exposed part surface potential at a development site: −100V

The image shown in FIG. 11 was printed out before and after the 30,000-sheet continuous printing for the evaluation of the level of ghost image at the half-tone area on a scale of A to D, where A=excellent, B=good, C=bad, and D=poor.

A white solid image was printed out before and after the 30,000-sheet continuous printing for the evaluation of background smear on a scale of A to D, where A=excellent, B=good, C=bad, and D=poor.

Furthermore, the ISO/JIS-SCID N1 pattern (portrait) was printed out after the 30,000-sheet continuous printing for the evaluation of the color reproducibility on a scale of A to D, where A=excellent, B=good, C=bad, and D=poor. The results are shown in Table 6-2.

EXAMPLES 6-32 to 6-45, AND COMPARATIVE EXAMPLES 6-9 TO 6-12

Evaluations similar to that for Example 6-31 were made except that Photoconductors 2 to 19 were used instead of Photoconductor 1. The results are also shown in Table 6-2.

TABLE 6-2

| | Photoconductor | Ghost image Before printing | Ghost image After 30,000-sheet printing | Background smear Before printing | Background smear After 30,000-sheet printing | Color balance | Remarks |
|---|---|---|---|---|---|---|---|
| Ex. 6-31 | 1 | A | B to A | B to A | C to B | B to A | |
| Ex. 6-32 | 2 | A | B to A | A | B to A | B to A | |
| Ex. 6-33 | 3 | A | B to A | B to A | C to B | B to A | |
| Ex. 6-34 | 4 | A | B to A | B to A | B | B to A | Slight moire fringe (no practical problem) |
| Ex. 6-35 | 5 | A | B | B to A | B | B | |
| Ex. 6-36 | 6 | A | B to A | B to A | B | B to A | Slight moire fringe (no practical problem) |

TABLE 6-2-continued

| | Photoconductor | Ghost image: Before printing | Ghost image: After 30,000-sheet printing | Background smear: Before printing | Background smear: After 30,000-sheet printing | Color balance | Remarks |
|---|---|---|---|---|---|---|---|
| Ex. 6-37 | 7 | A | B to A | A | B to A | B to A | |
| Ex. 6-38 | 8 | A | B to A | B to A | B | B to A | |
| Ex. 6-39 | 9 | A | B | A | B to A | B | |
| Ex. 6-40 | 10 | A | C to B | A | A | C to B | |
| Ex. 6-41 | 11 | A | B | B to A | C to B | B | |
| Ex. 6-42 | 12 | A | C to B | A | B to A | C to B | |
| Ex. 6-43 | 13 | A | B | B to A | C to B | B | |
| Ex. 6-44 | 14 | A | B | B to A | C to B | B | |
| Ex. 6-45 | 15 | A | B to A | A | B to A | B to A | |
| Compara. Ex. 6-9 | 16 | A | D to C | B to A | C to B | D to C | |
| Compara. Ex. 6-10 | 17 | A | D | A | B to A | D | |
| Compara. Ex. 6-11 | 18 | A | C | B to A | C to B | C | |
| Compara. Ex. 6-12 | 19 | A | D to C | B to A | C to B | D to C | |

As has been specifically described above, by using an electrophotographic photoconductor that includes at least an intermediate layer and a photosensitive layer wherein the intermediate layer contains a compound (electron transporting agent) represented by the foregoing general formula (1), it is made possible to provide an electrophotographic photoconductor that generates minimum abnormal images and features small variations in electrostatic characteristics after repetitive use of an image forming apparatus and/or under different usage environments.

In addition, this electrophotographic photoconductor can provide an image forming apparatus and full-color image forming apparatus that can also achieve stable image output, and a very easy-to-use process cartridge.

EXAMPLE 7-1

An aluminum cylinder of 340 mm length and 30 mm diameter (JIS1050) was adopted as a conductive support, and the following coating solution for under layer and coating solution for photosensitive layer were sequentially applied on the conductive support and dried to produce a photoconductor provided with an under layer of 0.9 μm thickness and a photosensitive layer of 20 μm thickness (hereinafter referred to as "Photoconductor 1").

| (Coating solution for under layer) | |
|---|---|
| Acethylacetone zirconium butoxide (Orgatics ZC540, Matsumoto Chemical Industry Co., Ltd.) | 20 Parts |
| γ-Aminopropyltriethoxysilane (A1100, Nippon Unicar Company Limited) | 2 Parts |
| Polyvinylbutyral resin (S-LEC BM-S, Sekisui Chemical Co., Ltd.) | 1.5 Parts |
| n-Butylalcohol | 70 Parts |

The coating solution consisting of these ingredients was applied on the conductive support by dip coating and dried for 10 minutes at 150° C. to form an under layer.

<Coating Solution for Photosensitive Layer>

As a charge generating substance, 30 parts of Pigment 1 was dispersed into 970 parts of cyclohexanone using a ball mill for 2 hours to prepare a dispersion of charge generating substance. Separately, 49 parts of Z-polycarbonate resin (viscosity-average molecular weight=40,000, Teijin Chemicals, Ltd.), 20 parts of Compound 1 prepared in Synthesis Example 1, 29.5 parts of the compound represented by the following structural formula, and 0.1 part of silicone oil (KF50-100CS, Shin-Etsu Chemical Co., Ltd.) were dissolved into 340 parts of tetrahydrofuran. To the resultant mixture was added 66.6 parts of the foregoing dispersion of charge generating substance, and stirred to prepare a coating solution for photosensitive layer.

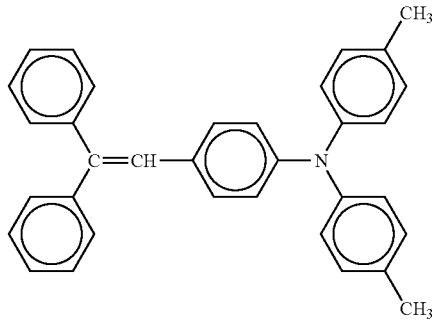

EXAMPLE 7-2

A photoconductor was prepared in a manner similar to that described in Example 7-1, with ingredients for the coating solution for under layer changed to those described below (hereinafter referred to as "Photoconductor 2").

| (Coating solution for under layer) | |
|---|---|
| Titanium acetylacetonate (Orgatics TC1000, Matsumoto Chemical Industry Co., Ltd.) | 10 Parts |
| γ-(2-aminoethyl)aminopropyltriethoxysilane | 1 Part |
| Polyvinylbutyral resin (S-LEC BM-1, Sekisui Chemical Co., Ltd.) | 1.5 Parts |
| Isopropylalcohol | 70 Parts |

EXAMPLE 7-3

A photoconductor was prepared in a manner similar to that described in Example 7-1, with Compound 2 prepared in Synthesis Example 2 used instead of Compound 1 prepared in Synthesis Example 1 (hereinafter referred to as "Photoconductor 3").

EXAMPLE 7-4

A photoconductor was prepared in a manner similar to that described in Example 7-1, with Compound 3 prepared in Synthesis Example 3 used instead of Compound 1 prepared in Synthesis Example 1 (hereinafter referred to as "Photoconductor 4").

EXAMPLE 7-5

A photoconductor was prepared in a manner similar to that described in Example 7-1, with Pigment 2 used instead of Pigment 1 (hereinafter referred to as "Photoconductor 5").

COMPARATIVE EXAMPLE 7-1

A photoconductor was prepared in a manner similar to that described in Example 7-1, with no under layer provided on the conductive support (hereinafter referred to as "Photoconductor 6").

COMPARATIVE EXAMPLE 7-2

A photoconductor was prepared in a manner similar to that described in Example 7-1, with ingredients for the coating solution for under layer changed to those described below and the thickness of the resultant under layer set to 0.3 μm (hereinafter referred to as "Photoconductor 7").

| <Coating solution for under layer> | |
|---|---|
| Alcohol-soluble nylon (Amilan CM8000, Toray Industries, Inc.) | 4 Parts |
| Methanol | 70 Parts |
| n-Butanol | 30 Parts |

COMPARATIVE EXAMPLE 7-3

A photoconductor was prepared in a manner similar to that described in Example 7-1, with Compound 1 prepared in Synthesis Example 1 not being used (hereinafter referred to as "Photoconductor 8").

COMPARATIVE EXAMPLE 7-4

A photoconductor was prepared in a manner similar to that described in Example 7-1, with the compound represented by the following structural formula used instead of Compound 1 prepared in Synthesis Example 1 (hereinafter referred to as "Photoconductor 9").

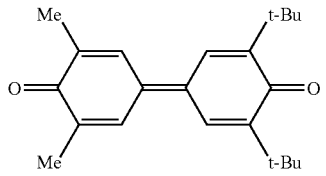

COMPARATIVE EXAMPLE 7-5

A photoconductor was prepared in a manner similar to that described in Example 7-1, with the compound represented by the following structural formula used instead of Compound 1 prepared in Synthesis Example 1 (hereinafter referred to as "Photoconductor 10").

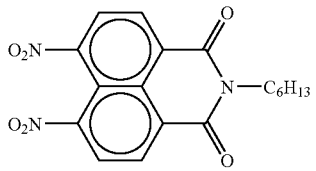

EXAMPLE 7-6

An aluminum cylinder of 340 mm length and 30 mm diameter (JIS1050) was adopted as a conductive support, and the following coating solution for under layer, coating solution for charge generating layer, and coating solution for charge transporting layer were sequentially applied on the conductive support and dried to produce a photoconductor provided with an under layer of 0.9 μm thickness, a charge generating layer of 0.3 μm thickness, and a charge transporting layer of 20 μm thickness (hereinafter referred to as "Photoconductor 11").

| (Coating solution for under layer) | |
|---|---|
| Acethylacetone zirconium butoxide (Orgatics ZC540, Matsumoto Chemical Industry Co., Ltd.) | 20 Parts |
| γ-Aminopropyltriethoxysilane (A1100, Nippon Unicar Company Limited) | 2 Parts |
| Polyvinylbutyral resin (S-LEC BM-S, Sekisui Chemical Co., Ltd.) | 1.5 Parts |
| n-Butylalcohol | 70 Parts |

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 Parts |
| 2-Butanone | 280 Parts |

A commercially available bead mill using PSZ balls of 0.5 mm diameter was adopted, and 2-butanone in which polyvinyl butyral is dissolved and the pigment were placed in the bead mill, performing a dispersing operation for 30 minutes at a rotor speed of 1,200 rpm to prepare a dispersion.

The particle size distribution of the pigment particles in this dispersion was measured using a particle size analyzer (CAPA-700, Horiba, Ltd.), and the average particle diameter of the pigment particles was determined to be 0.30 μm, with standard deviation of 0.19 μm.

| <Coating solution for charge transporting layer> | |
|---|---|
| Compound 1 prepared in Synthesis Example 1 | 9 Parts |
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of Compound 1 and silicone oil, allowing these ingredients to completely dissolve. In this way a coating solution for charge transporting layer was prepared.

COMPARATIVE EXAMPLE 7-6

A photoconductor was prepared in a manner similar to that described in Example 7-6, with no under layer being provided (hereinafter referred to as "Photoconductor 12").

COMPARATIVE EXAMPLE 7-7

A photoconductor was prepared in a manner similar to that described in Example 7-6, with the compound represented by the following structural formula used instead of Compound 1 prepared in Synthesis Example 1 (hereinafter referred to as "Photoconductor 13").

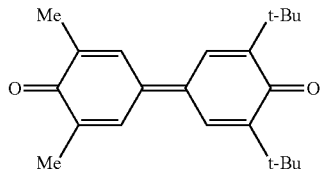

COMPARATIVE EXAMPLE 7-8

A photoconductor was prepared in a manner similar to that described in Example 7-6, with the compound represented by the following structural formula used instead of Compound 1 prepared in Synthesis Example 1 (hereinafter referred to as "Photoconductor 14").

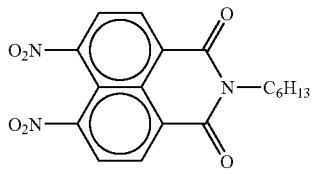

EXAMPLE 7-7

Photoconductor 1 prepared above was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): +500V

Development bias: +350V

Exposed part surface potential at a development site: +70V

Evaluation was made by measuring the exposed part potential before and after the 10,000-sheet continuous printing in the following manner: A surface electrometer was placed on the development site shown in FIG. 4, Photoconductor 1 was charged to +500V, exposure was performed to create a solid image using the semiconductor laser, and both the non-exposed part surface potential and exposed part potential at the development site were measured using the surface electrometer. In addition, a white solid image was printed out after the 10,000-sheet continuous printing for the evaluation of background smear on a scale of A to D, where A=excellent, B=good, C=bad, and D=poor. The results are also shown in Table 7-1.

EXAMPLES 7-8 to 7-12, AND COMPARATIVE EXAMPLES 7-9 TO 7-16

Evaluations similar to that for Example 7-7 were made except that Photoconductors 2 to 14 were used instead of Photoconductor 1. As a process condition, photoconductor's surface potential (non-exposed part potential) was set to +500V, and development bias was set to +350V. Exposure level was so adjusted that the exposed part potential of photoconductor at an initial state was +70V as in Example 7-7. At these settings, the exposed part surface potential was measured before and after the endurance test. The results are shown in Table 7-1.

TABLE 7-1

| | | Exposed part potential (V) | | Background smear | |
|---|---|---|---|---|---|
| | Photoconductor | Before printing | After 10,000-sheet printing | Before printing | After 10,000-sheet printing |
| Ex. 7-7 | 1 | 70 | 90 | B to A | B |
| Ex. 7-8 | 2 | 70 | 80 | B to A | B |
| Ex. 7-9 | 3 | 70 | 110 | B to A | B |
| Ex. 7-10 | 4 | 80 | 120 | B to A | B |
| Ex. 7-11 | 5 | 60 | 80 | A | B to A |
| Compara. Ex. 7-9 | 6 | 70 | 80 | C to B | D |
| Compara. Ex. 7-10 | 7 | 70 | 140 | B | D to C |
| Compara. Ex. 7-11 | 8 | 90 | 170 | B to A | B |
| Compara. Ex. 7-12 | 9 | 8 | 140 | B to A | B |

TABLE 7-1-continued

| | Photoconductor | Exposed part potential (V) Before printing | Exposed part potential (V) After 10,000-sheet printing | Background smear Before printing | Background smear After 10,000-sheet printing |
|---|---|---|---|---|---|
| Compara. Ex. 7-13 | 10 | 90 | 160 | B to A | B |
| Ex. 7-12 | 11 | 70 | 90 | B to A | B |
| Compara. Ex. 7-14 | 12 | 70 | 80 | C to B | D |
| Compara. Ex. 7-15 | 13 | 80 | 160 | B to A | B |
| Compara. Ex. 7-16 | 14 | 90 | 170 | B to A | B |

EXAMPLE 7-13

An aluminum cylinder of 340 mm length and 30 mm diameter (JIS1050) was adopted as a conductive support, and the following coating solution for under layer, coating solution for charge generating layer, and coating solution for charge transporting layer were sequentially applied on the conductive support and dried to produce a photoconductor provided with an under layer of 0.9 μm thickness, a charge generating layer of 0.3 μm thickness, and a charge transporting layer of 20 μm thickness (hereinafter referred to as "Photoconductor 15").

| (Coating solution for under layer) | |
|---|---|
| Acethylacetone zirconium butoxide (Orgatics ZC540, Matsumoto Chemical Industry Co., Ltd.) | 20 Parts |
| γ-Aminopropyltriethoxysilane (A1100, Nippon Unicar Company Limited) | 2 Parts |
| Polyvinylbutyral resin (S-LEC BM-S, Sekisui Chemical Co., Ltd.) | 1.5 Parts |
| n-Butylalcohol | 70 Parts |

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |
| Compound 1 prepared in Synthesis Example 1 | 1 Part |

A commercially available bead mill using PSZ balls of 0.5 mm diameter was adopted, and 2-butanone in which both polyvinyl butyral and Compound 1 are dissolved and the pigment were placed in the bead mill, performing a dispersing operation for 30 minutes at a rotor speed of 1,200 rpm to prepare a dispersion.

| <Coating solution for charge transporting layer> | |
|---|---|
| Charge transporting substance represented by the following structural formula | 7 Parts |

-continued

<Coating solution for charge transporting layer>

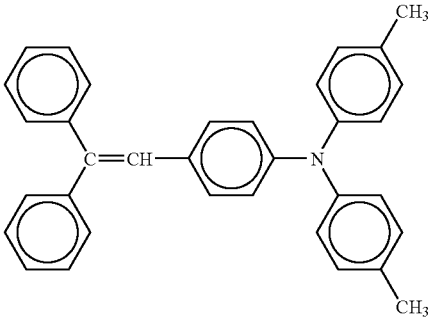

| | |
|---|---|
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

COMPARATIVE EXAMPLE 7-17

A photoconductor was prepared in a manner similar to that described in Example 7-13, with Compound 1 prepared in Synthesis Example 1 not being used (hereinafter referred to as "Photoconductor 16").

EXAMPLE 7-14

Photoconductor 15 prepared above was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): −900V

Development bias: −650V

Exposed part surface potential at a development site: −110V

Evaluation was made by measuring the non-exposed part potential before and after 10,000-sheet continuous printing in the following manner: A surface electrometer was placed on the development site shown in FIG. 4, development bias was fixed such that Photoconductor 15 was charged to −900V at an initial state, and the non-exposed part surface potential at the development site was measured using the surface electrometer. The evaluation was made for the first and second rotations of the photoconductor. The results are shown in Table 7-2.

COMPARATIVE EXAMPLE 7-18

Evaluation similar to that for Example 7-14 was made except that Photoconductor 16 was used instead of Photoconductor 15. The results are shown in Table 7-2.

TABLE 7-2

| | Photo-conductor | Non-exposed part potential before printing (−V) First rotation | Non-exposed part potential before printing (−V) Second rotation | Non-exposed part potential after 10,00-sheet printing (−V) First rotation | Non-exposed part potential after 10,00-sheet printing (−V) Second rotation |
|---|---|---|---|---|---|
| Ex. 7-14 | 15 | 900 | 900 | 870 | 900 |
| Compara. Ex. 7-18 | 16 | 900 | 900 | 750 | 890 |

EXAMPLE 7-15

Photoconductor 1 prepared above was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a non-contacting roller charger like that shown in FIG. 5 is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 10,000-sheet continuous printing of an A4-size document was carried out that has uniformly distributed characters accounting for 6% of the entire front surface.

Photoconductor's surface potential (non-exposed part potential): +500V

Development bias: +350V (negative/positive development)

Surface potential after removing of charges (non-exposed part): +80V

Evaluation was made by measuring the exposed part potential after 10,000-sheet continuous printing in the following manner: A surface electrometer was placed on the development site shown in FIG. 8, Photoconductor 1 was charged to +500V, exposure was performed to create a solid image using the semiconductor laser, and the exposed part potential at the development site was measured using the surface electrometer. Furthermore, the ISO/JIS-SCID N1 pattern (portrait) was printed out after the 10,000-sheet continuous printing for the evaluation of the color reproducibility on a scale of A to D, where A=excellent, B=good, C=bad, and D=poor. In addition, a white solid image was printed out after the 10,000-sheet continuous printing for the evaluation of background smear. The results thus obtained are shown in Table 7-3.

EXAMPLES 7-16 to 7-20, AND COMPARATIVE EXAMPLES 7-19 TO 7-26

Evaluations similar to that for Example 7-15 were made except that Photoconductors 2 to 14 were used instead of Photoconductor 1. As a process condition, photoconductor's surface potential (non-exposed part potential) was set to +500V, and development bias was set to +350V. Exposure level was so adjusted that the exposed part potential of photoconductor at an initial state was +80V as in Example 7-15. At these settings, the exposed part surface potential was measured before and after the endurance test. The results are shown in Table 7-3.

TABLE 7-3

| | Photo-conductor | Exposed part potential (V) Before printing | Exposed part potential (V) After 10,000-sheet printing | Color reproducibility After 10,000-sheet printing | Background smear After 10,000-sheet printing |
|---|---|---|---|---|---|
| Ex. 7-15 | 1 | 90 | 110 | B to A | B |
| Ex. 7-16 | 2 | 90 | 100 | B | B |
| Ex. 7-17 | 3 | 90 | 130 | B | B |
| Ex. 7-18 | 4 | 100 | 140 | B to A | B |
| Ex. 7-19 | 5 | 80 | 90 | B to A | B to A |
| Compara. Ex. 7-19 | 6 | 90 | 100 | B | D |
| Compara. Ex. 7-20 | 7 | 90 | 160 | C | D to C |
| Compara. Ex. 7-21 | 8 | 110 | 190 | D to C | B |
| Compara. Ex. 7-22 | 9 | 100 | 160 | C | B |
| Compara. Ex. 7-23 | 10 | 110 | 180 | D to C | B |
| Ex. 7-20 | 11 | 90 | 110 | B to A | B |
| Compara. Ex. 7-24 | 12 | 90 | 110 | B to A | D |
| Compara. Ex. 7-25 | 13 | 100 | 180 | D to C | B |
| Compara. Ex. 7-26 | 14 | 110 | 190 | D to C | B |

EXAMPLE 8-1

An aluminum cylinder of 340 mm length and 30 mm diameter (JIS1050) was adopted as a conductive support, and the following coating solution for intermediate layer and coating solution for photosensitive layer were sequentially applied thereon and dried to form an intermediate layer of 0.9 μm thickness and photosensitive layer of 20 μm thickness. In addition, a protective layer of 2.5 μm thickness was formed on the photosensitive layer in the following manner to fabricate a photoconductor (hereinafter referred to as "Photoconductor 1").

| (Coating solution for intermediate layer) | |
|---|---|
| Acethylacetone zirconium butoxide (Orgatics ZC540, Matsumoto Chemical Industry Co., Ltd.) | 20 Parts |
| γ-Aminopropyltriethoxysilane (A1100, Nippon Unicar Company Limited) | 2 Parts |
| Polyvinylbutyral resin (S-LEC BM-S, Sekisui Chemical Co., Ltd.) | 1.5 Parts |
| n-Butylalcohol | 70 Parts |

<Coating Solution for Photosensitive Layer>

As a charge generating substance, 30 parts of Pigment 1 was dispersed into 970 parts of cyclohexanone using a ball mill for 2 hours to prepare a dispersion of charge generating substance. Separately, 49 parts of Z-polycarbonate resin (viscosity-average molecular weight=40,000, Teijin Chemicals, Ltd.), 20 parts of Compound 1 prepared in Synthesis Example 1, 29.5 parts of the compound represented by the following structural formula, and 0.1 part of silicone oil (KF50-100CS, Shin-Etsu Chemical Co., Ltd.) were dissolved into 340 parts of tetrahydrofuran. To the resultant mixture was added 66.6 parts of the foregoing dispersion of charge generating substance, and stirred to prepare a coating solution for photosensitive layer.

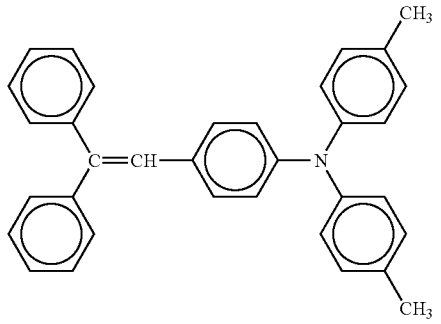

(Protective Layer)

Figure 15:
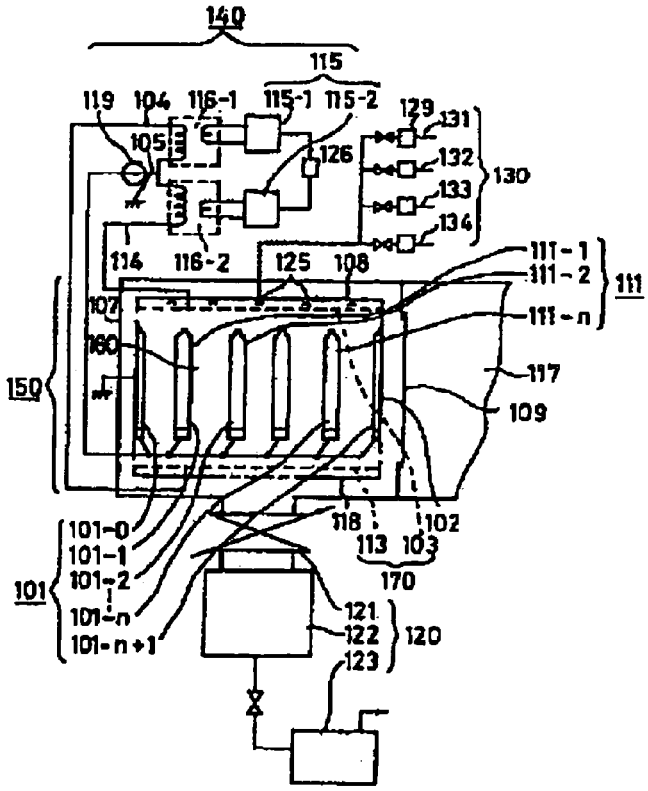
FIG. 15 shows an example of a plasma CVD device for forming a surface protection layer on an organic photosensitive layer.
Figure 16:
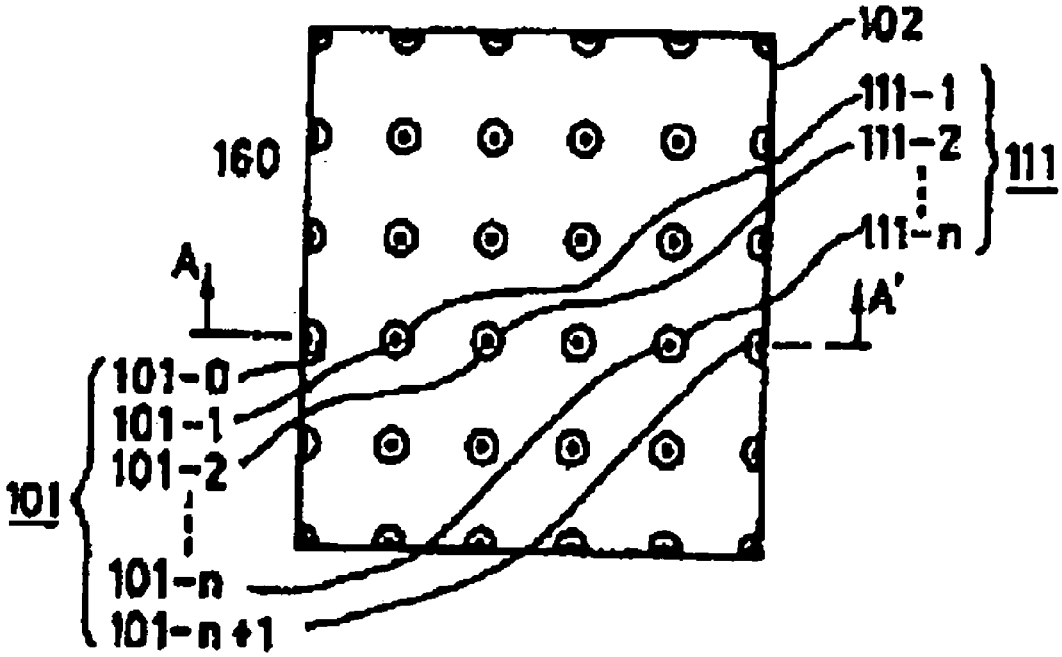
FIG. 16 shows a frame-shaped structure of the CVD device.
Figure 17:
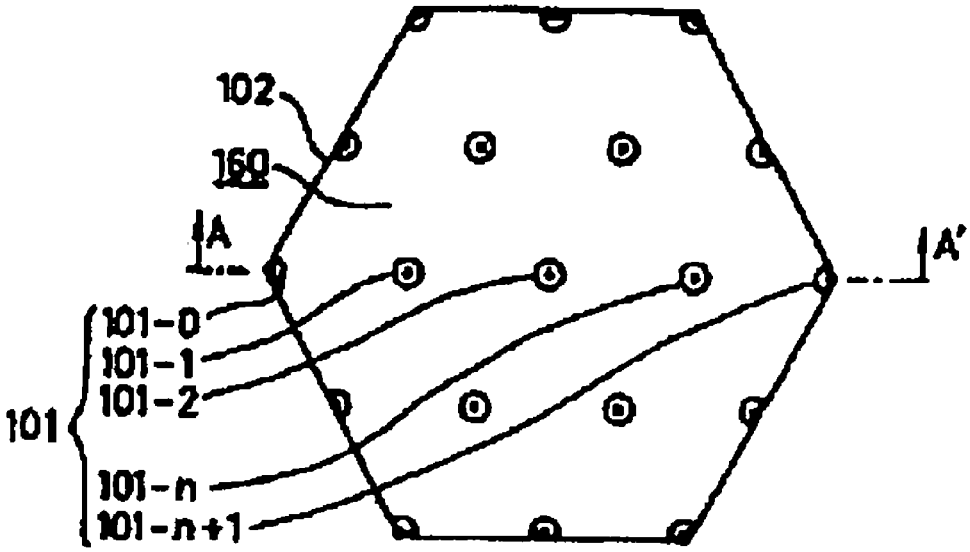
FIG. 17 shows a frame-shaped structure of the CVD device.

The photosensitive layer produced in this way was then placed in a plasma CVD device shown in FIGS. 15 to 17 for the formation of a surface protective layer thereon. In FIG. 15, reference numeral 107 denotes a vacuum chamber 107, which is separated by a gate valve 109 from a load/unload reserve chamber 117. The vacuum chamber 107 is maintained under vacuum by means of an exhaust system 120 consisting of a pressure adjusting valve 121, a turbo molecular pump 122 and a rotary pump 123, and a constant pressure is maintained. A reaction chamber 150 is provided in the vacuum chamber 107. The reaction chamber 150 consists of a frame-shaped structure 102 like that shown in FIG. 16 or FIG. 17 (it looks like a square or hexagonal when view from the electrode side), hoods 108 and 118 covering the openings on both ends of the structure 102, and a pair of identical first and second electrodes 103 and 113 (metal mesh made of aluminum or the like) provided to the hoods 108 and 118, respectively. Reference numeral 130 denotes gas lines through which gas is introduced in the reaction chamber 150 and to which various gas containers are connected, and each gas from the container passes through a flow meter 129 and is introduced into the reaction chamber 150 via a nozzle 125. In the frame-shaped structure 102 there are provided supports 111 (111-1, 111-2 . . . 111-n) that constitute the photosensitive layer, as shown in FIGS. 16 and 17. Each support is arranged as a third electrode as will be described later. The electrodes 103 and 113 are provided with a pair of power sources 115-1 and 115-2 for applying a first alternating current voltage. The frequency for the first alternating current voltage is 1 to 100 MHz. The power sources 115-1 and 115-2 are connected to matching transformers 116-1 and 116-2, respectively. A phase adjuster 126 is used for the phase adjustment in the matching transformers 116-1 and 116-2, producing signals that match or differ by a 180° phase shift. The end 104 of the matching transformer is connected to the second electrode 113, and the other end 114 of the matching transformer to the first electrode 103. The midpoint 105 of the transformer on the output side is maintained at a ground potential. A power source 119 is also arranged that applies a second alternating current voltage between the midpoint 105 and the third electrode, that is, each of the supports 101-1, 101-2 . . . 101-(n+1) or a holder 102 that is electrically connected with the supports 101. The frequency for the second alternating current voltage is 1 to 500 kHz. The output of the first alternating current voltage to be applied to the first and second electrodes is 0.1 to 1 kW in a case of 13.56 MHz, and the output of the second alternating current voltage to be applied to the third electrode (i.e., support) is about 100 W in a case of 150 MHz.

A surface protective layer was formed under the following condition.

Flow rate of $CH_4$: 200 sccm
Flow rate of $H_2$: 100 sccm
Reaction pressure: 0.05 Torr
First alternating current voltage output: 100 W, 13.56 MHz
Bias voltage (direct current): −200V

EXAMPLE 8-2

A photoconductor was prepared in a manner similar to that described in Example 8-1, with Compound 2 prepared in Synthesis Example 2 used instead of Compound 1 prepared in Synthesis Example 1 (hereinafter referred to as "Photoconductor 2").

EXAMPLE 8-3

A photoconductor was prepared in a manner similar to that described in Example 8-1, with Compound 3 prepared in Synthesis Example 3 used instead of Compound 1 prepared in Synthesis Example 1 (hereinafter referred to as "Photoconductor 3").

EXAMPLE 8-4

A photoconductor was prepared in a manner similar to that described in Example 8-1, with Pigment 2 used instead of Pigment 1 for the coating solution for photosensitive layer (hereinafter referred to as "Photoconductor 4").

COMPARATIVE EXAMPLE 8-1

A photoconductor was prepared in a manner similar to that described in Example 8-1, with no protective layer provided on the conductive support (hereinafter referred to as "Photoconductor 5").

COMPARATIVE EXAMPLE 8-2

A photoconductor was prepared in a manner similar to that described in Example 8-1, with Compound 1 prepared in Synthesis Example 1 not being used for the coating solution for photosensitive layer (hereinafter referred to as "Photoconductor 6").

COMPARATIVE EXAMPLE 8-3

A photoconductor was prepared in a manner similar to that described in Example 8-1, with the compound represented by the following structural formula used instead of Compound 1 prepared in Synthesis Example 1 (hereinafter referred to as "Photoconductor 7").

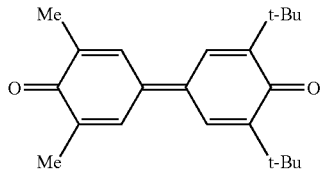

COMPARATIVE EXAMPLE 8-4

A photoconductor was prepared in a manner similar to that described in Example 8-1, with the compound represented by the following structural formula used instead of Compound 1 prepared in Synthesis Example 1 (hereinafter referred to as "Photoconductor 8").

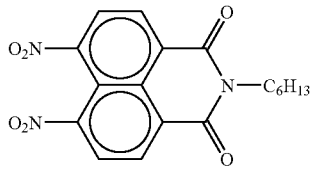

EXAMPLE 8-5

An aluminum cylinder of 340 mm length and 30 mm diameter (JIS1050) was adopted as a conductive support, and the following coating solution for intermediate layer, coating solution for charge generating layer, and coating solution for charge transporting layer were sequentially applied on the conductive support and dried to produce an intermediate layer of 0.9 μm thickness, a charge generating layer of 0.3 μm thickness, and a charge transporting layer of 20 μm thickness. In addition, a protective layer of 2.5 μm thickness was formed. In this way a photoconductor was fabricated (hereinafter referred to as "Photoconductor 9").

| (Coating solution for intermediate layer) | |
|---|---|
| Acethylacetone zirconium butoxide (Orgatics ZC540, Matsumoto Chemical Industry Co., Ltd.) | 20 Parts |
| γ-Aminopropyltriethoxysilane (A1100, Nippon Unicar Company Limited) | 2 Parts |
| Polyvinylbutyral resin (S-LEC BM-S, Sekisui Chemical Co., Ltd.) | 1.5 Parts |
| n-Butylalcohol | 70 Parts |

(Coating Solution for Charge Generating Layer)

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |

A commercially available bead mill using PSZ balls of 0.5 mm diameter was adopted, and 2-butanone in which polyvinyl butyral is dissolved and the pigment were placed in the bead mill, performing a dispersing operation for 30 minutes at a rotor speed of 1,200 rpm to prepare a dispersion.

| <Coating solution for charge transporting layer> | |
|---|---|
| Compound 1 prepared in Synthesis Example 1 | 9 Parts |
| Z-polycarbonate resin (PANLITE TS2040, Teijin Chemicals, Ltd.) | 10 Parts |

-continued

| <Coating solution for charge transporting layer> | |
|---|---|
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of Compound 1 and silicone oil, allowing these ingredients to completely dissolve. In this way a coating solution for charge transporting layer was prepared.

(Protective Layer)

A protective layer was formed as in Example 8-1.

COMPARATIVE EXAMPLE 8-5

A photoconductor was prepared in a manner similar to that described in Example 8-5, with no protective layer provided on the photoconductor (hereinafter referred to as "Photoconductor 10").

COMPARATIVE EXAMPLE 8-6

A photoconductor was prepared in a manner similar to that described in Example 8-5, with the compound represented by the following structural formula used instead of Compound 1 prepared in Synthesis Example 1 for the coating solution for charge transporting layer (hereinafter referred to as "Photoconductor 11").

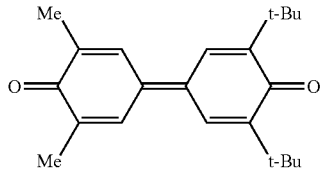

COMPARATIVE EXAMPLE 8-7

A photoconductor was prepared in a manner similar to that described in Example 8-5, with the compound represented by the following structural formula used instead of Compound 1 prepared in Synthesis Example 1 for the coating solution for charge transporting layer (hereinafter referred to as "Photoconductor 12").

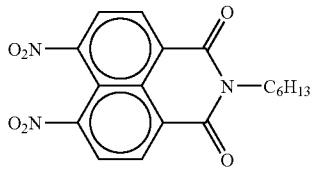

EXAMPLE 8-6

Photoconductor 1 prepared above was mounted on an image forming apparatus like that shown in FIG. 4, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted to satisfy the pre-test process condition shown below, and then 50,000-sheet continuous printing of an A4-size document was carried out that has uniformly distributed characters accounting for 6% of the entire front surface.

Photoconductor's surface potential (non-exposed part potential): +500V

Development bias: +350V

Exposed part surface potential at a development site: +70V

Evaluation was made by measuring the exposed part potential after 50,000-sheet continuous printing in the following manner: A surface electrometer was placed on the development site shown in FIG. 4, Photoconductor 1 was charged to +500V, exposure was performed to create a solid image using the semiconductor laser, and the exposed part potential at the development site was measured using the surface electrometer. In addition, a white solid image was printed out after the 50,000-sheet continuous printing for the evaluation of background smear on a scale of A to D, where A=excellent, B=good, C=bad, and D=poor. The results are shown in Table 8-1.

EXAMPLES 8-7 to 8-10, AND COMPARATIVE EXAMPLES 8-8 TO 8-14

Evaluations similar to that for Example 8-6 were made except that Photoconductors 2 to 12 were used instead of Photoconductor 1. As a process condition, photoconductor's surface potential (non-exposed part potential) was set to +500V, and development bias was set to +350V. Exposure level was so adjusted that the exposed part potential of photoconductor at an initial state was +60V as in Example 8-6. At these settings, the exposed part surface potential was measured before and after the endurance test. The results are shown in Table 8-1.

EXAMPLE 8-11

An aluminum cylinder of 340 mm length and 30 mm diameter (JIS1050) was adopted as a conductive support, and the following coating solution for intermediate layer, coating solution for charge generating layer, and coating solution for charge transporting layer were sequentially applied thereon and dried to form an intermediate layer of 3.5 μm thickness, a charge generating layer of 0.3 μm thickness, and a charge transporting layer of 20 μm thickness. In addition, a protective layer of 2.5 μm thickness was formed on the charge transporting layer. In this way a photoconductor was fabricated (hereinafter referred to as "Photoconductor 13").

| <Coating solution for intermediate layer> | |
|---|---|
| Titanium oxide (CR-EL, Ishihara Sangyo Kaisha, Ltd. Average particle diameter = 0.25 μm) | 84 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |
| Compound 1 prepared in Synthesis Example 1 | 1 Part |

A commercially available bead mill using PSZ balls of 0.5 mm diameter was adopted, and 2-butanone in which both

TABLE 8-1

| | | Exposed part potential (V) | | Background smear | | |
|---|---|---|---|---|---|---|
| | Photoconductor | Before printing | After 50,000-sheet printing | Before printing | After 50,000-sheet printing | Remarks (after 50,000-sheet printing) |
| Ex. 8-6 | 1 | 70 | 100 | B to A | B | |
| Ex. 8-7 | 2 | 80 | 120 | B to A | B | |
| Ex. 8-8 | 3 | 80 | 120 | B to A | B | |
| Ex. 8-9 | 4 | 60 | 90 | A | B to A | |
| Compara. Ex. 8-8 | 5 | 70 | 90 | C to B | D | |
| Compara. Ex. 8-9 | 6 | 90 | 170 | B to A | B | Reduced image density |
| Compara. Ex. 8-10 | 7 | 80 | 140 | B to A | B | Reduced image density |
| Compara. Ex. 8-11 | 8 | 90 | 160 | B to A | B | Reduced image density |
| Ex. 8-10 | 9 | 70 | 100 | B to A | B | |
| Compara. Ex. 8-12 | 10 | 70 | 90 | B to A | D | |
| Compara. Ex. 8-13 | 11 | 80 | 150 | B to A | B | Reduced image density |
| Compara. Ex. 8-14 | 12 | 80 | 180 | B to A | B | Reduced image density |

polyvinyl butyral and Compound 1 are dissolved and the pigment were all placed in the bead mill, performing a dispersing operation for 30 minutes at a rotor speed of 1,200 rpm to prepare a dispersion.

| <Coating solution for charge transporting layer> | |
|---|---|
| Charge transporting substance represented by the following structural formula | 7 Parts |

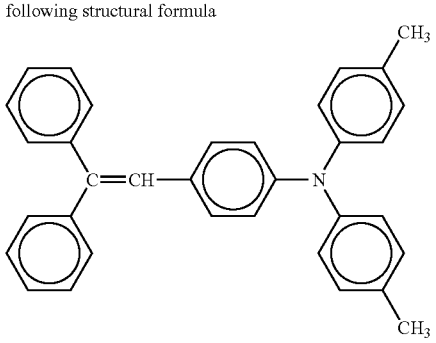

| | |
|---|---|
| Z-polycarbonate resin (PANLITE TS2040, Teijin Chemicals, Ltd.) | 10 Parts |
| Tetrahydrofuran | 120 Parts |
| Silicone oil (KF50-100CS, Shin-Etsu Chemical Co., Ltd.) | 0.01 Part |

The Z-polycarbonate resin was dissolved into tetrahydrofuran, followed by sequential addition of the charge transporting substance and silicone oil, allowing these ingredients to completely dissolve. In this way a coating solution for charge transporting layer was prepared.

(Protective Layer)

A protective layer was formed as in Example 8-1.

EXAMPLE 8-12

A photoconductor was prepared in a manner similar to that described in Example 8-11, with the intermediate layer changed to one consisting of a charge blocking layer and a moire preventing layer (hereinafter referred to as "Photoconductor 14"). A charge blocking layer of 0.5 μm thickness and a moire preventing layer of 3.5 μm thickness were formed by applying the following coating solutions for charge blocking layer and moire preventing layer on a conductive support.

| <Coating solution for charge blocking layer> | |
|---|---|
| N-methoxymethylated nylon (FR101, Namariichi Co., Ltd.) | 5 Parts |
| Methanol | 70 Parts |
| n-Butanol | 30 Parts |

| <Coating solution for moire preventing layer> | |
|---|---|
| Titanium oxide (CR-EL, Ishihara Sangyo Kaisha, Ltd. Average particle diameter = 0.25 μm) | 126 Parts |
| Alkyd resin (BEKKOLITE M6401-50-S, Dainippon Ink & Chemicals, Inc., solid content = 50%) | 33.6 Parts |
| Melamine resin (SUPER BEKKAMIN L-121-60, Dainippon Ink & Chemicals, Inc., solid content = 60%) | 18.7 Parts |
| 2-Butanone | 100 Parts |

EXAMPLE 8-13

A photoconductor was prepared in a manner similar to that described in Example 8-12, with the intermediate layer changed to one consisting of the following charge generating layer and charge blocking layer (hereinafter referred to as "Photoconductor 15").

<Coating Solution for Charge Generating Layer>

A dispersion containing the following ingredients was produced in a bead mill under the condition described below.

| | |
|---|---|
| Titanyl phthalocyanine pigment prepared in Pigment Synthesis Example 1 | 15 Parts |
| Polyvinyl butyral (BX-1, Sekisui Chemical Co., Ltd.) | 10 parts |
| 2-Butanone | 280 parts |

A commercially available bead mill using PSZ balls of 0.5 mm diameter was adopted, and 2-butanone in which polyvinyl butyral is dissolved and the pigment were both placed in the bead mill, performing a dispersing operation for 30 minutes at a rotor speed of 1,200 rpm to prepare a dispersion.

| <Coating solution for charge blocking layer> | |
|---|---|
| N-methoxymethylated nylon (FR101, Namariichi Co., Ltd.) | 5 Parts |
| Compound 1 prepared in Synthesis Example 1 | 1 Part |
| Methanol | 70 Parts |
| n-Butanol | 30 Parts |

EXAMPLE 8-14

A photoconductor was prepared in a manner similar to that described in Example 8-11, with the condition under which the surface protective layer is produced being changed to that described below (hereinafter referred to as "Photoconductor 16").

Flow rate of $CH_4$: 100 sccm

Flow rate of $H_2$: 200 sccm

Flow rate of $N_2$: 35 sccm

Reaction pressure: 0.02 Torr

First alternating current voltage output: 100 W, 13.56 MHz

Bias voltage (direct current): −150V

XPS analysis on the surface protective layer thus prepared revealed the presence of nitrogen therein.

EXAMPLE 8-15

A photoconductor was prepared in a manner similar to that described in Example 8-11, with the condition under which the surface protective layer is produced being changed to that described below (hereinafter referred to as "Photoconductor 17").

Flow rate of $C_2H_4$: 100 sccm

Flow rate of $H_2$: 50 sccm

Flow rate of $C_2F_6$: 100 sccm

Reaction pressure: 0.01 Torr

First alternating current voltage output: 100 W, 13.56 MHz

Bias voltage (direct current): −200V

XPS analysis on the surface protective layer thus prepared revealed the presence of fluorine therein.

EXAMPLE 8-16

A photoconductor was prepared in a manner similar to that described in Example 8-11, with the condition under which the surface protective layer is produced being changed to that described below (hereinafter referred to as "Photoconductor 18").

Flow rate of $C_2H_4$: 90 sccm

Flow rate of $H_2$: 200 sccm

Flow rate of $PH_3$: 45 sccm

Reaction pressure: 0.02 Torr

First alternating current voltage output: 100 W, 13.56 MHz

Bias voltage (direct current): −150V

XPS analysis on the surface protective layer thus prepared revealed the presence of phosphorus therein.

EXAMPLE 8-17

A photoconductor was prepared in a manner similar to that described in Example 8-11, with the condition under which the surface protective layer is produced being changed to that described below (hereinafter referred to as "Photoconductor 19").

Flow rate of $C_2H_4$: 90 sccm

Flow rate of $H_2$: 200 sccm

Flow rate of $CH_3Cl$: 50 sccm

Reaction pressure: 0.01 Torr

First alternating current voltage output: 100 W, 13.56 MHz

Bias voltage (direct current): −150V

XPS analysis on the surface protective layer thus prepared revealed the presence of chlorine therein.

EXAMPLE 8-18

A photoconductor was prepared in a manner similar to that described in Example 8-11, with the condition under which the surface protective layer is produced being changed to that described below (hereinafter referred to as "Photoconductor 20").

Flow rate of $C_2H_4$: 90 sccm

Flow rate of $H_2$: 200 sccm

Flow rate of $CH_3Br$: 30 sccm

Reaction pressure: 0.02 Torr

First alternating current voltage output: 100 W, 13.56 MHz

Bias voltage (direct current): −150V

XPS analysis on the surface protective layer thus prepared revealed the presence of bromine therein.

COMPARATIVE EXAMPLE 8-15

A photoconductor was prepared in a manner similar to that described in Example 8-11, with no protective layer being provided (hereinafter referred to as "Photoconductor 21").

COMPARATIVE EXAMPLE 8-16

A photoconductor was prepared in a manner similar to that described in Example 8-11, with Compound 1 not being used for the coating solution for charge generating layer (hereinafter referred to as "Photoconductor 22").

COMPARATIVE EXAMPLE 8-17

A photoconductor was prepared in a manner similar to that described in Example 8-13, with the compound represented by the following structural formula used instead of Compound 1 for the coating solution for charge blocking layer (hereinafter referred to as "Photoconductor 23").

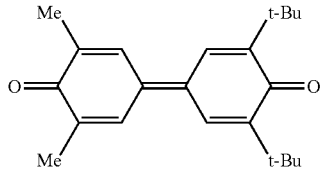

COMPARATIVE EXAMPLE 8-18

A photoconductor was prepared in a manner similar to that described in Example 8-13, with the compound represented by the following structural formula used instead of Compound 1 for the coating solution for charge blocking layer (hereinafter referred to as "Photoconductor 24").

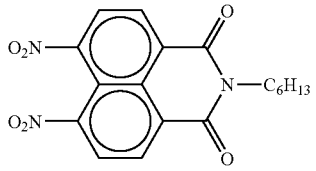

EXAMPLE 8-18

Photoconductor 13 prepared above was attached to a process cartridge like that shown in FIG. 7, and the process cartridge was attached to an image forming apparatus like that shown in FIG. 4 where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 50,000-sheet continuous printing of an A4-size document was carried out that has uniformly distributed characters accounting for 6% of the entire front surface.

Photoconductor's surface potential (non-exposed part potential): −900V

Development bias: −650V

Exposed part surface potential at a development site: −130V

Evaluation was made by measuring the non-exposed part potential before and after 50,000-sheet continuous printing in the following manner: A surface electrometer was placed on the development site shown in FIG. 4, development bias was fixed such that Photoconductor 1 was charged to −900V at an initial state, and the non-exposed part surface potential at the development site was measured using the surface electrometer. The evaluation was made for the first and second rotations of the photoconductor to determine ΔVD—non-exposed part surface potential for the second rotation minus non-exposed part surface potential for the first rotation. The exposed part potential was measured before and after the 50,000-sheet continuous printing in accordance with the method described in Example 8-6. In addition, a white solid image was printed out after the test for the evaluation of background smear on a scale of A to D, where A=excellent, B=good, C=bad, and D=poor. The results are shown in Table 8-2.

EXAMPLES 8-19 to 8-25, AND COMPARATIVE EXAMPLES 8-19 TO 8-22

Evaluations similar to that for Example 8-18 were made except that Photoconductors 14 to 24 were used instead of Photoconductor 13. The results are also shown in Table 8-2.

TABLE 8-2

| | | ΔVD(−V) | | Exposed part potential (−V) | | |
|---|---|---|---|---|---|---|
| | Photo-con-ductor | Before printing | After 50,000-sheet printing | Before printing | After 50,000-sheet printing | Bakcground smear |
| Ex. 8-18 | 13 | 0 | 20 | 130 | 150 | B |
| Ex. 8-19 | 14 | 0 | 30 | 130 | 155 | B to A |
| Ex. 8-20 | 15 | 0 | 10 | 130 | 145 | B to A |
| Ex. 8-21 | 16 | 0 | 20 | 130 | 140 | B |
| Ex. 8-22 | 17 | 0 | 20 | 130 | 140 | B |
| Ex. 8-23 | 18 | 0 | 20 | 130 | 140 | B |
| Ex. 8-24 | 19 | 0 | 20 | 130 | 140 | B |
| Ex. 8-25 | 20 | 0 | 20 | 130 | 140 | B |
| Compara. Ex. 8-19 | 21 | 0 | 10 | 120 | 140 | D |
| Compara. Ex. 8-20 | 22 | 0 | 110 | 130 | 160 | B |
| Compara. Ex. 8-21 | 23 | 0 | 70 | 130 | 155 | B |
| Compara. Ex. 8-22 | 24 | 0 | 90 | 130 | 155 | B |

EXAMPLE 8-26

Photoconductor 13 prepared above was attached to a process cartridge like that shown in FIG. 7, and the process cartridge was attached to a tandem-type full color image forming apparatus like that shown in FIG. 8, where a 780 nm semiconductor laser is used as an exposure source (a polygon mirror is used for image writing), a scorotron charger is used as a charging member, a transferring belt is used as a transfer member, and a 655 nm LED is used as a charge removing source. Both the level of bias applied to the charging member and the exposure level of the semiconductor laser were adjusted so as to satisfy the pre-test process condition shown below, and then 50,000-sheet continuous printing of an A4-size document was carried out that has uniformly distributed characters accounting for 6% of the entire front surface.

Photoconductor's surface potential (non-exposed part potential): −700V

Development bias: −500V

Exposed part surface potential at a development site: −110V

An image shown in FIG. 11 was printed out before and after the 50,000-sheet continuous printing for the evaluation of the level of ghost image at the half-tone area on a scale of A to D, where A=excellent, B=good, C=bad, and.D=poor.

A white solid image was printed out before and after the 50,000-sheet continuous printing for the evaluation of background smear on a scale of A to D, where A=excellent, B=good, C=bad, and D=poor.

Furthermore, the ISO/JIS-SCID N1 pattern (portrait) was printed out after the 50,000-sheet continuous printing for the evaluation of the color reproducibility on a scale of A to D, where A=excellent, B=good, C=bad, and D=poor. The results are shown in Table 8-3.

EXAMPLES 8-27 to 8-33, AND COMPARATIVE EXAMPLES 8-23 TO 8-26

Evaluations similar to that for Example 8-26 were made except that Photoconductors 14 to 24 were used instead of Photoconductor 13. The results are also shown in Table 8-3.

TABLE 8-3

| | | Ghost image | | Background smear | | |
|---|---|---|---|---|---|---|
| | Photo-conductor | Before printing | After 50,000-sheet printing | Before printing | After 50,000-sheet printing | Color balance |
| Ex. 8-26 | 13 | A | B to A | B to A | B | B |
| Ex. 8-27 | 14 | A | B | A | B to A | B |
| Ex. 8-28 | 15 | A | A | A | B to A | A |
| Ex. 8-29 | 16 | A | B to A | B to A | B | B to A |
| Ex. 8-30 | 17 | A | B to A | B to A | B | B to A |
| Ex. 8-31 | 18 | A | B to A | B to A | B | B to A |
| Ex. 8-32 | 19 | A | B to A | B to A | B | B to A |
| Ex. 8-33 | 20 | A | B to A | B to A | B | B to A |
| Compara. Ex. 8-23 | 21 | A | B to A | B to A | D | C |
| Compara. Ex. 8-24 | 22 | A | D | B to A | B | D |
| Compara. Ex. 8-25 | 23 | A | D to C | B to A | B | D to C |
| Compara. Ex. 8-26 | 24 | A | D to C | B to A | B | D to C |

PIGMENT SYNTHESIS EXAMPLE 3

A pigment was prepared in accordance with the method disclosed in JP-A No.2001-19871. More specifically, 29.2 g of 1,3-diiminoisoindoline was mixed with 200 ml of sulfolane, and 20.4 g of titanium tetrabutoxide was added dropwise to the mixture under nitrogen flow. Thereafter, the resultant mixture was gradually heated to 180° C., allowing reaction to take place for 5 hours at 170° C. to 180° C. with agitation. After cooled down, the resulting precipitate was recovered by filtration, washed with chloroform until it became blue, washed with methanol for several times, washed with 80° C. hot water for several times, and dried to produce coarse titanyl phthalocyanine particles. The coarse titanyl phthalocyanine particles were dissolved in 20 volumes of concentrated sulfuric acid, and the resulting mixture was added dropwise to 100 volumes of ice water with agitation. The crystals thus precipitated were recovered by filtration and repeatedly washed until the solution became neutral. In this way a wet cake (aqueous paste) of a titanyl phthalocyanine pigment was obtained, and 2 g of the wet cake was dissolved into 20 g of tetrahydrofuran and agitated for 4 hours. The resultant product was recovered by filtration and dried to produce a titanyl phthalocyanine powder (hereinafter referred to as "Pigment 3").

PIGMENT SYNTHESIS EXAMPLE 4

A pigment was prepared in accordance with the method described in Production Example 1 of JP-A No.03-269064 (Japanese Patent Application Publication (JP-B) No.2584682). More specifically, the wet cake prepared in Synthesis Example 1 was dried, and 1 g of the dried material was mixed with a mixture of 10 g of ion-exchanged water and 1 g of monochlorobenzene and stirred for 1 hour at 50° C. The resultant wet cake was washed with methanol and ion-exchanged water, and dried to produce a pigment (hereinafter referred to as "Pigment 4").

PIGMENT SYNTHESIS EXAMPLE 5

A pigment was prepared in accordance with the method described in Example 1 of JP-A No.11-5919 (JP-B No.3003664). More specifically, 20.4 parts of O-phthalodinitrile and 7.6 parts of titanium tetrachloride were heated for 2 hours at 200° C. in 50 parts of quinoline, and the solvent was removed by steam distillation. The resultant wet cake was then purified with a 2% chlorinated solution and a 2% aqueous solution of sodium hydroxide, washed with methanol and N,N-dimethylformamide, and dried to produce titanyl phthalocyanine. In 40 parts of 98% sulfuric acid (5° C.) was dissolved 2 parts of this titanyl phthalocyanine in small aliquots, and the resultant mixture was stirred for 1 hour at 5° C. Subsequently, the sulfuric solution was gently poured into 400 parts of vigorously agitated ice water, and the precipitated crystals were recovered by filtration. The crystals were washed with distilled water until no acid was observed, thereby producing a wet cake. The wet cake was stirred for 5 hours in 100 parts of THF, recovered by filtration, washed with THF, and dried to produce a pigment (hereinafter referred to as "Pigment 5").

The X-ray diffraction spectrums of all of these pigments obtained in the foregoing Synthesis Examples were determined under the condition described below; they were found to be identical to those corresponding to the respective Patent Literatures.

<Measurement Condition for X-Ray Diffraction Spectrum>

X-ray lamp: Cu

Voltage: 50 kV

Current: 30 mA

Scan speed: 2°/min

Scan range: 3° to 40°

Time constant: 2 seconds

PHOTOCONDUCTOR PRODUCTION EXAMPLE 1

Pigment 3 prepared in Pigment Synthesis Example 3 was dispersed in cyclohexanone under the condition described below to prepare a pigment dispersion.

| | |
|---|---|
| Titanyl phthalocyanine (Pigment 3) | 3 Parts |
| Cyclohexanone | 97 Parts |

Using a 9 cm-diameter glass pot provided with 0.5 mm-diameter PSZ balls, a dispersion operation was conducted for 5 hours at 100 rpm.

A coating solution for photosensitive layer containing the following ingredients was prepared.

| | |
|---|---|
| Pigment Dispersion prepared above | 60 Parts |
| Hole transporting substance represented by the following structural formula (1) | 30 Parts |
| Electron transporting substance represented by the following structural formula (2) | 20 Parts |
| Z-polycarbonate resin (PANLITE TS2050, Teijin Chemicals, Ltd.) | 50 Parts |
| Tetrahydrofuran | 350 Parts |
| Silicone oil (KF50, Shin-Etsu Chemical Co., Ltd.) | 0.01 Part |

Structural Formula (1)

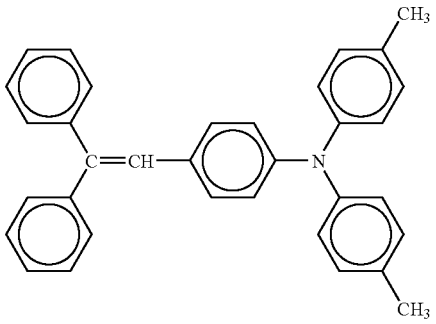

Structural Formula (2)

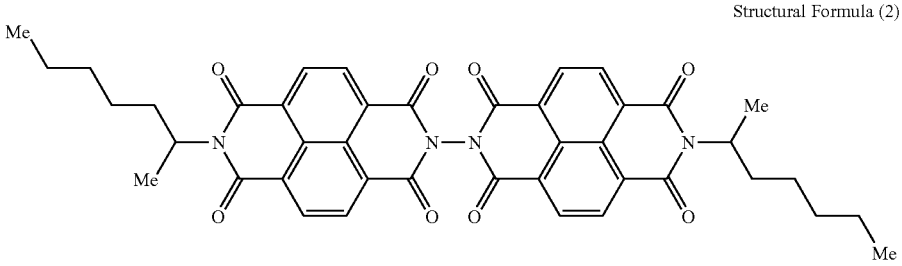

The electron transporting substance represented by the foregoing structural formula (2) was prepared in the manner described below.

<First Step>

To a 200 ml four-neck flask was added 5.0 g (18.6 mmol) of 1,4,5,8-naphthalelentetracarboxylic acid dianhydride and 50 ml of DMF, and heated to reflux. A mixture of 2.14 g (18.6 mmol) of 2-aminoheptane and 25 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography, and the recovered product was re-crystallized using toluene/hexane to produce 2.14 g of Monoimide A (yield=31.5%).

(Second Step)

To a 100 ml four-necked flask was added 2.0 g (5.47 mmol) of Monoimide A, 0.137 g of (2.73 mmol) of hydrazine monohydrate, 10 mg of p-toluene sulfonic acid and 50 ml of toluene, and heated to reflux for 5 hours. Thereafter, the flask was cooled and the mixture was concentrated under vacuum. The resultant residue was subjected to silica gel column chromatography, and the recovered product was re-crystallized using toluene/ethyl acetate to produce 0.668 g of the electron transporting substance represented by the structural formula (2) (yield=33.7%).

Identification of this product was made by Field Desorption Mass Spectroscopy (FD-MS), and it was revealed that the product was the compound of interest on the basis of the peak observed at M/z of 726. Elemental analysis of this compound was as follows: carbon=69.41%, hydrogen=5.27%, nitrogen=7.71% (calculated values) versus carbon=69.52%, hydrogen=5.09%, nitrogen=7.93% (found values).

Next, the coating solution for photosensitive layer was applied onto an aluminum drum of 30 mm diameter and 340 mm length by dip coating, and dried for 20 minutes at 120° C. to form a photosensitive layer of 25 μm thickness thereon. In this way a photoconductor was fabricated (hereinafter referred to as "Photoconductor 1").

PHOTOCONDUCTOR PRODUCTION EXAMPLES 2 AND 3

Photoconductors were prepared in a manner similar to that described in Photoconductor Production Example 1, with Pigments 4 and 5 prepared in Pigment Synthesis Examples 4 and 5 being used instead of Pigment 3 (hereinafter referred to as "Photoconductor 2" for Pigment 4 and "photoconductor 3" for Pigment 5).

PHOTOCONDUCTOR PRODUCTION EXAMPLE 4

A Photoconductor was prepared in a manner similar to that described in Photoconductor Production Example 1, with X-type metal-free phthalocyanine (Fastogen Blue 8120, Dainippon Ink & Chemicals, Inc.) used instead of Pigment 3 (hereinafter referred to as "Photoconductor 4").

PHOTOCONDUCTOR PRODUCTION EXAMPLE 5

A Photoconductor was prepared in a manner similar to that described in Photoconductor Production Example 1, with the bisazo pigment represented by the following structural formula (3) used instead of Pigment 3 used in Photoconductor Production Example 1 (hereinafter referred to as "Photoconductor 5").

Structural Formula (3)

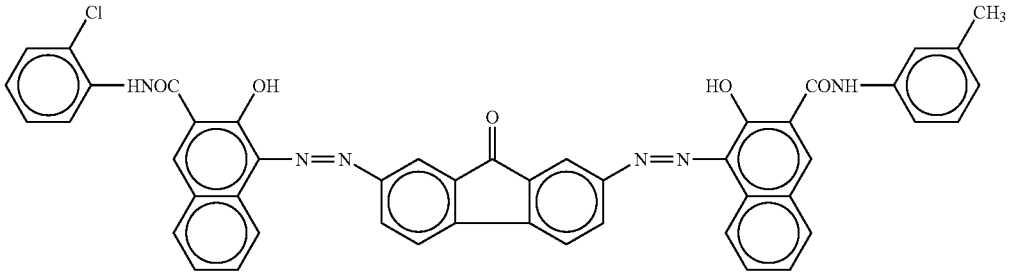

PHOTOCONDUCTOR PRODUCTION EXAMPLE 6

A photoconductor was prepared in a manner similar to that described in Photoconductor Production Example 1, with the hole transporting substance represented by the following structural formula (4) used instead of the hole transporting substance used in Photoconductor Production Example 1 (hereinafter referred to as "Photoconductor 6").

Structural Formula (4)

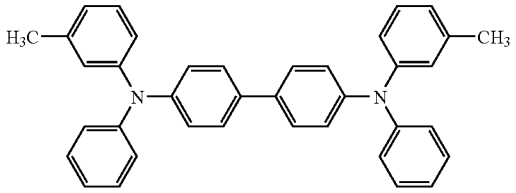

PHOTOCONDUCTOR PRODUCTION EXAMPLE 7

A photoconductor was prepared in a manner similar to that described in Photoconductor Production Example 1, with the hole transporting substance represented by the following structural formula (5) used instead of the hole transporting substance used in Photoconductor Production Example 1 (hereinafter referred to as "Photoconductor 7").

Structural Formula (5)

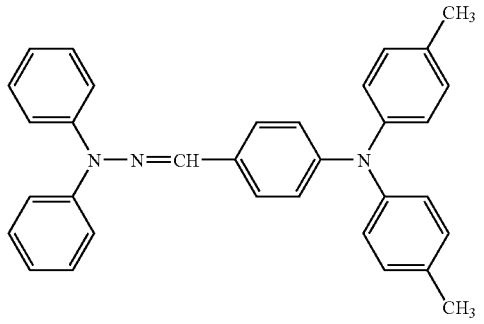

PHOTOCONDUCTOR PRODUCTION EXAMPLE 8

A photoconductor was prepared in a manner similar to that described in Photoconductor Production Example 1, with the electron transporting substance represented by the following structural formula (6) used instead of the electron transporting substance used in Photoconductor Production Example 1 (hereinafter referred to as "Photoconductor 8").

Structural Formula (6)

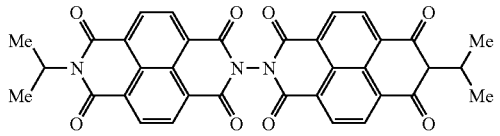

The electron transporting substance represented by the foregoing structural formula (6) was prepared in the manner described below.

<First Step>

To a 200 ml four-neck flask was added 5.0 g (18.6 mmol) of 1,4,5,8-naphthalelentetracarboxylic acid dianhydride and 50 ml of DMF, and heated to reflux. A mixture of 1.10 g (18.6 mmol) of 2-aminopropane and 25 ml of DMF was then added dropwise to the flask with agitation, and heated to reflux for 6 hours. Thereafter, the flask was cooled and the mixture was concentrated under vacuum. The resultant residue was added with toluene and subjected to silica gel column chromatography, and the recovered product was re-crystallized using toluene/hexane to produce 2.08 g of Monoimide B (yield=36.1%).

(Second Step)

To a 100 ml four-necked flask was added 2.0 g (6.47 mmol) of Monoimide B, 0.162 g of (3.23 mmol) of hydrazine monohydrate, 10 mg of p-toluene sulfonic acid and 50 ml of toluene, and heated to reflux for 5 hours. Thereafter, the flask was cooled and the mixture was concentrated under vacuum. The resultant residue was subjected to silica gel column chromatography, and the recovered product was re-crystallized using toluene/ethyl acetate to produce 0.810 g of the electron transporting substance represented by the foregoing structural formula (6) (yield=37.4%).

Identification of this product was made by Field Desorption Mass Spectroscopy (FD-MS), and it was revealed that the product was the compound of interest on the basis of the peak observed at M/z of 614. Elemental analysis of this compound was as follows: carbon=66.45%, hydrogen=3.61%, nitrogen=9.12% (calculated values) versus carbon=66.28%, hydrogen=3.45%, nitrogen=9.33% (found values).

PHOTOCONDUCTOR PRODUCTION EXAMPLE 9

A photoconductor was prepared in a manner similar to that described in Photoconductor Production Example 1, with the electron transporting substance represented by the following structural formula (7) used instead of the electron transporting substance used in Photoconductor Production Example 1 (hereinafter referred to as "Photoconductor 9").

Structural Formula (7)

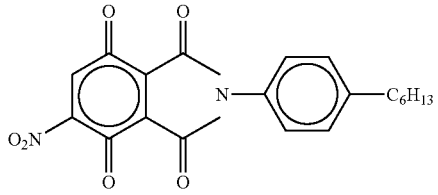

PHOTOCONDUCTOR PRODUCTION EXAMPLE 10

A photoconductor was prepared in a manner similar to that described in Photoconductor Production Example 1, with the electron transporting substance represented by the following structural formula (8) used instead of the electron transporting substance used in Photoconductor Production Example 1 (hereinafter referred to as "Photoconductor 10").

Structural Formula (8)

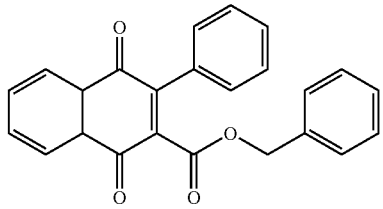

EXAMPLES 9-1 to 9-12, AND COMPARATIVE EXAMPLES 9-1 TO 9-14

Each of the photoconductors prepared above was incorporated into an image forming apparatus (modified IPSiO Color8100, Ricoh Company, Ltd.), where a power pack is changed to one that provide positive charges to the photoconductors, where a 780 nm laser diode is used for image exposure, and where the linear velocity can be changed freely. Subsequently, evaluations were made for each photoconductor as to the image density, image unevenness, and background smear, after adjusting the linear velocity to ensure that the time from charging to development was set to 100 msec, 250 msec, or 350 msec.

Both the toner and developer that are specifically designed for the IPSiO Color8100 were changed to those having an opposite polarity.

An external power source was used for the charging member (charging roller) of the apparatus. The voltage to be applied to the charging roller was as follows: Peak-to-Peak voltage=1.9 kV (AC component), frequency=1.35 kHz. In addition, bias was adjusted such that the photoconductor's surface potential was +700V (DC component), and the development bias was set to +500V. The test environment was as follows: Temperature=24° C., and relative humidity=54%.

Note that if the time from charging to development is set to 100 msec, 250 msec, or 350 msec in the modified IPSiO Color8100, the time it takes from exposure to development respectively becomes about 70 msec, 175 msec, or 245 msec.

Image evaluations are made in the manner described below.

<Image Density and Image Unevenness>

Both the image density and the presence of image unevenness were evaluated by printing out a black solid image. The evaluation criteria are as follows:

(1) Image Density
A: Sufficiently high image density
B: Slightly light
C: low image density (2) Image Unevenness
A: No image unevenness
B: Slight unevenness
C: Significant unevenness <Background Smear>

Evaluation was made for the occurrence of background smear on a white solid image. The evaluation criteria are as follows:
A: No background smear
B: Less background smear
C: Much background smear The evaluation results are summarized in Table 9-1.

TABLE 9-1

| | Photoconductor | Time from charging to development (msec) | Time from exposure to development (msec) | Evaluation: Image density | Image unevenness | Background smear |
|---|---|---|---|---|---|---|
| Ex. 9-1 | 1 | 100 | 70 | A | A | A |
| Ex. 9-2 | 2 | 100 | 70 | A | A | A |
| Ex. 9-3 | 3 | 100 | 70 | A | A | A |
| Compara. Ex. 9-1 | 4 | 100 | 70 | C | C | A |
| Compara. Ex. 9-2 | 5 | 100 | 70 | C | C | A |
| Ex. 9-4 | 6 | 100 | 70 | B | B | A |
| Ex. 9-5 | 7 | 100 | 70 | B | B | A |
| Ex. 9-6 | 8 | 100 | 70 | A | A | A |
| Compara. Ex. 9-3 | 9 | 100 | 70 | C | C | A |
| Compara. Ex. 9-4 | 10 | 100 | 70 | C | C | A |
| Ex. 9-7 | 1 | 250 | 175 | A | A | A |
| Ex. 9-8 | 2 | 250 | 175 | A | A | B |
| Ex. 9-9 | 3 | 250 | 175 | A | A | B |
| Compara. Ex. 9-5 | 4 | 250 | 175 | B | A | A |
| Compara. Ex. 9-6 | 5 | 250 | 175 | B | A | A |
| Ex. 9-10 | 6 | 250 | 175 | A | A | A |
| Ex. 9-11 | 7 | 250 | 175 | A | A | A |
| Ex. 9-12 | 8 | 250 | 175 | A | A | A |
| Compara. Ex. 9-7 | 9 | 250 | 175 | B | B | A |
| Compara. Ex. 9-8 | 10 | 250 | 175 | B | B | A |
| Compara. Ex. 9-9 | 1 | 350 | 245 | A | A | C |
| Compara. Ex. 9-10 | 2 | 350 | 245 | A | A | C |
| Compara. Ex. 9-11 | 3 | 350 | 245 | A | A | C |
| Compara. Ex. 9-12 | 6 | 350 | 245 | A | A | C |
| Compara. Ex. 9-13 | 7 | 350 | 245 | A | A | C |
| Compara. Ex. 9-14 | 8 | 350 | 245 | A | A | C |

It can be learned that the images in Examples 9-1 to 9-12 are excellent in image characteristics, which are produced by using the photoconductors that satisfy the requirements of the present invention and where the time from charging to development is 300 msec or less. Moreover, it can be learned that the use of such photoconductors can provide excellent images and achieve miniaturization and speedup of image forming apparatus, even when the time from exposure to development is set to as short as 70 msec.

On the other hand, when the time from exposure to development falls outside the range set forth by the present invention (i.e., 300 msec or more), background smea occurs even on these photoconductors and excellent images cannot be obtained.

As can be learned from the photoconductors prepared in Comparative Examples 9-1 to 9-8, photoconductors that do not satisfy the requirements of the present invention can provide relatively excellent images when the time from exposure to development is relatively long, but cannot ensure sufficient image density when the exposure-development time is short. For this reason, miniaturization and speedup of image forming apparatus cannot be achieved with these photoconductors.

What is claimed is:

1. An electrophotographic photoconductor comprising:

a support;

an under layer; and a photosensitive layer, the under layer and the photosensitive layer being disposed on or over the support, wherein the photosensitive layer comprises a compound represented by the following general formula (1):

General Formula (1)

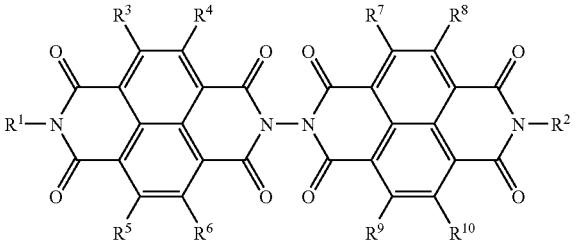

wherein:

$R^1$ and $R^2$ are each independently selected from the group consisting of a hydrogen atom, a substituted or unsubstituted alkyl group, a substituted or unsubstituted cycloalkyl group, and a substituted or unsubstituted aralkyl group; and $R^3$, $R^4$, $R^5$, $R^6$, $R^7$, $R^8$, $R^9$ and $R^{10}$are each independently selected from the group consisting of a hydrogen atom, a halogen atom, a cyano group, a nitro group, an amino group, a hydroxyl group, a substituted or unsubstituted alkyl group, a substituted or unsubstituted cycloalkyl group, and a substituted or unsubstituted aralkyl group, and wherein the under layer is composed of a charge blocking layer and a moire preventing layer.

2. The electrophotographic photoconductor according to claim 1, wherein the charge blocking layer comprises an insulating material, and the thickness of the charge blocking layer is 0.1 μm to less than 4.0 μm.

3. The electrophotographic photoconductor according to claim 2, wherein the insulating material is a polyamide.

4. The electrophotographic photoconductor according to claim 3, wherein the polyamide is N-methoxymethylated nylon.

5. The electrophotographic photoconductor according to claim 1, wherein the photosensitive layer comprises a charge generating substance, and the charge generating substance is titanyl phthalocyanine which has a maximum peak at least at a Bragg angle 2θ(±0.2°) of 27.2° in its X-ray diffraction spectrum for CuKα X-ray.

6. The electrophotographic photoconductor according to claim 1, wherein the photosensitive layer comprises a charge generating substance, and the charge generating substance is a titanyl phthalocyanine crystal which has a maximum peak at least at a Bragg angle 2θ(±0.2°) of 27.2°, main peaks at Bragg angle 2θ(±0.2°) of 9.4°, 9.6° and 24.0°, a peak at the smallest Bragg angle 2θ(±0.2°) of 7.3°, and no peaks between 7.3° and 9.4° and at 26.3° in its X-ray diffraction spectrum for CuKα X-ray.

7. The electrophotographic photoconductor according to claim 6, wherein the average particle diameter of the titanyl phthalocyanine is 0.25 μm or less.

* * * * *